US006686912B1

(12) United States Patent
Kishi et al.

(10) Patent No.: US 6,686,912 B1
(45) Date of Patent: Feb. 3, 2004

(54) DRIVING APPARATUS AND METHOD, PLASMA DISPLAY APPARATUS, AND POWER SUPPLY CIRCUIT FOR PLASMA DISPLAY PANEL

(75) Inventors: Tomokatsu Kishi, Kawasaki (JP); Tetsuya Sakamoto, Kawasaki (JP); Shigetoshi Tomio, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 79 days.

(21) Appl. No.: 09/606,434

(22) Filed: Jun. 28, 2000

(30) Foreign Application Priority Data

Jun. 30, 1999 (JP) ..... 11-185715
Jun. 9, 2000 (JP) ..... 2000-173056
Jun. 23, 2000 (JP) ..... 2000-188663

(51) Int. Cl.[7] ..... G09G 5/00
(52) U.S. Cl. ..... 345/211; 345/212; 345/213; 345/60; 345/62; 315/169.4
(58) Field of Search ..... 345/211–215, 41, 345/42, 60, 62, 67, 68; 315/169.3, 169.4

(56) References Cited

U.S. PATENT DOCUMENTS 4,009,415 A 2/1977 Ngo
4,263,534 A * 4/1981 Martin et al. ..... 315/169.4
4,652,796 A 3/1987 Delgrange et al.
4,813,041 A * 3/1989 Reyneri ..... 370/112
5,844,373 A 12/1998 Yao et al.
6,091,388 A 7/2000 Kanbe et al.

FOREIGN PATENT DOCUMENTS

JP 56-104390 8/1981
JP 60-93485 5/1985
JP 62-43167 9/1987
JP 3-203777 9/1991
JP 5-40451 2/1993
JP 6-284723 10/1994
JP 8-320667 12/1996
JP 9-47032 2/1997
JP 9-68946 3/1997
JP 09068946 A * 11/1997 ..... G09G/3/28
JP 11-145791 5/1999
JP 11-146662 5/1999
TW 255516 8/1995

OTHER PUBLICATIONS

Trogdon, Ray L., "Transformer Coupled Driving Circuits for Plasma Panel Displays", SID 1970, pp. 26–27.

* cited by examiner

*Primary Examiner*—Bipin Shalwala
*Assistant Examiner*—Tommy Sheng
(74) *Attorney, Agent, or Firm*—Staas & Halsey LLP

(57) ABSTRACT

A driving apparatus comprises switches SW1 to Sw3, a first signal line OUTA, and a second signal line OUTB. By ON/OFF control of the switches SW1 to Sw3, the voltage of the first signal line OUTA is changed between a positive voltage (+1/2V) level, which is smaller than a voltage V to be applied to a load 20, and the ground level, and the voltage of the second signal line OUTB is changed between the ground level and a negative voltage (−1/2V). By ON/OFF control of switches SW4 and SW5, the positive and negative voltages given by the first and second signal lines are selectively applied to the load 20. The maximum voltage applied to each element in the driving apparatus can be thereby lowered to the voltage (1/2V), which is smaller than the voltage V to be applied to the load 20. This makes it possible to hold down the breakdown voltage of each element to half the conventional value.

77 Claims, 99 Drawing Sheets

10: PDP
X1~X5: ELECTRODE X
Y1~Y4: ELECTRODE Y
A1~A6: ADDRESS ELECTRODE
L1~L8: DISPLAY LINE
171~177: PARTITION

DRIVING APPARATUS AND METHOD, PLASMA DISPLAY APPARATUS, AND POWER SUPPLY CIRCUIT FOR PLASMA DISPLAY PANEL

BACKGROUND OF THE INVENTION

1. Field of the Invention

The present invention relates to driving apparatus and methods, plasma display apparatus, and power supply circuits for plasma display panel, suitable for, e.g., AC-driven plasma displays.

2. Description of the Related Art

In recent years, demand has increased for replacing CRTs with flat matrix type display apparatus such as PDPs (Plasma Display Panels), LCDs (Liquid Crystal Displays), and ELDs (Electro-Luminescence Displays) in terms of decreased thickness. In particular, AC-driven PDPs are excellent in visibility because they are self-emission type displays. They can make display on a large screen with a thin device. Thus they have received a great deal of attention as a next-generation display that can realize higher image quality than CRTs.

Conventionally well-known AC-driven PDPs are classified into two-electrode type PDPs performing selective discharge (address discharge) and sustain discharge with two electrodes, and three-electrode type PDPS performing address discharge further using a third electrode. The three-electrode type PDPs are further classified into PDPs having its third electrode formed on the same substrate as its first and second electrodes, and PDPs having its third electrode formed on another substrate opposite to the substrate of its first and second electrodes.

All types of PDP apparatus described above are based on the same principle. Thus the construction of a PDP apparatus will be described below wherein first and second electrodes for performing sustain discharge are formed on a first substrate, and a third electrode is separately prepared on a second substrate opposite to the first substrate.

FIG. 1 is a diagrammatic view showing the whole construction of an AC-driven PDP apparatus. Referring to FIG. 1, an AC-driven PDP 1 is provided with parallel scanning electrodes Y1 to Yn and common electrodes X formed on one surface, and address electrodes A1 to Am formed on the opposite surface so as to be perpendicular to the electrodes Y1 to Yn and X. Each common electrode X is disposed close to its corresponding one of the scanning electrodes Y1 to Yn. The common electrodes X are commonly connected to one terminal.

The common terminal of the common electrodes X is connected to the output terminal of an X-side circuit 2. The scanning electrodes Y1 to Yn are connected to the output terminals of a Y-side circuit 3. The address electrodes A1 to Am are connected to the output terminals of an address-side circuit 4. The X-side circuit 2 comprises a circuit for repeating a discharge. The Y-side circuit 3 comprises a circuit for line-sequential scan, and a circuit for repeating a discharge. The address-side circuit 4 comprises a circuit for selecting a line to be displayed. These X-side circuit 2, Y-side circuit 3, and address-side circuit 4 are controlled with control signals from a control circuit 5. More specifically, the address-side circuit 4 and the circuit for line-sequential scan in the Y-side circuit determine cells to be lit, and the display of the PDP is made by repeating discharges of the X- and Y-side circuits 2 and 3.

The control circuit 5 generates the control signals on the basis of external display data D, a clock CLK representing read timing for the display data D, a horizontal sync signal HS, and a vertical sync signal VS, and supplies the control signals to the X-side circuit 2, the Y-side circuit 3, and the address-side circuit 4.

FIG. 2A is a sectional view of a cell Cij as one pixel, which is in the i-th row and the j-th column. Referring to FIG. 2A, a common electrode X and a scanning electrode Yi are formed on a front glass substrate 11. The structure is coated with a dielectric layer 12 for insulating the electrodes from a discharge space 17. The resultant structure is further coated with an MgO (magnesium oxide) protective film 13.

An address electrode Aj is formed on a back glass substrate 14 opposite to the front glass substrate 11. A dielectric layer 15 is formed on the address electrode Aj. The dielectric layer 15 is coated with a fluorescent substance. The discharge space 17 between the MgO protective film 13 and the dielectric layer 15 is charged with Ne+Xe Penning gas.

FIG. 2B is for explaining a capacitance Cp in the AC-driven PDP. Referring to FIG. 2B, in the AC-driven PDP, capacitance components Ca, Cb, Cc appear in the discharge space 17, between the common and scanning electrodes X and Y, and within the front glass substrate 11, respectively. The sum of them gives the capacitance Cpcell per cell (Cpcell=Ca+Cb+Cc). The total of the capacitances Cpcell of all cells gives the panel capacitance Cp.

FIG. 2C is for explaining fluorescence in the AC-driven PDP. Referring to FIG. 2C, fluorescent substances for red, blue, and yellow are applied to be arranged each color in stripes on the inside surfaces of a ribs 16. A discharge between common and scanning electrodes X and Y excites the corresponding fluorescent substance 18 to fluoresce.

FIG. 3 is a timing chart showing voltage waveforms in a driving method of the AC-driven PDP. FIG. 3 shows one of subfields making up one frame. One subfield is divided into a reset period consisting of a full write period and a full erase period, an address period, and a sustain discharge period.

First in the reset period, all the scanning electrodes Y1 to Yn are set at the ground level (0 V). Simultaneously with this, a full write pulse having a voltage Vs+Vw (about 400 V) is applied to the common electrodes X. At this time, all the address electrodes A1 to Am are at a potential Vaw (about 100 V). As a result, discharge occurs in every cell of every display line to generate wall charges, independently of the preceding display state.

Next, the potentials of the common electrodes X and the address electrodes A1 to Am become 0 V. The voltage by wall charges themselves then exceeds the discharge start voltage in every cell, and discharge starts. This discharge makes no wall charge because there is no difference in potential between electrodes. Space charges are neutralized by themselves to end discharge. This is so-called self-erase discharge. By this self-erase discharge, all cells in the panel become a uniform state free from wall charges. This reset period serves to set all cells in the same state independently of the ON/OFF state of each cell in the preceding subfield. This makes it possible to perform the subsequent address (write) discharge stably.

Next, in the address period, address discharge is line-sequentially performed to turn each cell ON/OFF in accordance with display data. More specifically, a voltage at −Vy level (about −150 V) is applied to the scanning electrode Y1 corresponding to the first display line, and a voltage at −Vsc level (about −50 V) is applied to the scanning electrodes Y2 to Yn corresponding to the remaining display lines. At the same time, an address pulse having a voltage Va (about 50 V) is selectively applied to an address electrode Aj corresponding to a cell to undergo sustain discharge, i.e., to be turned ON, in the address electrodes A1 to Am.

Consequently, discharge occurs between the scanning electrode Y1 and the address electrode Aj of the cell to be turned ON. With this priming (pilot), discharge between the scanning electrode Y1 and the corresponding common electrode X having a voltage Vx starts immediately. An amount of wall charges enough for the next sustain discharge is then stored on the surface of the MgO protective film 13 on the common electrode X and the scanning electrode Y1 of the selected cell. Similarly for the scanning electrodes Y2 to Yn corresponding to the remaining display lines, the voltage at −Vy level is applied to the scanning electrodes of selected cells in order, and the voltage at −Vsc level is applied to the remaining scanning electrodes of non-selected cells. New display data is thereby written in all display lines.

In the subsequent sustain discharge period, a sustain pulse having the voltage Vs (about 200 V) is alternately applied to the scanning electrodes Y1 to Yn and the common electrodes X to perform sustain discharge. An image of one subfield is displayed. The luminance of the image is determined by the length of the sustain discharge period, i.e., the number of times or the frequency of sustain pulse application.

In such an AC-driven PDP, the voltage Vf at which a gas discharge starts between the surfaces of the common and scanning electrodes X and Y, is within the range of 220 to 260 V in general. Within an address period, e.g., in a cell to display, the voltage is applied between the address and scanning electrodes A and Y to make a gas discharge occur. Using it as a trigger, a discharge is made to occur between the common and scanning electrodes X and Y, so as to leave wall charges on the common and scanning electrodes X and Y in the cell.

In the subsequent sustain discharge period, with the wall charges Vwall generated in the address period, and the sustain pulse voltage Vs applied between the common and scanning electrodes X and Y, a gas discharge can be made to occur by setting $|Vs+Vwall|$ at Vf or more. The value of the voltage Vs is not more than the discharge start voltage Vf. A voltage value that $|Vs|<|Vf|<|Vs+Vwall|$ is used as Vs.

When a gas discharge once occurs between the common and scanning electrodes X and Y, the wall charges on the common and scanning electrodes X and Y in the cell are replaced by wall charges in the reverse polarity to end the gas discharge. Thus a sustain pulse voltage Vs in the polarity reverse to the previous one is applied between the common and scanning electrodes X and Y. A gas discharge thereby occur again using the wall charges newly generated on the common and scanning electrodes X and Y. By repeating the above operations, the gas discharges can be repeated.

The above-described "write address method" is an example of driving method for such an AC-driven PDP, in which the wall charges of all cells in the panel are erased in a reset period, and cells to display are selectively subjected to discharges in the subsequent address period to accumulate wall charges. Contrastingly in "erasion address method" as another example, wall charges are accumulated in relation to all cells in the panel in a reset period, and cells not to display are selectively subjected to discharges in the subsequent address period to erase their wall charges, thereby leaving wall charges only in cells to display.

FIG. 4 is a circuit diagram showing a partial construction of a driving apparatus for the conventional PDP apparatus. Referring to FIG. 4, a load 20 represents the total capacitance of the cells formed between one common electrode X and one scanning electrode Y. The load 20 is provided with a common electrode X and a scanning electrode Y, to which pulse voltages described with FIG. 3 are applied by the X-side circuit 2 and the Y-side circuit 3.

The X-side circuit 2 includes a power supply circuit 21, a power recovery circuit 22, and a sustainer circuit 23. The power supply circuit 21 comprises a diode D1 connected to the power supply line of the sustain pulse voltage Vs, transistors Tr1 and Tr2 connected in series between the ground (GND) and the power supply line of the write voltage Vw, and a capacitor C1, connected between the common drain of the transistors Tr1 and Tr2 and the output of the diode D1.

To apply the full write pulse to the common electrodes X in the reset period, the transistor Tr1 is turned ON, and the transistor Tr2 is turned OFF. The sustain pulse voltage Vs having passed through the diode D1 and the write voltage Vw are summed and supplied to the sustainer circuit 23. To apply the sustain pulse to the common electrodes X in the sustain discharge period, the transistor Tr1 is turned OFF, and the transistor Tr2 is turned ON. The sustain pulse voltage Vs having passed through the diode D1 is directly supplied to the sustainer circuit 23.

The sustainer circuit 23 comprises a switch circuit made by a parallel connection of a transistor Tr5 and a diode D5, two diodes D7 and D8 connected in series to the switch circuit, and a switch circuit made by a parallel connection of a transistor Tr6 and a diode D6 and connected in series to the diode D8. The node between the diodes D7 and D8 is connected to the common electrode X of the load 20.

When the transistor Tr5 is ON and the transistor Tr6 is OFF, the sustain pulse voltage Vs or the full write pulse voltage Vs+Vw supplied from the power supply circuit 21 is applied to the common electrode X. Contrastingly, when the transistor Tr5 is OFF and the transistor Tr6 is ON, the ground level voltage (0 V) is applied to the common electrode X.

The power recovery circuit 22 comprises two coils L1 and L2 connected to the capacitive load 20 of the PDP through the respective diodes D7 and D8, a diode D3 and a transistor Tr3 connected in series to one coil L1, a diode D4 and a transistor Tr4 connected in series to the other coil L2, and a capacitor C2 connected between the ground and the common terminal of the transistors Tr3 and Tr4.

The capacitive load 20 and the two coils L1 and L2 connected to the load 20 through the two diodes D7 and D8 form two series of resonance circuits. More specifically, the power recovery circuit 22 has two series of L-C resonance circuits. The power recovery circuit 22 is for recover the charges supplied by a resonance of the coil L1 and the capacitive load 20, by a resonance of the coil L2 and the capacitive load 20.

The Y-side circuit 3 includes a scan driver 31, a sustainer circuit and power supply circuit 32, and a power recovery circuit 33. The scan driver 31 comprises two transistors Tr7 and Tr8 connected in series. The node between the two transistors Tr7 and Tr8 is connected to the scanning electrode Y of the load 20. A scan pulse voltage −Vy, a non-selection pulse voltage −Vsc, or a sustain pulse voltage Vs supplied from the power supply circuit 32 described later is applied to the scanning electrode Y.

The sustainer circuit and power supply circuit 32 comprises transistors Tr9 and Tr10 connected to the power supply line of the scan pulse voltage −Vy, a transistor Tr11 and a diode D9 connected to the power supply line of the non-selection pulse voltage −Vsc, a transistor Tr12 connected to the power supply line of the sustain pulse voltage Vs, a transistor Tr13 connected to the ground for leakage control, and a transistor Tr14 and diode D14 for disconnecting the power supply line of the scan pulse voltage −Vy and non-selection pulse −Vsc, from a GND line.

By appropriately controlling ON/OFF of each of the transistors Tr7 to Tr14 of this sustainer circuit and power supply circuit 32 and scan driver 31, the scan pulse voltage −Vy, the non-selection pulse voltage −Vsc, or the sustain pulse voltage Vs is applied to the scanning electrode Y, as shown in FIG. 3.

The power recovery circuit 33 comprises two coils L3 and L4 connected to the capacitive load 20 through the respective transistors Tr7 and Tr8, a diode D12 and a transistor Tr15 connected in series to one coil L3, a diode D13 and a transistor Tr16 connected in series to the other coil L4, and a capacitor C3 connected between the ground and the common terminal of the transistors Tr15 and Tr16.

This power recovery circuit 33 also has two series of L-C resonance circuits. The power recovery circuit 22 is for recover the charges supplied by a resonance of the coil L1 and the capacitive load 20, by a resonance of the coil L2 and the capacitive load 20.

FIG. 5 is a circuit diagram showing an example of the conventional constructions of a line-sequentially scanning circuit in the Y-side circuit 3, and discharge repeating circuits in the X- and Y-side circuits 2 and 3.

Referring to FIG. 5, each of switches SW1 and SW2 comprises FETs connected in parallel. The switch SW1 is connected to a power supply Vs. A power recovery circuit including coils L1 and L2, switches SW3, SW5, and SW6, and a capacitor C1 is provided on the common electrode X side. A switch SW7 is connected between a power supply Vax and the common electrode X.

On the scanning electrode Y side, a scan driver including switches SW20 and SW21 is connected to the scanning electrode Y. On the switch SW20 side of the scan driver, a power supply Vsc is connected through a switch SW18, and a switch SW11 is connected. On the switch SW21 side of the scan driver, a power supply (−Vy) is connected through switches SW16 and SW17, and the ground terminal is connected through a switch SW19. On the switch SW21 side, a diode D1 and switches SW10 and SW15 are connected between the switch SW21 and the power supply Vs, as shown in the drawing.

An A/S separation circuit for isolating the circuit for line-sequential scan (for address) and the circuit for repeating a discharge (for sustainer) is made up from a diode D2 provided on the switch SW20 side of the scan driver, and a switch SW15 provided on the switch SW21 side of the scan driver. Also on the scanning electrode Y side, a power recovery circuit is provided which comprises coils L3 and L4, switches SW12, SW13, and SW14, and a capacitor C2.

FIG. 6 shows an example of construction of a high-voltage power supply necessary for the above circuit shown in FIG. 5. Referring to FIG. 6, as the values of the voltages Vs, Vax, Vy, and Vsc, respectively used are 180 V, 50 V, −180 V, and −80 V, which are high voltages.

FIG. 7 is a timing chart showing an operation of the above circuit shown in FIG. 5. In a scanning period, the switches SW16, SW17, and SW18 on the scanning electrode Y side are turned ON to apply a voltage Vsc (=100 V) between both terminals of the scan driver. Further, the switch SW21 is turned ON to apply a voltage (−Vy=−180 V) to one scanning electrode Y which is the scanning target, and the switch SW20 is turned ON to apply a voltage (Vsc−Vy=−80 V) to the remaining scanning electrodes Y.

At the intersection between the scan pulse of 180 V to the one scanning electrode Y which is the scanning target, and each address electrode A, e.g., in case of making a display, a gas discharge is made to occur by a voltage Va (=60 V) applied to the address electrode A. Using the gas discharge between the address and scanning electrodes A and Y as a trigger, a discharge is further made to occur between the common electrode X (to which a voltage Vax is applied by turning the switch SW7 ON) and the scanning electrode Y (to which a voltage of −180 V is applied). Wall charges different in polarity from the applied voltages are thereby generated on the dielectric layer 12 on the scanning electrodes X and Y shown in FIG. 2. This operation is performed to every scanning electrode Y.

The A/S separation circuit is for preventing a short circuit between the diode D1 and the switch SW16 in its ON state due to the voltage (−Vy) that is lower than the ground level, and for preventing a short circuit between the switch SW18 and a diode parasitic on the switch SW11 due to the voltage Vsc that is lower than the ground level. During the above operation, the switch SW15 is kept OFF. A voltage of 180 V is applied between both terminals of the switch SW15.

In the subsequent sustain discharge period, the switches SW12 and SW15 on the scanning electrode Y side are turned ON, and the switch SW2 on the common electrode X side is turned ON. An L-C resonance thereby occurs by the coil L3 and the capacitance Cp of the PDP panel with using the capacitor C2, whose one terminal is always grounded, as a power supply. The voltage on the scanning electrode Y side is raised near Vs. Next, the switch SW10 is turned ON to raise the voltage to Vs, and thereby the voltage being applied to the scanning electrode Y is set at Vs. At this time, the voltage Vs (=180 V) is applied between both terminals of the switch SW11, which is being OFF.

The voltage Vs being applied between the common and scanning electrodes X and Y is thereby added to a voltage due to wall charges generated in the above-described scanning period, and so a gas discharge starts. The current then flows through the switches SW10, SW15, and SW2. At this time, wall charges are again generated as described above.

Next, on the scanning electrode Y side, the switches SW10 and SW12 are turned OFF, and the switch SW13 is turned ON. An L-C resonance thereby occurs by the coil L4 and the capacitance Cp of the PDP panel with using the capacitor C2, whose one terminal is always grounded, as a power supply. The voltage on the scanning electrode Y side is lowered near the ground level. Next, the switch SW11 is turned ON to lower the voltage to the ground level, and thereby the voltage being applied to the scanning electrode Y is set at the ground level. At this time, the voltage Vs (=180 V) is applied between both terminals of the switch SW 10, which is being OFF.

Next, the switch SW3 on the common electrode X side is turned ON. An L-C resonance thereby occurs by the coil L1 and the capacitance Cp of the PDP panel with using the capacitor C1, whose one terminal is always grounded, as a power supply. The voltage on the common electrode X side is raised near Vs. Next, the switch SW1 is turned ON to raise the voltage to Vs, and thereby the voltage being applied to the common electrode X is set at Vs. At this time, the voltage Vs (=180 V) is applied between both terminals of the switch SW 2, which is being OFF.

The voltage Vs being applied between the common and scanning electrodes X and Y is thereby added to a voltage due to wall charges generated some time ago, and so a gas discharge starts. The current then flows through the switches SW1 and SW11. At this time, wall charges are again generated as described above.

Next, on the common electrode X side, the switches SW1 and SW3 are turned OFF, and the switch SW6 is turned ON. An L-C resonance thereby occurs by the coil L2 and the capacitance Cp of the PDP panel with using the capacitor C1, whose one terminal is always grounded, as a power supply. The voltage on the common electrode X side is lowered near the ground level. Next, the switch SW2 is turned ON to lower the voltage to the ground level, and thereby the voltage being applied to the common electrode X is set at the ground level. At this time, the voltage Vs (=180 V) is applied between both terminals of each of the switch SW 1 on the common electrode X side and the switch SW10 on the scanning electrode Y side, which are being OFF.

The breakdown voltages of various elements of the driving apparatus are determined by the maximum voltage of the pulse to be applied to the elements. In the conventional driving apparatus, a fixed voltage supplied from the power supply lines is applied to the load. For example, one of the X and Y electrodes is set at the ground level and the fixed voltage is applied to the other. For this reason, each element in the driving apparatus must have a high breakdown voltage corresponding to the fixed voltage.

In particular, in case of the construction shown in FIG. 4, each element making up the sustainer circuit 23 in the X-side circuit 2, requires a very high breakdown voltage corresponding to the full write pulse voltage Vs+Vw (about 400 V). Thus an expensive and large switching element such as a FET must be used to ensure a sufficient breakdown voltage. This causes a complex circuit construction and a very high manufacturing cost.

Besides, in case of the construction shown in FIG. 5, the breakdown voltage of each FET of the switches SW1, SW2, SW10, SW11, and SW15, must be Vs or more. In addition, each FET of those switches is for controlling a gas discharge current, so it must have a low ON voltage for a stable gas discharge. However, generally in FETs, the higher the breakdown voltage is, the higher the ON voltage is (in case of double the breakdown voltage, proportionally to the third to fourth power of two). For this reason, in order to drive the PDP stably, it is required to dispose FETs in parallel in each of the switches SW1, SW2, SW10, SW11, and SW15 for controlling a gas discharge current, so as to decrease its ON voltage. Thus a higher breakdown voltage causes an increase in cost of each FET. Besides, an increase in the number of FETs causes a further increase in cost. Further, for realizing such waveforms as shown in FIG. 7 by the circuit of FIG. 5, four kinds of high-voltage power supplies are required. This also causes an increase in cost.

Besides, a fixed voltage to be applied to the load is very high. For this reason, when charging or discharging is performed in relation to the capacitance of the load, a very large power loss occurs.

SUMMARY OF THE INVENTION

It is an object of the present invention to provide driving apparatus and methods wherein the breakdown voltage of each element of the driving apparatus is held down (i.e., minimized), thereby realizing simplification in circuit construction and reduction of manufacturing cost.

It is another object of the present invention to reduce the power consumption when charging or discharging is performed in relation to the capacitance of the load.

A driving apparatus according to the present invention comprises a first signal line for applying a voltage at a first level to a load, and a second signal line for applying a voltage at a second level to the load, wherein the voltage of the second signal line is set at a third level and the voltage of the first signal line is set at the first level to apply the voltage at the first level to the load through the first signal line, and the voltage of the first signal line is set at the third level and the voltage of the second signal line is set at the second level to apply the voltage at the second level to the load through the second signal line.

The present invention having the above technical feature makes it possible for a power supply, which generates a voltage less than a predetermined to be applied to the load, to generate the voltages at the first and second levels, the absolute values of which are less than that of the predetermined voltage. Selectively applying those voltages to the load substantially achieves application of the predetermined voltage to the load. The voltage applied to each element in the driving apparatus is then the first or second level voltage at most, so the breakdown voltage of each element can be hold down in comparison with its conventional value. This makes it possible to use inexpensive small elements and so realize simplification in circuit construction and reduction of manufacturing cost.

Besides, the voltage to be applied to the load is sufficed by the voltages at the first and second levels, whose absolute values are less than that of the predetermined voltage. Thus the power consumption can be reduced in comparison with the conventional manner, in which the predetermined voltage itself is applied to the load.

BRIEF DESCRIPTION OF THE DRAWINGS

FIGS. 13A to 13C are circuit diagrams showing the constructions of switches, wherein FIG. 9A shows an example of construction of a switch SW3, FIG. 9B shows an example of construction of each of switches SW1 and SW2, and FIG. 9C shows another example of construction of the switch SW3;

DETAILED DESCRIPTION OF THE PREFERRED EMBODIMENTS

Hereinafter, embodiments of the present invention will be described with reference to drawings.

Figure 8:
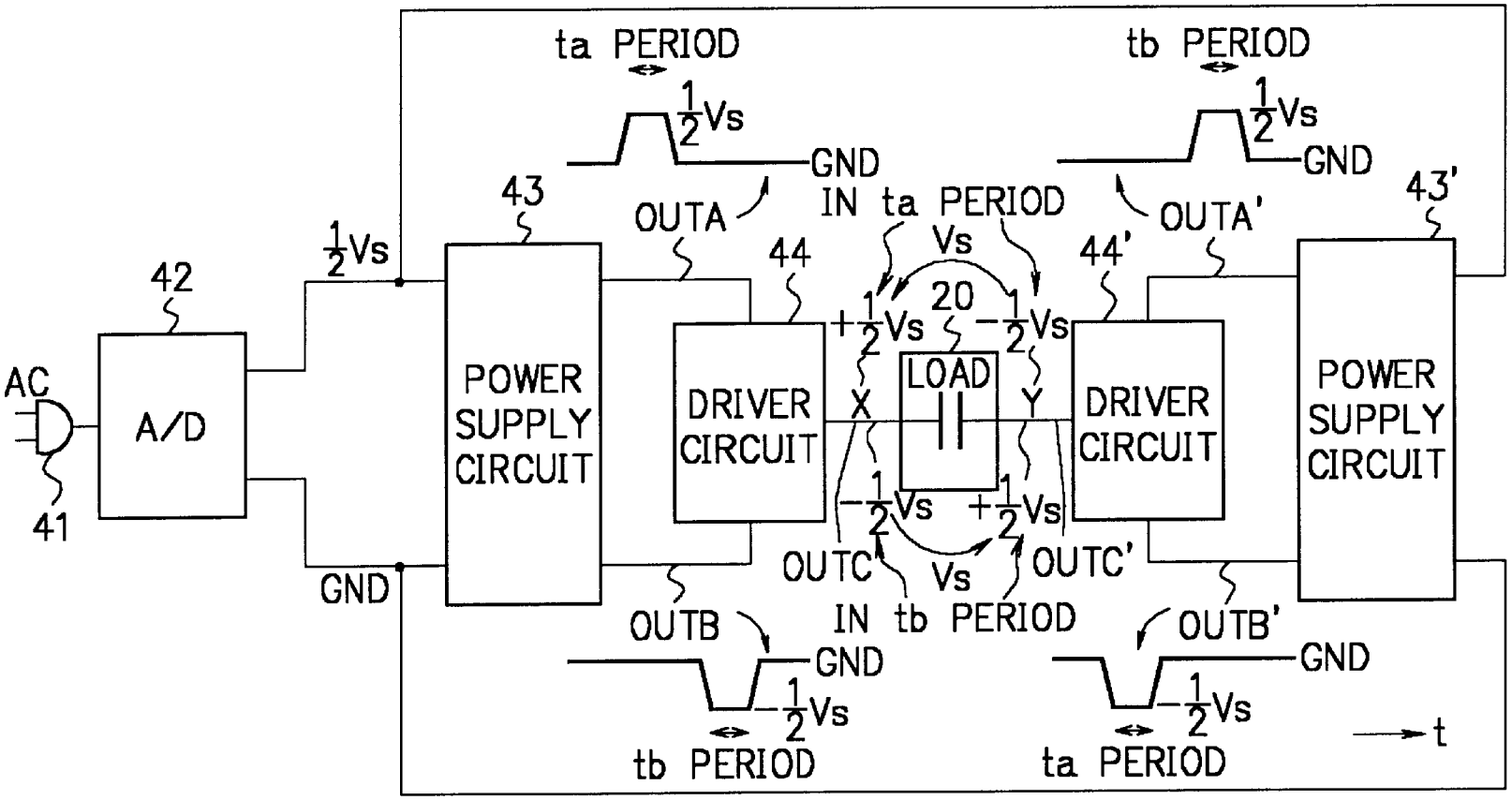
FIG. 8 is a circuit diagram showing an elemental feature of a driving apparatus according to an embodiment of the present invention.

FIG. 8 is a circuit diagram showing the construction of a driving apparatus according to an embodiment of the present invention, wherein only an elemental feature of the present invention is shown.

The driving apparatus of this embodiment shown in FIG. 8 can be applied to a display panel such as an AC-driven PDP apparatus, though it is not limited to such an application. In this case, the whole construction and the structure in section of each cell are the same as those shown in FIGS. 1 and 2.

Referring to FIG. 8, an A/D converter 42 A/D-converts an AC power supply voltage supplied from an AC power supply 41 to generate a DC power supply voltage. At this time, the A/D converter 42 generates, e.g., a voltage (Vs/2), which is half of a sustain pulse voltage Vs.

Using the voltage (Vs/2) supplied from the A/D converter 42, a power supply circuit 43 selectively outputs positive and negative voltages (+Vs/2 and −Vs/2). A driver circuit 44 applies, to a load 20, the power supply voltage (+Vs/2) supplied from the power supply circuit 43.

The power supply circuit 43 and the driver circuit 44 are connected to each other through first and second signal lines OUTA and OUTB. These power supply circuit 43 and driver circuit 44 are connected to the common electrode X side of the load 20 corresponding to the PDP, and make up an X-side circuit 2 shown in FIG. 1.

A power supply circuit 43' and a driver circuit 44' include the same constructions as the power supply circuit 43 and the driver circuit 44, respectively. The power supply circuit 43' and the driver circuit 44' are connected to each other through third and fourth signal lines OUTA' and OUTB'. These power supply circuit 43' and driver circuit 44' are connected to the scanning electrode Y side of the load 20, and make up a Y-side circuit 3 shown in FIG. 1.

In this embodiment, the power supply voltage (Vs/2) output from the A/D converter 42 and the ground voltage are supplied to both the power supply circuit 43 for the common electrode X and the power supply circuit 43' for the scanning electrode Y. That is, one A/D converter 42 is shared by the two power supply circuits 43 and 43'.

Operations of the driving apparatus having the above construction will be described below. For example, in a sustain discharge period, the power supply circuit 43 for common electrode X outputs alternating voltages (+Vs/2, 0) to the first signal line OUTA, and alternating voltages (0, −Vs/2) to the second signal line OUTB. At this time, the-power supply circuit 43' for scanning electrode Y outputs alternating voltages (0, +Vs/2) to the third signal line OUTA', and alternating voltages (−Vs/2, 0) to the fourth signal line OUTB' in the reverse phases to those of the power supply circuit 43 for common electrode X.

The driver circuit 44 for common electrode X outputs the voltages output on the first and second signal lines OUTA and OUTB, onto the output line OUTC to apply them to the load 20. The driver circuit 44' for scanning electrode Y applies the voltages output on the third and fourth signal lines OUTA' and OUTB', to the load 20 through the output line OUTC'.

In this manner, when the voltage (+Vs/2) of the first signal line OUTA is applied through the output line OUTC to the common electrode X of the load 20, the voltage (−Vs/2) of the fourth signal line OUTB' is applied through the output line OUTC' to its scanning electrode Y. Conversely, when the voltage (−Vs/2) of the second signal line OUTB is applied through the output line OUTC to the common electrode X of the load 20, the voltage (+Vs/2) of the third signal line OUTA' is applied through the output line OUTC' to the scanning electrode Y.

In short, according to this embodiment, the voltages (+Vs/2) in opposite phases are applied to the common electrode X and the scanning electrode Y, respectively. For example, when the positive voltage (+Vs/2) is applied to the common electrode X, the negative voltage (−Vs/2) is applied to the scanning electrode Y. The common electrode X and the scanning electrode Y are then able to have a potential difference corresponding to the sustain pulse voltage Vs. This makes it possible to provide the same state as that in the sustain discharge period shown in FIG. 3 (the state that the sustain pulse voltage Vs is alternately applied to the common electrode X and the scanning electrode Y).

The absolute values of the voltages then being applied to the power supply circuits 43 and 43' and the driver circuits 44 and 44' are Vs/2 at most. Each element in these circuits thus only need have the breakdown voltage of Vs/2, i.e., half the conventional breakdown voltage. This makes it possible to use compact and inexpensive elements and so realize simplification in circuit construction and reduction of manufacturing cost.

Besides, in the driving apparatus according to this embodiment, the voltage to be applied to the load is Vs/2 at most, i.e., sufficed by half the voltage Vs. Therefore, even taking an increase in power consumption which is caused by the fact that cycles of applying the voltages to the load become double the conventional ones, into consideration, the total power loss can be reduced in comparison with the conventional manner, in which the voltage Vs itself is applied to the load 20.

In the driving apparatus according to this embodiment, the positive and negative power supply voltages (±Vs/2) can be generated on the basis of output voltages from a single A/D power supply. In general, to generate such positive and negative power supply voltages, a power supply for the positive voltage and a power supply for the negative voltage need be prepared individually. According to this embodiment, however, only a single A/D power supply suffices. Additionally in this embodiment, since the single A/D power supply is shared by the common electrode X side and the scanning electrode Y side, the circuit scale can be reduced more.

FIG. 8 illustrates an example in which the voltages respectively applied to the common and scanning electrodes X and Y have the same absolute value (either is Vs/2). However, as far as the voltage Vs is applied between both ends of the load 20, the voltages with the same absolute value need not always be applied respectively to the common and scanning electrodes X and Y. Besides, the power supply voltages supplied by the A/D converter 42 to the power supply circuits 43 and 43' need not always be positive.

Specific examples of constructions of the power supply circuits 43 and 43' and the driver circuits 44 and 44' shown in FIG. 8 will be described below.

First Embodiment

Figure 9:
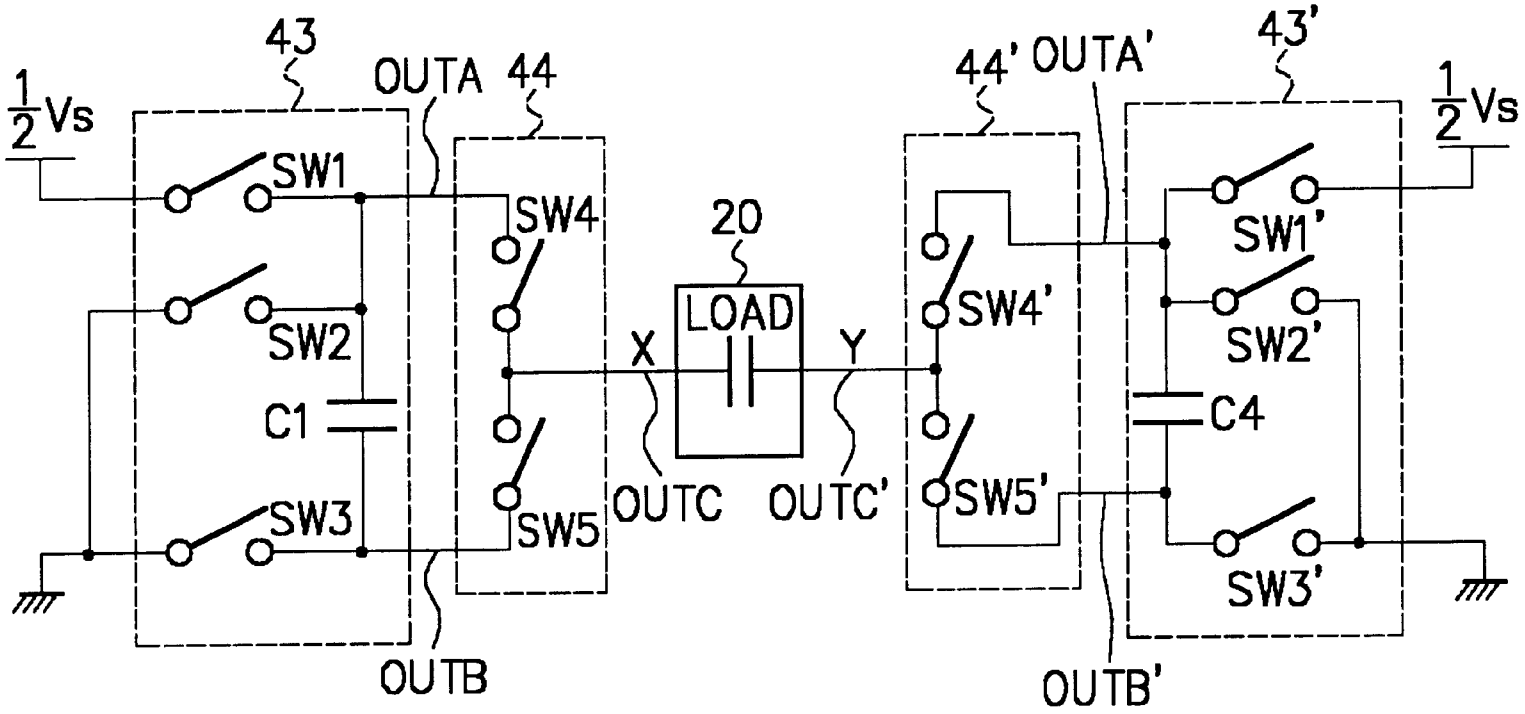
FIG. 9 is a circuit diagram showing an example of construction of a driving apparatus according to the first embodiment of the present invention.

FIG. 9 is a circuit diagram showing an example of construction of a driving apparatus according to the first embodiment of the present invention, wherein the same functional blocks as in FIG. 8 are denoted by the same references as in FIG. 8. As described above, the power supply circuits 43' and the driver circuit 44' for scanning electrode Y have the same constructions as the power supply circuits 43 and the driver circuit 44 for common electrode X, respectively. Thus here are typically shown the constructions on the common electrode X side only.

Referring to FIG. 9, the power supply circuit 43 comprises a capacitor C1 and three switches SW1, SW2, and SW3. The driver circuit 44 comprises two switches SW4 and SW5.

Figure 5:
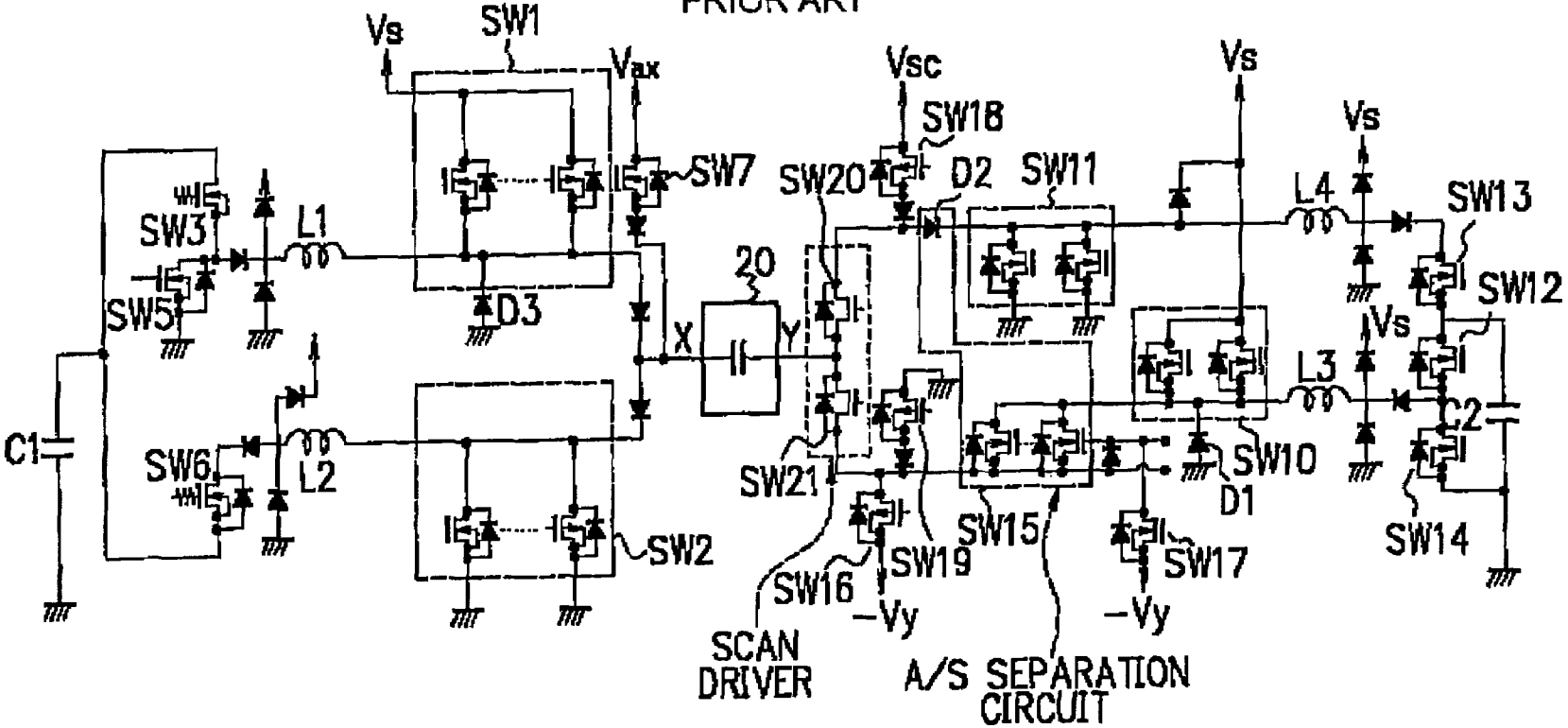
FIG. 5 PRIOR ART
FIG. 5 is a circuit diagram showing another example of construction of a conventional driving apparatus.
Figure 6:
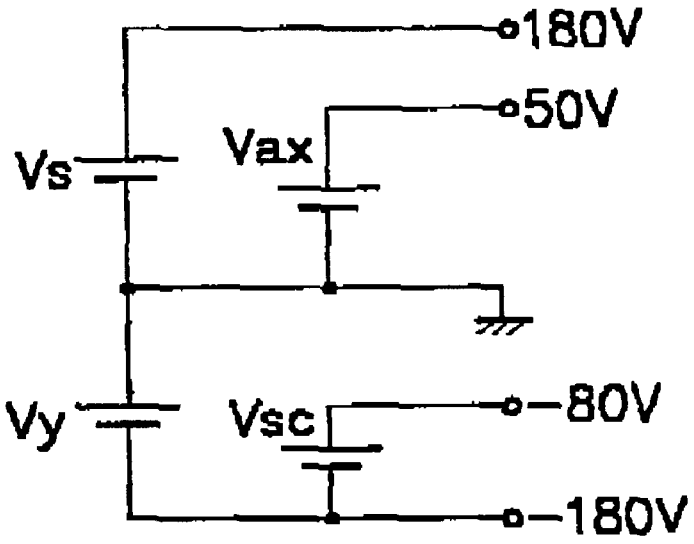
FIG. 6 PRIOR ART
FIG. 6 is a circuit diagram showing the construction of a high-voltage power supply required for the driving apparatus of FIG. 5.

Two switches SW1 and SW2 in the power supply circuit 43 are connected in series between the ground (GND) and the power supply line of the voltage (Vs/2) generated by the A/D converter 42 of FIG. 5. The node between the switches SW1 and SW2 is connected to one terminal of the capacitor C1. The remaining switch SW3 is connected between GND and the other terminal of the capacitor C1.

The two switches SW4 and SW5 in the driver circuit 44 are connected in series between the terminals of the capacitor C1 in the power supply circuit 43. The node between the switches SW4 and SW5 is connected to the load 20.

Figure 10:
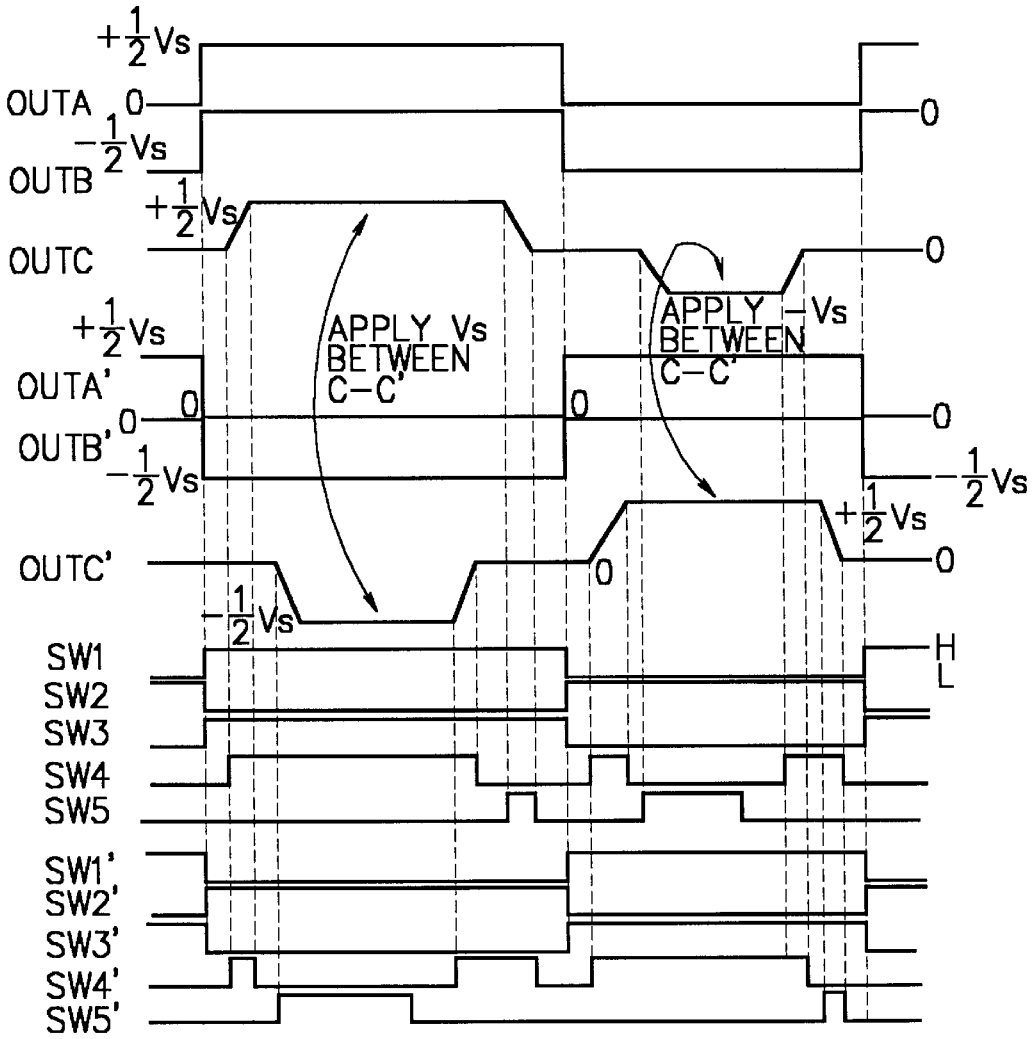
FIG. 10 is a timing chart showing an example of driving waveforms in a sustain discharge period by the driving apparatus of FIG. 9.

An example of operation of the driving apparatus constructed as in FIG. 9 will be described below with reference to FIG. 10. FIG. 10 is a timing chart showing a specific example of driving waveforms in a sustain discharge period by the driving apparatus according to this embodiment.

Referring to FIG. 10, firstly on the common electrode X side, two switches SW1 and SW3 are turned ON, and the remaining switches SW2, SW4, and SW5 are kept OFF. At this time, the voltage of the first signal line OUTA rises to a voltage level (+Vs/2) given through the A/D converter 42 via the switch SW1, while the voltage of the second signal line OUTB remains at the ground level. At the next timing a little after of that, the switch SW4 is turned ON, and switches SW4' and SW2' on the scanning electrode Y side are turned ON. The voltage (+Vs/2) of the first signal line OUTA is thereby applied to the load 20 via the output line OUTC. The reason why the switches SW4' and SW2' on the scanning electrode Y side is turned ON, is for applying the voltage (Vs/2) between the common and scanning electrodes X and Y.

At this stage, since the switches SW1 and SW3 are turned ON to connect the capacitor C1 to the power supply, charges corresponding to the voltage (Vs/2) given through the A/D converter 42 via the switch SW1 are stored in the capacitor C1.

At the next timing, the switch SW4 is turned OFF to stop the current path for applying the voltage, and then the switch SW5 is turned ON like a pulse. The voltage of the output line OUTC is thereby lowered to the ground level. Next, the switch SW2 is turned ON, and the remaining four switches SW1, SW3, SW4, and SW5 are set OFF. The switch SW4 is then turned ON like a pulse. This switch SW4 in the ON state serves as the current path for applying a voltage to the scanning electrode Y side, in contrast with the common electrode X (at the ground).

Next, the switch SW5 is turned ON while the switch SW2 is kept ON. No power supply voltage is then supplied to the first signal line OUTA through the A/D converter 42 via the switch SW1, so the voltage of the first signal line OUTA remains at the ground level. Contrastingly as for the second signal line OUTB, the first signal line OUTA is grounded because the switch SW2 is ON. The second signal line OUTB has a potential (−Vs/2) lower than the ground level by a voltage (Vs/2) corresponding to the charges stored in the capacitor C1. Since the switch SW5 is ON, the voltage (−Vs/2) of the second signal line OUTB is applied to the load 20 through the output line OUTC. At this time, the switches SW3' and SW4' are turned ON to apply the voltage (−Vs/2) to the common electrode X side, in contrast with the scanning electrode Y (at Vs/2).

At the next timing, the switches SW2 and SW4 are set ON, and the remaining switches SW1, SW3, and SW5 are set OFF. The voltage of the output line OUTC is thereby raised to the ground level. After that, three switches SW1, SW3, and SW4 are set ON, and the remaining two switches SW2 and SW5 are set OFF, like the first stage. This operation is repeated after this.

Using the driving apparatus with this construction, the positive voltage (+Vs/2) and the negative voltage (−Vs/2) are alternately applied to the common electrode X of the load 20, as shown on the output line OUTC in FIG. 10. Also to the scanning electrode Y of the load 20, the positive voltage (+Vs/2) and the negative voltage (−Vs/2) are alternately applied by performing a switching control similar to that on the common electrode X side.

In this case, the respective voltages (±Vs/2) are applied to the common and scanning electrodes X and Y so that they are reverse in phase to each other. For example, when the positive voltage (+Vs/2) is applied to the common electrode X, the negative voltage (−Vs/2) is applied to the scanning electrode Y. By this manner, the potential difference between the common and scanning electrodes X and Y can be kept at the voltage Vs, which is equal to a sustain pulse. This makes it possible to provide the same state as that in the sustain discharge period shown in FIG. 3 (the state that the sustain pulse voltage Vs is applied alternately to the common and scanning electrodes X and Y).

Figure 11:
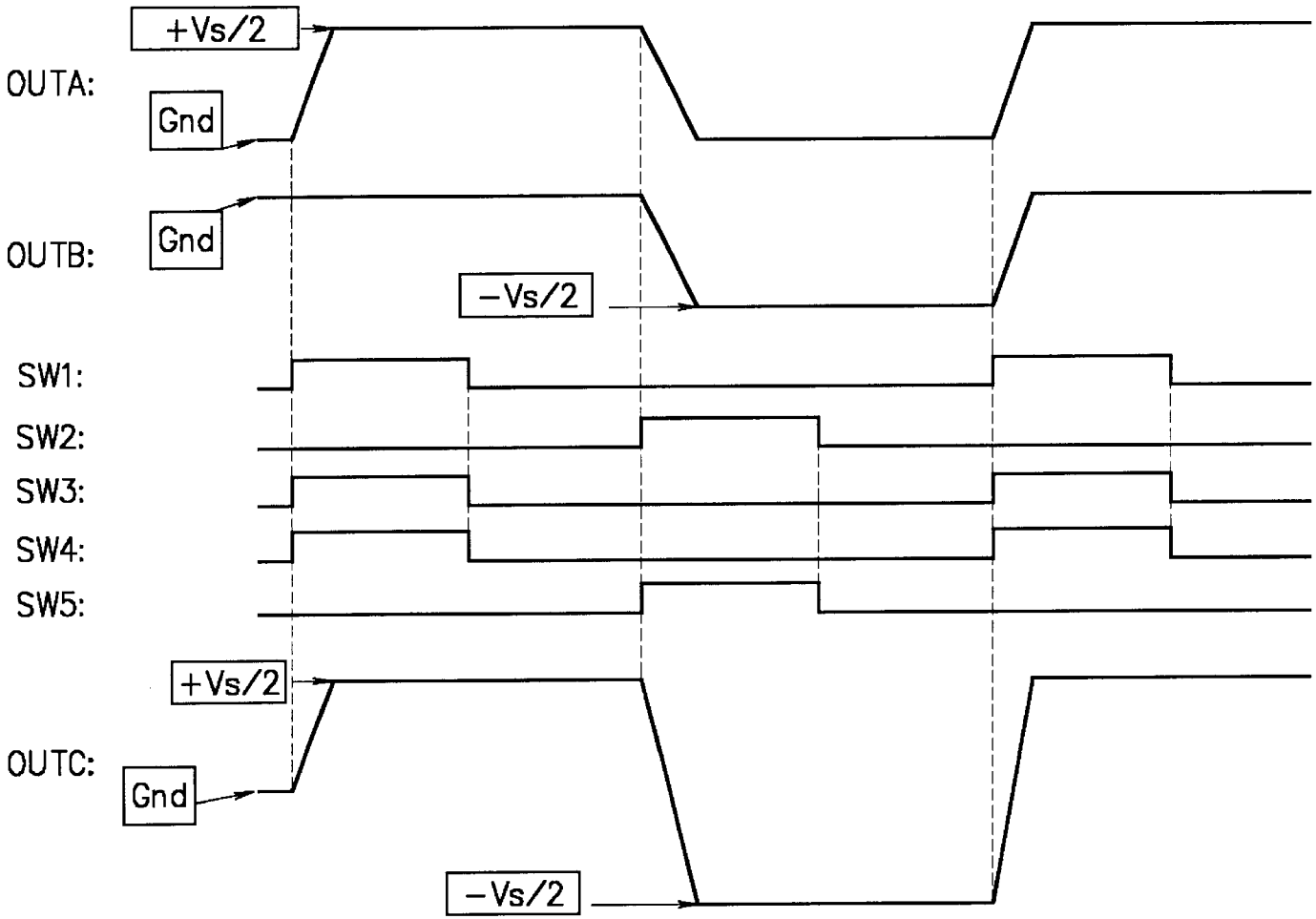
FIG. 11 is a timing chart showing another example of driving waveforms in a sustain discharge period by the driving apparatus of FIG. 9.

FIG. 11 is a timing chart showing another example of driving waveforms in a sustain discharge period by the driving apparatus according to this embodiment.

Referring to FIG. 11, firstly, three switches SW1, SW3, and SW4 are turned ON, and the remaining switches SW2 and SW5 are kept OFF. At this time, the voltage of the first signal line OUTA rises to a voltage level (+Vs /2) given through the A/D converter 42 via the switch SW1, while the voltage of the second signal line OUTB remains at the ground level. Since the switch SW4 is ON, the voltage (+Vs/2) of the first signal line OUTA is applied to the load 20 via the output line OUTC.

At this stage, since the switches SW1 and SW3 are turned ON to connect the capacitor C1 to the power supply, charges corresponding to the voltage (Vs/2) given through the A/D converter 42 via the switch SW1 are stored in the capacitor C1.

At the next timing, all the five switches SW1 to SW5 are turned OFF. The first signal line OUTA is then at a high impedance to maintain its voltage (Vs/2), and the output line OUTC also maintains its voltage (Vs/2).

Next, two switches SW2 and SW5 are turned ON, and the remaining three switches SW1, SW3, and SW4 are kept OFF. No power supply voltage is then supplied to the first signal line OUTA through the A/D converter 42 via the switch SW1, so the voltage of the first signal line OUTA remains at the ground level.

As for the second signal line OUTB, the first signal line OUTA is grounded because the switch SW2 is ON. The second signal line OUTB has a potential (−Vs/2) lower than the ground level by a voltage (Vs/2) corresponding to the charges stored in the capacitor C1. Since the switch SW5 is ON, the voltage (−Vs/2) of the second signal line OUTB is applied to the load 20 through the output line OUTC.

At the next timing, all the five switches SW1 to SW5 are turned OFF again. The second signal line OUTB is then at a high impedance to maintain its voltage (Vs/2), and the output line OUTC also maintains its voltage (−Vs/2). After that, three switches SW1, SW3, and SW4 are turned ON, and the remaining two switches SW2 and SW5 are kept OFF, like the first stage. This operation is repeated after this.

As described above, the driving apparatus shown in FIG. 9 according to the first embodiment of the present invention is characterized by including the first signal line OUTA the voltage on which changes between the Vs/2 level and the ground level in accordance with ON/OFF of the capacitor C1 and the switches SW1 to SW3, the second signal line OUTB the voltage on which changes between the ground level and the −Vs/2 level similarly, and the driver circuit for the load 20 provided between the first and second signal lines.

Using the driving apparatus with this construction, the positive voltage (+Vs/2) and the negative voltage (−Vs/2) are alternately applied to the common electrode X of the load 20 by controlling ON/OFF of the switches SW4 and SW5 in the driver circuit, as shown on the output line OUTC in FIG. 11. The positive voltage (+Vs/2) and the negative voltage (−Vs/2) are also alternately applied to the scanning electrode Y of the load 20 by driving the power supply circuit 43' and the driver circuit 44' in the same way as that described above.

In this case, the respective voltages (±Vs/2) are applied to the common and scanning electrodes X and Y so that they are reverse in phase to each other. For example, when the positive voltage (+Vs/2) is applied to the common electrode X, the negative voltage (−Vs/2) is applied to the scanning electrode Y. By this manner, the common and scanning electrodes X and Y can have a potential difference corresponding to the sustain pulse voltage Vs. This makes it possible to provide the same state as that in the sustain discharge period shown in FIG. 3 (the state that the sustain pulse voltage Vs is applied alternately to the common and scanning electrodes X an Y).

The absolute values of the voltages applied to the power supply circuits 43 and 43' and the driver circuits 44 and 44' are Vs/2 at most. Thus each element in these circuits only need have the breakdown voltage of Vs/2, i.e., half the conventional breakdown voltage. This makes it possible to use compact and inexpensive elements, and so realize simplification in circuit construction and reduction of manufacturing cost.

Besides, in the driving apparatus according to this embodiment, the voltage to be applied to the load is Vs/2 at most, i.e., sufficed by half the voltage Vs. Therefore, even taking an increase in power consumption which is caused by the fact that cycles of applying the voltages to the load become double the conventional ones, into consideration, the total power loss can be reduced in comparison with the conventional manner, in which the voltage Vs itself is applied to the load 20.

Figure 12:
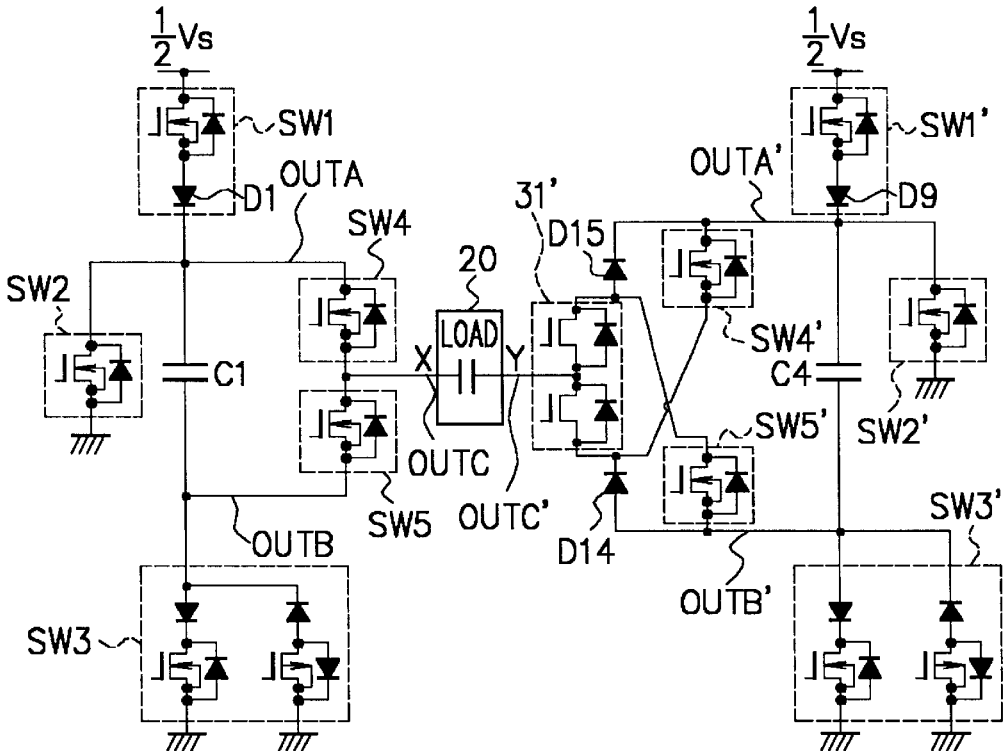
FIG. 12 is a circuit diagram showing a specific example of construction of the driving apparatus according to the first embodiment.

FIG. 12 is a circuit diagram showing a specific example of construction of a driving apparatus to which the characteristic feature of the first embodiment shown in FIG. 9 is applied. In FIG. 12, the same references as those in FIGS. 9 and 4 denote the same functional components as those in FIGS. 9 and 4.

Referring to FIG. 12, on the common electrode X side, the switches SW1 and SW2 are connected in series between the ground (GND) and the power supply line of the voltage (Vs/2) generated by the A/D converter 42 of FIG. 8 (not shown in FIG. 12). The node between the switches SW1 and SW2 is connected to one terminal of the capacitor C1. The switch SW3 is connected between GND and the other terminal of the capacitor C1.

The switches SW4 and SW5 are connected in series between both terminals of the capacitor C1. The node between the switches SW4 and SW5 is connected to the common electrode X of the load 20.

On the scanning electrode Y side, the switches SW1' and SW2' are connected in series between GND and the power supply line of the voltage (Vs/2) generated by the A/D converter 42 of FIG. 8. The node between the switches SW1' and SW2' is connected to one terminal of a capacitor C4. The switch SW3' is connected between GND and the other terminal of the capacitor C4.

The switch SW4' connected to one terminal of the capacitor C4 is connected to the cathode of the diode D14. The anode of the diode D14 is connected to the other terminal of the capacitor C4. The switch SW5' connected to the other terminal of the capacitor C4 is connected to the anode of the diode D15. The cathode of the diode D15 is connected to the one terminal of the capacitor C4. One terminal of each of the switches SW4' and SW5' respectively connected to the cathode of the diode D14 and the anode of the diode D15, is connected to the load 20 through a scan driver 31'. FIG. 12 illustrates only one scan driver 31' though the same is provided in practice for every display line in the PDP. Contrastingly, the other circuits are shared by display lines as common circuits.

Each of the switches SW1 to SW5 and SW1' to SW5' shown in FIG. 12 comprises, e.g., a MOSFET and, as occasion demands, a diode connected to the MOSFET.

For example, each of the switches SW1 and SW1' comprises a p- or n-channel MOSFET connected to the power supply line of Vs/2, and a diode having its anode connected to the drain of the p-channel MOSFET or the source of the n-channel MOSFET.

Each of the switches SW2 and SW2' comprises an n-channel MOSFET connected to the GND line, and a diode having its cathode connected to the drain of the n-channel MOSFET.

Figure 13A:
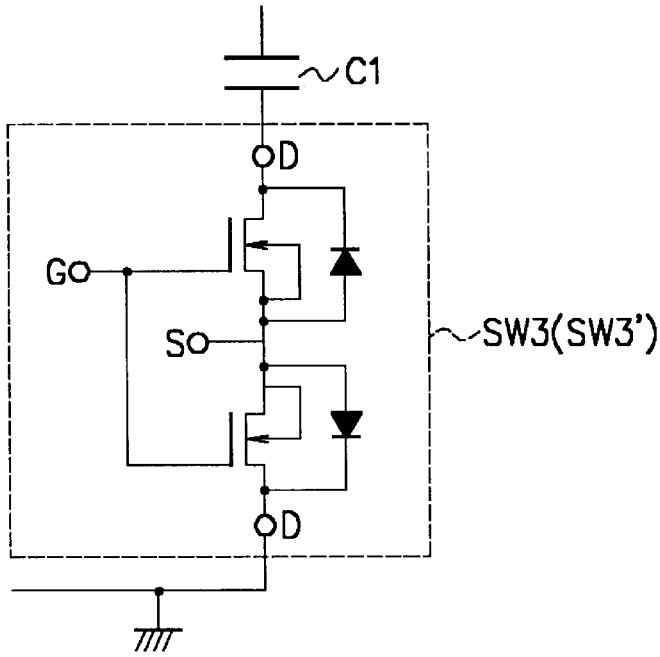

Although the switches SW3 and SW3' can be constructed like the switches SW2 and SW2', each comprises two sets of such a MOSFET and a diode connected in series as described above, the two sets being connected in parallel in relation to the ground, as shown in FIG. 12. Otherwise, for example, the sources of both MOSFETs may be connected to each other, and the common source may be connected to the anodes of both diodes, as shown in FIG. 13A. When the switches SW3 and SW3' are constructed as shown in FIG. 12 or 13A, a current can flow in either direction when the switch SW3 or SW3' is ON. When the switch is OFF, the current can be completely cut off. A more stable operation is thus realized.

Figure 13B:
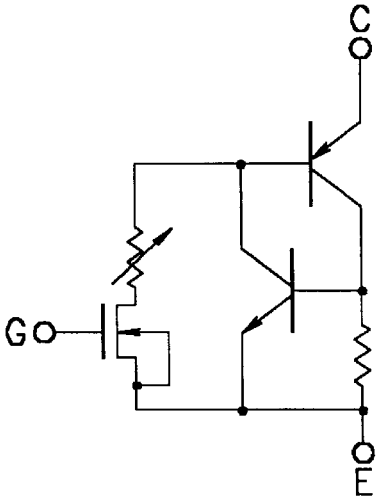
Figure 13C:
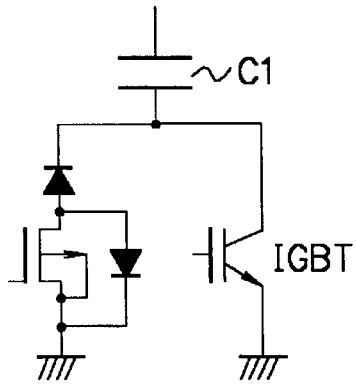

Each of the switches SW1, SW2, SW1', and SW2' may comprise an IGBT (Insulated Gate Bipolar Transistor) element as shown in FIG. 13B. As for the switches SW3 and SW3', as shown in FIG. 13C, one of the two sets of switching elements each comprising a MOSFET and a diode may comprises such an IGBT element. The IGBT element is a bipolar-MOS composite element with three terminals, and its operation resistance lower than that of MOSFET affords reduced loss. In addition, since it does not allow any countercurrent, no diode is required.

In the driving apparatus having the above construction, by the above switching control of the switches SW1 to SW5 on the common electrode X side and the switches SW1' to SW5' on the scanning electrode Y side, the positive and negative voltages (+Vs/2) are applied inversely in phase to the common and scanning electrodes X and Y.

In each sustain discharge period, the timing at which the voltage (+Vs/2 or −Vs/2) is applied to the common electrode X may not always be equal to the timing at which the voltage in the opposite phase (Vs/2 or +Vs/2) is applied to the scanning electrode Y. The timings for both voltages may differ to some degree. For example, the voltage may be applied to one electrode after the voltage in the opposite phase applied to the other electrode has reached its stationary state. This causes a more stable action of sustain discharge.

The times of pulse voltages being applied to the electrodes X and Y need not always be equal to each other. The timings and times for applying voltages to the common and scanning electrodes X and Y can be controlled, e.g., by controlling ON/OFF timings of the switches SW4, SW4', SW5, and SW5'.

It is also possible to make, e.g., ON/OFF control of the above switches SW1 to SW5 and SW1' to SW5' in accordance with a program stored in a storage medium such as a ROM. This makes it possible to vary freely the waveform of voltage to be applied by changing ROM.

FIGS. 14 to 20 show various examples of driving waveforms of pulse voltages to be applied to the electrodes X and Y in a sustain discharge period.

Figure 14:
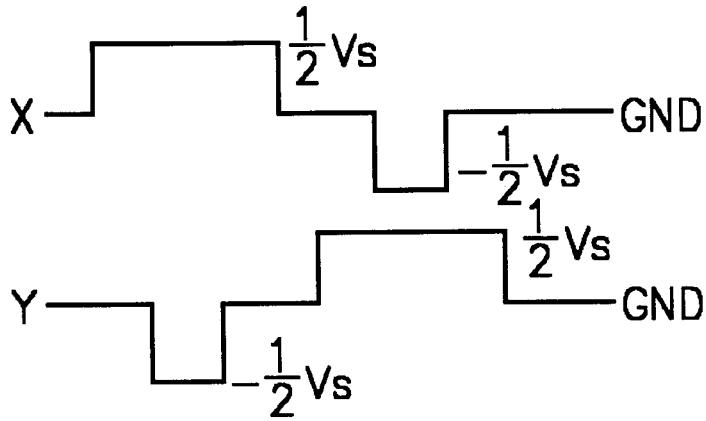
FIG. 14 is a chart showing an example of driving waveforms of pulse voltages applied to electrodes X and Y in a sustain discharge period.

FIG. 14 shows an example of driving waveforms in which the timing of applying the positive voltage (+Vs/2) is always earlier than that of applying the negative voltage (−Vs/2), and the timing of returning the applied positive voltage (+Vs/2) to the ground level is always later than that of returning the applied negative voltage (−Vs/2) to the ground level. More specifically, after the positive voltage (+Vs/2) applied to one of the common or scanning electrodes X and Y has reached its stationary state, the negative voltage (−Vs/2) is applied to the other electrode. Besides, after the voltage being returned from the negative voltage (−Vs/2) to the ground level has reached its stationary state at one electrode, the voltage being applied to the other electrode is returned from the positive voltage (+Vs/2) to the ground level.

Furthermore, in this example of FIG. 14, the pulse width of the negative voltage (−Vs/2) is smaller than that of the positive voltage (+Vs/2) so that the negative voltage is returned to the ground level while the positive voltage is applied. This affords a more stable action of sustain discharge.

Figure 15:
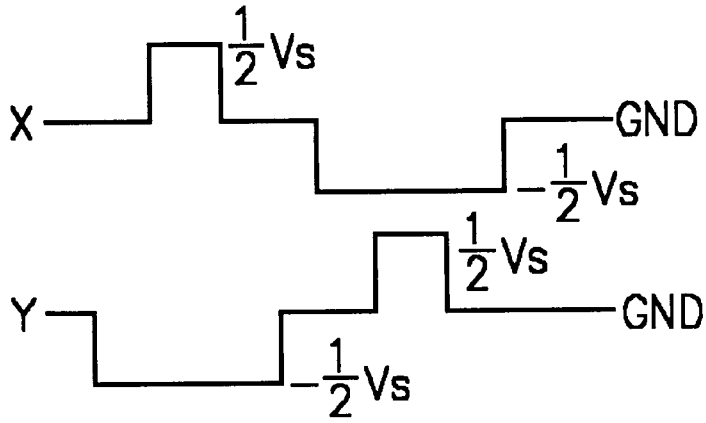
FIG. 15 is a chart showing another example of driving waveforms of pulse voltages applied to electrodes X and Y in a sustain discharge period.

FIG. 15 shows an example of driving waveforms in which the relation in polarity is reversed to that in FIG. 14. That is, the timing of applying the negative voltage (−Vs/2) is always earlier than that of applying the positive voltage (+Vs/2), and the timing of returning the applied negative voltage (−Vs/2) to the ground level is always later than that of returning the applied positive voltage (+Vs/2) to the ground level. More specifically, after the negative voltage (−Vs/2) applied to one electrode has reached its stationary state, the positive voltage (+Vs/2) is applied to the other electrode. Besides, after the voltage being returned from the positive voltage (+Vs/2) to the ground level has reached its stationary state at one electrode, the voltage being applied to the other electrode is returned from the negative voltage (−Vs/2) to the ground level.

Furthermore, in this example of FIG. 15, the pulse width of the positive voltage (+Vs/2) is smaller than that of the negative voltage (−Vs/2) so that the positive voltage is returned to the ground level while the negative voltage is applied. This affords a more stable action of sustain discharge.

Figure 16:
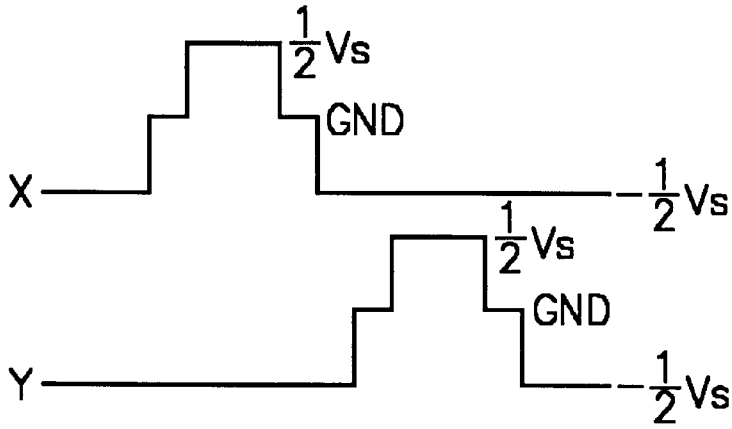
FIG. 16 is a chart showing another example of driving waveforms of pulse voltages applied to electrodes X and Y in a sustain discharge period.

FIG. 16 shows an example of driving waveforms in which the negative voltage (−Vs/2) is used as the reference voltage. More specifically, in a sustain discharge period, both the electrodes X and Y are kept at the voltage (−Vs/2) while no sustain pulse is applied, and the voltage of one electrode is raised to (+Vs/2) at the timing of actually applying a sustain pulse to discharge. Also in this example of FIG. 16, the pulse width of the negative voltage (−Vs/2) is greater than that of the positive voltage (+Vs/2), like the example of FIG. 15.

As shown in this example of driving waveforms of FIG. 16, the voltage being applied to one electrode is fixed while the voltage being applied to the other electrode is changed. In this case, a predetermined voltage can be applied between the common and scanning electrodes X and Y only by such a change in voltage of the other electrode. This makes it possible to realize a more stable action of sustain discharge.

Figure 17:
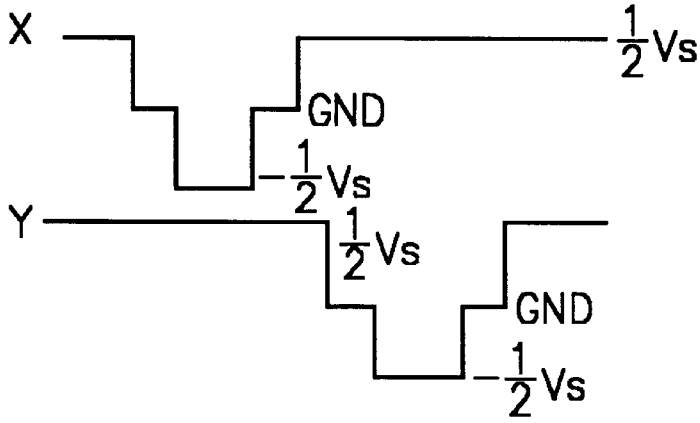
FIG. 17 is a chart showing another example of driving waveforms of pulse voltages applied to electrodes X and Y in a sustain discharge period.

FIG. 17 shows an example of driving waveforms in which the relation in polarity is reversed to that in FIG. 16. That is, the positive voltage (+Vs/2) is used as the reference voltage. More specifically, in a sustain discharge period, both the electrodes X and Y are kept at the voltage (+Vs/2) while no sustain pulse is applied, and the voltage of one electrode is lowered to (−Vs/2) at the timing of actually applying a sustain pulse to cause a discharge. In this example of FIG. 17, the pulse width of the positive voltage (+Vs/2) is greater than that of the negative voltage (−Vs/2), like the example of FIG. 14.

As shown in this example of driving waveforms of FIG. 17, the voltage being applied to one electrode is fixed while the voltage being applied to the other electrode is changed. In this case, a predetermined voltage can be applied between the common and scanning electrodes X and Y only by such a change in voltage of the other electrode. This makes it possible to realize a more stable action of sustain discharge.

Figure 18:
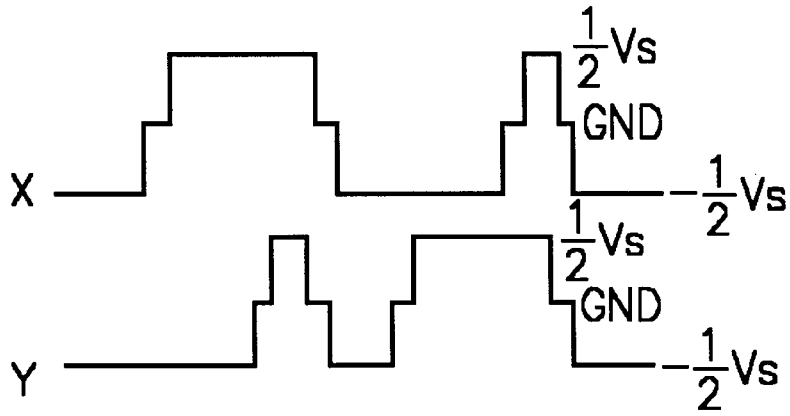
FIG. 18 is a chart showing another example of driving waveforms of pulse voltages applied to electrodes X and Y in a sustain discharge period.

FIG. 18 shows an example of driving waveforms in which the negative voltage (−Vs/2) is used as the reference voltage and the voltage of one electrode is raised to (+Vs/2) at the timing of an actual discharge, like the example of FIG. 16. Further in this example of FIG. 18, before the one electrode is returned to the negative voltage (−Vs/2) after the discharge, the voltage of the other electrode is raised to the positive voltage (+Vs/2) and then returned to the negative voltage (−Vs/2).

For example, while the scanning electrode Y is kept at the negative voltage (−Vs/2), the voltage of the common electrode X is raised from the negative voltage (−Vs/2) to the positive voltage (+Vs/2) so that the difference voltage is applied between both electrodes to cause a discharge. The load 20 then stores charges according to the applied voltage.

After this, before the common electrode X is returned from the positive voltage (+Vs/2) to the original negative voltage (−Vs/2), the voltage of the scanning electrode Y is also raised to (+Vs/2). The charges stored in the load 20 are thereby returned to the capacitor C1 on the common electrode X side. In this manner, the charges stored in the load 20 due to the electric discharge are not simply abandoned but returned to the capacitor C1, thereby achieving power saving.

While the common electrode X is kept at the positive voltage (+Vs/2), the voltage of the scanning electrode Y is raised also to the positive voltage (+Vs/2). The positive voltage (+Vs/2) is then applied to both the common and scanning electrodes X and Y, so the electrodes X and Y are at the same potential.

At this time, all the switches SW1 to SW5 on the common electrode X side are turned or kept OFF to keep the common electrode X side in the state of high impedance, and the voltage being applied to the scanning electrode Y side is lowered to the negative voltage (−Vs/2). Also the voltage on the common electrode X side is then lowered by the function of the capacitance of the load 20 to the negative voltage (−Vs/2) with following the voltage on scanning electrode Y side. At this time, charging the load 20 is not performed, and the charged electricity to the load 20 is zero. Thus there is no power loss, and power saving is achieved.

Figure 19:
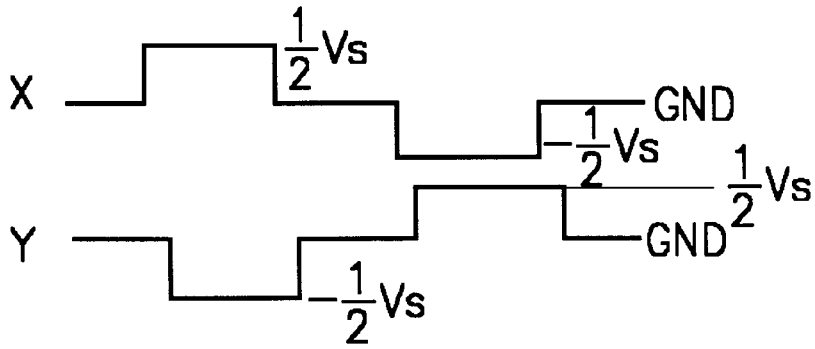
FIG. 19 is a chart showing another example of driving waveforms of pulse voltages applied to electrodes X and Y in a sustain discharge period.

FIG. 19 shows an example of driving waveforms in which the pulse width of the positive voltage (+Vs/2) is equal to that of the negative voltage (−Vs/2) but the timings of applying the voltages to the common and scanning electrodes X and Y are not the same. In this example of FIG. 19, the timing of applying one voltage to the common electrode X is always earlier than that of applying the other voltage to the scanning electrode Y. But the case to the contrary is also.possible. By applying the positive or negative voltage to one electrode after the negative or positive voltage applied to the other electrode has reached its stationary state, control is made for preventing any large momentary current from flowing through the circuit. This affords a more stable action of sustain discharge.

Figure 20:
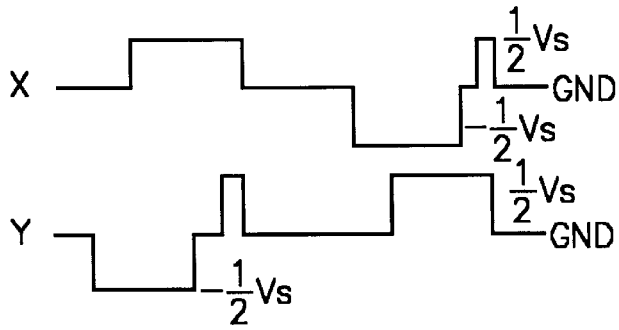
FIG. 20 is a chart showing another example of driving waveforms of pulse voltages applied to electrodes X and Y in a sustain discharge period.

FIG. 20 shows an example of driving waveforms in which the ground level is used as the reference voltage and the positive and negative voltages (±Vs/2) are applied to both the common and scanning electrodes X and Y. In this case, the timing of applying the negative voltage (−Vs/2) is always earlier than that of applying the positive voltage (+Vs/2), and the timing of returning the applied negative voltage (−Vs/2) to the ground level is always earlier than that of returning the applied positive voltage (+Vs/2) to the ground level.

Further in this example of FIG. 20, the positive voltage (+Vs/2) is applied to either electrode after discharging, to make both electrodes at the same potential, like the example of FIG. 18. After this, one electrode is returned to the ground level while the other electrode is kept at high impedance. The other electrode is returned to the ground level with following the voltage drop of the one electrode. At this time, charging the load 20 is not performed, and the charged electricity to the load 20 is zero. Thus there is no power loss, and power saving is achieved.

Figure 21:
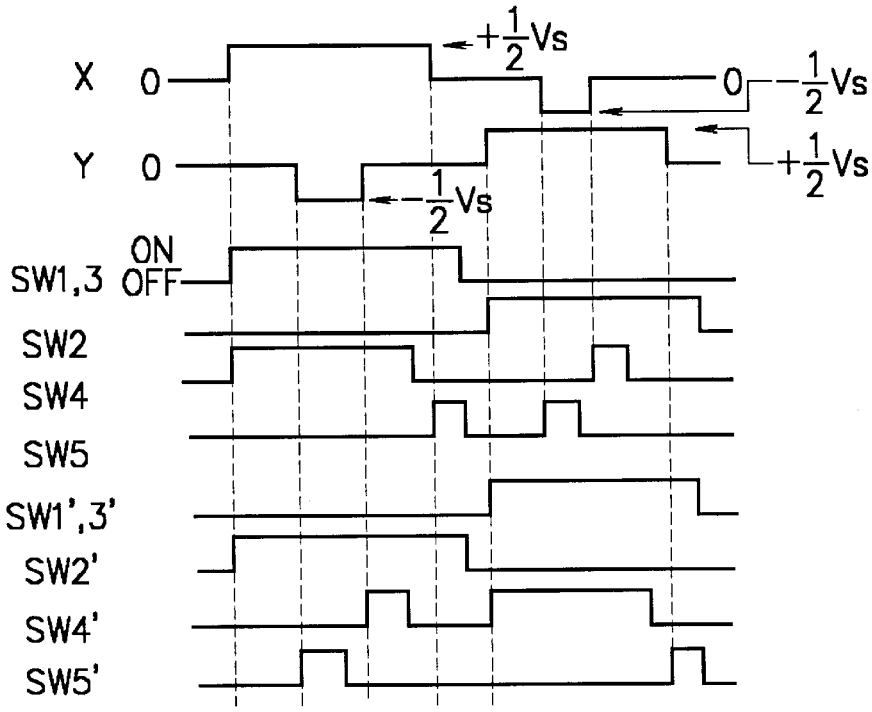
FIG. 21 is a timing chart showing an example of switching control for generating the waveforms shown in FIG. 14.

FIG. 21 is a timing chart showing an example of control of the switches SW1 to SW5 and SW1' to SW5' to generate the waveforms on the electrodes X and Y shown in FIG. 14. In this example of FIG. 21, it is assumed that, by processing in the preceding subfield, the charges corresponding to the voltage (Vs/2) are stored in either of the capacitor C1 on the common electrode X side and the capacitor C4 on the scanning electrode Y side.

In sustain discharge period, on the common electrode X side, firstly, three switches SW1, SW3, and SW4 are turned ON and the remaining switches SW2 and SW5 are kept OFF. At this time, the first signal line OUTA is at the voltage level (+Vs/2) applied through the switch SW1. The voltage (+Vs/2) of this first signal line OUTA is output on the output line OUTC through the switch SW4 to be applied to the load 20.

At this stage, the switches SW1 and SW3 are ON, and so the capacitor C1 is connected to the power supply. Thus the capacitor C1 stores the charges corresponding to the voltage (Vs/2) applied through the switch SW1.

On the scanning electrode Y side, the switch SW2' is turned ON at the same time when the switches SW1, SW3, and SW4 on the common electrode X side are turned ON. After the positive voltage (+Vs/2) is applied to the common electrode X side, the switch SW5' is also turned ON at a proper timing. In this state, the remaining three switches SW1', SW3', and SW4' are kept OFF.

Since the switch SW2' is turned ON and the first signal line OUTA' is grounded, the voltage of the fourth signal line OUTB' falls to the potential (−Vs/2), which is lower than the ground level by the voltage (Vs/2) corresponding to the charges stored in the capacitor C4. After this, since the switch SW5' is turned ON at the proper timing, the voltage (−Vs/2) of the fourth signal line OUTB' is applied to the load 20 through the output line OUTC'. The difference voltage (Vs) is then applied between the electrodes X and Y of the load 20, and a sustain discharge occurs.

After applying the difference voltage (Vs) to the load 20 for the sustain discharge, on the common electrode X side, the switch SW4 is turned OFF to stop the supply of the voltage (+Vs/2), and then the switch SW5 is turned ON to return the voltage being applied to the common electrode X, to the ground level.

On the scanning electrode Y side, at a timing before the switch SW4 is turned OFF on the common electrode X side as described above, the switch SW5' is turned OFF to stop the supply of the voltage (−Vs/2), and then the switch SW4' is turned ON. In this manner, before the voltage being applied to the common electrode X is returned to the ground level, the voltage being applied to the scanning electrode Y is returned to the ground level.

At the next timing, all the five switches SW1 to SW5 on the common electrode X side and the five switches SW1' to SW5' on the scanning electrode Y side are OFF. Switch control completely reverse to the above on the common electrode X side and the scanning electrode Y side, is then performed so that the positive voltage (+Vs/2) with a large pulse width is applied to the scanning electrode Y side and the negative voltage (−Vs/2) with a pulse width smaller than that of the positive voltage on the scanning electrode Y side, is applied to the common electrode X side. After this, the same controls are repeated alternately.

Figure 22:
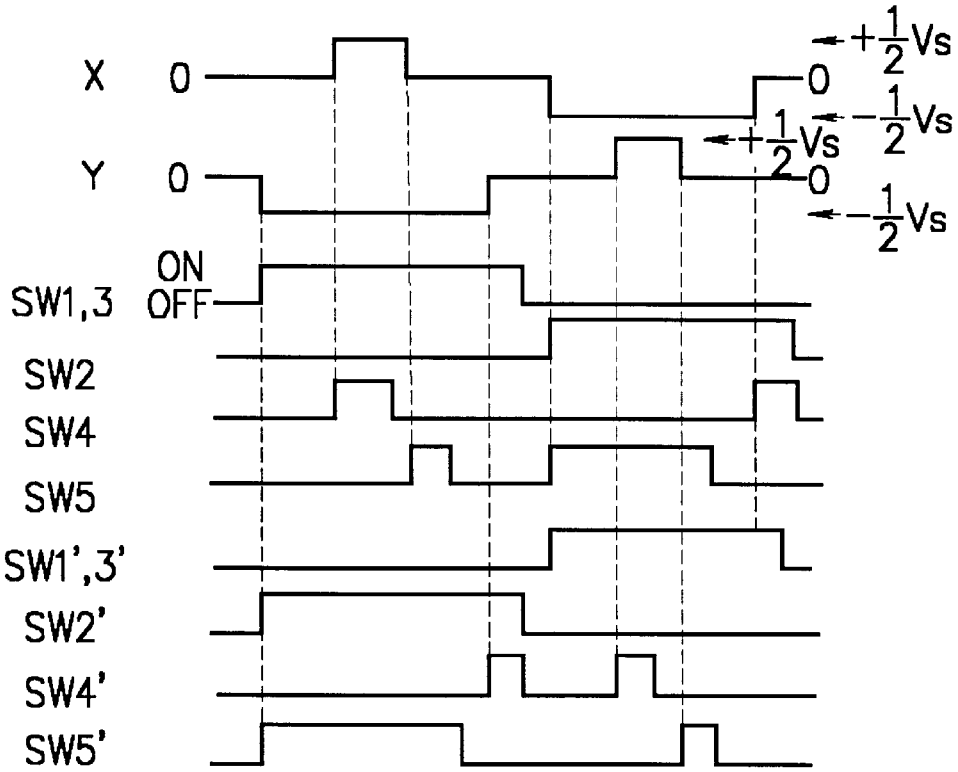
FIG. 22 is a timing chart showing an example of switching control for generating the waveforms shown in FIG. 15.

FIG. 22 is a timing chart showing an example of control of the switches SW1 to SW5 and SW1' to SW5' to generate the waveforms on the electrodes X and Y shown in FIG. 15. In this example of FIG. 22, it is assumed that, by processing in the preceding subfield, the charges corresponding to the voltage (Vs/2) are stored in either of the capacitor C1 on the common electrode X side and the capacitor C4 on the scanning electrode Y side.

In sustain discharge period, on the scanning electrode Y side, firstly, two switches SW2' and SW5' are turned ON and the remaining switches SW1', SW3', and SW4' are kept OFF. Since the switch SW2' is turned ON and the first signal line OUTA' is grounded, the voltage of the fourth signal line OUTB' falls to the potential (−Vs/2), which is lower than the ground level by the voltage (Vs/2) corresponding to the charges stored in the capacitor C4. At this time, since the switch SW5' is turned ON simultaneously with the switch SW2', the voltage (−Vs/2) of the fourth signal line OUTB' is applied to the load 20 through the output line OUTC'.

On the common electrode X side, the switches SW1 and SW3 are turned ON at the same time when the switches SW2' and SW5' on the scanning electrode Y side are turned ON. After the negative voltage (−Vs/2) is applied to the scanning electrode Y side, the switch SW4 is also turned ON at a proper timing. In this state, the remaining two switches SW2 and SW5 are kept OFF.

The first signal line OUTA is thereby raised to the voltage level (+Vs/2) at the timing when the switch SW1 is turned ON. The voltage (+Vs/2) of this first signal line OUTA is output on the output line OUTC through the switch SW4, which has been turned ON at the proper timing, to be applied to the load 20. Thus the difference voltage (Vs) is applied between the electrodes X and Y of the load 20.

At this stage, the switches SW1 and SW3 are ON, and so the capacitor C1 is connected to the power supply. Thus the capacitor C1 stores the charges corresponding to the voltage (Vs/2) applied through the switch SW1.

After applying the difference voltage (Vs) to the load 20 for a sustain discharge, on the scanning electrode Y side, the switch SW5' is turned OFF to stop the supply of the voltage (−Vs/2), and then the switch SW4' is turned ON to return the voltage being applied to the scanning electrode Y, to the ground level.

On the common electrode X side, at a timing before the switch SW5' is turned OFF on the scanning electrode Y side as described above, the switch SW4 is turned OFF to stop the supply of the voltage (+Vs/2), and then the switch SW5 is turned ON. In this manner, before the voltage being applied to the scanning electrode Y is returned to the ground level, the voltage being applied to the common electrode X is returned to the ground level.

At the next timing, all the five switches SW1 to SW5 on the common electrode X side and the five switches SW1' to SW5' on the scanning electrode Y side are OFF. Switch control completely reverse to the above on the common electrode X side and the scanning electrode Y side, is then performed so that the negative voltage (−Vs/2) with a large pulse width is applied to the common electrode X side and the positive voltage (+Vs/2) with a pulse width smaller than that of the negative voltage on the common electrode X side, is applied to the scanning electrode Y side. After this, the same controls are repeated alternately.

Figure 23:
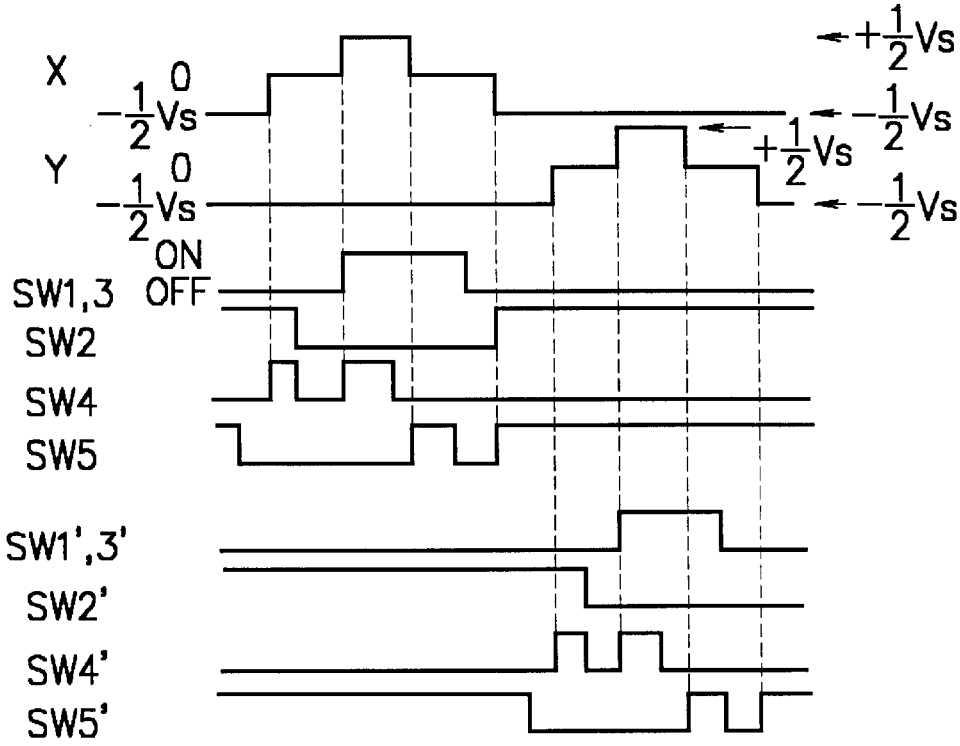
FIG. 23 is a timing chart showing an example of switching control for generating the waveforms shown in FIG. 16.

FIG. 23 is a timing chart showing an example of control of the switches SW1 to SW5 and SW1' to SW5' to generate the waveforms on the electrodes X and Y shown in FIG. 16. In this example of FIG. 23, it is assumed that, by processing in the preceding subfield, the charges corresponding to the voltage (Vs/2) are stored in either of the capacitors C1 and C4 on the common electrode X side and the scanning electrode Y side.

In a sustain discharge period, on the common electrode X side, at first, the switches SW1, SW3, and SW4 are OFF and the remaining switches SW2 and SW5 are ON. This makes the state that the negative voltage (−Vs/2) is being applied to the common electrode X. Also on the scanning electrode Y side, at first, the switches SW1', SW3', and SW4' are OFF and the remaining switches SW2' and SW5' are ON, and this makes the state that the negative voltage (−Vs/2) is being applied to the scanning electrode Y.

At the next timing, on the common electrode X side, after the switch SW5 is turned OFF to stop the supply of the voltage (−Vs/2), the switch SW4 is turned ON. The voltage being applied to the common electrode X is thereby returned to the ground level. Further, after the switches SW2 and SW4 are turned OFF, the switches SW1, SW3, and SW4 are turned ON. At this time, the remaining switches SW2 and SW5 are kept OFF.

In this manner, on the common electrode X side, the first signal line OUTA is raised to the voltage level (+Vs/2) applied through the switch SW1. The voltage (+Vs/2) of this first signal line OUTA is output on the output line OUTC through the switch SW4 to be applied to the load 20. At this time, the scanning electrode Y is kept in the state that the negative voltage (−Vs/2) is being applied thereto. Consequently, the difference voltage (Vs) is applied between the electrodes X and Y of the load 20, and a sustain discharge occurs.

At this stage, the switches SW1 and SW3 are ON, and so the capacitor C1 is connected to the power supply. Thus the capacitor C1 stores the charges corresponding to the voltage (Vs/2) applied through the switch SW1.

After applying the difference voltage (Vs) to the load 20 for the sustain discharge, on the common electrode X side, the switch SW4 is turned OFF to stop the supply of the voltage (+Vs/2), and then the switch SW5 is turned ON to return the voltage being applied to the common electrode X, to the ground level. Further, all the switches SW1 to SW5 are once set OFF, and then the switches SW2 and SW5 are turned ON.

Since the switch SW2 is turned ON and the higher terminal side of the capacitor C1 is grounded, the second signal line OUTB falls to the potential (−Vs/2), which is lower than the ground level by the voltage (Vs/2) corresponding to the charges stored in the capacitor C1. At this time, since the switch SW5 is ON, the voltage (−Vs/2) of the second signal line OUTB is applied to the load 20 through the output line OUTC.

After the positive voltage (+Vs/2) is applied to the common electrode X, and the voltage being applied to the common electrode X is again returned to the negative voltage (−Vs/2), the same switching control is performed also on the scanning electrode Y side. By this control, also on the scanning electrode Y side, performed is the operation of applying the positive voltage (+Vs/2) and then returning to the state that the negative voltage (−Vs/2) is again applied. After this, the same controls are repeated alternately.

Figure 24:
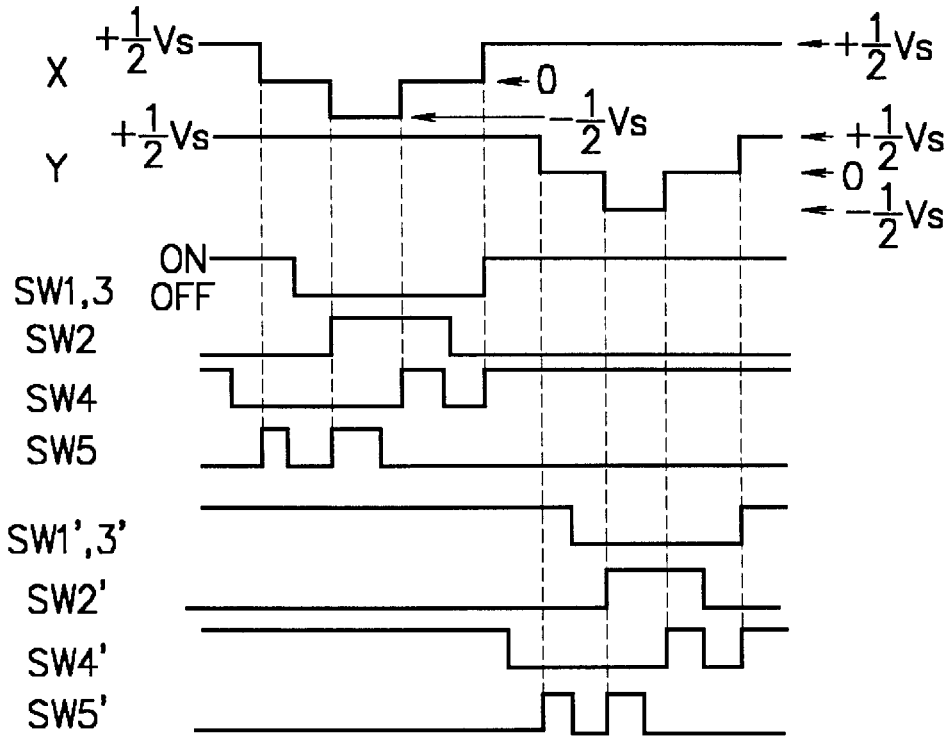
FIG. 24 is a timing chart showing an example of switching control for generating the waveforms shown in FIG. 17.

FIG. 24 is a timing chart showing an example of control of the switches SW1 to SW5 and SW1' to SW5' to generate the waveforms on the electrodes X and Y shown in FIG. 17. In this example of FIG. 24, it is assumed that, by processing in the preceding subfield, the charges corresponding to the voltage (Vs/2) are stored in either of the capacitors C1 and C4 on the common electrode X side and the scanning electrode Y side.

In a sustain discharge period, on the common electrode X side, at first, the switches SW1, SW3, and SW4 are ON and the remaining switches SW2 and SW5 are OFF. This makes the state that the positive voltage (+Vs/2) is being applied to the common electrode X. Also on the scanning electrode Y side, at first, the switches SW1', SW3', and SW4' are ON and the remaining switches SW2' and SW5' are OFF, and this makes the state that the positive voltage (+Vs/2) is being applied to the scanning electrode Y.

At this stage, the switches SW1 and SW3 on the common electrode X side are ON, and so the capacitor C1 is connected to the power supply. Thus the capacitor C1 stores the charges corresponding to the voltage (Vs/2) applied through the switch SW1. Similarly, since the switches SW1' and SW3' on the scanning electrode Y side are ON, and so the capacitor C4 is connected to the power supply, the capacitor C4 stores the charges corresponding to the voltage (Vs/2) applied through the switch SW1'.

At the next timing, on the common electrode X side, the switch SW4 is turned OFF to stop the supply of the voltage (+Vs/2), and then the switch SW5 is turned ON to return the voltage being applied to the common electrode X, to the ground level. Further, all the switches SW1 to SW5 are once set OFF, and then the switches SW2 and SW5 are turned ON.

Since the switch SW2 is turned ON and the first signal line OUTA is grounded, the second signal line OUTB falls to the potential (−Vs/2), which is lower than the ground level by the voltage (Vs/2) corresponding to the charges stored in the capacitor C1. At this time, since the switch SW5 is ON, the voltage (−Vs/2) of the second signal line OUTB is applied to the load 20 through the output line OUTC.

At this time, the scanning electrode Y is kept in the state that the positive voltage (+Vs/2) is being applied thereto. Consequently, the difference voltage (Vs) is applied between the electrodes X and Y of the load 20, and a sustain discharge occurs. After applying the difference voltage (Vs) to the load 20 for the sustain discharge, on the common electrode X side, the switch SW5 is turned OFF to stop the supply of the voltage (−Vs/2), and then the switch SW4 is turned ON to return the voltage being applied to the common electrode X, to the ground level.

Further, all the switches SW1 to SW5 are set OFF, and then the switches SW1, SW3, and SW4 are turned ON. At this time, the remaining switches SW2 and SW5 are kept OFF. The positive voltage (+Vs/2) is thereby applied to the common electrode X again.

After the negative voltage (−Vs/2) is applied to the common electrode X, and the voltage being applied to the common electrode X is again returned to the positive voltage (+Vs/2), the same switching control is performed also on the scanning electrode Y side. By this control, also on the scanning electrode Y side, performed is the operation of applying the negative voltage (−Vs/2) and then returning to the state that the positive voltage (+Vs/2) is again applied. After this, the same controls are repeated alternately.

Figure 25:
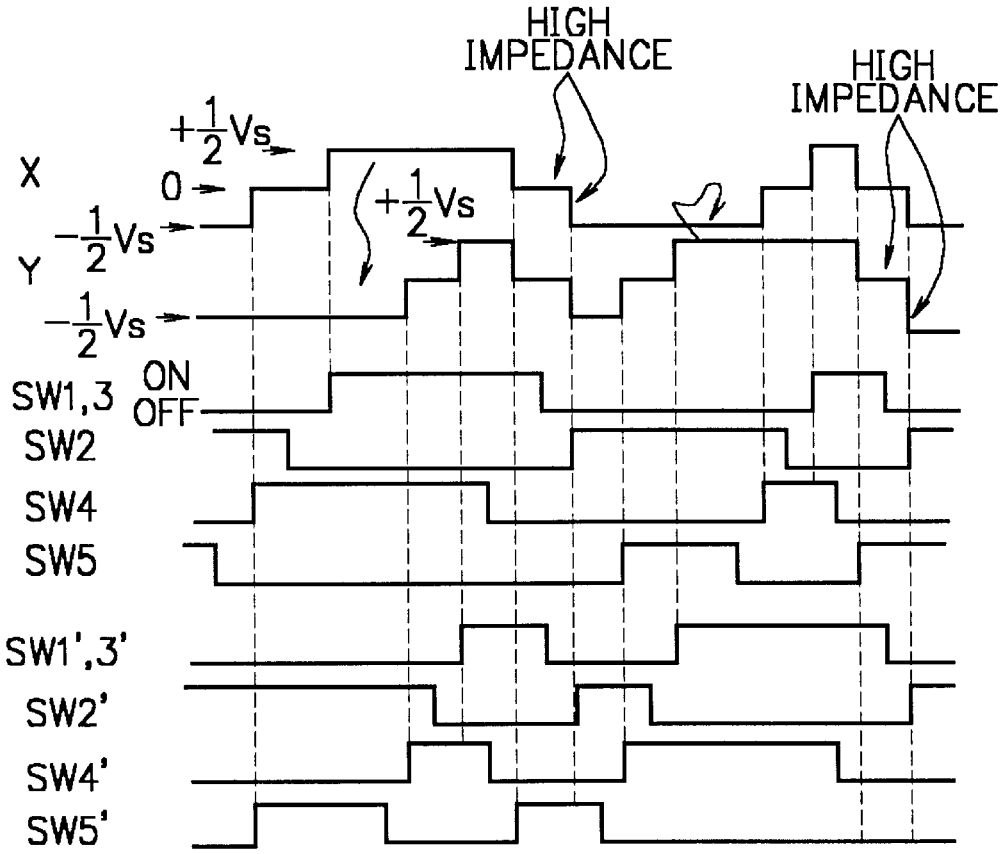
FIG. 25 is a timing chart showing an example of switching control for generating the waveforms shown in FIG. 18.

FIG. 25 is a timing chart showing an example of control of the switches SW1 to SW5 and SW1' to SW5' to generate the waveforms on the electrodes X and Y shown in FIG. 18. In this example of FIG. 25, it is assumed that, by processing in the preceding subfield, the charges corresponding to the voltage (Vs/2) are stored in either of the capacitors C1 and C4 on the common electrode X side and the scanning electrode Y side.

In a sustain discharge period, on the common electrode X side, at first, the switches SW1, SW3, and SW4 are OFF and the remaining switches SW2 and SW5 are ON. This makes the state that the negative voltage (−Vs/2) is being applied to the common electrode X. Also on the scanning electrode Y side, at first, the switches SW1', SW3', and SW4' are OFF and the remaining switches SW2' and SW5' are ON, and this makes the state that the negative voltage (−Vs/2) is being applied to the scanning electrode Y.

At the next timing, on the common electrode X side, after the switch SW5 is turned OFF to stop the supply of the voltage (−Vs/2), the switch SW4 is turned ON. The voltage being applied to the common electrode X is thereby returned to the ground level. Further, after the switch SW2 is turned OFF, the switches SW1 and SW3 are turned ON. At this time, the remaining switches SW4 and SW5 are kept ON and OFF, respectively.

In this manner, on the common electrode X side, the first signal line OUTA is raised to the voltage level (+Vs/2) applied through the switch SW1. The voltage (+Vs/2) of this first signal line OUTA is output on the output line OUTC through the switch SW4 to be applied to the load 20. At this time, the scanning electrode Y is kept in the state that the negative voltage (−Vs/2) is being applied thereto. Consequently, the difference voltage (Vs) is applied between the electrodes X and Y of the load 20, and a sustain discharge occurs.

At this stage, the switches SW1 and SW3 are ON, and so the capacitor C1 is connected to the power supply. Thus the capacitor C1 stores the charges corresponding to the voltage (Vs/2) applied through the switch SW1.

After applying the difference voltage (Vs) to the load 20 for the sustain discharge, on the scanning electrode Y side, the switch SW5' is turned OFF to stop the supply of the voltage (−Vs/2), and then the switch SW4' is turned ON to return the voltage being applied to the scanning electrode Y, to the ground level. Further, the switch SW2' is turned OFF, and then the switches SW1' and SW3' are turned ON. At this time, the remaining switches SW4' and SW5' are kept ON and OFF, respectively.

In this manner, on the scanning electrode Y side, the voltage of the third signal line OUTA' is raised to the voltage level (+Vs/2) applied through the switch SW1'. The voltage (+Vs/2) of this third signal line OUTA' is output on the output line OUTC' through the switch SW4' to be applied to the load 20. At this time, the common electrode X is kept in the state that the positive voltage (+Vs/2) is being applied thereto. Consequently, both electrodes X and Y of the load 20 are at the same potential.

Next, on the scanning electrode Y side, the switch SW4' is turned OFF to stop the supply of the voltage (+Vs/2), and then the switch SW5' is turned ON to return the voltage being applied to the scanning electrode Y, to the ground level. Further, the switches SW1' and SW3' are turned OFF, and then the switch SW2' is turned ON. At this time, the remaining switches SW4' and SW5' are kept OFF and ON, respectively.

Since the switch SW2 is turned ON and the first signal line OUTA' is grounded, the voltage of the fourth signal line OUTB' falls to the potential (−Vs/2), which is lower than the ground level by the voltage (Vs/2) corresponding to the charges stored in the capacitor C4. At this time, since the switch SW5' is ON, the voltage (−Vs/2) of the fourth signal line OUTB' is applied to the load 20 through the output line OUTC'.

On the common electrode X side, the switch SW4 is turned OFF synchronously with the switch SW4' on the scanning electrode Y side being turned OFF. The supply of the voltage (+Vs/2) is thereby stopped to make the common electrode X at a high impedance. Further, the switch SW5' is turned ON. The voltage of the common electrode X is thereby returned to the ground level by a function of the capacitance of the load 20, synchronously with the timing at which the voltage (+Vs/2) on the scanning electrode Y side is lowered to the ground level. After this, the switches SW1 and SW3 are turned OFF synchronously with the switches SW1' and SW3' on the scanning electrode Y side being turned OFF.

After this, the switch SW2 is turned ON synchronously with the switch SW2' on the scanning electrode Y side being turned ON in the state that the switch SW5' is kept ON. In this manner, by the function of the capacitance of the load 20, the voltage ion the common electrode X side is lowered to the negative voltage (−Vs/2) with following the voltage on the scanning electrode Y side.

After the positive voltage (+Vs/2) is applied to the common electrode X, and the voltage being applied to the common electrode X is again returned to the negative voltage (−Vs/2), the same switching control is performed also on the scanning electrode Y side. By this control, also on the scanning electrode Y side, performed is the operation of applying the positive voltage (+Vs/2) and then returning to the state that the negative voltage (−Vs/2) is again applied. After this, the same controls are repeated alternately.

Figure 26:
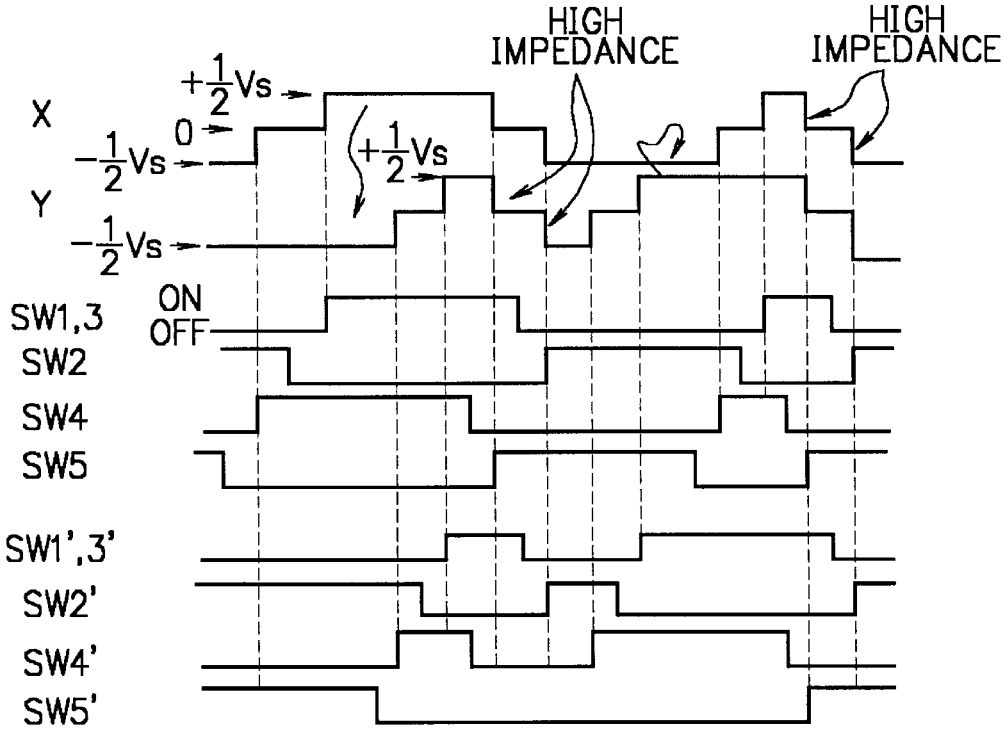
FIG. 26 is a timing chart showing another example of switching control for generating the waveforms shown in FIG. 19.

FIG. 26 is a timing chart showing another example of control of the switches SW1 to SW5 and SW1' to SW5' to generate the waveforms on the electrodes X and Y shown in FIG. 18. This example of FIG. 26 is almost the same as that of FIG. 25 described above, only except timings for turning the switches SW5 and SW5' ON.

More specifically, in the example of FIG. 25, the difference voltage (Vs) is applied between the electrodes X and Y to make a sustain discharge occur, and then both electrodes X and Y are set at the Vs level. After this, the switches on the common electrode X side are set OFF to make a high impedance state on the common electrode X side. With following a voltage drop on the scanning electrode Y side, the voltage being applied to the common electrode X is lowered from (+Vs/2) to the ground level, and then from the ground level to (−Vs/2). Contrastingly in the example of FIG. 26, the switches on the scanning electrode Y side are set OFF to make a high impedance state on the scanning electrode Y side, and the voltage being applied to the scanning electrode Y is lowered from (+Vs/2) to the ground level, and then from the ground level to (−Vs/2), with following a voltage drop on the common electrode X side.

Figure 27:
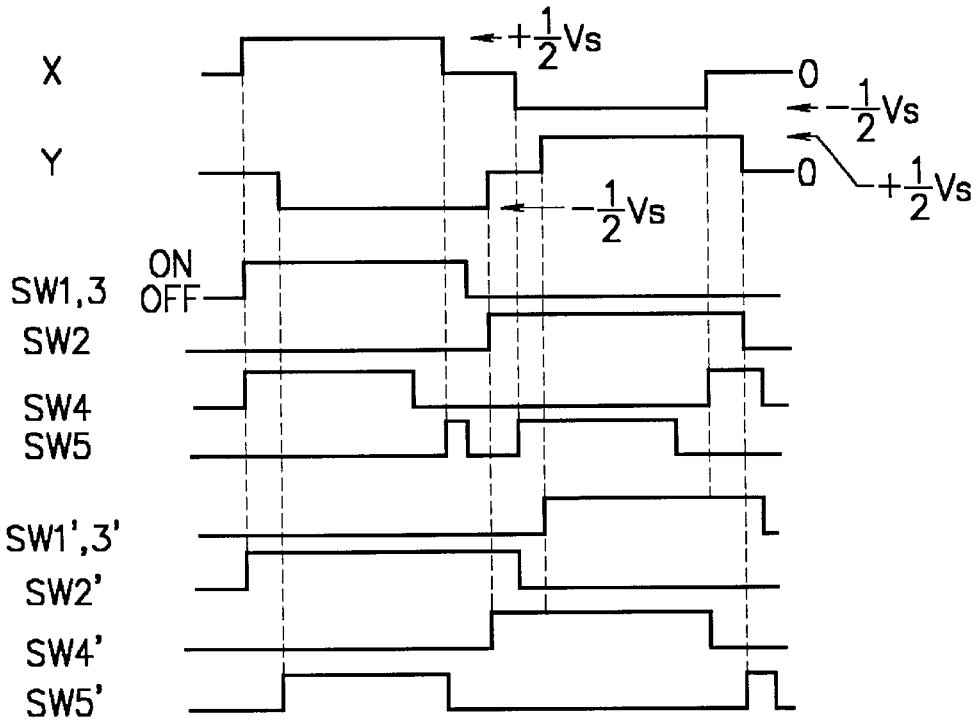
FIG. 27 is a timing chart showing an example of switching control for generating the waveforms shown in FIG. 20.

FIG. 27 is a timing chart showing an example of control of the switches SW1 to SW5 and SW1' to SW5' to generate the waveforms on the electrodes X and Y shown in FIG. 19. In this example of FIG. 27, it is assumed that, by processing in the preceding subfield, the charges corresponding to the voltage (Vs/2) are stored in either of the capacitors C1 and C4 on the common electrode X side and the scanning electrode Y side.

In sustain discharge period, on the common electrode X side, firstly, the switches SW1, SW3, and SW4 are turned ON and the remaining switches SW2 and SW5 are kept OFF. The first signal line OUTA is thereby set at the voltage level (+Vs/2) applied through the switch SW1. The voltage (+Vs/2) of this first signal line OUTA is output on the output line OUTC through the switch SW4 to be applied to the load 20.

At this stage, the switches SW1 and SW3 are ON, and so the capacitor C1 is connected to the power supply. Thus the capacitor C1 stores the charges corresponding to the voltage (Vs/2) applied through the switch SW1.

On the scanning electrode Y side, the switch SW2' is turned ON at the same time when the switches SW1, SW3, and SW4 on the common electrode X side are turned ON. A little after of this, the switch SW5' is also turned ON. At this time, the remaining switches SW1', SW3', and SW4' are kept OFF.

Since the switch SW2' is thus turned ON and the first signal line OUTA' is grounded, the voltage of the fourth signal line OUTB' falls to the potential (−Vs/2), which is lower than the ground level by the voltage (Vs/2) corresponding to the charges stored in the capacitor C4. Since the switch SW5' is turned ON a little after of the switch SW2', the voltage (−Vs/2) of the fourth signal line OUTB' is applied to the load 20 through the output line OUTC'. The difference voltage (Vs) is then applied between the electrodes X and Y of the load 20.

After applying the difference voltage (Vs) to the load 20 for the sustain discharge, on the common electrode X side, the switch SW4 is turned OFF to stop the supply of the voltage (+Vs/2), and then the switch SW5 is turned ON to return the voltage being applied to the common electrode X, to the ground level. At the next timing, all the switches SW1 to SW5 on the common electrode X side are set OFF. Next, the switch SW2 is turned ON. A little after of this, the switch SW5' is also turned ON. At this time, the remaining switches SW1', SW3', and SW4' are kept OFF.

Since the switch SW2 is thus turned ON and the first signal line OUTA is grounded, the second signal line OUTB falls to the potential (−Vs/2), which is lower than the ground level by the voltage (Vs/2) corresponding to the charges stored in the capacitor C1. Since the switch SW5 is turned ON, the voltage (−Vs/2) of the second signal line OUTB is applied to the load 20 through the output line OUTC.

On the scanning electrode Y side, at a timing before the switch SW5 on the common electrode X side is turned ON as described above, the switch SW5' is turned OFF to stop the supply of the voltage (−Vs/2). The switch SW4' is then turned ON to return the voltage being applied to the scanning electrode Y, to the ground level.

A little late after the switch SW5 on the common electrode X side is turned ON as described above, the switches SW1', SW3', and SW4' are turned ON. The voltage being applied to the scanning electrode Y is raised to the positive voltage (+Vs/2). By the above operation, the timing of applying the positive and negative voltages (+Vs/2) to the common electrode X can be always earlier than that of applying the positive and negative voltages (+Vs/2) to the scanning electrode Y.

Figure 28:
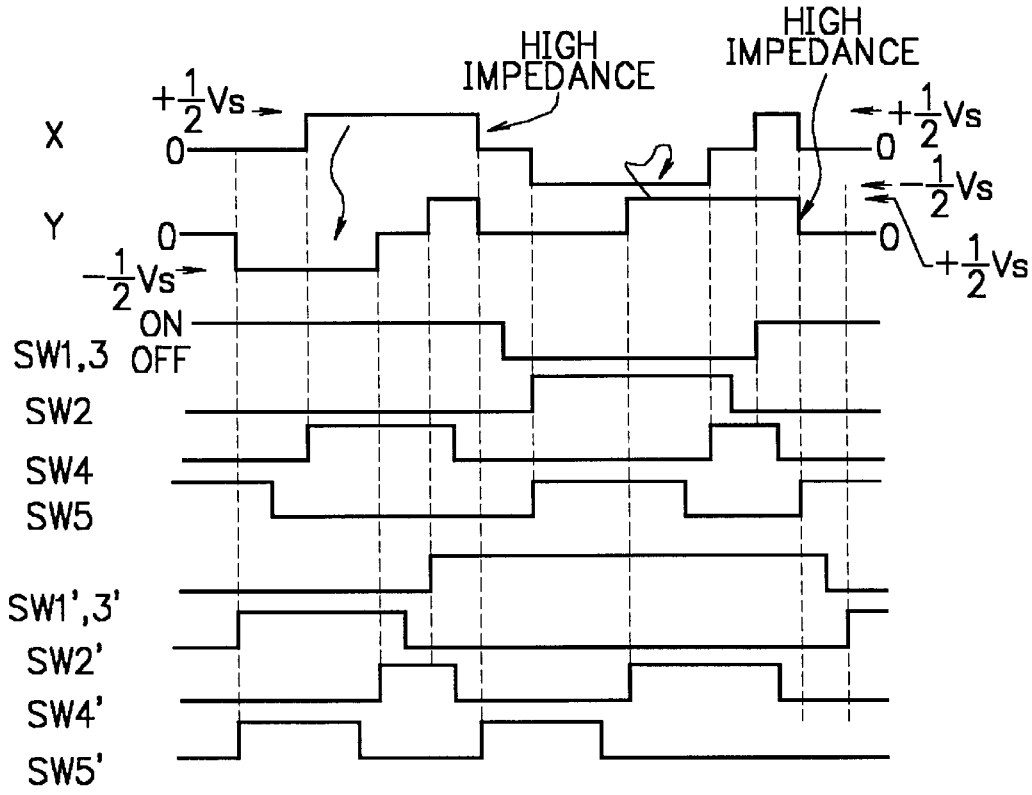
FIG. 28 is a timing chart showing another example of switching control for generating the waveforms shown in FIG. 21.

FIG. 28 is a timing chart showing an example of control of the switches SW1 to SW5 and SW1' to SW5' to generate the waveforms on the electrodes X and Y shown in FIG. 20. In this example of FIG. 28, it is assumed that, by processing in the preceding subfield, the charges corresponding to the voltage (Vs/2) are stored in either of the capacitors C1 and C4 on the common electrode X side and the scanning electrode Y side.

In sustain discharge period, on the scanning electrode Y side, firstly, two switches SW2' and SW5' are turned ON and the remaining switches SW1', SW3', and SW4' are kept OFF. Since the switch SW2' is turned ON and the first signal line OUTA' is grounded, the voltage of the fourth signal line OUTB' falls to the potential (−Vs/2), which is lower than the ground level by the voltage (Vs/2) corresponding to the charges stored in the capacitor C4. At this time, since the switch SW5' is turned ON simultaneously with the switch SW2', the voltage (−Vs/2) of the fourth signal line OUTB' is applied to the load 20 through the output line OUTC'.

On the common electrode X side, firstly, the switches SW1, SW3, and SW5 are ON, and the remaining switches SW2 and SW4 are OFF. After the switches SW2' and SW5' on the scanning electrode Y side are turned ON, the switch SW5 is turned OFF, and then the switch SW4 is turned ON. That is, the switches SW1, SW3, and SW4 are set ON, and the switches SW2 and SW5 are set OFF.

The first signal line OUTA is thereby raised to the voltage level (+Vs/2) applied through the switch SW1. The voltage (+Vs/2) of this first signal line OUTA is output on the output line OUTC through the switch SW4, which has been turned ON at the proper timing, to be applied to the load 20. Thus the ii difference voltage (Vs) is applied between the electrodes X and Y of the load 20 to cause a sustain discharge.

At this stage, the switches SW1 and SW3 are ON, and so the capacitor C1 is connected to the power supply. Thus the capacitor C1 stores the charges corresponding to the voltage (Vs/2) applied through the switch SW1.

After applying the difference voltage (Vs) to the load 20 for the sustain discharge, on the scanning electrode Y side, the switch SW5' is turned OFF to stop the supply of the voltage (−Vs/2), and then the switch SW4' is turned ON to return the voltage being applied to the scanning electrode Y, to the ground level. Further, the switch SW2' is turned OFF, and then the switches SW1' and SW3' are turned ON. At this time, the remaining switches SW4' and SW5' are kept ON and OFF, respectively.

In this manner, on the scanning electrode Y side, the voltage of the third signal line OUTA' is raised to the voltage level (+Vs/2) applied through the switch SW1'. The voltage (+Vs/2) of this third signal line OUTA' is output on the output line OUTC' through the switch SW4' to be applied to the load 20. At this time, the common electrode X is kept in the state that the positive voltage (+Vs/2) is being applied thereto. Consequently, both electrodes X and Y of the load 20 are at the same potential.

Next, on the scanning,electrode Y side, the switch SW4' is turned OFF to stop the supply of the voltage (+Vs/2), and then the switch SW5' is turned ON to return the voltage being applied to the scanning electrode Y, to the ground level.

On the common electrode X side, the switch SW4 is turned OFF synchronously with the switch SW4' on the scanning electrode Y side being turned OFF. At this time, since the switch SW5 is also OFF, the common electrode X becomes an high impedance state. In this manner, by the function of the capacitance of the load 20, the voltage on the common electrode X side is lowered to the ground level with following the voltage on the scanning electrode Y side.

After the negative and positive voltages (−Vs/2) and (+Vs/2) are respectively applied to the scanning and common electrodes Y and X to return the voltages of both electrodes X and Y to the ground level, switching control to the contrary is performed successively, thereby applying the positive and negative voltages (+Vs/2) and (−Vs/2) to the scanning and common electrodes Y and X sides, respectively. After this, the same controls are repeated alternately.

Figure 29:
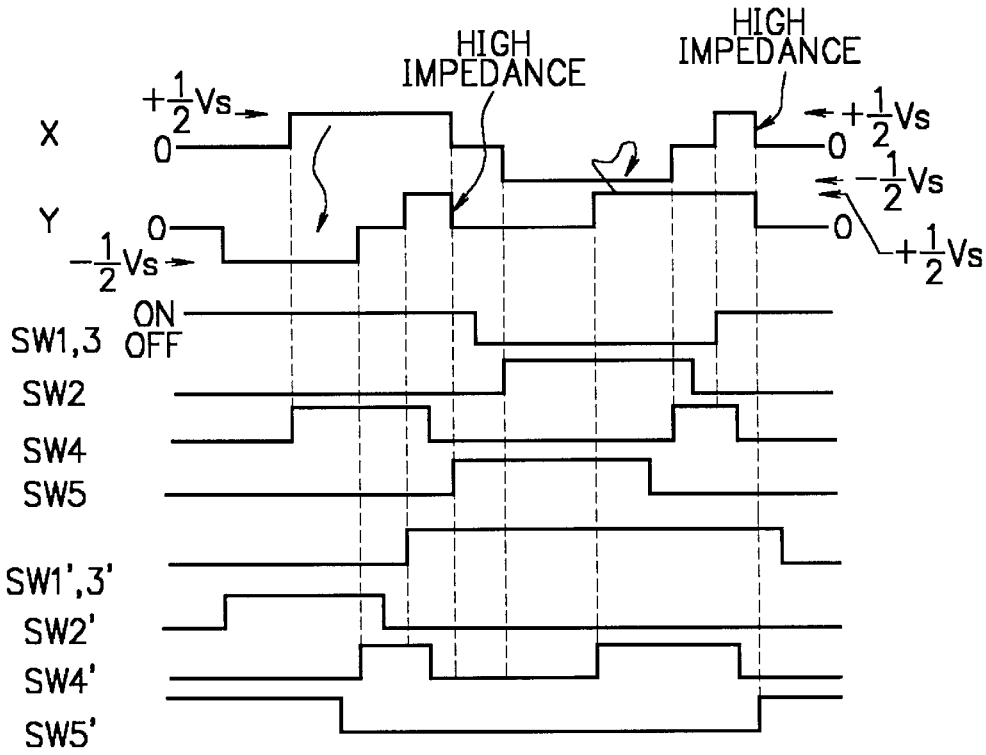
FIG. 29 is a timing chart showing an example of switching control for generating the waveforms shown in FIG. 22.

FIG. 29 is a timing chart showing another example of control of the switches SW1 to SW5 and SW1' to SW5' to generate the waveforms on the electrodes X and Y shown in FIG. 20. This example of FIG. 29 is almost the same as that of FIG. 28 described above, only except timings for turning the switches SW5 and SW5' ON.

More specifically, in the example of FIG. 28, after the difference voltage (Vs) is applied between the electrodes X and Y to make a sustain discharge occur, the switches SW4 and SW5 on the common electrode X side are set OFF to make a high impedance state on the common electrode X side. The voltage being applied to the common electrode X is lowered to (−Vs/2) with following the voltage drop on the scanning electrode Y side. Contrastingly in the example of FIG. 29, the switches SW4' and SW5' on the scanning electrode Y side are set OFF to make a high impedance state on the scanning electrode Y side, and the voltage being applied to the scanning electrode Y is lowered to (−Vs/2) with following the voltage drop on the common electrode X side.

Figure 30:
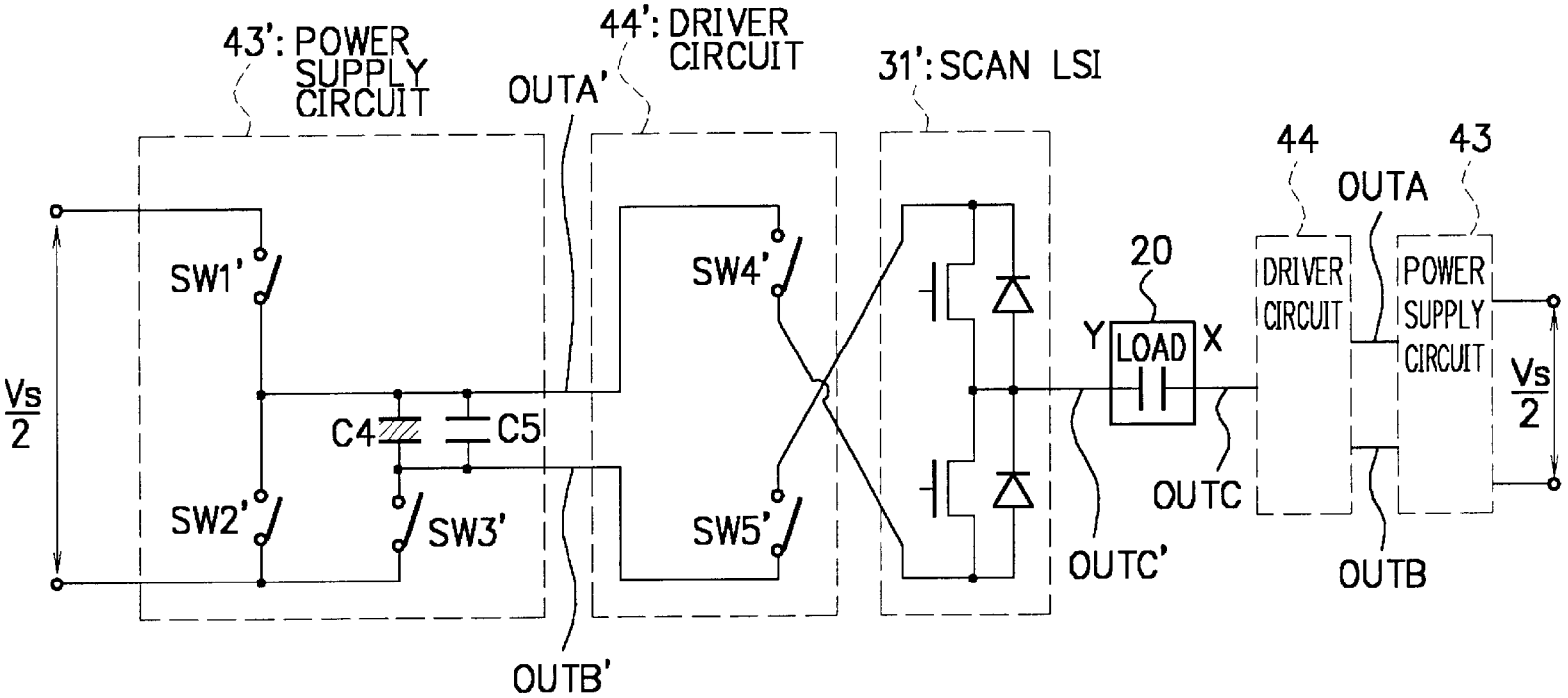
FIG. 30 is a circuit diagram showing another example of construction of a driving apparatus according to the first embodiment.

FIG. 30 is a circuit diagram showing another example of construction of a driving apparatus according to this first embodiment. In FIG. 30, the components denoted by the same references as those in FIG. 9 or 12 have the same functions as those in FIG. 9 or 12, respectively. Thus the repetitive descriptions thereof will be omitted. FIG. 26 illustrates only the construction on the scanning electrode Y side in detail, but the power supply circuit 43 and the driver circuit 44 on the common electrode X side also have substantially the same constructions as the power supply circuit 43' and the driver circuit 44' on the scanning electrode Y side.

This example uses two capacitors C4 and C5 for storing charges on the scanning electrode Y side, and differs on this point from the example of FIG. 12 that uses only one capacitor C4. For example, an electrolytic capacitor and a film capacitor may be used as one capacitor C4 and the other capacitor C5, respectively. Use of such a film capacitor C5 in addition to an electrolytic capacitor C4 affords a stable operation even in a high frequency range. Besides, even in a low temperature condition in which the electrolytic capacitor C4 is hard to operate as a capacitance, the film capacitor C5 can compensate the operation. In case of the example of FIG. 5 using only one capacitor C4, the capacitor C4 may be either a film capacitor or an electrolytic capacitor.

Figure 31:
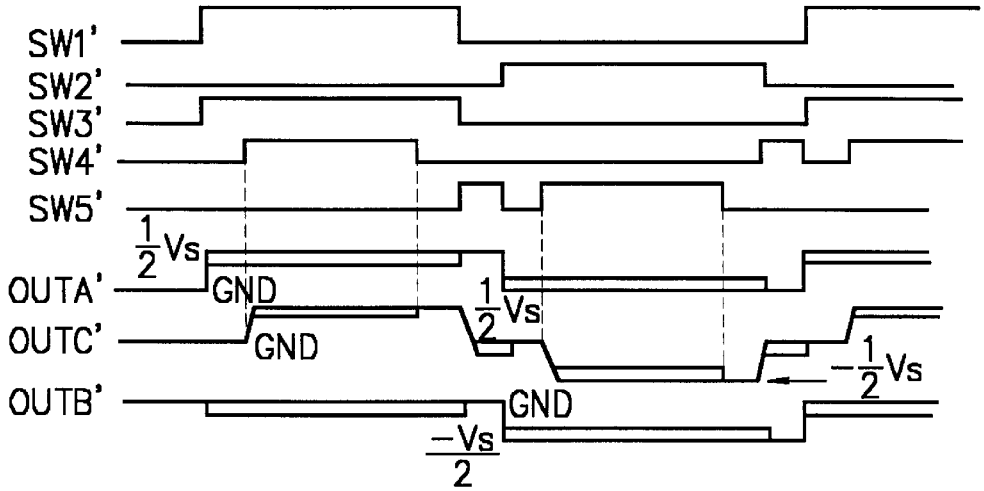
FIG. 31 is a timing chart showing an example of driving waveforms in a sustain discharge period by the driving apparatus constructed as in FIG. 30.

FIG. 31 is a timing chart showing a specific example of driving waveforms in a sustain discharge period by the driving apparatus constructed as in FIG. 30. In FIG. 31, the parts shown by double lines in the driving waveforms of the third and fourth signal lines OUTA' and OUTB' and the output line OUTC', correspond to low impedance periods, i.e., periods in which any of the switches SW1' to SW5' is ON.

The features that, by switching operation of three switches SW1' to SW3', the voltage on the third signal line OUTA' is swung between the positive voltage (+Vs/2) and the ground level, and the voltage on the fourth signal line OUTB' is swung between the ground level and the negative voltage (−Vs/2), and that the positive or negative voltage applied to the first or second signal line OUTA' or OUTB' is selectively output on the output line OUTC' by switching operation of two switches SW4' and SW5', are as described above. Thus their detailed description will be omitted here.

It should be noted in FIG. 31 that the switch SW4' or SW5' is turned ON after the voltages of the first and second signal lines OUTA' and OUTB' are fixed by switching operation of the three switches SW1' to SW3'. That is, in this example of FIG. 31, the timings of actually applying voltages to the load 20 are determined by the timings of turning the switches SW4' and SW5' ON.

Figure 32:
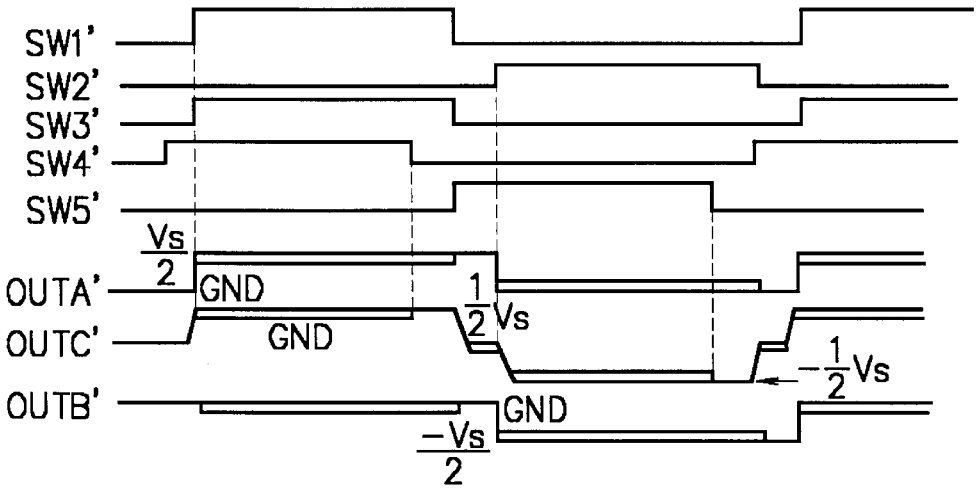
FIG. 32 is a timing chart showing another example of driving waveforms in a sustain discharge period by the driving apparatus constructed as in FIG. 30.

FIG. 32 is a timing chart showing another example of driving waveforms in a sustain discharge period by the driving apparatus constructed as in FIG. 30. It should be noted in FIG. 32 that the switch SW4' or SW5' is turned ON in advance before the voltages of the first and second signal lines OUTA' and OUTB' are fixed by switching operation of the three switches SW1' to SW3'.

In this manner, the moment that the positive or negative voltage is output on the first or second signal lines OUTA' or OUTB' by switching operation of the three switches SW1' to SW3', either voltage can immediately be applied to the load 20. This makes it possible to shorten the useless period in which any of the switches SW1' to SW5' are OFF, and to achieve a higher-speed operation than that in FIG. 31.

Second Embodiment

Next, the second embodiment of the present invention will be described.

Figure 33:
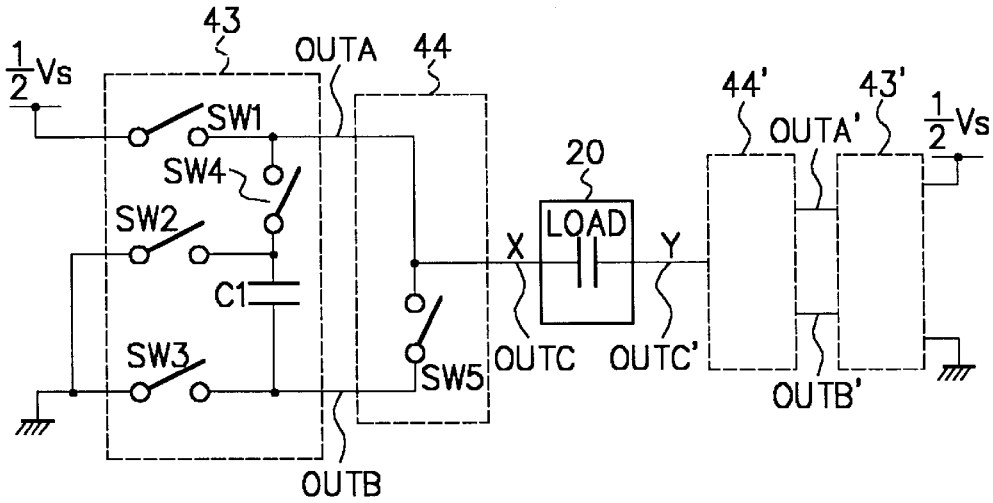
FIG. 33 is a circuit diagram showing an example of construction of a driving apparatus according to the second embodiment of the present invention.

FIG. 33 is a circuit diagram showing an example of construction of a driving apparatus according to this second embodiment. In FIG. 33, the components having the same functions as those in FIG. 9 are denoted by the same references as those in FIG. 9, respectively. Thus the repetitive descriptions thereof will be omitted.

In the driving apparatus shown in FIG. 9, the switch SW4 is provided in the driver circuit 44, and it and the switch SW5 are connected in series between both terminals of the capacitor C1 in the power supply circuit 43. Contrastingly in this second embodiment shown in FIG. 33, the switch SW4 is provided in the power supply circuit 43, and connected between one terminal of the capacitor C1 and the first signal line OUTA. The other construction is the same as that in FIG. 9.

This second embodiment shown in FIG. 33 is the same as the first embodiment on the point that the switches SW1, SW3, and SW4 are turned ON in order to apply the positive voltage (+Vs/2) to the load 20 through the output line OUTC, thereby charging the capacitor C1. This second embodiment is the same as the first embodiment also on the point that the switches SW2 and SW5 are turned ON in order to apply the negative voltage (−Vs/2) to the load 20 through the output line OUTC by using the charges stored in the capacitor C1. For this purpose, various patterns of driving waveforms like those described in the first embodiment can be used to be applied to the common and scanning electrodes X and Y.

According to this second embodiment thus constructed, the total voltage drop caused by a current flowing through switches when either voltage is applied to the load 20 can be made small, and so the power loss is suppressed. More specifically, when the positive voltage (+Vs/2) is applied to the load 20, a current flows through two switches SW1 and SW4 in case of the first embodiment. Contrastingly in this second embodiment, the current flows through only one switch SW1 to apply the positive voltage (+Vs/2) to the load 20. Hence, the voltage drop can be decreased by the degree corresponding to one switch.

FIG. 33 shows the example that either of the power supply circuit 43 and the driver circuit 44 is constructed as a common circuit for all display lines provided in the PDP. But, as for the driver circuit 44, it may be alternatively constructed into an LSI that is provided with such a driver circuit for every display line, as the eighth and ninth embodiments of the present invention, which will be described later. Such a driver circuit 44 with LSI structure requires two switches SW4 and SW5 for every display line in case of the first embodiment. But the same according to this second embodiment only requires one switch SW5 for every display line, thereby considerably decreasing the total number of switches. This affords a reduced circuit scale and a cost reduction.

Figure 34:
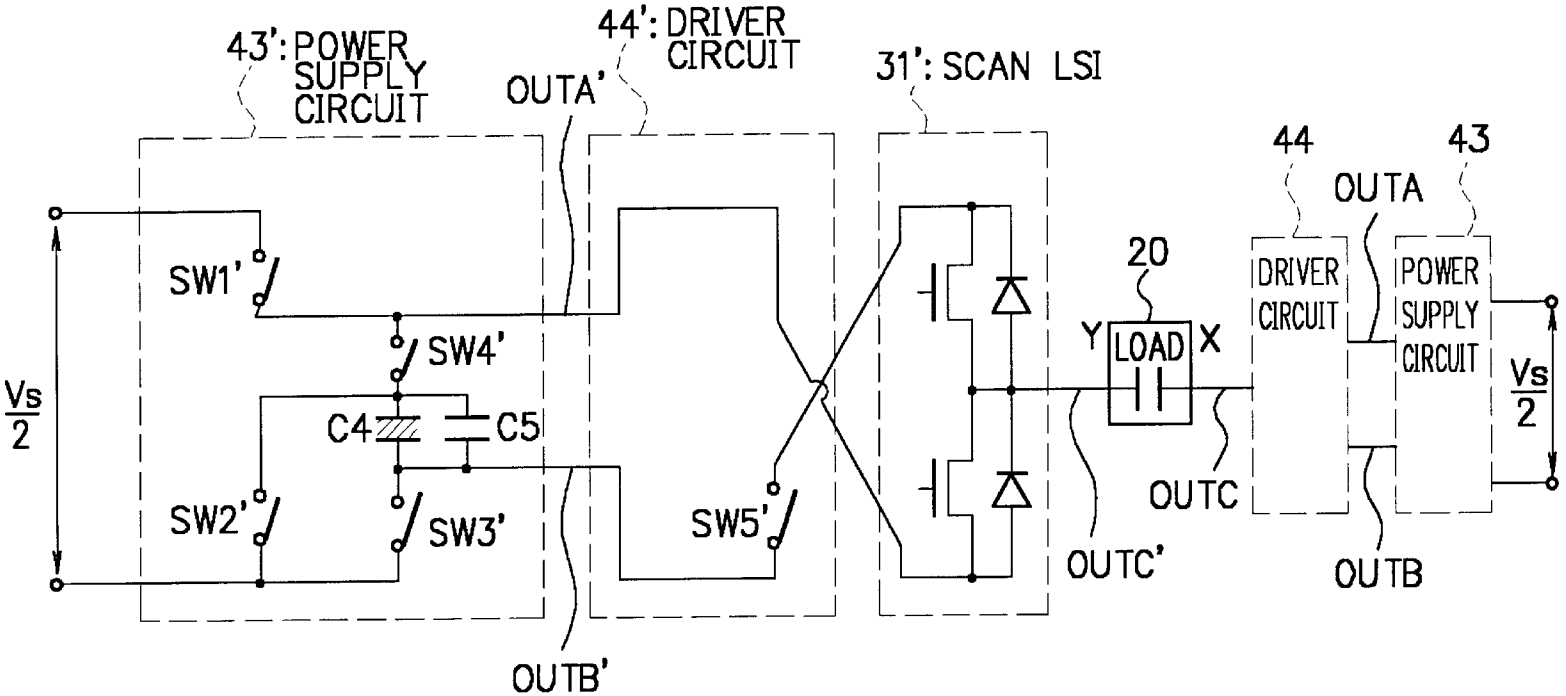
FIG. 34 is a circuit diagram showing another example of construction of a driving apparatus according to the second embodiment.

FIG. 34 is a circuit diagram showing another example of construction of a driving apparatus according to this second embodiment. In FIG. 34, the components having the same functions as those in FIG. 30 are denoted by the same references as those in FIG. 30, respectively. Thus the repetitive descriptions thereof will be omitted.

In this example of FIG. 34, the switch SW4' is provided in the power supply circuit 43', and connected between one terminal of each of the capacitors C4 and C5, and the third signal lines OUTA'. The switches SW1', SW4', and SW2' are connected in series between the power supply line of the voltage (Vs/2) and the ground line. The other construction is the same as that in FIG. 30.

Figure 35:
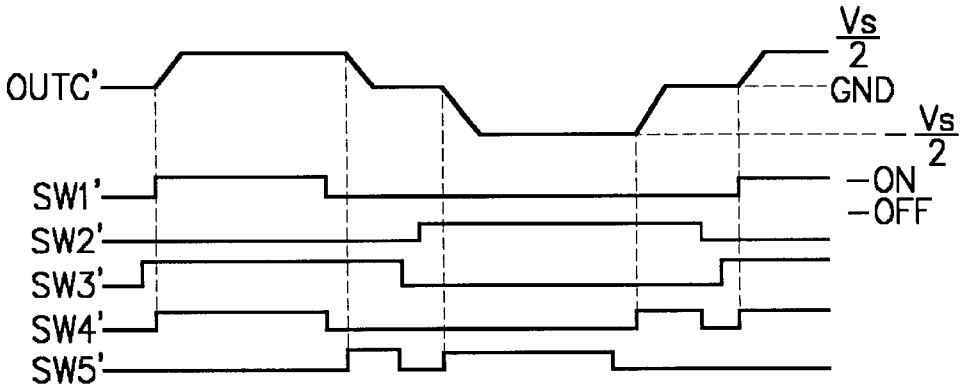
FIG. 35 is a timing chart showing an example of driving waveforms in a sustain discharge period by the driving apparatus constructed as in FIG. 34.

FIG. 35 is a timing chart showing a specific example of driving waveforms in a sustain discharge period by the driving apparatus constructed as in FIG. 34.

The basic operations for alternately applying the positive and negative voltages (±Vs/2) on the output line OUTC' by switching control of the five switches SW1' to SW5' are the same as those in the first embodiment described above. Thus the detailed description thereof will be omitted here.

It should be noted in FIG. 35 that, when three switches SW1', SW3', and SW4' are turned ON in order to output the positive voltage (+Vs/2) on the output line OUTC', the timing of turning the switch SW3' ON is clearly earlier than the timing of turning the switches SW1' and SW4' ON.

In case of controlling two or more switches to be changed at a time, those switches may not always simultaneously change due to various causes including unevenness in manufacturing elements, and there is a little time difference. In such a case, it is no problem if the timing of turning the switch SW3' ON is shifted to be earlier than the timing of turning the switches SW1' and SW4' ON. However, delay of the timing of turning the switch SW3' ON may cause a bad operation of the circuit. For this reason, in this example of FIG. 31, the timing of turning the switch SW3' ON is set to be clearly earlier, thereby insuring a stable operation of the circuit.

Besides in this example of FIG. 35, when two switches SW2' and SW5' are turned ON in order to output the negative voltage (−Vs/2) on the output line OUTC', the timing of turning the switch SW2' ON is set to be clearly earlier than the timing of turning the switch SW5' ON.

Third Embodiment

Next, the third embodiment of the present invention will be described.

Figure 36:
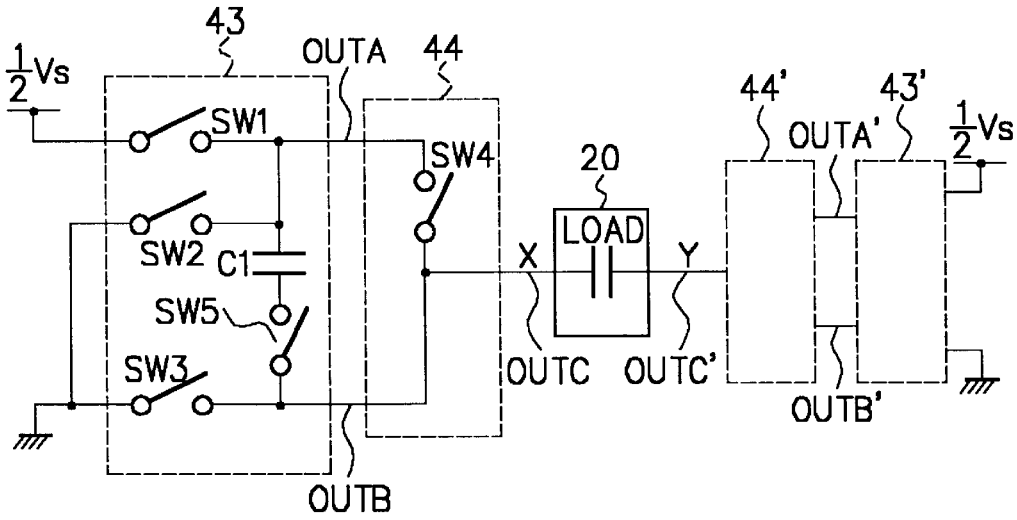
FIG. 36 is a circuit diagram showing an example of construction of a driving apparatus according to the third embodiment of the present invention.

FIG. 36 is a circuit diagram showing an example of construction of a driving apparatus according to this third embodiment. In FIG. 36, the components having the same functions as those in FIG. 9 are denoted by the same references as those in FIG. 9, respectively. Thus the repetitive descriptions thereof will be omitted.

In the driving apparatus shown in FIG. 9, the switch SW5 is provided in the driver circuit 44, and it and the switch SW4 are connected in series between both terminals of the capacitor C1 in the power supply circuit 43. Contrastingly in this third embodiment shown in FIG. 36, the switch SW5 is provided in the power supply circuit 43, and connected between the other terminal of the capacitor C1 and the second signal line OUTB. The other construction is the same as that in FIG. 9.

In this third embodiment shown in FIG. 36, for applying the positive voltage (+Vs/2) to the load 20 through the output line OUTC, the switches SW1 and SW4 are turned ON for example. Besides, for applying the negative voltage (−Vs/2) to the load 20 through the output line OUTC by using the charges stored in the capacitor C1, the switches SW2 and SW5 are turned ON. For this purpose, various patterns of driving waveforms like those described in the first embodiment can be used to be applied to the common and scanning electrodes X and Y.

According to this third embodiment thus constructed, the total voltage drop caused by a current flowing through switches at each timing when the capacitor of the load 20 is discharged, can be made small, and so the power loss is suppressed. More specifically, when the charges stored in the load 20 are eliminated to the ground line to return the load 20 from the positive voltage (+Vs/2) to the ground level, the current flows through two switches SW5 and SW3 in case of the first embodiment. Contrastingly in this third embodiment, the current flows through only one switch SW3 to discharge the load 20. Hence, the voltage drop can be decreased by the degree corresponding to one switch in comparison with the first embodiment.

Besides, in case of the driver circuit 44 constructed into an LSI as the eighth and ninth embodiments of the present invention which will be described later, it requires two switches SW4 and SW5 for every display line in case of the first embodiment. But the same according to this third embodiment only requires one switch SW5 for every display line, thereby considerably decreasing the total number of switches. This affords a reduced circuit scale and a cost reduction.

Figure 37:
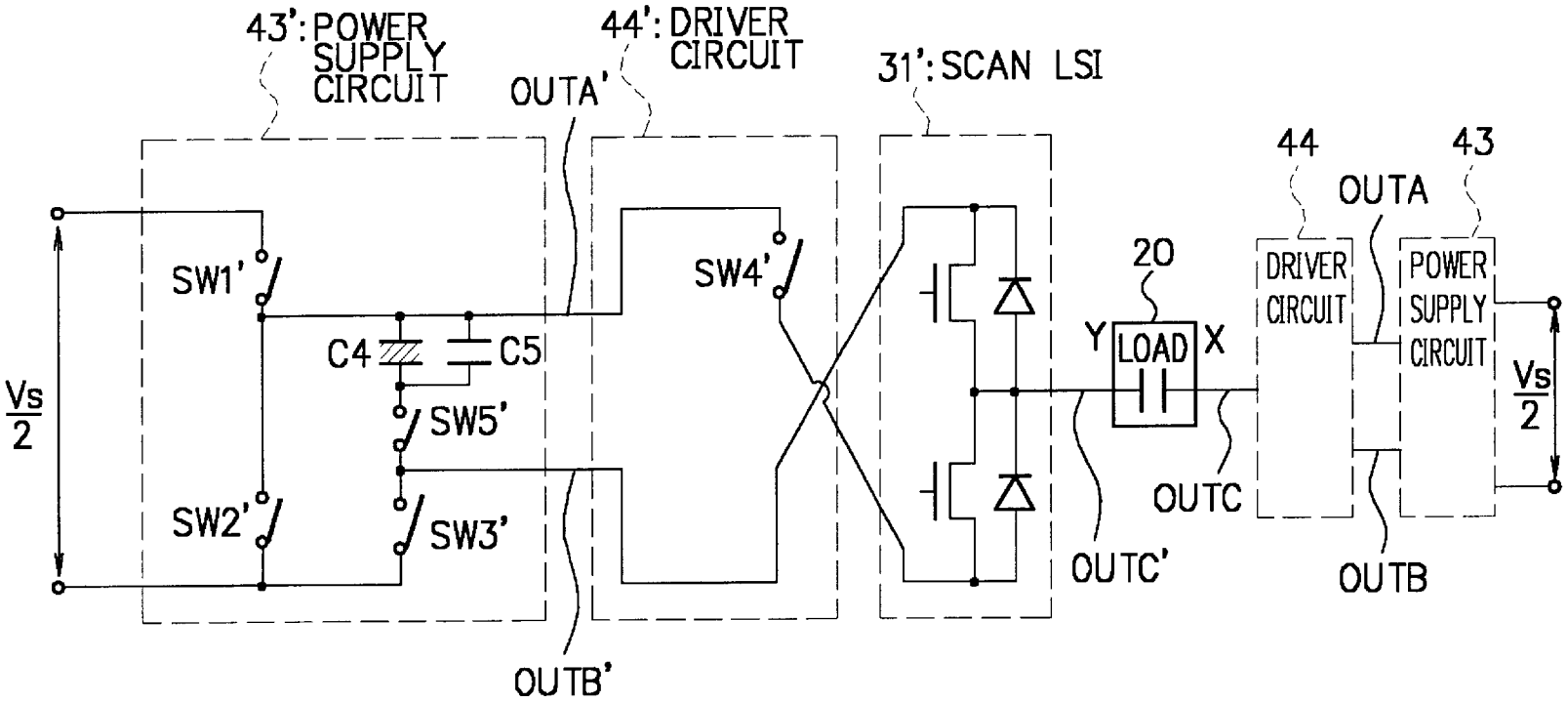
FIG. 37 is a circuit diagram showing another example of construction of a driving apparatus according to the third embodiment.

FIG. 37 is a circuit diagram showing another example of construction of a driving apparatus according to this third embodiment. In FIG. 37, the components having the same functions as those in FIG. 30 are denoted by the same references as those in FIG. 30, respectively. Thus the repetitive descriptions thereof will be omitted.

In this example of FIG. 37, the switch SW5' is provided in the power supply circuit 43', and connected between the other terminal of each of the capacitors C4 and C5, and the fourth signal lines OUTB'. The other construction is the same as that in FIG. 30.

Figure 38:
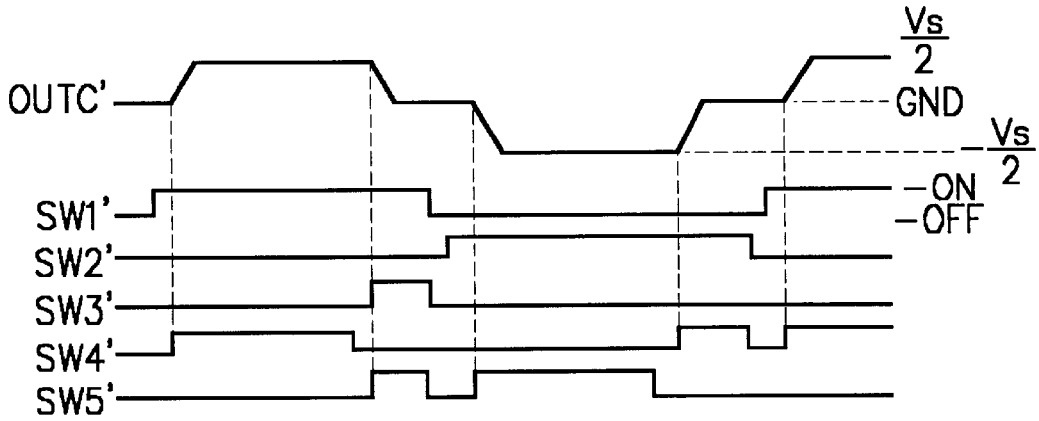
FIG. 38 is a timing chart showing an example of driving waveforms in a sustain discharge period by the driving apparatus constructed as in FIG. 37.

FIG. 38 is a timing chart showing a specific example of driving waveforms in a sustain discharge period by the driving apparatus constructed as in FIG. 37.

The basic operations for alternately applying the positive and negative voltages (±Vs/2) on the output line OUTC' by switching control of the five switches SW1' to SW5' are the same as those in the first embodiment described above. Thus the detailed description thereof will be omitted here.

It should be noted in FIG. 38 that the switches SW3' and SW5' are not turned ON when the switches SW1' and SW4' are turned ON to apply the positive voltage (+Vs/2) to the load 20, but those switches SW3' and SW5' are turned ON when the charges stored in the load 20 by the application of the positive voltage (+Vs/2) are eliminated to return the voltage being applied, to the ground level. In this example of FIG. 38, by keeping the switch SW1' ON till the switch SW3' is turned ON, the capacitors C4 and C5 are charged at the timing of discharging the load 20. In this manner, changeover of each of the switches SW1' to SW5' can be made more effectively without useless.

Besides, in this example of FIG. 38, the timing of turning the switch SW1' ON is clearly earlier than the timing of turning the switch SW4' ON. This is for insuring a stable operation of the circuit like the second embodiment described with FIG. 35, by the manner that not the changeover timings of the switches SW1' and SW4' are set at the same timing but the timing of turning the switch SW1' ON is set to be clearly earlier.

Also in this example of FIG. 38, when two switches SW2' and SW5' are turned ON in order to output the negative voltage (−Vs/2) on the output line OUTC', the timing of turning the switch SW2' ON is set to be clearly earlier than the timing of turning the switch SW5' ON.

Fourth Embodiment

Next, the fourth embodiment of the present invention will be described.

Figure 39:
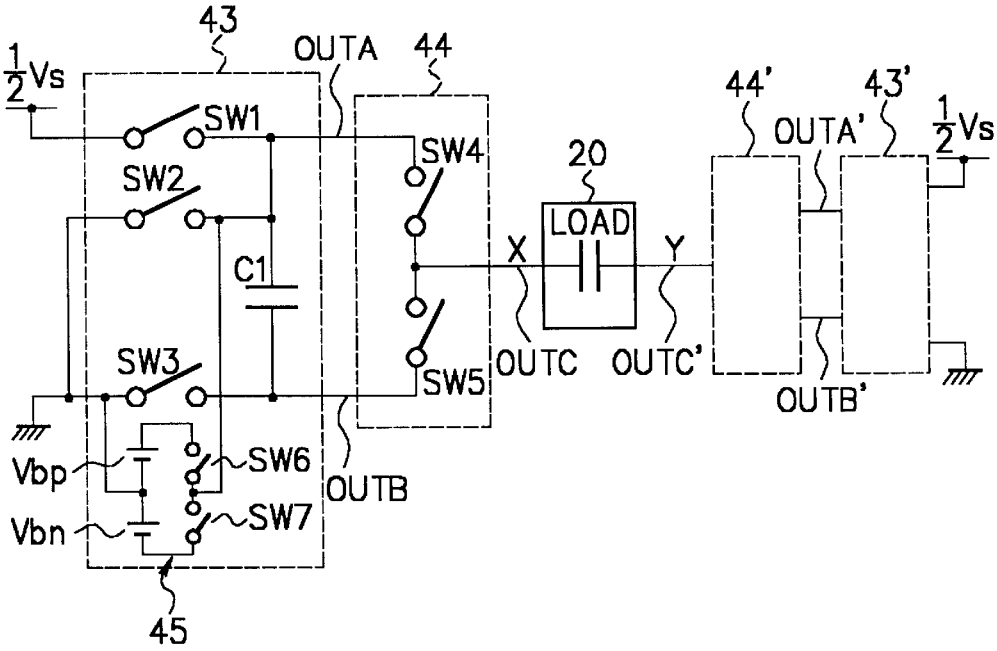
FIG. 39 is a circuit diagram showing an example of construction of a driving apparatus according to the fourth embodiment of the present invention.

FIG. 39 is a circuit diagram showing an example of construction of a driving apparatus according to this fourth embodiment. In FIG. 39, the components having the same functions as those in FIG. 9 are denoted by the same references as those in FIG. 9, respectively. Thus the repetitive descriptions thereof will be omitted.

The driving apparatus according to this fourth embodiment shown in FIG. 39 is further provided with an offset circuit 45 in addition to the construction shown in FIG. 9. The offset circuit 45 comprises two routes for connecting between the ground and the first signal line OUTA. One route is made up from a power supply of an offset voltage Vbp, and a switch SW6. The other route is made up from a power supply of an offset voltage Vbn, and a switch SW7.

In this construction, when the switch SW6 is ON, the offset circuit 45 outputs a positive voltage (+Vbp) on the first signal line OUTA. When the switch SW7 is ON, the offset circuit 45 outputs a negative voltage (−Vbn) on the first signal line OUTA. Thus a voltage using such an offset voltage (+Vbp or −Vbn) can be applied through the first signal line OUTA and the output line OUTC to the load 20. Besides, using such an offset voltage, the voltage which is-lower than the offset voltage level (+Vbp or −Vbn) by the voltage (Vs/2) corresponding to the charges accumulated in the capacitor C1, can be set on the second signal line OUTB, and the voltage can be applied to the load 20 through the output line OUTC.

In this manner, the provision of the offset circuit 45 according to this fourth embodiment makes it possible to output also a voltage other than (±Vs/2) on the first or second signal line OUTA or OUTB. This raises the degree of freedom of voltage to be applied to the load 20. For example, a voltage used in a period other than such a sustain discharge period can be generated by this offset circuit 45.

Figure 40:
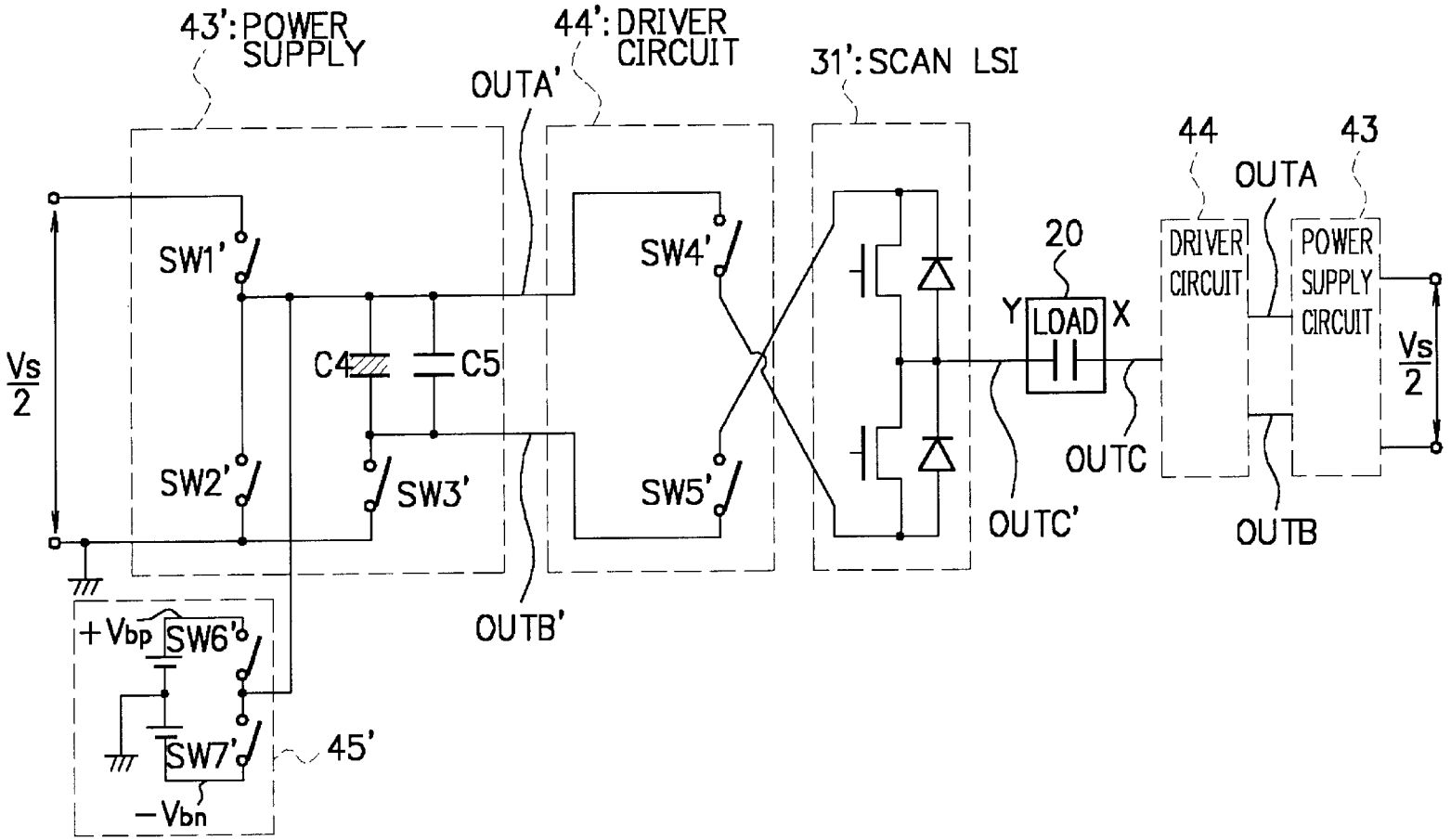
FIG. 40 is a circuit diagram showing another example of construction of a driving apparatus according to the fourth embodiment.

FIG. 40 is a circuit diagram showing another example of construction of a driving apparatus according to this fourth embodiment. In FIG. 40, the components having the same functions as those in FIGS. 30 and 39 are denoted by the same references as those in FIGS. 30 and 39, respectively. Thus the repetitive descriptions thereof will be omitted.

In this example of FIG. 40, an offset circuit 45' having the same construction as the above-described offset circuit 45 on the common electrode X side, is provided on the scanning electrode Y side.

Figure 41:
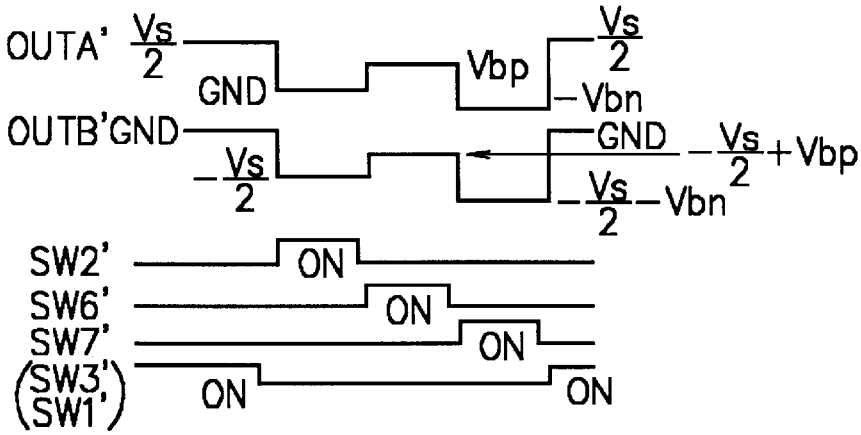
FIG. 41 is a timing chart showing an example of driving waveforms in a sustain discharge period by the driving apparatus constructed as in FIG. 40.

FIG. 41 is a timing chart showing a specific example of driving waveforms in a sustain discharge period by the driving apparatus constructed as in FIG. 40.

In particular, FIG. 41 shows states of the voltages output on the first and second signal lines OUTA' and OUTB' when the switches SW6' and SW7' of the offset circuit 45' are turned ON.

Referring to FIG. 41, when the switch SW6' of the offset circuit 45' is turned ON in the state that the voltages of the third and fourth signal lines OUTA' and OUTB' are respectively at the ground level and (−Vs/2), the voltages of the third and fourth signal lines OUTA' and OUTB' are shifted to (+Vbp) and (−Vs/2+Vbp), respectively. After this, when the switch SW6' is turned OFF and the switch SW7' is turned ON, the voltages of the third and fourth signal lines OUTA' and OUTB' are shifted to (−Vbn) and (−Vs/2−Vbn), respectively.

In any case, the potential difference between the third and fourth signal lines OUTA' and OUTB' is always kept at (−Vs/2).

In the construction shown in FIG. 39 or 40, various patterns of driving waveforms like those described in the first embodiment can be used to be applied to the common and scanning electrodes X and Y.

Fifth Embodiment

Next, the fifth embodiment of the present invention will be described.

In this fifth embodiment, a circuit for applying a write voltage Vw' (=Vs/2+Vw) to the scanning electrode Y in a reset period, and a circuit for applying the voltage (−Vs/2) to the scanning electrode Y in an address period are further provided for the circuit shown in any of the first to fourth embodiments described above.

Figure 42:
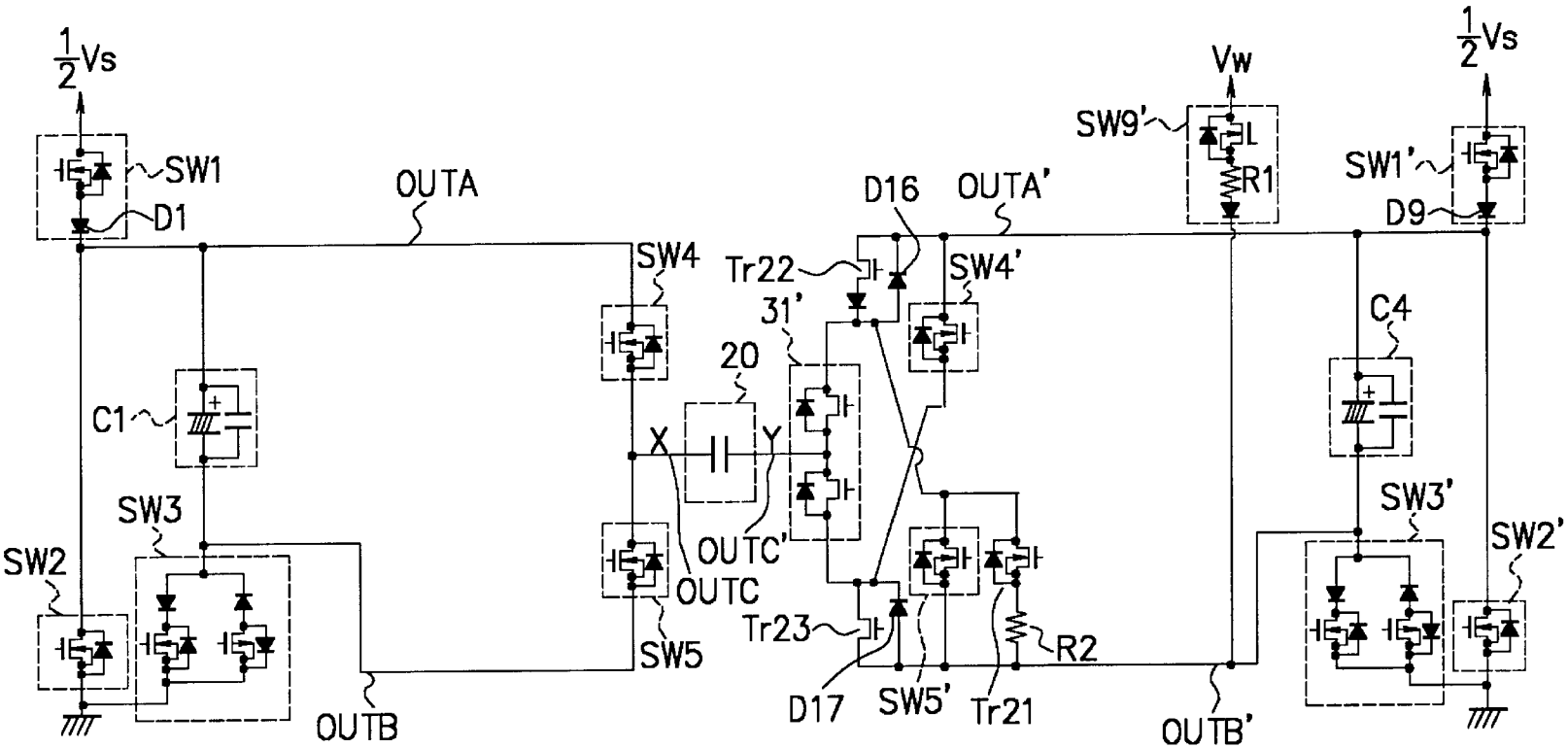
FIG. 42 is a circuit diagram showing an example of construction of a driving apparatus according to the fifth embodiment of the present invention.

FIG. 42 is a circuit diagram showing a specific example of construction of a driving apparatus according to this fifth embodiment. The example of FIG. 42 is a further improvement of the circuit shown in the first embodiment. In FIG. 42, the components having the same functions as those in FIG. 12 are denoted by the same references as those in FIG. 12, respectively. Thus the repetitive descriptions thereof will be omitted. In FIG. 38, for convenience' sake, C1 or C4 denotes a combination of electrolytic and film capacitors for storing charges.

In this example of FIG. 42, a circuit for applying a write voltage Vw' (=Vs/2+Vw) is provided on the scanning electrode Y side. More specifically, a switch SW9' is provided between the power supply line Vw for generating the write voltage and the fourth signal line OUTB'. This switch SW9' includes a resistor R1.

On the scanning electrode Y side, in addition to the above construction, three transistors Tr21, Tr22, and Tr23, and two diodes D16 and D17 are provided. The transistor Tr21 is turned ON to make the waveform of pulse voltage being applied to the scanning electrode Y, obtuse by the function of a resistor R2 connected to the transistor Tr21. This transistor Tr21 and the resistor R2 are connected in parallel with the switch SW5'.

The transistors Tr22 and Tr23 are for giving the potential difference (Vs/2) between both terminals of the scan driver 31' in address period. This is by the following reason. In sustain discharge period, the switches SW2' and SW5' are turned ON. The upper side voltage of the scan driver 31' thereby becomes (−Vs/2) in accordance with the charges accumulated in the capacitor C4, but the lower side voltage of the scan driver 31' also becomes (−Vs/2) by a function of the diode in the scan driver 31'. Thus the potential difference (Vs/2) can not be given between both terminals of the scan driver 31'.

Contrastingly in address period, the switch SW2' and the transistor Tr22 are turned ON. The upper side voltage of the scan driver 31' thereby becomes the ground level. Besides, the transistor Tr23 is turned ON at this time. The negative voltage (−Vs/2) output on the fourth signal line OUTB' in accordance with the charges accumulated in the capacitor C4 is thereby applied to the lower side of the scan driver 31'. In outputting a scan pulse by the scan driver 31', the negative voltage (−Vs/2) can be applied to the scanning electrode Y.

One diode D16 is used when a current is made to flow from the scan driver 31' to the ground at the timing of applying the positive voltage (+Vs/2) to the common electrode X. For the current flowing from the scan driver 31' to the ground, a route in case of turning the switch SW2' ON and a route in case of turning the switches SW3' and SW5' ON are present. In this example, however, the diode D16 is provided in the middle of the route on the switch SW2' side so that the current may be made to flow through the switch SW2' to the ground. In this manner, the total voltage drop caused by the current flowing through switches, can be made small, and so the power loss is suppressed.

The other diode D17 is used when a current is made to flow from the ground to the scan driver 31' at the timing of returning the voltage being applied to the common electrode X, from the positive voltage (+Vs/2) to the ground level. For the current flowing from the ground to the scan driver 31', thinkable are the route through the switch SW3', the fourth signal line OUTB', and the diode D17, and the route through the switch SW2', the third signal line OUTA', and the switch SW4'. In this example, however, the diode D17 is provided so that the current may be made to flow through this route. The number of stages of switches to pass through is thereby reduced, and the total voltage drop can be made small.

Figure 43:
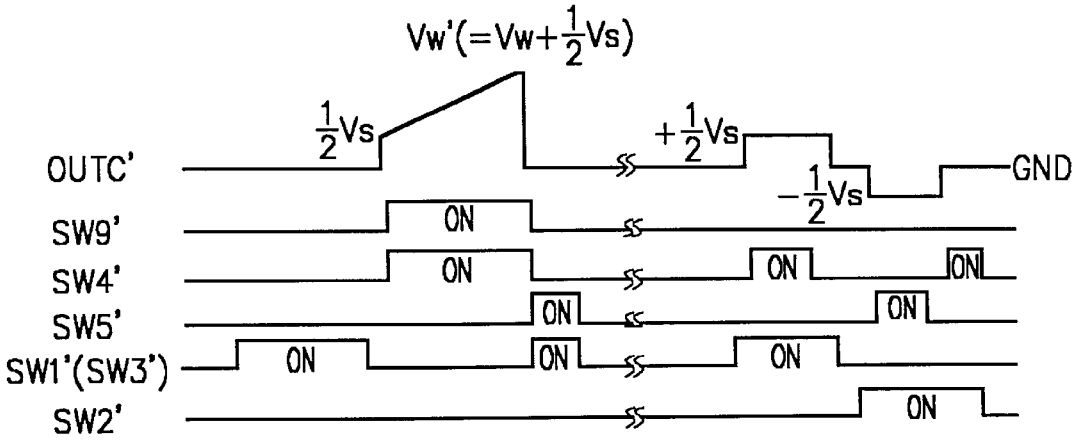
FIG. 43 is a timing chart showing an example of driving waveforms in a reset period and the subsequent sustain discharge period by the driving apparatus constructed as in FIG. 42.

FIG. 43 is a timing chart showing driving waveforms on the scanning electrode Y side by the driving apparatus constructed as in FIG. 42, which shows only the reset and sustain discharge periods in one subfield.

Referring to FIG. 43, in reset period, the switches SW1' and SW3' are turned ON to accumulate the charges corresponding to the voltage (Vs/2) in the capacitor C4. After this, the switches SW1' and SW3' are turned OFF, and then the switch SW9' as well as the switch SW4' is turned ON. The voltage of the third signal line OUTA' is thereby raised to the voltage level corresponding to the sum of the voltage (Vs/2) of the capacitor C4 and the voltage Vw of the fourth signal line OUTB'. The voltage (Vs/2+Vw) is applied to the scanning electrode Y of the load 20. At this time, as shown in FIG. 43, the voltage rises gradually by the function of the resistor R1 provided in the switch SW9'.

At this time, by applying the negative voltage (−Vs/2) to the common electrode X, the potential difference between the common and scanning electrodes X and Y becomes (Vs+Vw). The same potential difference as the full write pulse shown in the reset period of FIG. 3 can be thereby applied between the common and scanning electrodes X and Y. In this case, the voltage applied to the element of the switch SW9' is Vw at most. Thus the breakdown voltage of this element may be set at Vw, and it can be held down to a considerably low value in comparison with its conventional breakdown voltage.

Besides, since the voltages between the third and fourth signal lines OUTA' and OUTB' and between the first and second signal lines OUTA and OUTB are always Vs/2 or less, the breakdown voltage of each of the switches SW4', SW5', SW4, and SW5, and the scan driver 31' may be Vs/2 or more. This makes it possible to apply the full write pulse voltage (Vs+Vw) between the common and scanning electrodes X and Y using a circuit with a low breakdown voltage, and so realize a reduced cost in manufacturing.

In the sustain discharge period, the switch SW9' is not turned ON, and the other switches SW1' to SW5' are controlled in the same manner as in the above embodiments so that the positive and negative voltages (±Vs/2) are alternately applied to the scanning electrode Y of the load 20.

Figure 44:
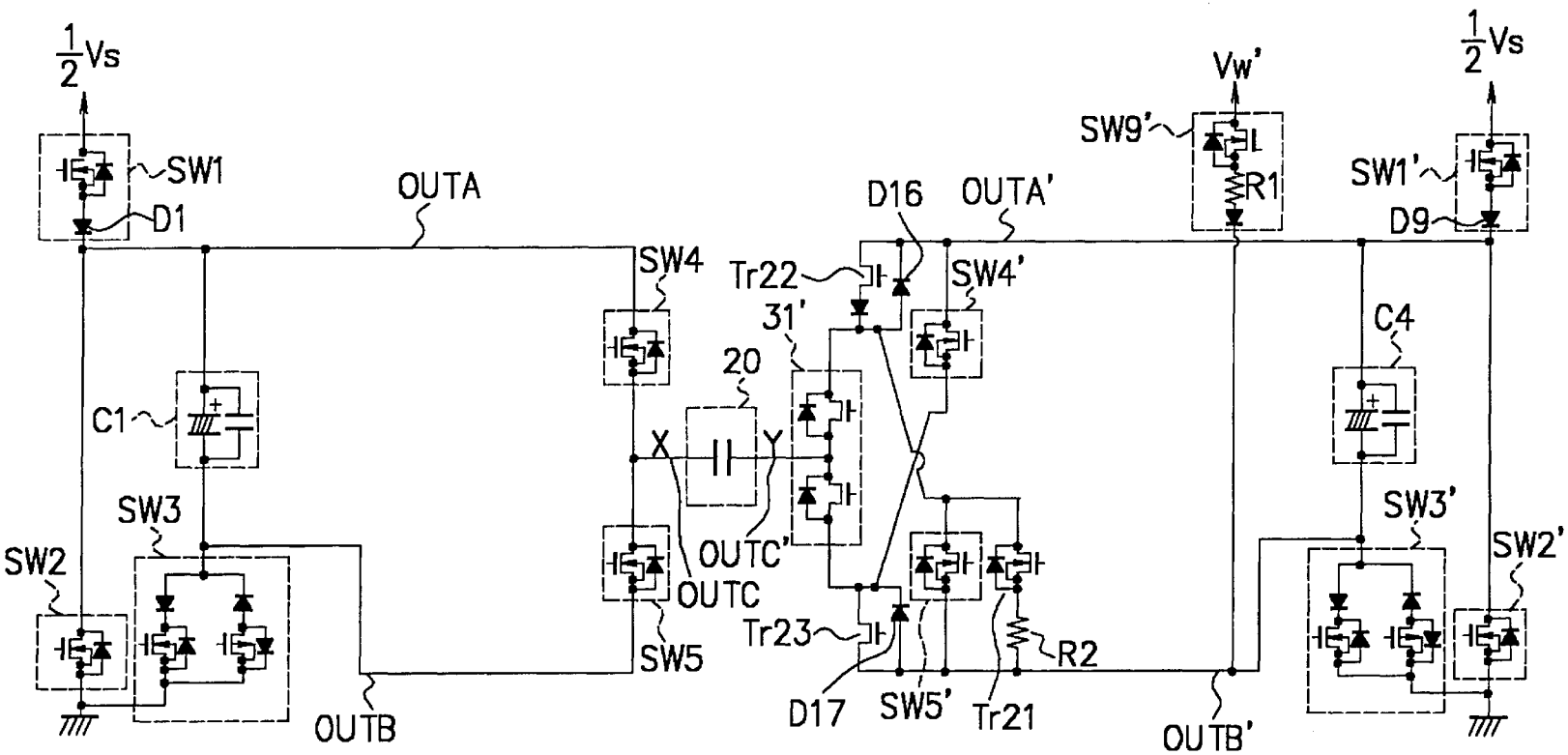
FIG. 44 is a circuit diagram showing another example of construction of a driving apparatus according to the fifth embodiment.

FIG. 44 is a circuit diagram showing another example of construction of a driving apparatus according to this fifth embodiment. In FIG. 44, the components having the same functions as those in FIG. 42 are denoted by the same references as those in FIG. 42, respectively. Thus the repetitive descriptions thereof will be omitted.

In this example of FIG. 44, a circuit for applying a voltage Vw' is provided on the scanning electrode Y side. More specifically, the switch SW9' is provided between the power supply line for the voltage Vw' and the fourth signal line OUTB'. This switch SW9' includes a resistor R1. This power supply voltage Vw' is greater than the voltage (Vs/2). For example, it has the same voltage value as the full write pulse voltage (Vs/2+Vw) applied to the load 20 in the reset period.

In this construction, to apply the voltage Vw' to the load 20, the switch SW9' is turned ON. The voltage Vw' is thereby applied through the route of the diode D17 provided in parallel with the transistor Tr 23, and a diode in the scan driver 31'. When the voltage Vw' is applied, all the switches other than the switch SW9' are OFF on the scanning electrode Y side.

Figure 45:
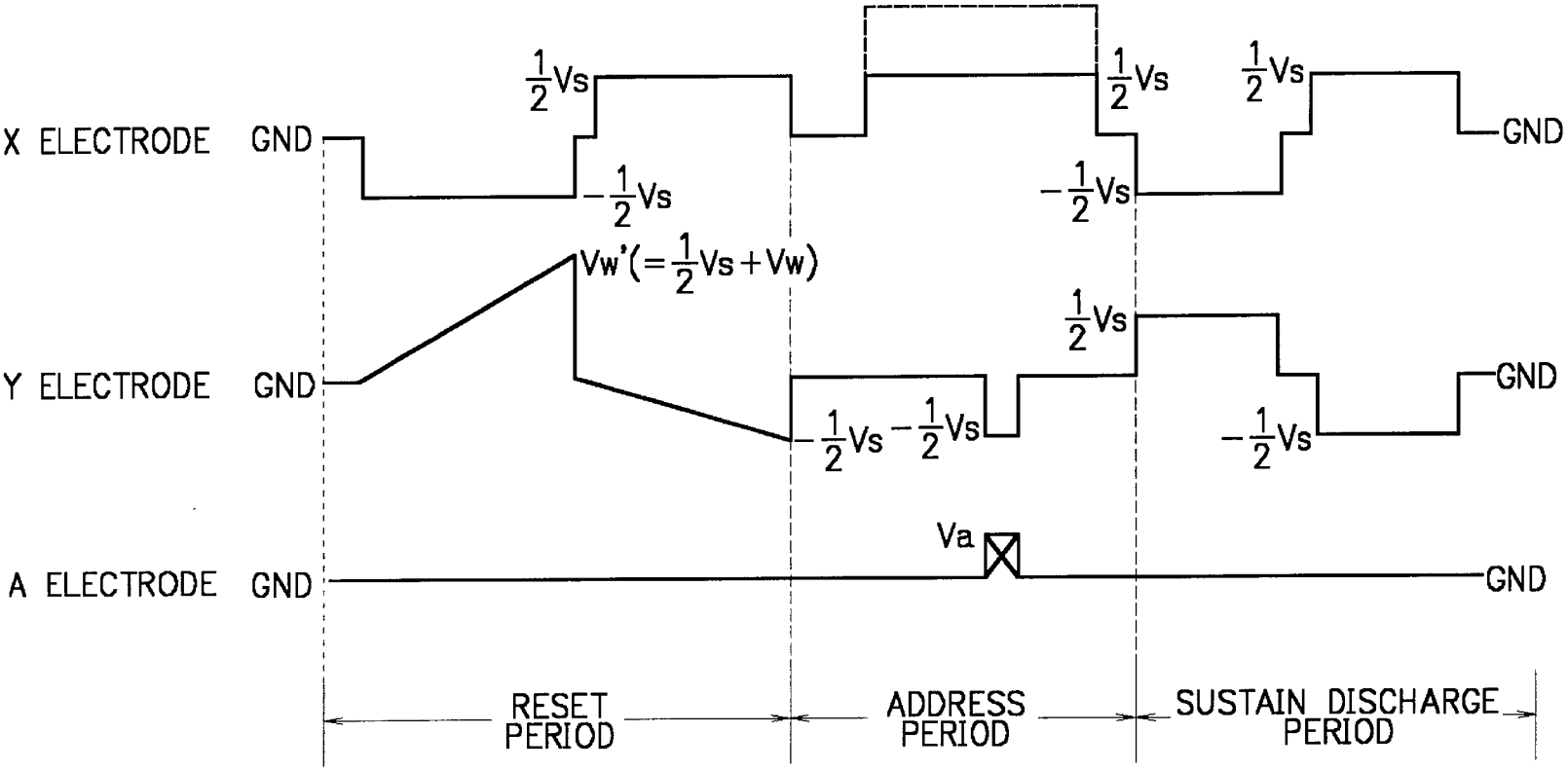
FIG. 45 is a timing chart showing an example of driving waveforms by the driving apparatus constructed as in FIG. 44.

FIG. 45 is a timing chart showing driving waveforms of the PDP by the driving apparatus constructed as in FIG. 44. FIG. 45 shows one of the subfields making up one frame. In this example of FIG. 45, it is assumed that, by processing in the preceding subfield, the charges corresponding to the voltage (Vs/2) are stored in either of the capacitors C1 and C4 on the common electrode X side and the scanning electrode Y side.

Firstly in reset period, on the common electrode X side, the switches SW2 and SW5 are turned ON, and the remaining switches SW1, SW3, and SW4 are kept OFF. The voltage of the second signal line OUTB is thereby lowered to (−Vs/2) in accordance with the charges stored in the capacitor C1. The voltage (−Vs/2) is output on the output line OUTC through the switch SW5 to be applied to the common electrode X of the load 20.

On the scanning electrode Y side, the switch SW9' is turned ON, and the switches SW1' to SW4' are kept OFF. The voltage of the fourth signal line OUTB' is thereby raised to the level of the voltage Vw' (=Vs/2+Vw) applied through the switch SW9'. The voltage Vw' is output on the output line OUTC' through the diode D17 and the diode in the scan driver 31', to be applied to the scanning electrode Y of the load 20.

Thus the potential difference between the common and scanning electrodes X and Y becomes (Vs+Vw). The same potential difference as the full write pulse shown in the reset period of FIG. 3 can be thereby applied between the common and scanning electrodes X and Y. In this case, the voltage applied to the element of the switch SW9' is Vw'=(Vs/2+Vw) at most. Thus the breakdown voltage of this element may be set at (Vs/2+Vw), and it can be held down to a low value in comparison with its conventional breakdown voltage.

Besides, since the voltages between the third and fourth signal lines OUTA' and OUTB' and between the first and second signal lines OUTA and OUTB are always Vs/2 or less, the breakdown voltage of each of the switches SW4', SW5', SW4, and SW5, and the scan driver 31' may be Vs/2 or more. This makes it possible to apply the full write pulse voltage (Vs+Vw) between the common and scanning electrodes X and Y using a circuit with a low breakdown voltage, and so realize a reduced cost in manufacturing.

IN this reset period, the voltage applied to the scanning electrode Y by turning the switch SW9' ON, has a waveform in which the voltage being applied changes continuously with time elapsing by the function of the resistor R1 (this is referred to as an obtuse wave). When such an obtuse wave is applied, discharges occur in order of the cells whose discharge voltages become equal to a pulse voltage in the rising of the obtuse wave. This means that substantially the optimum voltage for each cell (voltage substantially equal to its discharge start voltage) is applied to the cell.

As such a pulse that the voltage being applied changes gradually with time elapsing, usable are obtuse waves whose rates of change per unit time varies gradually, or triangular waves whose rates of change per unit time are constant, etc.

Next, the switches SW5 and SW4 on the common electrode X side are respectively turned OFF and ON so that the voltage of the common electrode X is set at the ground level, while, on the scanning electrode Y side, the switch SW9' is turned OFF, and the switches SW1', SW3', and SW5' are turned ON, so that the voltage of the scanning electrode Y is returned to the ground level. After this, on the common electrode X side, the switches SW2 and SW5 are turned OFF, and the switches SW1, SW3, and SW4 are turned ON, and, on the scanning electrode Y side, the switches SW1', SW3', SW4', SW5', and SW9' are turned OFF, and the switch SW2' and the transistor TR21 is turned ON.

The voltage being applied to the common electrode X is thereby raised from the ground level to (Vs/2), while the voltage being applied to the scanning electrode Y is lowered to (−Vs/2). At this time, by turning the transistor Tr21 ON, the voltage is gradually lowered as shown in FIG. 41. The voltage due to the wall charges themselves thereby exceeds the discharge start voltage in every cell, and a discharge starts. Also at this time, weak discharges occur by applying the obtuse wave so that the accumulated wall charges are eliminated except part of them.

As for the voltage being applied to the common electrode X, it is also possible to make the voltage be continuously lowered from the ground level to the (−Vs/2) level if the same components as the above transistor Tr21 and resistor R are provided in parallel with the switch SW5 on the common electrode X side.

Next, in the subsequent address period, for making each cell ON/OFF in accordance with display data, address discharges occur line-sequentially. At this time, on the common electrode X side, the switches SW1, SW3, and SW4 are turned ON, and the remaining switches SW2 and SW5 are kept OFF. The voltage of the first signal line OUTA is thereby raised to the voltage (Vs/2) applied through the switch SW1. The voltage (Vs/2) is output on the output line OUTC through the switch SW4 to be applied to the common electrode X of the load 20.

To apply a voltage to the scanning electrode Y corresponding to a certain display line, the switch SW2' and the transistor Tr22 are turned ON. The upper side voltage of the scan driver 31' is thereby set at the ground level. At this time, since the transistor Tr23 is turned ON, the negative voltage (−Vs/2) output on the fourth signal line OUTB' in accordance with the charges accumulated in the capacitor C4 is applied to the lower side of the scan driver 31'. By this operation, the voltage at the (−Vs/2) level is applied to the scanning electrode Y of the load 20 when the scanning electrode Y is selected in a line-sequential manner. When the scanning electrode Y is not selected, the voltage at the ground level is applied to it.

At this time, an address pulse of the voltage Va is selectively applied to an address electrode Aj corresponding to the cell in which a sustain discharge should occur, i.e., the cell to be lit, in the address electrodes A1 to Am. As a result, a discharge occurs between the address electrode Aj and the scanning electrode Y selected in the line-sequential manner, of the cell to be lit, and it serves as a priming (pilot) for a discharge immediately occurring between the common and scanning electrodes X and Y. A quantity of wall charges for making the next sustain discharge possible is thereby stored in the surface of the MgO protective film on the common and scanning electrodes X and Y of the selected cell.

The discharge between the address and scanning electrodes Aj and Y is started by the potential difference (Va+Vs/2) between the electrodes. Thus the discharge can be started at a lower voltage than the conventional potential difference (Va+Vy). This is adjusted by applying an obtuse wave in the reset period as described above, causing a weak discharge to occur, and thereby not completely eliminating the wall charges on the scanning electrode Y to leave some wall charges there. In short, when the sum of the voltage corresponding to the remaining wall charges and the voltage being applied reaches the discharge start voltage, the discharge starts.

Figure 3:
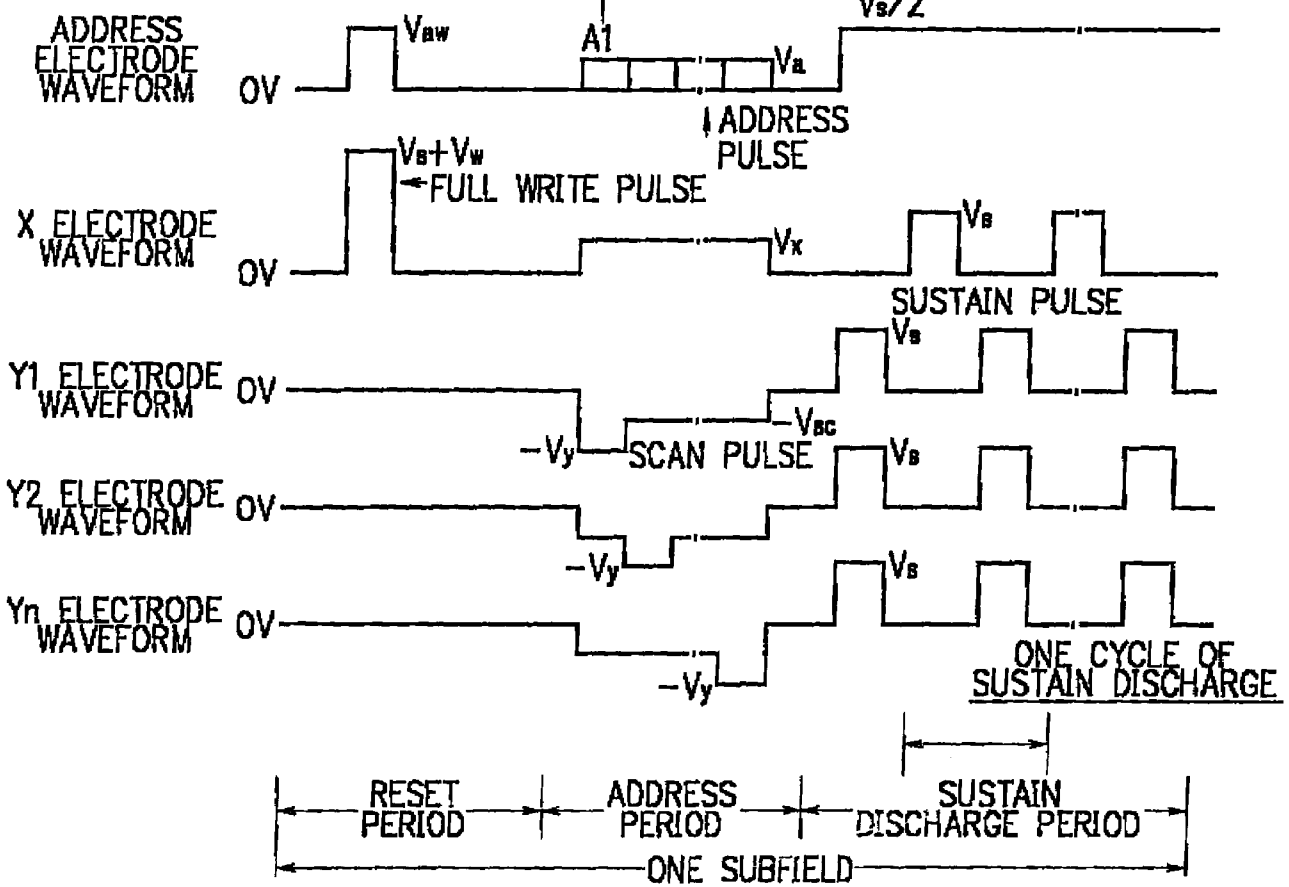
FIG. 3 PRIOR ART
FIG. 3 is a waveform chart showing an example of a conventional driving method of the PDP.
Figure 4:
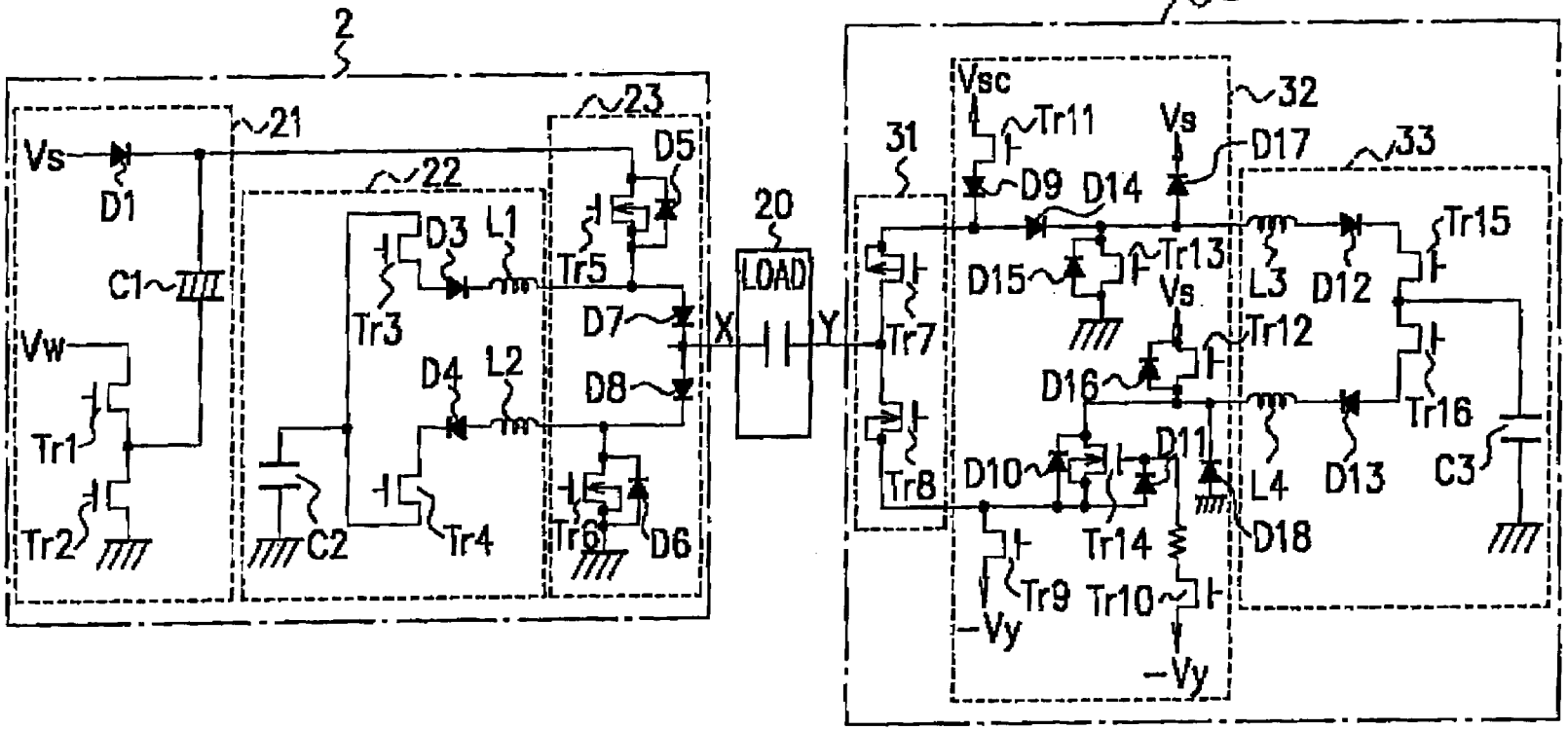
FIG. 4 PRIOR ART
FIG. 4 is a circuit diagram showing an example of construction of a conventional driving apparatus.

For this reason, the driving apparatus according to this embodiment requires no power supply for generating the voltage −Vy in the address period, unlike the prior art. Thus it does not require also the switching circuit such as the transistor Tr14 for disconnecting the power supply line of the voltage −Vy as shown in FIG. 4. Furthermore, as clearly when FIGS. 45 and 3 are compared, the driving apparatus according to this embodiment also requires no power supply for generating the non-selection pulse voltage −Vsc in the address period. This makes it possible to simplify the circuit construction accordingly.

After this, in the sustain discharge period, the voltages (+Vs/2 and −Vs/2) in opposite phases to each other are alternately applied to the common electrode X and the scanning electrode Y of each display line to make sustain discharges occur, and an image display of one subfield is made.

During this sustain discharge period, the potentials of the address electrodes A1 to Am are kept at the ground level. In general, the address electrodes A1 to Am are preferably set at the middle potential between the voltages to be applied respectively to the common and scanning electrodes X and Y during the sustain discharge period. For this reason, in the conventional driving apparatus as shown in FIG. 3, the address electrodes A1 to Am must be set at (Vs/2) that is the middle potential between the common and scanning electrodes X and Y. Contrastingly in this embodiment, the middle potential between the common and scanning electrodes X and Y is the ground level. Thus it is not required to raise the potentials of the address electrodes A1 to Am to (Vs/2), and any circuit for that purpose may not be provided.

Figure 46:
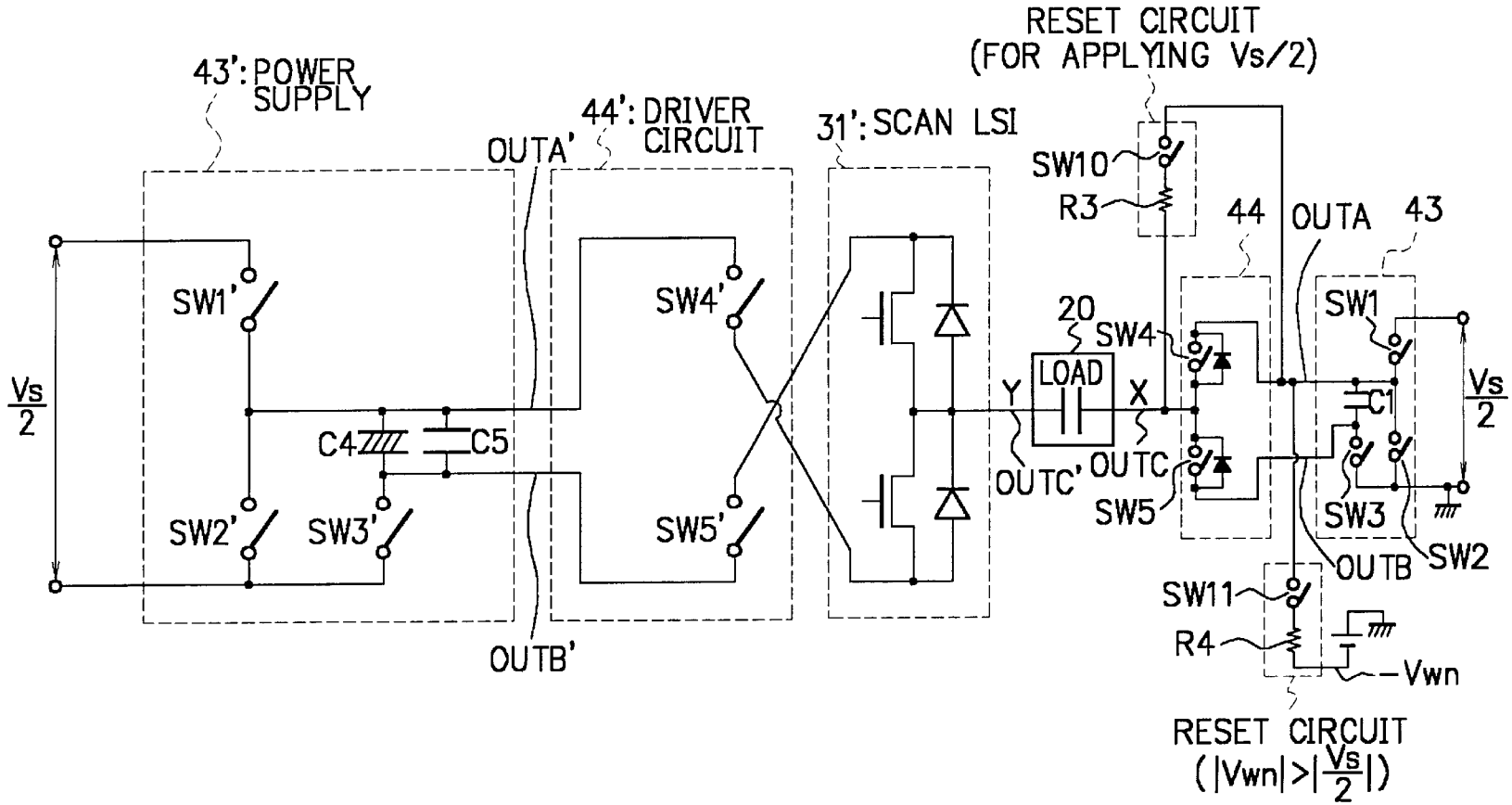
FIG. 46 is a circuit diagram showing another example of construction of a driving apparatus according to the fifth embodiment.

FIG. 46 is a circuit diagram showing another example of construction of a driving apparatus according to this fifth embodiment. In FIG. 46, the components having the same functions as those in FIG. 44 are denoted by the same references as those in FIG. 44, respectively. Thus the repetitive descriptions thereof will be omitted.

In the above example of FIG. 44, the circuit for applying the voltage Vw' is provided on the scanning electrode Y side. Contrastingly in the example of FIG. 46, on the common electrode X side, a switch SW10 with a resistor R3 is provided between the first signal line OUTA and the output line OUTC, and a switch SW11 with a resistor R4 and a power supply for a voltage Vwn are provided between the first signal line OUTA and the ground.

By turning the switch SW10 ON, the positive voltage (+Vs/2) is gradually applied to the common electrode X of the load 20 by the function of the resistor R3. By turning the switch SW11 ON, the negative voltage (−Vwn) is gradually applied to the common electrode X of the load 20 by the function of the resistor R4.

Figure 47:
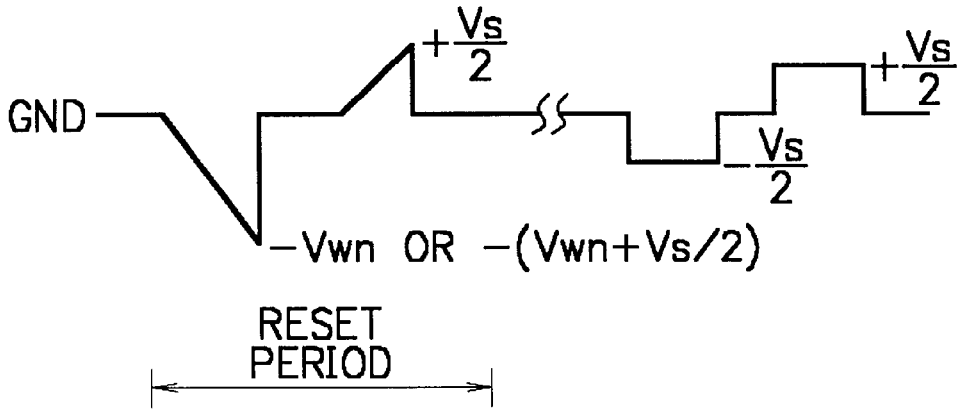
FIG. 47 is a timing chart showing an example of driving waveforms in a reset period and the subsequent sustain discharge period by the driving apparatus constructed as in FIG. 46.

FIG. 47 is a timing chart showing driving waveforms on the common electrode X side by the driving apparatus constructed as in FIG. 46, which shows only the reset and sustain discharge periods in one subfield.

Referring to FIG. 47, in reset period, firstly by turning the switch SW11 ON, the negative voltage (−Vwn) is gradually applied to the common electrode X of the load 20. At this time, the switches SW2 and SW5 may be also turned ON so as to add the voltage (−Vs/2) by utilizing the charges stored in the capacitor C1, thereby applying the voltage −(Vwn+Vs/2). Next, the switches SW11 and SW5 are turned OFF, and the switches SW2 and SW4 are turned ON, so that the voltage of the common electrode X becomes the ground level. Next, by setting the switches SW2, SW4, SW5, and SW11 OFF, and the remaining switches SW1, SW3, and SW10 ON, the positive voltage (+Vs/2) is gradually applied to the common electrode X of the load 20.

In the subsequent sustain discharge period, the switches SW10 and SW11 are not turned ON, and the other switches SW1 to SW5 are controlled like the above embodiments so as alternately to apply the positive and negative voltages (+Vs/2) to the common electrode X.

Sixth Embodiment

Next, the sixth embodiment of the present invention will be described.

In this sixth embodiment, a power recovery circuit is further provided for the circuit shown in each of the above first to fifth embodiments.

Figure 48:
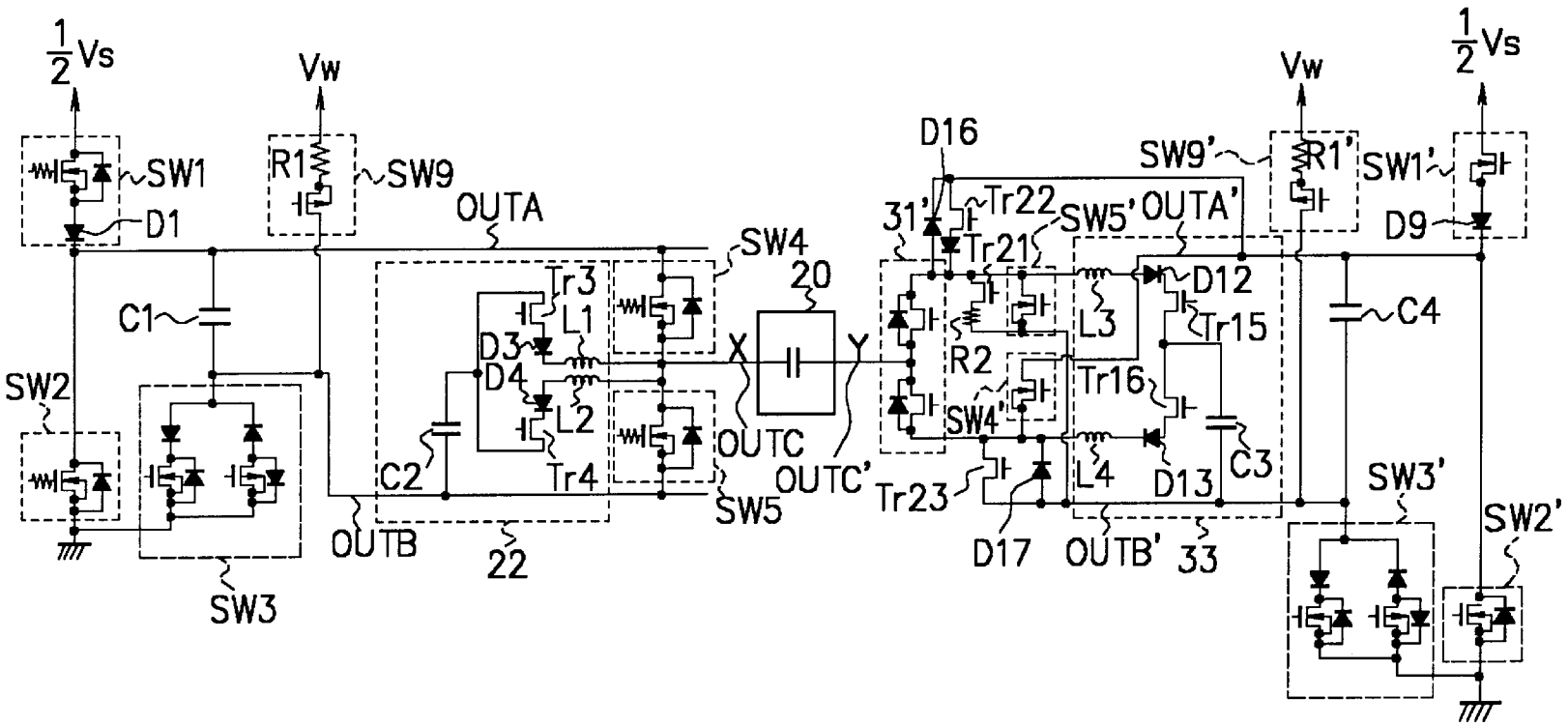
FIG. 48 is a circuit diagram showing an example of construction of a driving apparatus according to the sixth embodiment of the present invention.

FIG. 48 is a circuit diagram showing a specific example of construction of a driving apparatus according to this sixth embodiment. In this example of FIG. 48, circuits for applying the voltage Vw other than the voltage (Vs/2), like that of the fifth embodiment, are provided on both the common electrode X side and the scanning electrode Y side. FIG. 48 shows a construction for driving associated with not only a sustain discharge period but also reset and address periods. In FIG. 48, the same references as in FIG. 4 denote the same parts as in FIG. 4.

Referring to FIG. 48, on the common electrode X side, the switches SW1 and SW2 are connected in series between the ground (GND) and the power supply line of the voltage (Vs/2). The node between the switches SW1 and SW2 is connected to one terminal of the capacitor C1. The switch SW3 is connected between GND and the other terminal of the capacitor C1.

The switches SW4 and SW5 are connected in series between both terminals of the capacitor C1. The node between the switches SW4 and SW5 is connected to the common electrode X of the load 20 and the power recovery circuit 22. The switch SW9 with the resistor R1 is connected between the second signal line OUTB and the power supply line for generating a write voltage Vw.

In the power recovery circuit 22 shown in FIG. 4, the coils L1 and L2 and the common electrode X (output line OUTC) of the load 20 are isolated by the diodes D7 and D8 connected to the load 20. In this example of FIG. 48, however, no such diodes D7 and D8 are provided. Besides, in the power recovery circuit 22 shown in FIG. 4, the capacitor C2 is connected to the ground. In this example of FIG. 48, however, it is connected to the second signal line OUTB.

On the scanning electrode Y side, the switches SW1' and SW2' are connected in series between GND and the power supply line of the voltage (Vs/2) generated by the A/D converter 42 of FIG. 8. The node between the switches SW1' and SW2' is connected to one terminal of a capacitor C4. The switch SW3' is connected between GND and the other terminal of the capacitor C4.

The switch SW4' connected to one terminal of the capacitor C4 is connected to the cathode of the diode D17. The anode of the diode D17 is connected to the other terminal of the capacitor C4. The switch SW5' connected to the other terminal of the capacitor C4 is connected to the anode of the diode D16. The cathode of the diode D16 is connected to the one terminal of the capacitor C4. One terminal of each of the switches SW4' and SW5' respectively connected to the cathode of the diode D17 and the anode of the diode D16, is connected to the load 20 through a scan driver 31', and to a power recovery circuit 33. The switch SW9' with the resistor R1' is connected between the fourth signal line OUTB' and the power supply line for generating a write voltage Vw.

In the power recovery circuit 33 shown in FIG. 4, the capacitor C3 is connected to the ground. In this example of FIG. 48, however, it is connected to the fourth signal line OUTB'.

Figure 49:
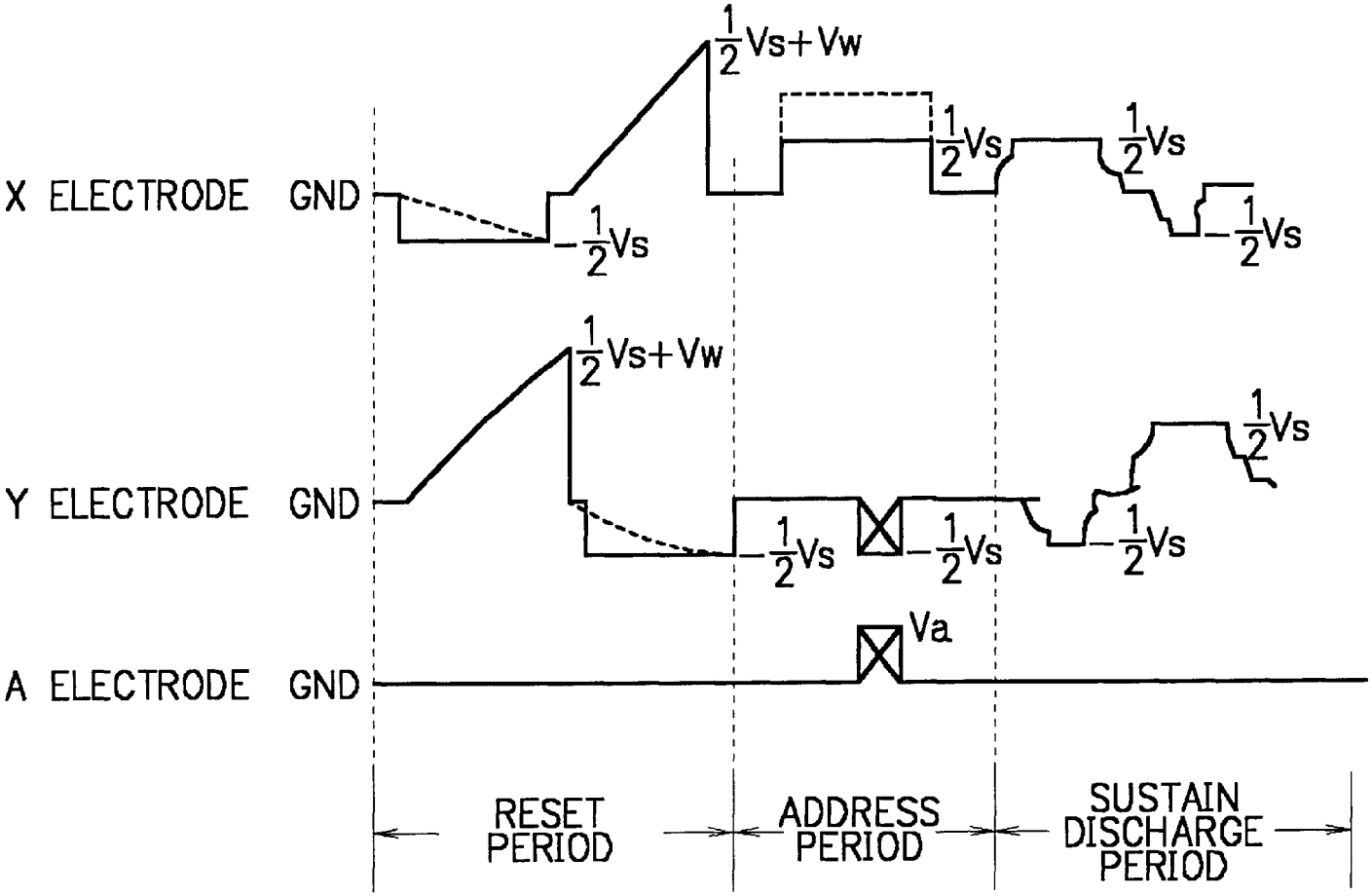
FIG. 49 is a timing chart showing an example of driving waveforms by the driving apparatus constructed as in FIG. 48.

On the scanning electrode Y side, in addition to the above-described construction, three transistors Tr21 to Tr23 and two diodes D16 and D17 are further provided. The roles of these transistors Tr21 to Tr23 and diodes D16 and D17 were already described in the fifth embodiment. Thus the repetitive descriptions thereof will be omitted FIG. 49 is a timing chart showing driving waveforms of the PDP by the driving apparatus constructed as shown in FIG. 48. FIG. 49 shows one of the subfields making up one frame. The waveforms shown in FIG. 49 is almost the same as the waveforms shown in FIG. 45 except parts in reset and sustain discharge periods. Therefore, only the parts in the reset and sustain discharge periods will be described.

The waveforms of the voltages to be applied to the common and scanning electrodes X and Y in the sustain discharge period shown in FIG. 49 differs from those shown in FIG. 45 because of the presence/absence of power recovery circuit. That is, since the circuit shown in FIG. 44 is provided with no power recovery circuit, no L-C resonance occur, so the waveforms as shown in FIG. 45 appear.

When the capacitance of the load 20 is represented by Cp, the absolute value of a voltage to be applied to the load 20 is represented by V, and the frequency when the voltage is applied to the load 20 is represented by f, the power loss when charging or discharging the load 20 is expressed by $2Cp \cdot V^2 \cdot f$ in the prior art shown in FIG. 4. Contrastingly in this embodiment, the absolute value of a voltage to be applied to the load 20 is sufficed by half the conventional value, though the frequency when the voltage is applied to the load 20 becomes double. Consequently, the power loss when charging or discharging the load 20 is expressed by $2Cp \cdot (V/2)^2 \cdot (2f)$. Thus the power loss can be held down to half the conventional one. Therefore, even if no such power recovery circuit is provided, a power saving can be achieved in comparison with the prior art. But, by providing such a power recovery circuit as shown in the sixth embodiment, a more power saving can be achieved.

Referring to FIG. 49, in the reset period, on the common electrode X side, firstly, the switches SW2 and SW5 are turned ON, and the remaining switches SW1, SW3, SW4, and SW9 are kept OFF. The voltage of the second signal line OUTB is thereby lowered to (−Vs/2) in accordance with the charges stored in the capacitor C1. The voltage (−Vs/2) is output on the output line OUTC through the switch SW5 to be applied to the common electrode X of the load 20.

On the scanning electrode Y side, the switches SW1', SW4', and SW9' are turned ON, and the remaining switches SW2', SW3', and SW5' are kept OFF. By this operation, the voltage corresponding to the sum of the voltage Vw and the voltage (Vs/2) in accordance with the charges accumulated in the capacitor C4 is applied to the output line OUTC'. The voltage (Vs/2+Vw) is applied to the scanning electrode Y of the load 20. At this time, the voltage gradually rises by the function of the resistor R1' in the switch SW9'.

Since the potential difference between the common and scanning electrodes X and Y thereby becomes (Vs+Vw), the same voltage as that of the full write pulse shown in the reset period in FIG. 3 can be applied between the common and scanning electrodes X and Y.

Next, all the switches SW1 to SW5, SW9, SW1' to SW5', and SW9' are properly controlled to return the voltages being applied to the common and scanning electrodes X and Y, to the ground level. The common electrode X side and the scanning electrode Y side are then made in the states reverse to those described above. More specifically, on the common electrode X side, the switches SW1, SW4, and SW9 are turned ON, and the remaining switches SW2, SW3, and SW5 are turned OFF. At the same time, on the scanning electrode Y side, the switches SW2' and SW5' are turned ON, and the remaining switches SW1', SW3', SW4', and SW9' are turned OFF.

The voltage being applied to the common electrode X thereby continuously rises from the ground level to (Vs/2+Vw), and the voltage being applied to the scanning electrode Y is lowered to (−Vs/2). In every cell, the voltage due to the wall charges themselves then exceeds its discharge start voltage, and a discharge starts. At this time, weak discharges occur by applying the obtuse wave so that the accumulated wall charges are eliminated except part of them.

In this reset period, by turning the transistor Tr21 ON, the voltage being applied to the scanning electrode Y may be continuously lowered from the ground level to the (−Vs/2) level, as indicated by a dotted line. Also the voltage being applied to the common electrode X can be continuously lowered from the ground level to the (−Vs/2) level, as indicated by another dotted line, if the same components as the above transistor Tr21 and resistor R2 are provided in parallel with the switch SW5 on the common electrode X side.

Figure 50:
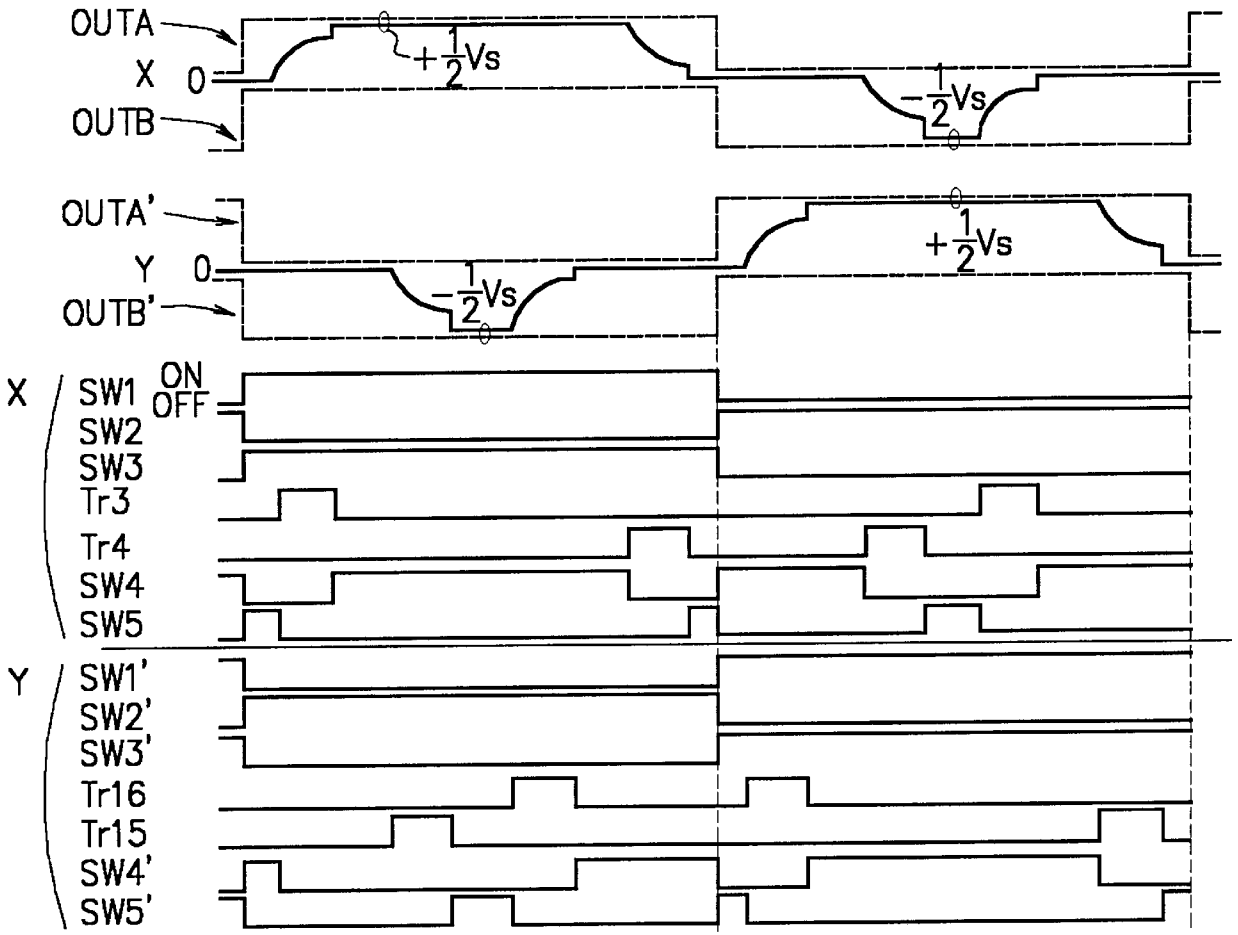
FIG. 50 is a timing chart showing a manner of power recovery by the power recovery circuit shown in FIG. 48.

FIG. 50 is a timing chart showing a manner of power recovery in each of the power recovery circuits 22 and 33 showing in FIG. 48. On the common electrode X side, the switches SW1 and SW3 are turned ON to apply the positive voltage (+Vs/2) is applied on the first signal line OUTA. When the voltage of the second signal line OUTB is at the ground level, the transistor Tr3 in the power recovery circuit 22 is turned ON. An L-C resonance thereby occur with the coil L1 and the capacitance of the load 20 due to the potential difference between the above capacitor C2 and the common electrode X at the ground level. The charges having been recovered in the capacitor C2 are then supplied to the load 20 via the transistor Tr3, the diode D3, and the coil L1.

At this time, on the scanning electrode Y side, since the switch SW2' is ON, the current supplied from the capacitor C2 through the switch SW3 on the common electrode X side to the common electrode X flows through the diode in the scan driver 31' and the diode D16 on the scanning electrode Y side, and then flows into the ground through the third signal line OUTA' and the switch SW2'. With such a current flow, the voltage of the common electrode X gradually rises as shown in FIG. 50. By turning the switch SW4 ON near a peak voltage appearing in this resonance, the voltage of the common electrode X is clamped to (Vs/2).

Next, further on the scanning electrode Y side, the transistor Tr15 in the power recovery circuit 33 is turned ON. An L-C resonance thereby occur with the coil L3 and the capacitance of the load 20 due to the potential difference between the voltage of the capacitor C3 and the voltage of the scanning electrode Y at the ground level. The current supplied from the capacitor C1 through the switch SW3 on the common electrode X side to the common electrode X via the first signal line OUTA and switch SW4, flows through the diode in the scan driver 31' and the diode D12 in the power recovery circuit 33 on the scanning electrode Y side, and further flows through the transistor Tr15, the capacitors C3 and C4, and the switch SW2' into the ground. With such a current flow, the voltage of the scanning electrode Y is gradually lowered as shown in FIG. 50. At this time, part of the charges can be recovered in the capacitor C3. By further turning the switch SW5' ON near a peak voltage appearing in this resonance, the voltage of the scanning electrode Y is clamped to (−Vs/2).

Next, in this state, on the scanning electrode Y side, the switch SW2' and the transistor Tr16 in the power recovery circuit 33 are set ON. An L-C resonance thereby occur with the coil L4 and the capacitance of the load 20 due to the potential difference between the voltage of the capacitor C3 and the voltage (−Vs/2) of the scanning electrode Y. The charges recovered in the capacitor C3 are then supplied to the load 20 through the transistor Tr16, the diode D13, the coil L4, and the diode in the scan driver 31'.

At this time, on the common electrode X side, since the switches SW1, SW3, and SW4 are ON, the current supplied from the capacitor C3 through the switch SW2' and the capacitor C4 on the scanning electrode Y side to the scanning electrode Y flows through the switch SW4 on the common electrode X side, and then flows into the ground through the first signal line OUTA, the capacitor C1, and the switch SW3. With such a current flow, the voltage of the scanning electrode Y gradually rises as shown in FIG. 50. By further turning the switch SW4' ON near a peak voltage appearing in this resonance, the voltage of the scanning electrode Y is clamped to the ground level.

Next, on the common electrode X side, the switches SW1 and SW3 and the transistor Tr4 in the power recovery circuit 22 are set ON. An L-C resonance thereby occur with the coil L2 and the capacitance of the load 20 due to the potential difference between the voltage of the capacitor C2 and the voltage (Vs/2) of the common electrode X. The charges accumulated in the load 20 are supplied through the switches SW2' and SW4', and the diode in the scan driver 31' on the scanning electrode Y side, and the coil L2 and the diode D4 in the power recovery circuit 22 on the common electrode X side, and further through the transistor Tr4, the capacitor C2, and the switch SW3 into the ground. With such a current flow, the voltage of the common electrode X is gradually lowered as shown in FIG. 50. At this time, part of the charges can be recovered in the capacitor C2. By turning the switch SW5 ON near a peak voltage appearing in this resonance, the voltage of the common electrode X is clamped to the ground level.

Next, on the common electrode X side, the switches SW2 and SW4 are set ON. The voltages of the first and second signal lines OUTA and OUTB are thereby set at the ground level and the negative voltage (Vs/2), respectively. On the scanning electrode Y side, the switches SW1', SW3', and SW5' are set ON. The voltages of the third and fourth signal lines OUTA' and OUTB' are thereby swung to (+Vs/2)and the ground level, respectively.

In this state, on the scanning electrode Y side, the transistor Tr16 in the power recovery circuit 33 is turned ON. An L-C resonance thereby occur with the coil L4 and the capacitance of the load 20 due to the potential difference between the voltage of the capacitor C3 and the voltage (+Vs/2) of the scanning electrode Y. The charges recovered in the capacitor C3 are then supplied to the load 20 through the transistor Tr16, the diode D13, the coil L4, and the diode in the scan driver 31'.

At this time, on the common electrode X side, since the switches SW2 and SW4 are ON, the current supplied from the capacitor C3 through the switch SW3' on the scanning electrode Y side to the scanning electrode Y flows through the switch SW4 on the common electrode X side, and then flows into the ground through the first signal line OUTA and the switch SW2. With such a current flow, the voltage of the scanning electrode Y gradually rises as shown in FIG. 50. By further turning the switch SW4' ON near a peak voltage appearing in this resonance, the voltage of the scanning electrode Y is clamped to (Vs/2).

Next, on the common electrode X side, the switch SW2 and the transistor Tr4 in the power recovery circuit 22 is set ON. An L-C resonance thereby occur with the coil L2 and the capacitance of the load 20 due to the potential difference between the voltage of the capacitor C2 and the voltage of the common electrode X. The current supplied from the capacitor C4 through the switch SW3' on the scanning electrode Y side and through the third signal line OUTA', the switch SW4', and the diode in the scan driver 31' to the scanning electrode Y, flows through the coil L2 and the diode D4 in the power recovery circuit 22, and further flows through the transistor Tr4, the capacitors C2 and C1, and the switch SW2 into the ground. With such a current flow, the voltage of the common electrode X is gradually lowered as shown in FIG. 50. At this time, part of the charges can be recovered in the capacitor C2. By further turning the switch SW5 ON near a peak voltage appearing in this resonance, the voltage of the common electrode X is clamped to (−Vs/2).

Next, in this state, on the common electrode X side, the switch SW2 and the transistor Tr3 in the power recovery circuit 22 are set ON. An L-C resonance thereby occur with the coil L1 and the capacitance of the load 20 due to the potential difference between the voltage of the capacitor C2 and the voltage (−Vs/2) of the common electrode X. The charges recovered in the capacitor C2 are then supplied to the load 20 through the transistor Tr3, the diode D3, and the coil L1.

At this time, on the scanning electrode Y side, since the switches SW1', SW3', and SW4' are ON, the current supplied from the capacitor C2 and the switch SW2 and the capacitor C1 on the common electrode X side to the common electrode X flows through the diode in the scan driver 31' and the diode D16 on the scanning electrode Y side, and then flows into the ground through the third signal line OUTA', the capacitor C4, and the switch SW3'. With such a current flow, the voltage of the common electrode X gradually rises as shown in FIG. 50. By further turning the switch SW4 ON near a peak voltage appearing in this resonance, the voltage of the common electrode X is clamped to the ground level.

Next, on the scanning electrode Y side, the switches SW1' and SW3' and the transistor Tr15 in the power recovery circuit 33 are set ON. An L-C resonance thereby occur with the coil L3 and the capacitance of the load 20 due to the potential difference between the voltage of the capacitor C3 and the voltage (Vs/2) of the scanning electrode Y. The charges accumulated in the load 20 are supplied through the switches SW2 and SW4 on the common electrode X side, and through the diode in the scan driver 31' on the scanning electrode Y side, and further through the coil L3 and the diode D12 in the power recovery circuit 33, the transistor Tr15, the capacitor C3, and the switch SW3', into the ground. With such a current flow, the voltage of the scanning electrode Y is gradually lowered as shown in FIG. 50. At this time, part of the voltage can be recovered in the capacitor C3. By further turning the switch SW5' ON near a peak voltage appearing in this resonance, the voltage of the scanning electrode Y is clamped to the ground level.

Figure 51:
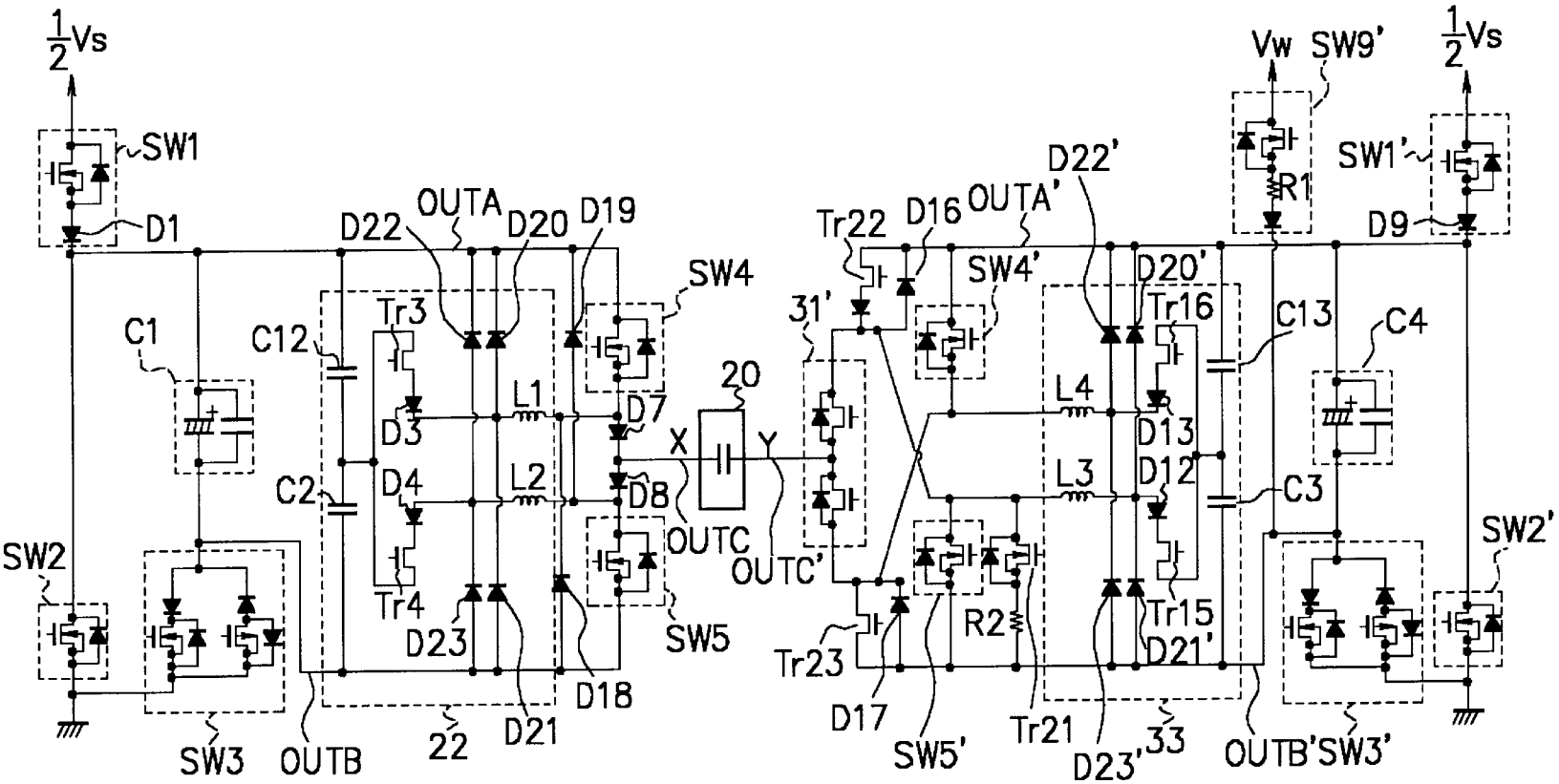
FIG. 51 is a circuit diagram showing another example of construction of a driving apparatus according to the sixth embodiment.

FIG. 51 is a circuit diagram showing another example of construction of a driving apparatus according to this sixth embodiment. In FIG. 51, the components having the same functions as those in FIG. 48 are denoted by the same references as those in FIG. 48, respectively. Thus the repetitive descriptions thereof will be omitted.

On the common electrode X side, the driving apparatus shown in FIG. 51 is provided with a power recovery circuit 22 comprising two systems of coils L1 and L2, like the driving apparatus shown in FIG. 48. The coils L1 and L2 are isolated from the common electrode X of the load 20 (output line OUTC) by diodes D7 and D8. The diodes D18 and D19 respectively connected between the coil L1 of the power recovery circuit 22 and the second signal line OUTB, and between the coil L2 and the first signal line OUTA, have the same roles as the diodes D16 and D17 on the scanning electrode Y side.

The power recovery circuit 22 further comprises four diodes D20 to D23 for clamping. The diodes 20 and 21 are connected in series between the first and second signal lines OUTA and OUTB. The node between the diodes is connected between the cathode of the diode D3 and the coil L1. The diodes 22 and 23 are also connected in series between the first and second signal lines OUTA and OUTB. The node between the diodes is connected between the anode of the diode D4 and the coil L2.

The power recovery circuit 22 shown in FIG. 51 further comprises two capacitors C2 and C12 for power recovery. The capacitor C12, which is newly provided in this example of FIG. 51, is connected between a common terminal of two transistors Tr3 and Tr4, and the first signal line OUTA.

By the provision of this capacitor C12, when the voltage of the first signal line OUTA is to be set at the ground level by turning the switch SW2 ON, the power of the first signal line OUTA can be recovered or supplied as it is, in relation to the capacitance of the load 20, using the capacitor C12 without passing through the capacitors C1 and C2, thereby decreasing power loss.

More specifically, when the power recovery circuit 22 comprises only the capacitor C2 as shown in FIG. 48, power recovery is performed by the manner that a current flows in the route of the capacitors C2 and C1 and the switch SW2. That is, the current flows through two capacitors. Contrastingly in case of also providing the capacitor C12 as shown in FIG. 51, power recovery is performed by the manner that a current flows in the route of the capacitor C12 and the switch SW2. That is, the current flows through only one capacitor. Consequently, in case of FIG. 51, power loss due to the impedance components caused by capacitors is a little, so the power recovery efficiency can be improved.

Figure 52:
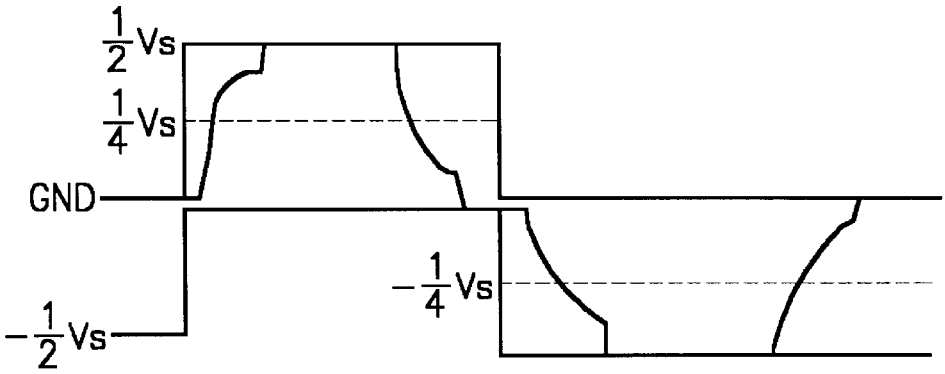
FIG. 52 is a timing chart showing the manner of power recovery by the power recovery circuit shown in FIG. 51.

FIG. 52 is a timing chart showing the manner of power recovery by the power recovery circuit 22 shown in FIG. 51. When the switches SW1 and SW3 are ON to apply the positive voltage (+Vs/2) to the first signal line OUTA, and the second signal line OUTB is at the ground level, the voltage of the node between the capacitors C2 and C12 is Vs/4.

In this state, when the transistor Tr3 in the power recovery circuit 22 is turned ON, an L-C resonance occurs with the coil L1 and the capacitance of the load 20 due to the potential difference (Vs/4) between the above node between the capacitors C2 and C12, and the common electrode X, which is at the ground level. The voltage of the common electrode X thereby gradually rises as shown in FIG. 52, using the power having been recovered in the capacitors C2 and C12. By turning the switch SW4 ON near a peak voltage appearing in this resonance, the voltage of the common electrode X is clamped to (Vs/2).

Further, in this state, when the transistor Tr3 and the switch SW4 are turned OFF, and the transistor Tr4 in the power recovery circuit 22 is turned ON, an L-C resonance occurs with the coil L2 and the capacitance of the load 20 due to the potential difference (Vs/4) between the voltage (Vs/4) of the above node between the capacitors C2 and C12, and the voltage (Vs/2) of the common electrode X. The voltage of the common electrode X is thereby gradually lowered as shown in FIG. 52. At this time, part of the charges can be recovered in the capacitors C2 and C12. By turning the switch SW5 ON near a peak voltage appearing in this resonance, the voltage of the common electrode X is clamped to the ground level.

Next, the switch SW2 is turned ON to set the voltages of the first and second signal lines OUTA and OUTB at the ground level and the negative voltage (−Vs/2), respectively. The voltage of the node between the capacitors C2 and C12 then becomes (−Vs/4).

In this state, when the transistor Tr4 in the power recovery circuit 22 is turned ON, an L-C resonance occurs with the coil L2 and the capacitance of the load 20 due to the potential difference (Vs/4) between the above node between the capacitors C2 and C12, and the common electrode X, which is at the ground level. The voltage of the common electrode X is thereby gradually lowered as shown in FIG. 52. At this time, part of the charges can be recovered in the capacitors C2 and C12. By turning the switch SW5 ON near a peak voltage appearing in this resonance, the voltage of the common electrode X is clamped to (−Vs/2).

Further, in this state, when the transistor TR4 and the switch SW5 are turned OFF, and the transistor Tr3 in the power recovery circuit 22 is turned ON, an L-C resonance occurs with the coil L1 and the capacitance of the load 20 due to the potential difference (Vs/4) between the voltage (−Vs/4) of the above node between the capacitors C2 and C12, and the voltage (−Vs/2) of the common electrode X.

The voltage of the common electrode X thereby gradually rises as shown in FIG. 52, using the power having been recovered in the capacitors C2 and C12. By turning the switch SW4 ON near a peak voltage appearing in this resonance, the voltage of the common electrode X is clamped to the ground level.

In this manner, according to the example of construction of FIG. 51, by the provision of the two capacitors C2 and C12 between the first and second signal lines OUTA and OUTB for power recovery, two stages of power recovery can be performed with a small circuit construction. Besides, since the Q value of current flowing each time of power recovery is made small, the efficiency of power recovery can be remarkably improved. Furthermore, these two capacitors C2 and C12 can also realize the function of the capacitor C1, so the capacitor C1 may be omitted.

The above description is for the construction on the common electrode X side. The construction on the scanning electrode Y side is similar. More specifically, a power recovery circuit 33 on the scanning electrode Y side comprises four diodes D20' to D23' for clamping. The diodes 20' and 21' are connected in series between the third and fourth signal lines OUTA' and OUTB'. The node between the diodes is connected between the anode of a diode D12 and a coil L3. The diodes 22' and 23' are also connected in series between the third and fourth signal lines OUTA' and OUTB'. The node between the diodes is connected between the cathode of a diode D13 and a coil L4.

The power recovery circuit 33 shown in FIG. 51 further comprises two capacitors C3 and C13 for power recovery. The capacitor C13, which is newly provided in this example of FIG. 51, is connected between a common terminal of two transistors Tr15 and Tr16, and the third signal line OUTA'.

By the provision of this capacitor C13, when the voltage of the third signal line OUTA' is to be set at the ground level by turning the switch SW2' ON, the power of the third signal line OUTA' can be recovered and supplied as it is, in relation to the capacitance of the load 20, using the capacitor C13 without passing through the capacitors C4 and C3, thereby decreasing power loss.

More specifically, when the power recovery circuit 22 comprises only the capacitor C2 as shown in FIG. 48, power recovery is performed by the manner that a current flows in the route of the capacitors C2 and C1 and the switch SW2. That is, the current flows through two capacitors. Contrastingly in case of also providing the capacitor C12 as shown in FIG. 51, power recovery is performed by the manner that a current flows in the route of the capacitor C12 and the switch SW2. That is, the current flows through only one capacitor. Consequently, in case of FIG. 51, power loss due to the impedance components caused by capacitors is a little, so the power recovery efficiency can be improved.

In this driving apparatus shown in FIG. 51, the capacitors C12 and C13 may be omitted (open). Also, the capacitors C2 and C3 may be omitted (open). Also, the capacitors C1 and C4 may be omitted (open). The ratio of the capacitor C2 to the capacitor C12 may be equal to or different from the ratio of the capacitor C3 to the capacitor C13. The values of the coils L1 and L2 and the values of the coils L3 and L4 may be equal to or different from each other.

For example, when the coils L1 and L2 have different values and the coils L3 and L4 have different values, the time of rising and the time of falling of the voltage in the L-C resonance can be made to differ from each other. More specifically, the smaller the value of a coil is, the greater the gradient of rising/falling of the voltage is. For example, the values of the coils L1 and L3 used in supplying the recovered power are made small, and the values of the coils L2 and L4 used in recovering power are made great. By this setting, rising of the voltage in supplying power can be made fast to improve the luminance in a plasma display panel, and falling of the voltage in recovering power can be made relatively slow to suppress generation of noise.

Figure 53:
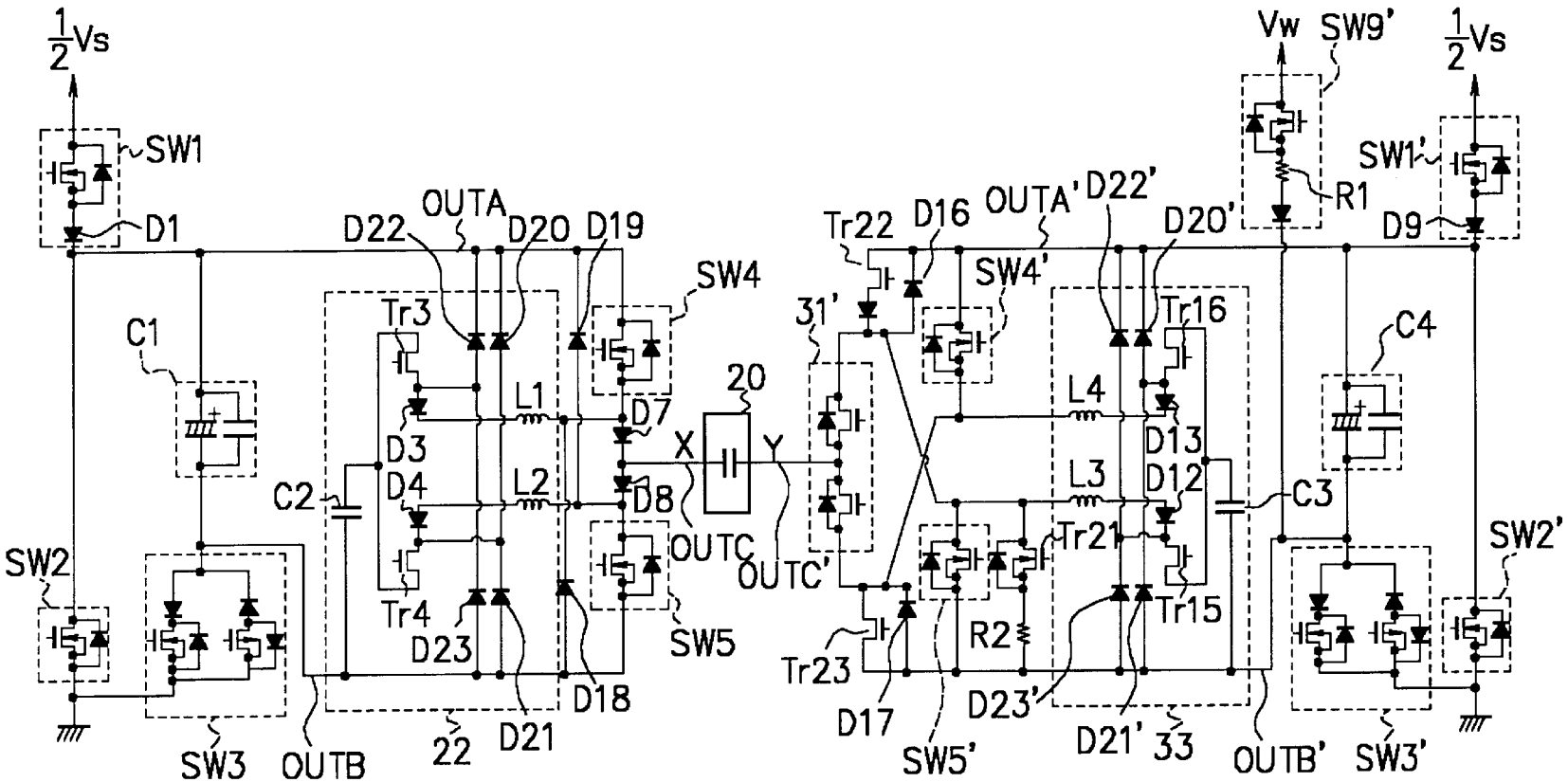
FIG. 53 is a circuit diagram showing another example of construction of a driving apparatus according to the sixth embodiment.

FIG. 53 is a circuit diagram showing another example of construction of a driving apparatus according to this sixth embodiment. In FIG. 53, the components having the same functions as those in FIG. 51 are denoted by the same references as those in FIG. 51, respectively. Thus the repetitive descriptions thereof will be omitted.

The construction shown in FIG. 53 differs from the construction shown in FIG. 51 only in the point of absence of the capacitors C12 and C13, and in the feature of connection in relation to the diodes D20 to D23 and D20' to D23' for clamping.

More specifically, in the construction shown in FIG. 53, in the power recovery circuit 22 on the common electrode X side, the node between the diodes D20 and D21, which are connected in series between the first and second signal lines OUTA and OUTB, is connected between the cathode of the diode D4 and the transistor Tr4. Besides, the node between the diodes D22 and D23, which are also connected in series between the first and second signal lines OUTA and OUTB, is connected between the anode of the diode D3 and the transistor Tr3.

In the power recovery circuit 33 on the scanning electrode Y side, the node between the diodes D20' and D21', which are connected in series between the third and fourth signal lines OUTA' and OUTB', is connected between the anode of the diode D13 and the transistor Tr16. Besides, the node between the diodes D22' and D23', which are also connected in series between the third and fourth signal lines OUTA' and OUTB', is connected between the cathode of the diode D12 and the transistor Tr15.

Figure 54:
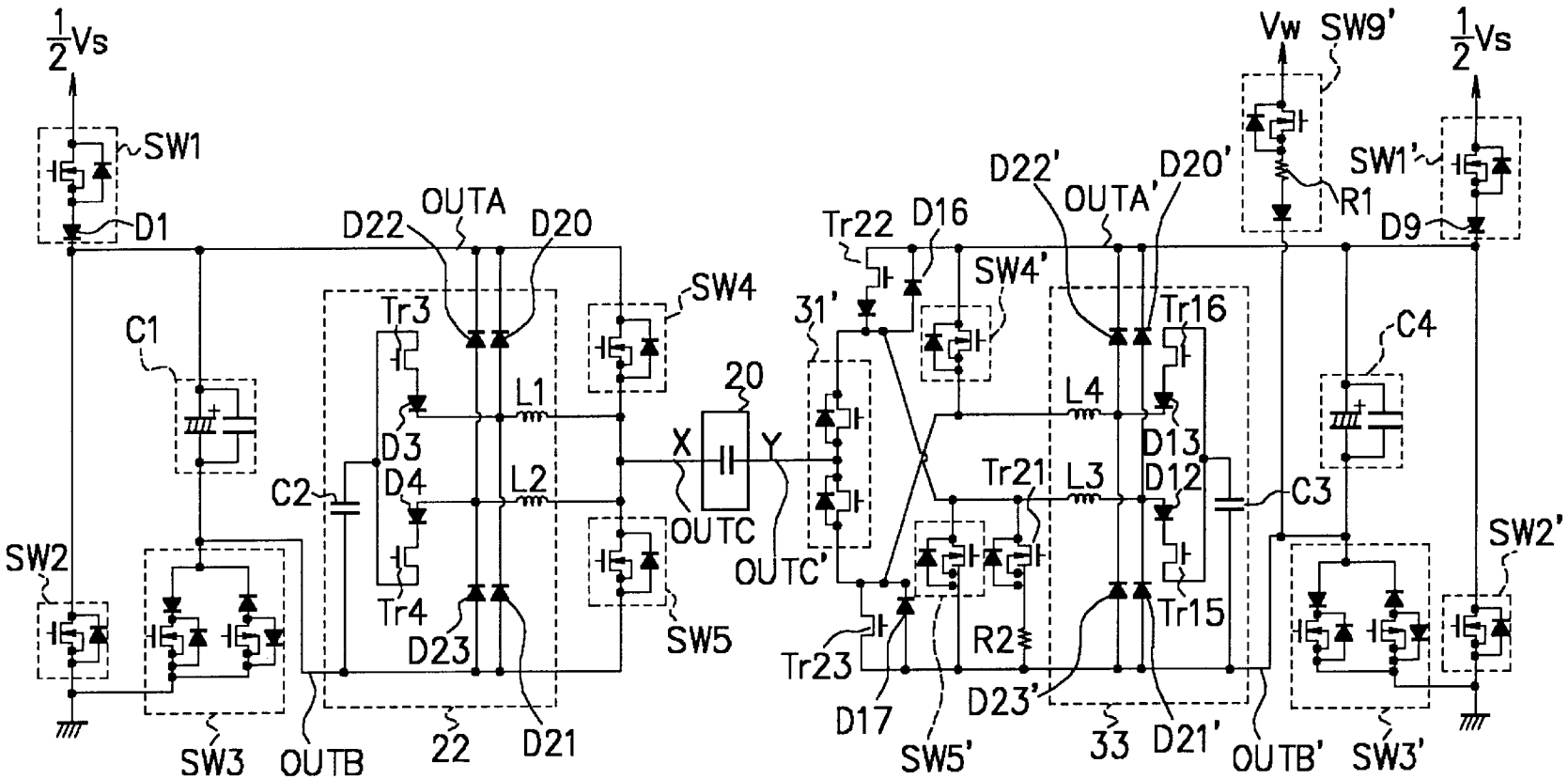
FIG. 54 is a circuit diagram showing another example of construction of a driving apparatus according to the sixth embodiment.

FIG. 54 is a circuit diagram showing another example of construction of a driving apparatus according to this sixth embodiment. In FIG. 54, the components having the same functions as those in FIG. 51 are denoted by the same references as those in FIG. 51, respectively. Thus the repetitive descriptions thereof will be omitted.

The construction shown in FIG. 54 differs from the construction shown in FIG. 51 only in the point of absence of the capacitors C12 and C13, and in the feature that the coils L1 and L2 are not isolated from the common electrode X of the load 20 (output line OUTC) by using the diodes D7, D8, D18, and D19.

More specifically, in the construction shown in FIG. 54, on the common electrode X side, there are not provided the diodes D7, D8, D18, and D19 which are provided in the example of FIG. 51. Thus the coils L1 and L2 can be directly seen from the common electrode X side. Besides, in either of the common electrode X side and the scanning electrode Y side, the capacitors C12 and C13 may be provided which are provided in the example of FIG. 51.

Figure 55:
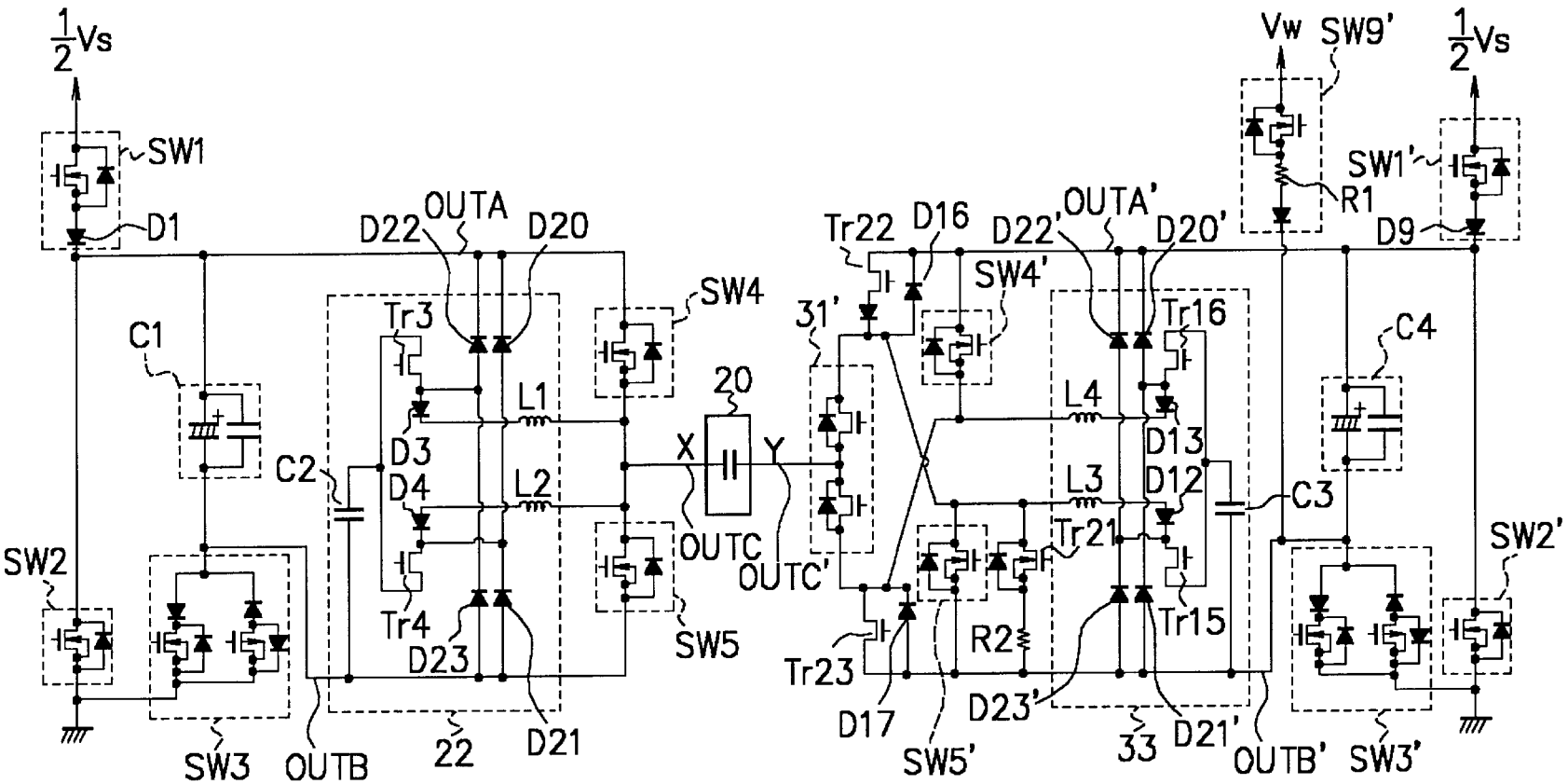
FIG. 55 is a circuit diagram showing another example of construction of a driving apparatus according to the sixth embodiment.

FIG. 55 is a circuit diagram showing another example of construction of a driving apparatus according to this sixth embodiment. In FIG. 55, the components having the same functions as those in FIG. 51 are denoted by the same references as those in FIG. 51, respectively. Thus the repetitive descriptions thereof will be omitted.

The construction shown in FIG. 55 differs from the construction shown in FIG. 51 only in the point of absence of the capacitors C12 and C13, in the feature of connection in relation to the diodes D20 to D23 and D20' to D23' for clamping, and in the feature that the coils L1 and L2 are not isolated from the common electrode X of the load 20 (output line OUTC) by using the diodes D7 and D8.

More specifically, in the construction shown in FIG. 55, in the power recovery circuit 22 on the common electrode X side, the node between the diodes D20 and D21, which are connected in series between the first and second signal lines OUTA and OUTB, is connected between the cathode of the diode D4 and the transistor Tr4. Besides, the node between the diodes D22 and D23, which are also connected in series between the first and second signal lines OUTA and OUTB, is connected between the anode of the diode D3 and the transistor Tr3.

In the power recovery circuit 33 on the scanning electrode Y side, the node between the diodes D20' and D21', which are connected in series between the third and fourth signal lines OUTA' and OUTB', is connected between the anode of the diode D13 and the transistor Tr16. Besides, the node between the diodes D22' and D23', which are also connected in series between the third and fourth signal lines OUTA' and OUTB', is connected between the cathode of the diode D12 and the transistor Tr15.

On the common electrode X side, there are not provided the diodes D7, D8, D18, and D19 which are provided in the example of FIG. 51. Thus the coils L1 and L2 can be directly seen from the common electrode X side. Besides, in either of the common electrode X side and the scanning electrode Y side, the capacitors C12 and C13 may be provided which are provided in the example of FIG. 51.

Figure 56:
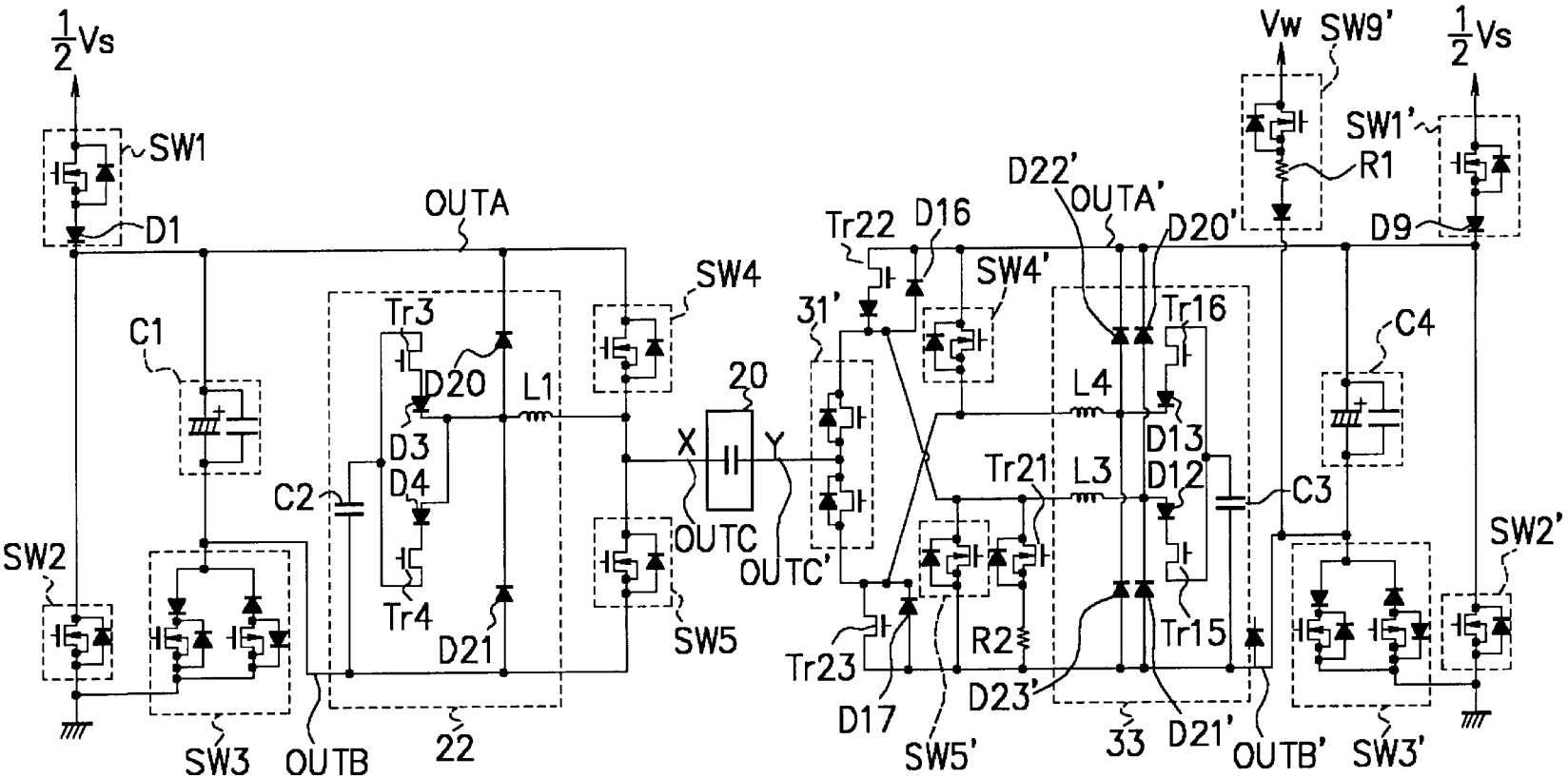
FIG. 56 is a circuit diagram showing another example of construction of a driving apparatus according to the sixth embodiment.

FIG. 56 is a circuit diagram showing another example of construction of a driving apparatus according to this sixth embodiment. In FIG. 56, the components having the same functions as those in FIG. 51 are denoted by the same references as those in FIG. 51, respectively. Thus the repetitive descriptions thereof will be omitted.

The construction shown in FIG. 56 differs from the construction shown in FIG. 51 only in the point of absence of the capacitors C12 and C13, in the feature that the power recovery circuit 22 on the common electrode X side is made up from only one system of the coil L1, and in the feature that the coil L1 is not isolated from the common electrode X of the load 20 (output line OUTC) by using the diodes D7 and D8.

More specifically, in the construction shown in FIG. 56, in the power recovery circuit 22 on the common electrode X side, the node between the diodes D20 and D21, which are connected in series between the first and second signal lines OUTA and OUTB, is connected between the cathode of the diode D3 and the coil L1. The coil L2 and the diodes D22 and D23 which are provided in the example of FIG. 51, are not provided in this construction shown in FIG. 56.

On the common electrode X side, there are not provided the diodes D7, D8, D18, and D19 which are provided in the example of FIG. 51. Thus the coil L1 can be directly seen from the common electrode X side. Besides, in either of the common electrode X side and the scanning electrode Y side, the capacitors C12 and C13 may be provided which are provided in the example of FIG. 51.

Since the power recovery circuit 22 is made up from only one system of the coil L1, a simple circuit construction can be obtained.

Figure 57:
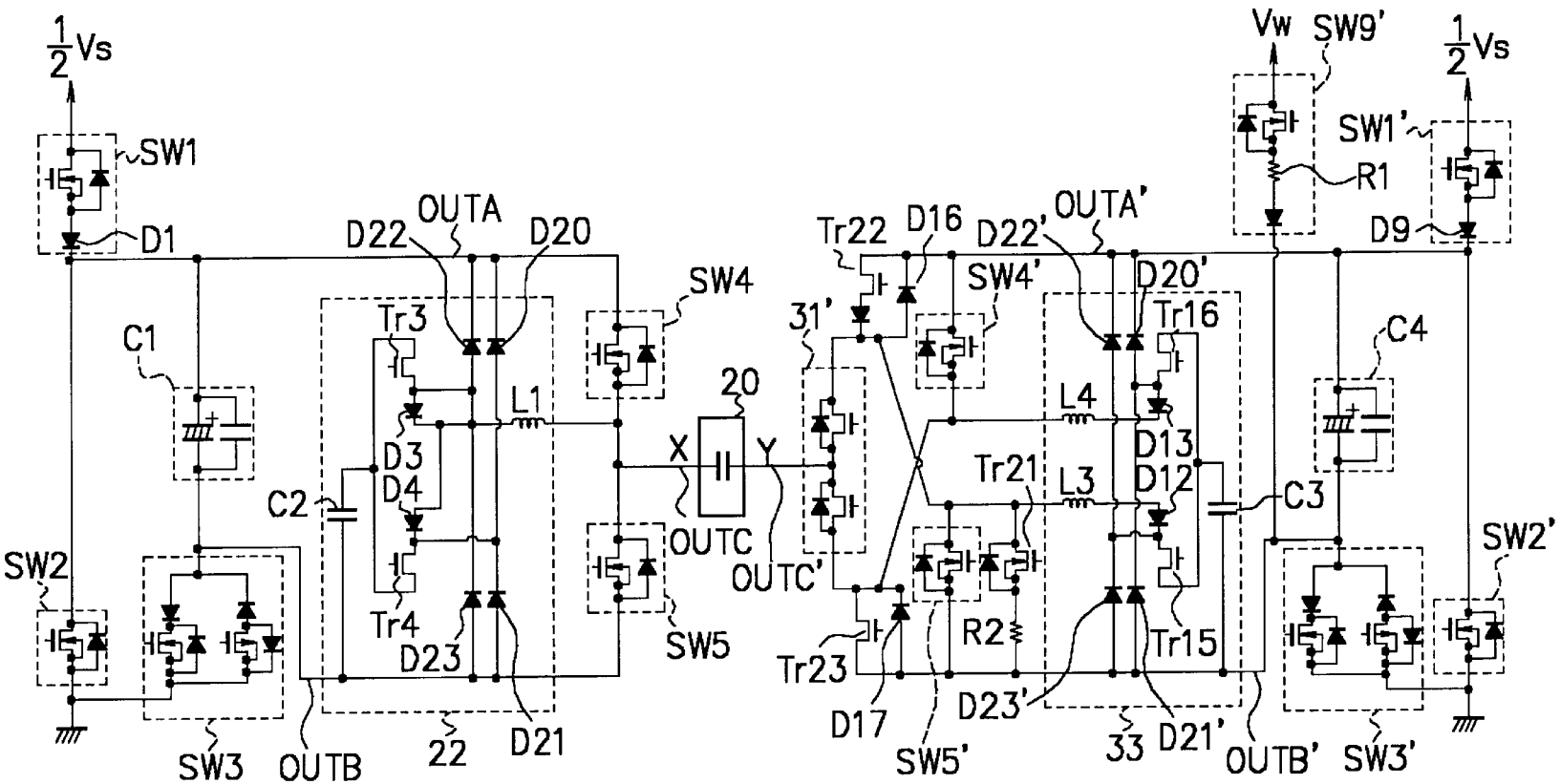
FIG. 57 is a circuit diagram showing another example of construction of a driving apparatus according to the sixth embodiment.

FIG. 57 is a circuit diagram showing another example of construction of a driving apparatus according to this sixth embodiment. In FIG. 57, the components having the same functions as those in FIG. 56 are denoted by the same references as those in FIG. 56, respectively. Thus the repetitive descriptions thereof will be omitted.

The construction shown in FIG. 57 differs from the construction shown in FIG. 56 only in the feature of using four diodes D20 to D23 for clamping in the power recovery circuit 22 on the common electrode X side, in the feature of connection in relation to them, and in the feature of connection in relation to the diodes D20' to D23' on the scanning electrode Y side.

More specifically, in the construction shown in FIG. 57, in the power recovery circuit 22 on the common electrode X side, the node between the diodes D20 and D21, which are connected in series between the first and second signal lines OUTA and OUTB, is connected between the cathode of the diode D4 and the transistor Tr4. Besides, the node between the diodes D22 and D23, which are also connected in series between the first and second signal lines OUTA and OUTB, is connected between the anode of the diode D3 and the transistor Tr3. The construction on the scanning electrode Y side is quite the same as that in FIG. 53.

Figure 58:
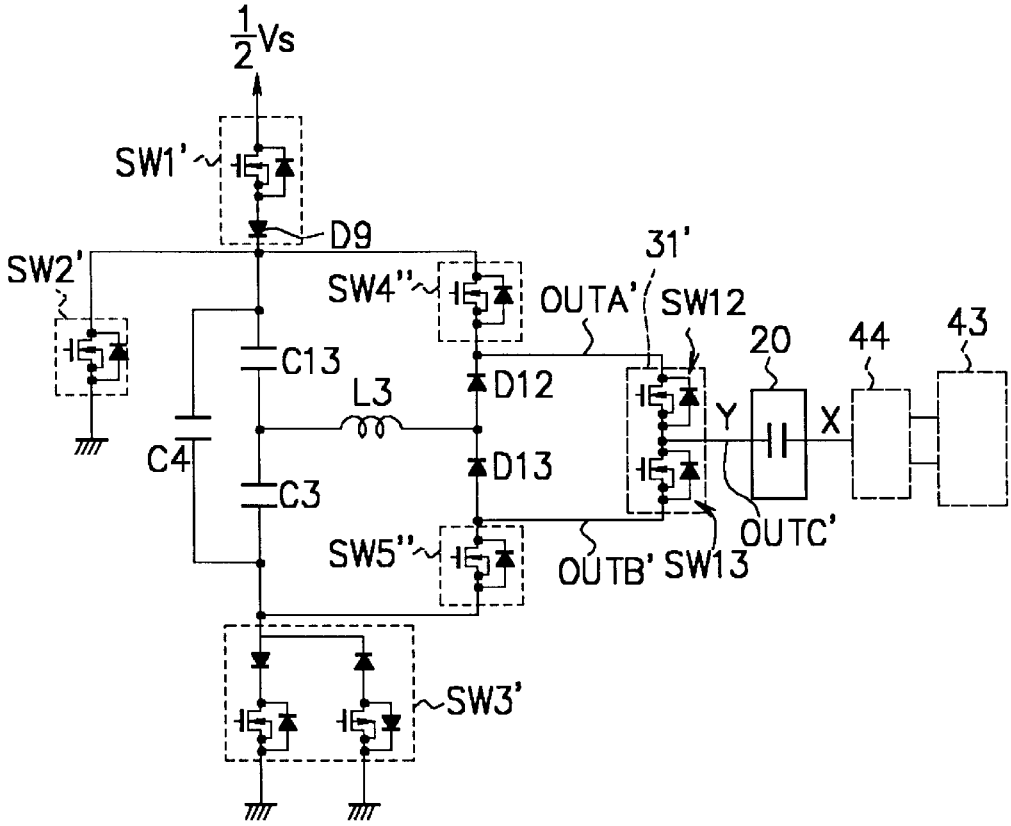
FIG. 58 is a circuit diagram showing another example of construction of a driving apparatus according to the sixth embodiment.

FIG. 58 is a circuit diagram showing another example of construction of a driving apparatus according to this sixth embodiment. In FIG. 58, the components having the same functions as those in FIG. 51 are denoted by the same references as those in FIG. 51, respectively. Thus the repetitive descriptions thereof will be omitted. FIG. 58 only shows the construction on the scanning electrode Y side as a representative.

In the construction shown in FIG. 58, a switch SW4" serves as both the switch SW4' and the transistor Tr22 in FIG. 51. Besides, a switch SW5" serves as both the switch SW5' and the transistor Tr23 in FIG. 51. Further, the switches SW12 and SW13 making up the scan driver 31', serve as the transistors Tr16 and Tr15 in FIG. 51, respectively.

On the scanning electrode Y side, by controlling changeover of the switches including those switches SW4", SW5", SW12, and SW13 at proper timings, the negative voltage (−Vs/2) in the address period shown in FIG. 45, and the positive and negative voltages (+Vs/2) repeating alternately in the sustain discharge period can be generated.

For example, the negative voltage (−Vs/2) in the address period can be applied to the scanning electrode Y by turning the switch SW4" (transistor Tr22) and the switch SW5" (transistor Tr23) ON. More specifically, turning the transistor Tr22 ON causes the third signal line OUTA' to be at the ground level, and turning the transistor Tr23 ON causes the fourth signal line OUTB' to be at the (−Vs/2) level. As a result, the negative voltage (−Vs/2) is applied to the load 20 through the output line OUTC'.

The positive and negative voltages (±Vs/2) to the scanning electrode Y in the sustain discharge period can be generated by the switching operation shown in FIG. 59, which will be described next.

Figure 59:
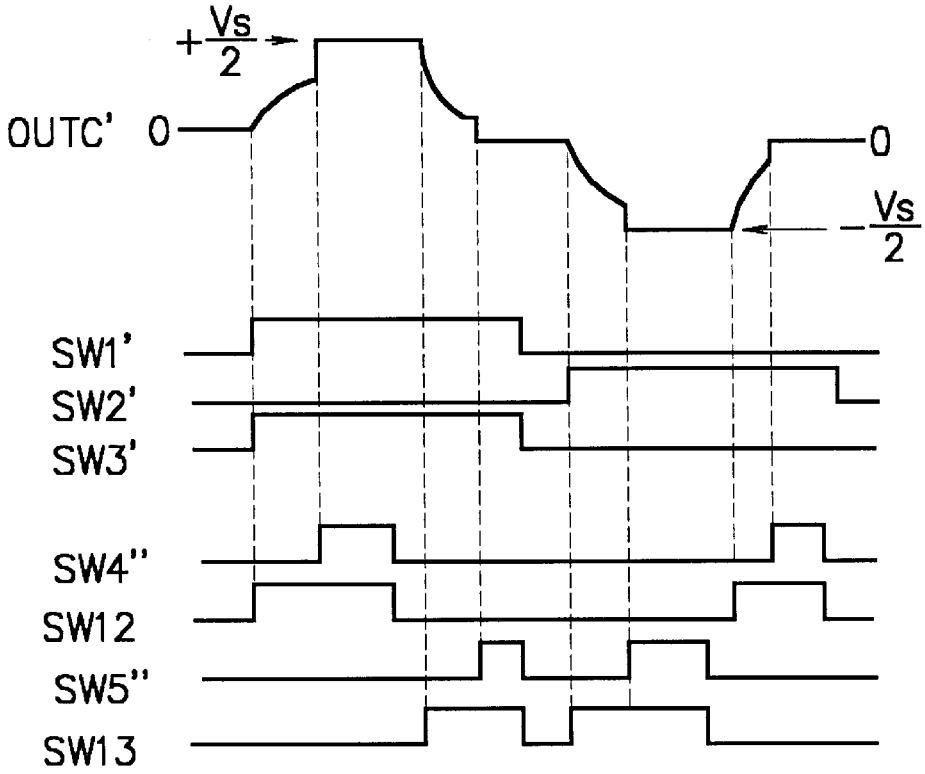
FIG. 59 is a timing chart showing an example of driving waveforms in a sustain discharge period by the driving apparatus constructed as in FIG. 58.

FIG. 59 is a timing chart showing an example of control for generating driving waveforms to the scanning electrode Y in a sustain discharge period by the driving apparatus shown in FIG. 58.

At first, the switches SW1', SW3', and SW12 (transistor Tr16) are turned ON. An L-C resonance thereby occurs between the capacitance of the load 20 and the coil L3. The voltage then gradually rising is applied to the scanning electrode Y through the output line OUTC'. Next, the switch SW4" (switch SW4') is turned ON near a peak voltage appearing in the resonance, so that the voltage being applied to the scanning electrode Y clamped to (+Vs/2).

Next, while the switches SW1' and SW3' are kept ON, the switches SW4" and SW12 are turned OFF, and the switch SW13 (transistor Tr15) is turned ON. The charges stored in the capacitance of the load 20 are thereby drawn through the switch SW13, and the voltage of the scanning electrode Y is gradually lowered due to the L-C resonance between the capacitance of the load 20 and the coil L3. The switch SW5" (switch SW5') is then turned ON near a peak voltage appearing in the resonance, so that the voltage being applied to the scanning electrode Y is clamped to the ground level.

Next, all the switches are once set OFF, and then the switch SW2' is turned ON, thereby swinging the voltage of the third signal line OUTA' from (+Vs/2) to the ground level, and the voltage of the fourth signal line OUTB' from the ground level to (−Vs/2).

At the same time when the switch SW2' is turned ON, the switch SW13 (transistor Tr15) is turned ON. The voltage of the scanning electrode Y is gradually lowered toward the negative voltage (−Vs/2) by the L-C resonance between the capacitance of the load 20 and the coil L3. After this, by turning the switch SW5" (switch SW5') ON near a peak voltage appearing in the resonance, the voltage being applied to the scanning electrode Y is clamped to (−Vs/2).

Next, while the switch SW2' is kept ON, the switches SW5" and SW13 are turned OFF, and the switch SW12 (transistor Tr16) is turned ON. The voltage of the scanning electrode Y is thereby gradually raised due to the L-C resonance between the capacitance of the load 20 and the coil L3. The switch SW4" (switch SW4') is then turned ON near a peak voltage appearing in the resonance, so that the voltage being applied to the scanning electrode Y is clamped to the ground level.

As described above, according to the driving apparatus with the construction shown in FIG. 58, the switching elements necessary for driving in the address period serve as the switching elements necessary for driving in the sustain discharge period. Thus the number of elements can be decreased, and a simple circuit can be obtained.

Figure 60:
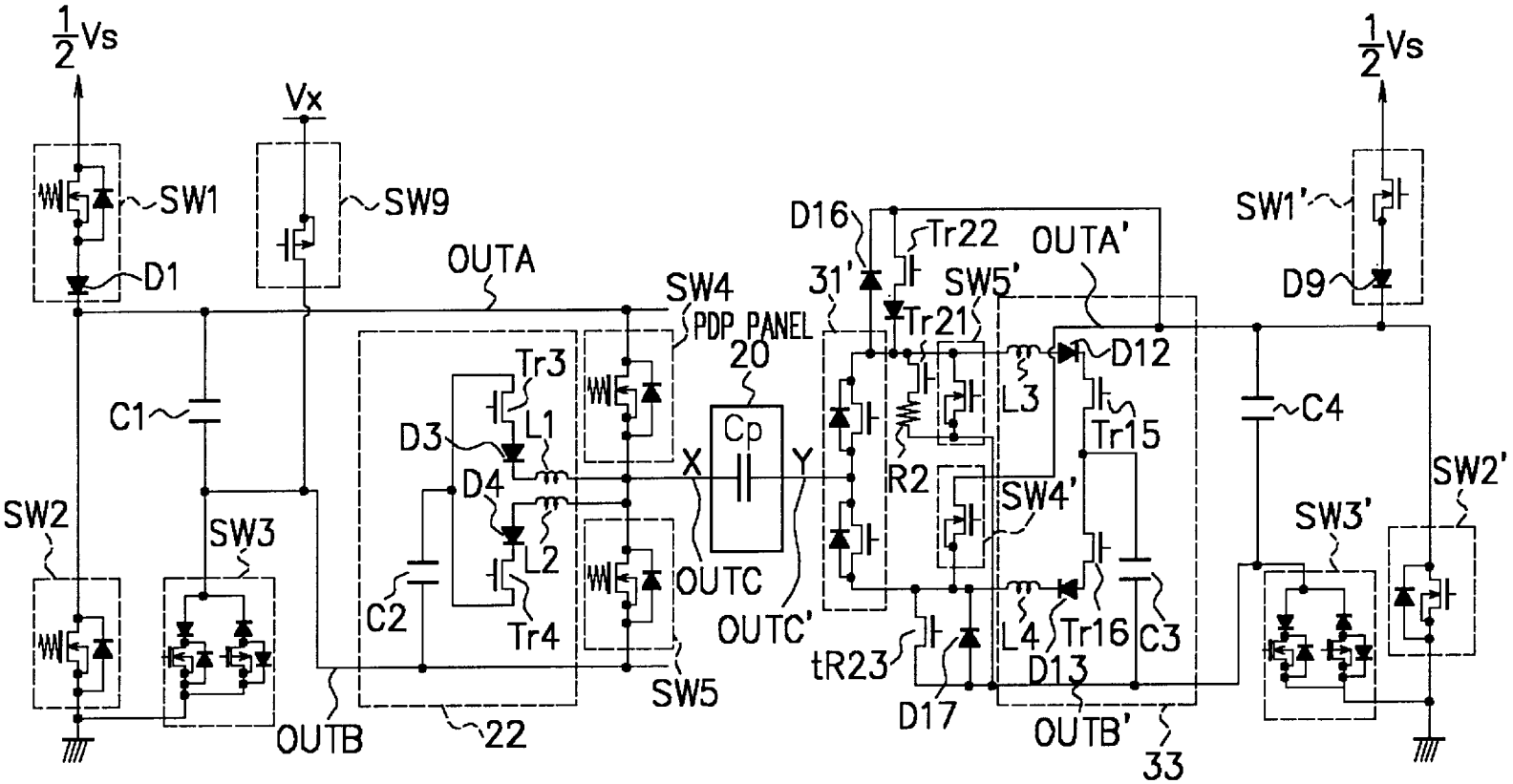
FIG. 60 is a circuit diagram showing another example of construction of a driving apparatus according to the sixth embodiment.
Figure 61:
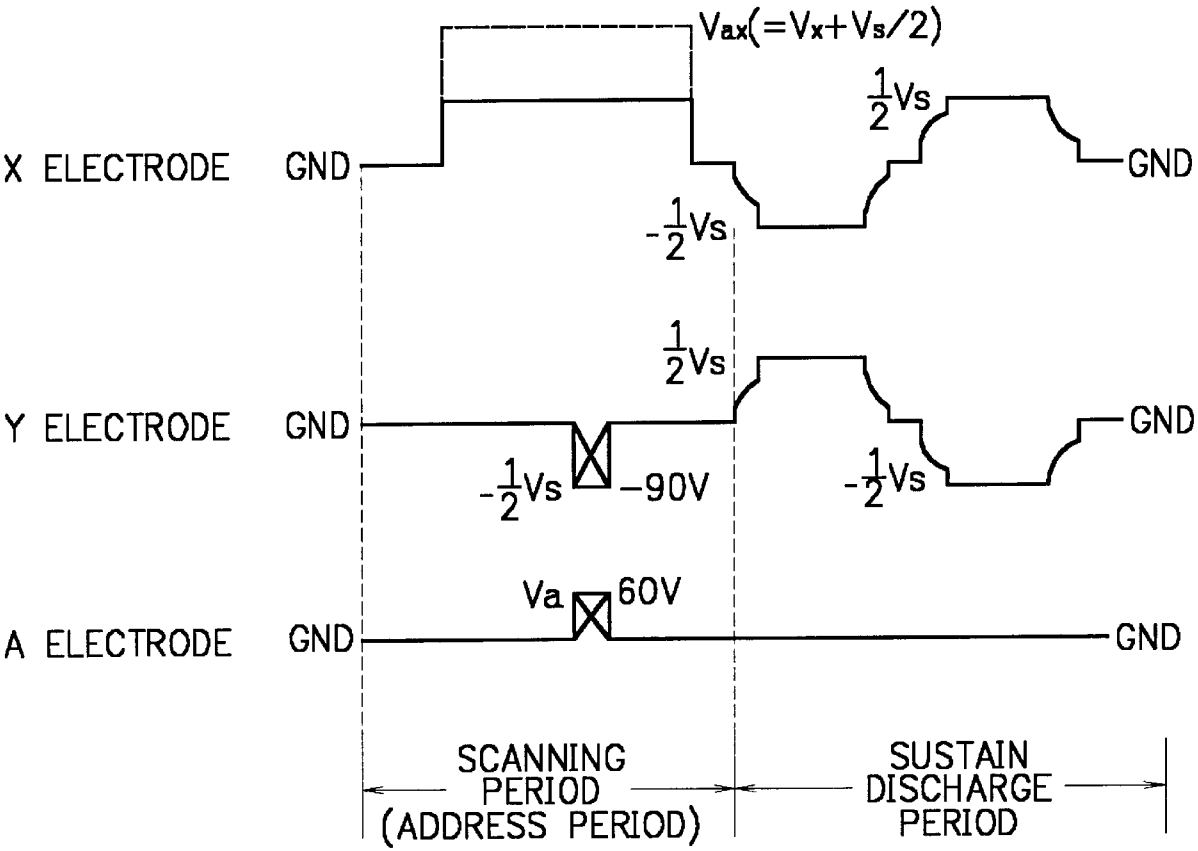
FIG. 61 is a timing chart showing an example of driving waveforms in a sustain discharge period by the driving apparatus constructed as in FIG. 58.

FIG. 60 is a circuit diagram showing another example of construction of a driving apparatus according to this sixth embodiment. In FIG. 60, the components having the same functions as those in FIG. 48 are denoted by the same references as those in FIG. 48, respectively. Thus the repetitive descriptions thereof will be omitted. FIG. 61 is a timing chart showing an example of control of each switch for generating driving waveforms to the scanning electrode Y in scanning and sustain discharge periods, in the driving apparatus shown in FIG. 60. FIGS. 60 and 61 are for comparing the present invention with the prior art shown in FIGS. 5 and 7.

In the scanning period, the switch SW2' on the scanning electrode Y side is turned ON to set the voltage of the third signal line OUTA' at the ground level. The voltage of the fourth signal line OUTB' is thereby set at (−Vs/2) with the charges of (C4×Vs/2) accumulated beforehand in the capacitor C4. By turning the transistors Tr22 and Tr23 ON, the voltage (Vs/2) is applied between both terminals of the scan driver 31', and the scan pulse of (−90 V) is applied to one scanning electrode Y like in FIG. 7.

On the common electrode X side, by turning beforehand the switch SW9 ON, the voltage of the second signal line OUTB is set at Vx (50 V), and the voltage of the first signal line OUTA is set at (Vx+Vs/2=140 V) with the charges of (C1×Vs/2) accumulated in the capacitor C1. By turning the switch SW4 ON, the potential difference between the common and scanning electrode X and Y in the scan pulse becomes (Vx+Vs/2) +Vs/2=230 V.

At this time, since the voltage difference (Vs/2) between the first and second signal lines OUTA and OUTB is applied to the FETs (switches SW4 and SW5) for treating the above discharge current, the breakdown voltage of each of the FETs is sufficed by Vs/2 or more. This shows that the potential difference 230 V between the electrodes X and Y in the scan pulse shown in FIG. 7 can be realized by the low-voltage circuit according to this embodiment.

Figure 7:
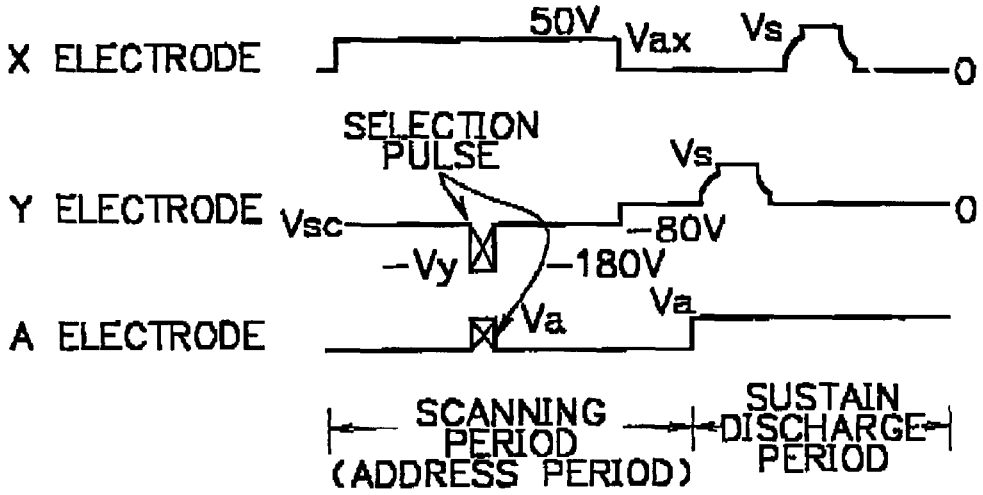
F I G. 7 PRIOR ART
FIG. 7 is a timing chart showing an example of driving waveforms in address and sustain discharge periods by the driving apparatus of FIG. 5.

Since the voltage Va of the address electrode A is 60 V and the scan pulse voltage of the scanning electrode Y is (−Vs/2=−90 V), the potential difference between the address and scanning electrodes A and Y in the address period is 150 V. This potential difference is less than the potential difference 240 V between the address and scanning electrodes A and Y shown in FIG. 7. In this relation, in the subsequent reset period, wall charges can easily be accumulated in the dielectric layer on the address electrode A. In the reset period, the wall charges of 240 V−150 V=90 V are accumulated. By the above manner, the same operation as that in FIG. 7 is performed.

The operation in sustain discharge period is the same as that shown in FIG. 49, and the potential difference.between the first and second signal lines OUTA and OUTB is always Vs/2. Since the switches SW4 and SW5, or SW4' and SW5' for exchanging the gas discharge current shown in FIG. 60 are disposed within the first and second signal lines OUTA and OUTB, or the third and fourth signal lines OUTA' and OUTB', the breakdown voltage of the FET making up each of the switches is sufficed by Vs/2 or more.

In this manner, since the breakdown voltage of each FET is held down to half the conventional value, the ON resistance of the FET can be considerably reduced. Consequently, the number of elements can be considerably reduced though the prior art requires a number of FETs provided in parallel for realizing a stable gas discharge. Besides, the unit cost of element itself can be reduced because of its low breakdown voltage. Further, the high-voltage power supply required for driving is sufficed by two kinds of Vs/2 (90 V) and Vx (50 V). This makes it possible to omit some power supplies. It should be noted that the cost of the additional circuit according to this embodiment is substantially the same as that of the A/S separation circuit used in the prior art shown in FIG. 5. Therefore, with the above-described construction, an inexpensive PDP can be realized.

Figure 62:
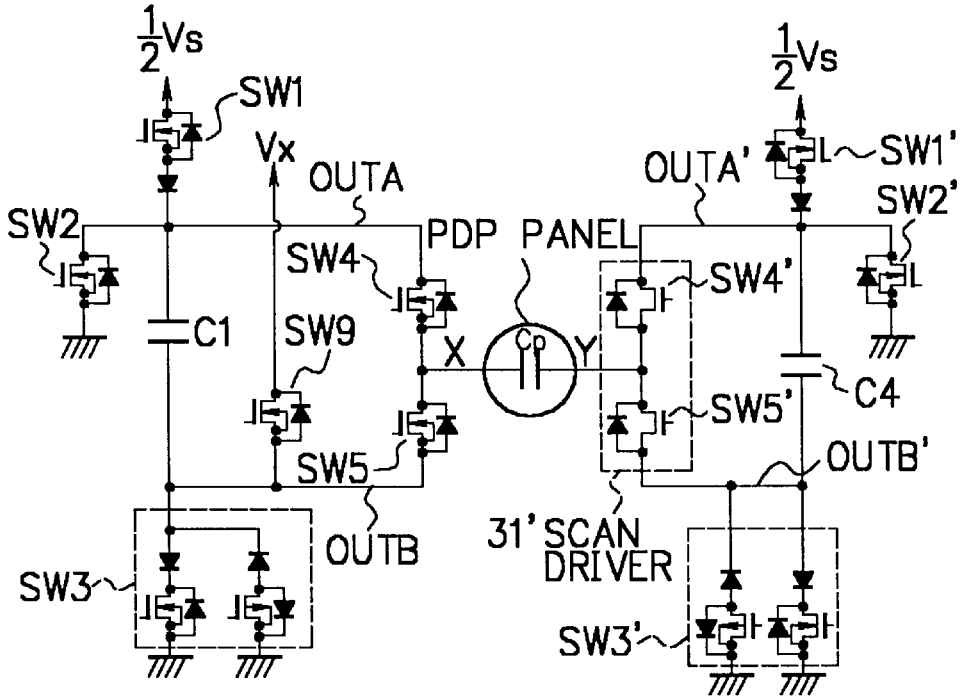
FIG. 62 is a circuit diagram showing another example of construction of a driving apparatus according to the sixth embodiment.

The above-described embodiment is provided with a power recovery circuit. Since the power in case of no power recovery circuit is proportional to $Cp \cdot V^2 \cdot f$, the power loss can be held down to half the conventional one. Therefore, such a power recovery circuit can be omitted. FIG. 62 shows a circuit with no power recovery circuit. The output waveforms in sustain discharge period are the same as those shown in FIG. 21. the output waveforms in line-sequential scanning period are the same as those shown in FIG. 61.

When the power recovery circuit is provided, a circuit (the switches SW4' and SW5' shown in FIG. 60) is required for clamping to the power supply after outputting the L-C resonance voltage, as shown in FIG. 60. But, since the power recovery circuit can be omitted, charging and discharging currents and a gas discharge current can be made to flow to the load capacitance Cp through the FETs of the scan driver comprising only the switches SW4' and SW5' shown in FIG. 62. In sustain discharge period, the switch SW4' is turned ON when the voltage of the third signal line OUTA' is applied to the scanning electrode Y, and the switch SW5' is turned ON when the voltage of the fourth signal line OUTB' is applied to the scanning electrode Y.

As for the operation on the scanning electrode Y side in line-sequential scanning period, by turning the switch SW2' ON, the voltages of the third and fourth signal lines OUTA' and OUTB' are set at the ground level and (−Vs/2), respectively. The voltages of both terminals of the scan driver are thereby set at the ground level and (−Vs/2), respectively. In scanning, the scan pulse voltage (−Vs/2) is output to the scanning electrode Y.

As described above, by omitting the power recovery circuit, in addition to the above-described effects according to the construction shown in FIG. 60, the number of circuits can be reduced more. This makes it possible to realize a PDP at a more reduced cost.

Seventh Embodiment

Next, the seventh embodiment of the present invention will be described.

In this seventh embodiment, a circuit for applying a voltage for the address period, the reset period, or scan from each independent power supply through switching elements, is further provided for the circuit shown in each of the above first to sixth embodiments.

Figure 63:
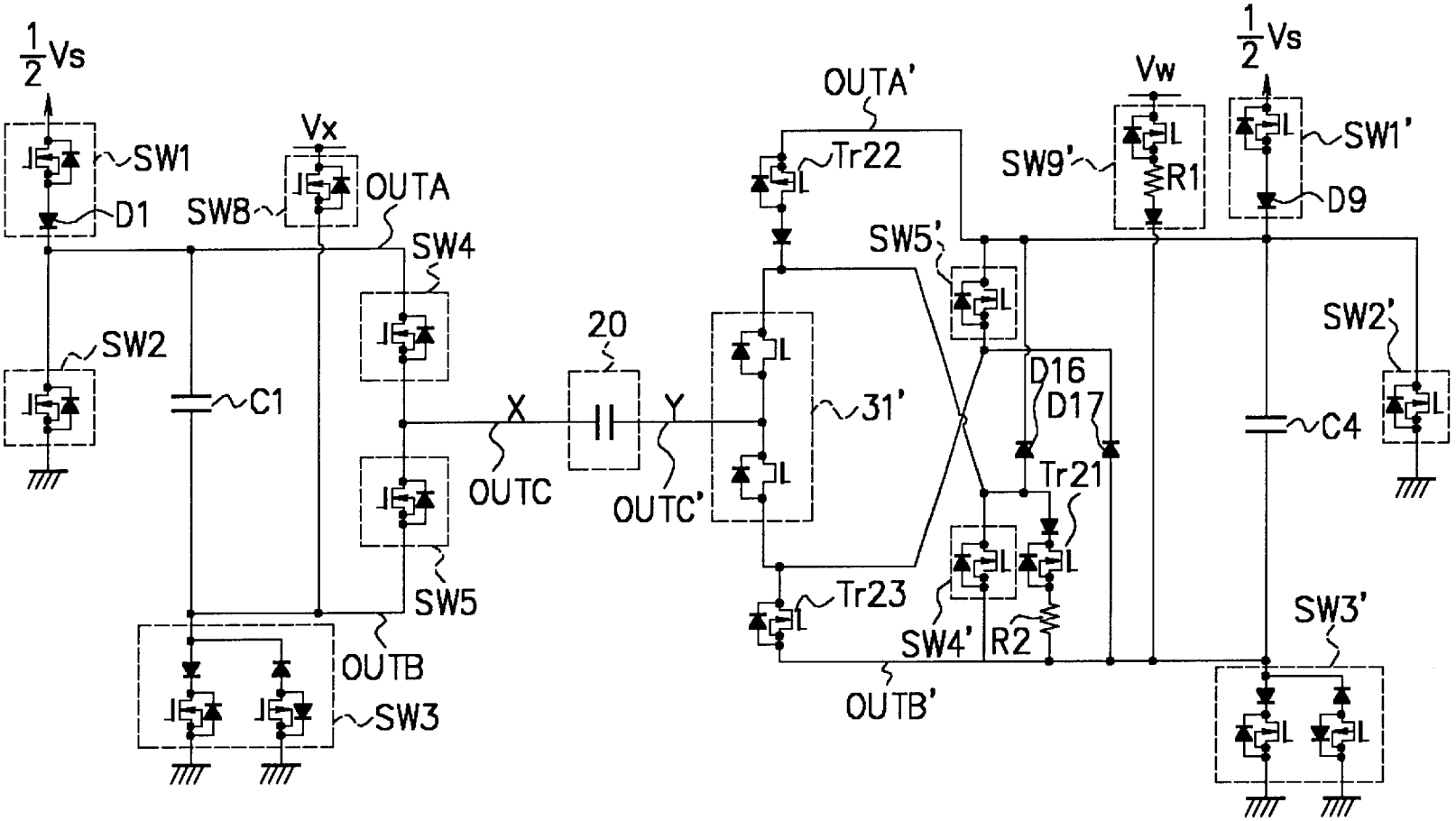
FIG. 63 is a circuit diagram showing an example of construction of a driving apparatus according to the seventh embodiment of the present invention.

FIG. 63 is a circuit diagram showing a specific example of construction of a driving apparatus according to this seventh embodiment. FIG. 63 shows a construction for driving associated with not only a sustain discharge period but also reset and address periods. In FIG. 63, the components having the same functions as those in FIG. 12 or 42, etc., are denoted by the same references as those in FIG. 12 or 42, etc., respectively. Thus the repetitive descriptions thereof will be omitted.

Referring to FIG. 63, on the common electrode X side, a switch SW8 is provided between the power supply line for generating a voltage Vx, and the second signal line OUTB. On the scanning electrode Y side, a switch SW9' is provided between the power supply line for generating the voltage Vw, and the fourth signal line OUTB'.

Figure 64:
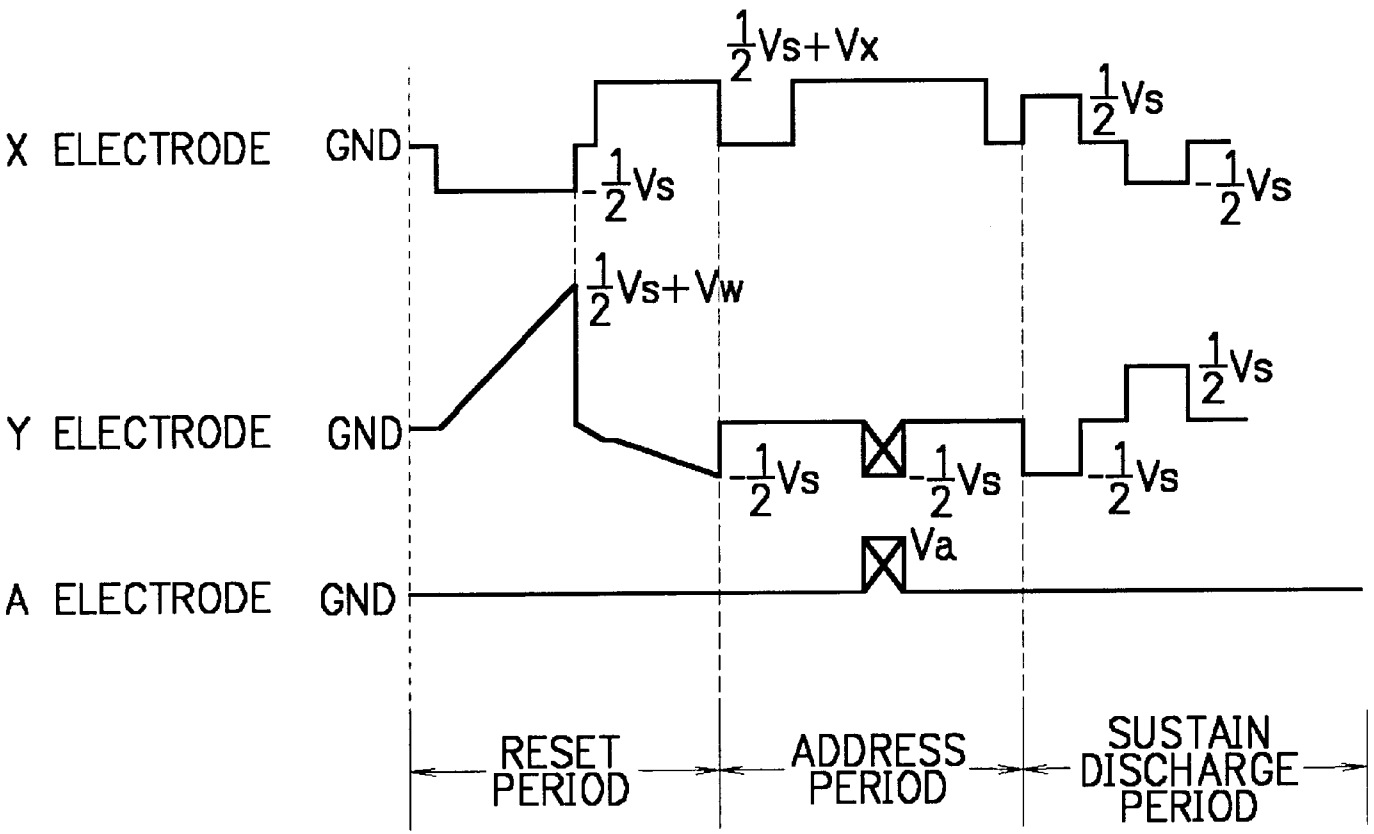
FIG. 64 is a timing chart showing an example of driving waveforms by the driving apparatus constructed as in FIG. 63.

FIG. 64 is a timing chart showing driving waveforms of the PDP by the driving apparatus constructed as shown in FIG. 63. FIG. 64 shows one of the subfields making up one frame. The waveforms shown in FIG. 64 is almost the same as the waveforms shown in FIG. 45 except the magnitude of the positive voltage applied to the common electrode X in the reset and address periods.

In the example of FIG. 64, to apply the positive voltage to the common electrode X in the reset period, the switches SW1, SW3, SW4, and SW8 are turned ON, and the switch SW2 is kept OFF. The voltage of the output line OUTC is thereby raised to the voltage level corresponding to the sum of the voltage (Vs/2) applied to the first signal line OUTA through the switch SW1, and the voltage Vx applied to the second signal line OUTB through the switch SW8. The voltage (Vs/2+Vx) is applied to the common electrode X of the load 20.

This is the same in case of applying the voltage (Vs/2+Vx) to the common electrode X in the address period.

Figure 65:
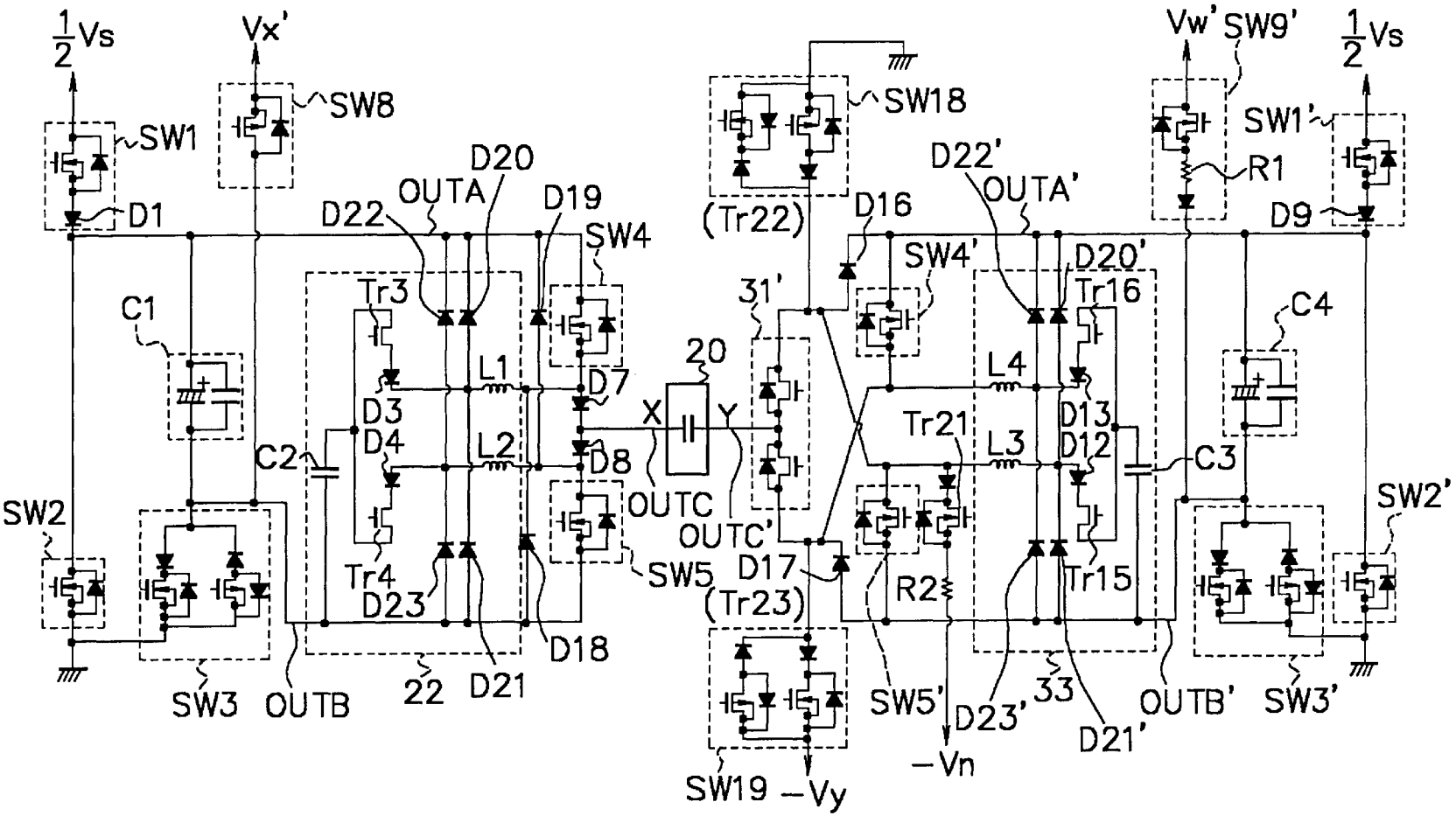
FIG. 65 is a circuit diagram showing another example of construction of a driving apparatus according to the seventh embodiment.

FIG. 65 is a circuit diagram showing another example of construction of a driving apparatus according to this seventh embodiment. In FIG. 65, the components having the same functions as those in FIG. 63 or 51, etc., are denoted by the same references as those in FIG. 63 or 51, etc., respectively. Thus the repetitive descriptions thereof will be omitted.

Referring to FIG. 65, on the common electrode X side, the same switch SW8 as that shown in FIG. 63 is connected. But, the voltage of the power supply line connected to the switch SW8 in FIG. 65 is Vx' which is higher than the voltage Vx shown in FIG. 63. This power supply voltage Vx' is equal to, e.g. the voltage (Vs/2+Vx) applied to the load 20 in reset period.

On the scanning electrode Y side, a switch SW18 is connected between the third signal line OUTA' and the ground. A switch SW19 is connected between the fourth signal line OUTB' and the power supply line for generating the voltage (−Vy). These switches SW18 and SW19 also serve as transistors Tr22 and Tr23, respectively. A transistor Tr21 is connected through a resistor R2 to the power supply line of a voltage (−Vn).

According to this example of construction shown in FIG. 65, by switching control of the above switches SW8, SW9', SW18, and SW19 in addition to the switches SW1 to SW5 and SW1' to SW5' at proper timings, minute voltage adjustments in relation to various pulses necessary in reset and address periods, can be performed using elements with lower breakdown voltages than those of the prior art, thereby obtaining a more sure display performance. This will be described with reference to a timing chart shown in FIG. 66.

Figure 66:
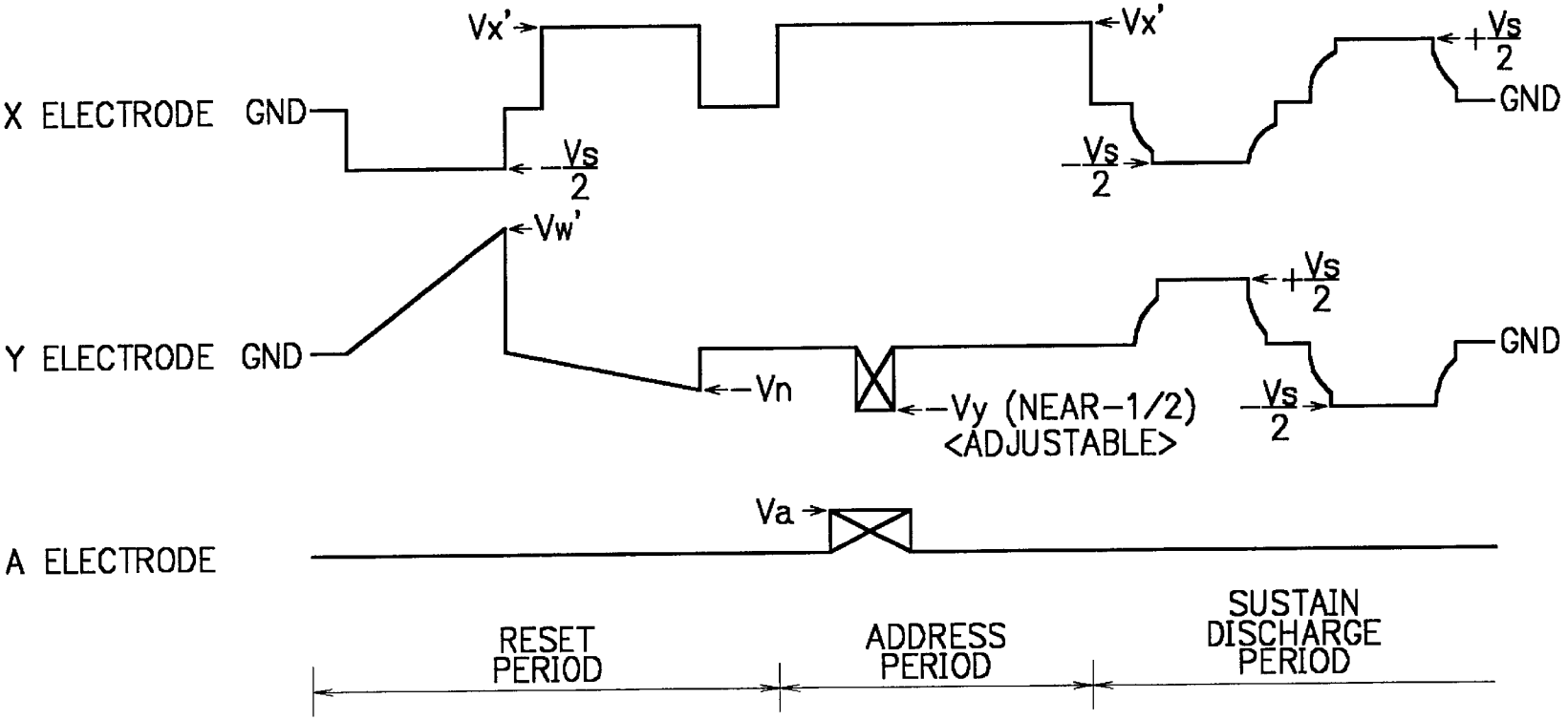
FIG. 66 is a timing chart showing an example of driving waveforms by the driving apparatus constructed as in FIG. 65.

FIG. 66 is a timing chart showing driving waveforms of the PDP by the driving apparatus constructed as shown in FIG. 65. FIG. 66 shows one of the subfields making up one frame. The waveforms shown in FIG. 66 is almost the same as the waveforms shown in FIG. 64 except the voltage value applied in reset period, the pulse waveforms in sustain discharge period, and the voltage value of the scan pulse. The difference in pulse waveforms in sustain discharge period is due to presence/absence of power recovery circuit. The detail thereof was already described, so the repetitive description will be omitted.

In reset period, firstly, the voltage (−Vs/2) is applied to the common electrode X side of the load 20, and the voltage Vw' (=Vs/2+Vw) is gradually applied to the scanning electrode Y side. The potential difference between the common and scanning electrodes X and Y thereby becomes (Vs+Vw). Thus the potential difference equal to the full write pulse in the reset period can be applied between the common and scanning electrodes X and Y. To this, the operation is the same as that in FIG. 64.

After this, on the scanning electrode Y side, the switches SW1', SW3', SW4', SW5', and SW9' are set OFF, and the switch SW2' and the transistor Tr21 are set ON.

On the common electrode X side, the switches SW5 and SW4 are respectively turned OFF and ON so that the voltage of the common electrode X becomes the ground level. At this time, the switch SW 2 is ON. After this, on the common electrode X side, the switch SW2 is turned OFF, and the switches SW5 and SW8 are turned ON, so that the voltage being applied to the common electrode X is raised from the ground level to Vx' (=Vs/2+Vx). On the scanning electrode Y side, by turning the transistor Tr21 ON as described above, the voltage being applied to the scanning electrode Y is gradually lowered to (−Vn). The absolute value of the voltage (−Vn) is slightly less than, e.g., the absolute value of (−Vs/2). The quantity of wall charges to be left in a cell due to a weak discharge by applying an obtuse wave can be controlled with this voltage value. After this, the common and scanning electrodes X and Y are set at the ground level by proper switching control. By provision of the switch SW19 capable of independently setting the voltage of the scan pulse in address period with the (−Vy) power supply, more sure display performance can be obtained.

Eighth Embodiment

Next, the eighth embodiment of the present invention will be described.

In this eighth embodiment, driver circuits corresponding to the driver circuit on one side according to any of the above-described first to seventh embodiments, for applying voltages to loads 20, are provided in the form of an LSI such as a scan driver circuit.

Figure 67:
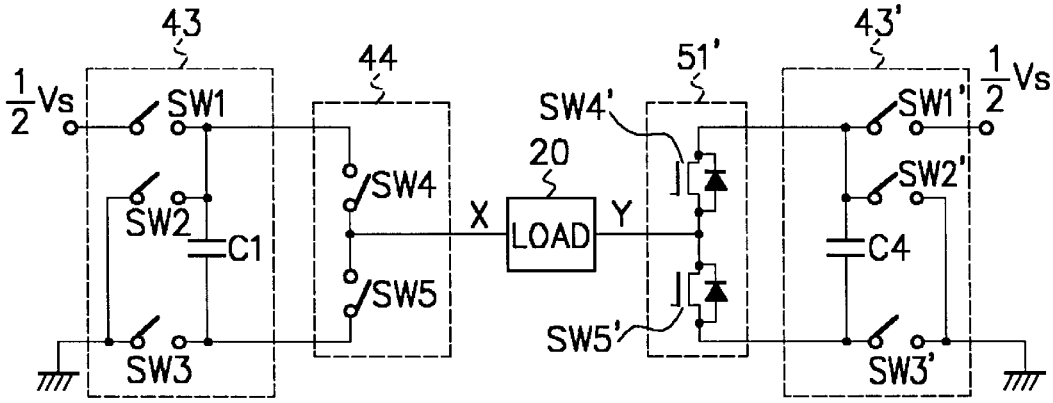
FIG. 67 is a circuit diagram showing an example of construction of a driving apparatus according to the eighth embodiment of the present invention.

FIG. 67 is a circuit diagram showing a specific example of construction of a driving apparatus according to this eighth embodiment. In FIG. 67, the components having the same functions as those in FIG. 9, are denoted by the same references as those in FIG. 9, respectively. Thus the repetitive descriptions thereof will be omitted.

Referring to FIG. 67, the driver circuit 51' on the scanning electrode Y side is made as part of an LSI such as a scan driver circuit. That is, such a driver circuit 51' is provided for every display line of the PDP. Namely, there are provided the same numbers of switches SW4' and SW5' as the number of display lines.

Contrastingly, the driver circuit 44 on the common electrode X side is provided in common for all display lines of the PDP, like the power supply circuit 43.

In this construction, at least on the scanning electrode Y side, by switching control of the switches SW4' and SW5' provided for each display line, in the sustain discharge period, the voltage to be applied to the display line can be controlled individually. Besides, the transistors Tr22 and Tr23 in the above-described embodiments, which are the switching elements for applying the voltage (−Vs/2) in the address period, can be omitted.

Figure 68:
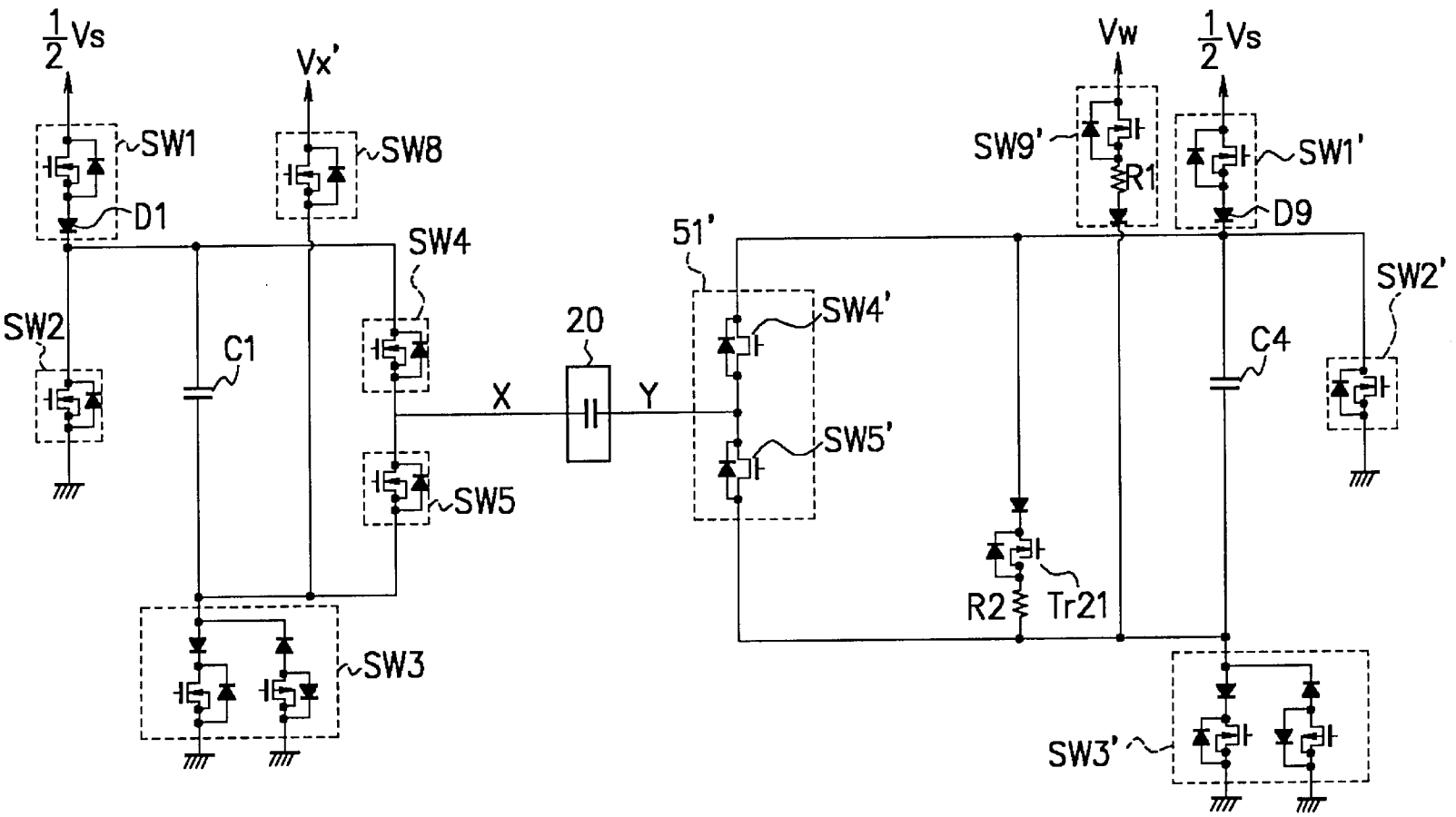
FIG. 68 is a circuit diagram showing another example of construction of a driving apparatus according to the eighth embodiment.

FIG. 68 is a circuit diagram showing another example of construction of a driving apparatus according to this eighth embodiment. In FIG. 68, the components having the same functions as those in FIG. 67, are denoted by the same references as those in FIG. 67, respectively. Thus the repetitive descriptions thereof will be omitted.

In the construction shown in FIG. 68, the driver circuit 51' on the scanning electrode Y side is made as part of an LSI such as a scan driver circuits. Besides, the switch SW8 connected to the power supply line of the voltage Vx' and the switch SW9' connected to the power supply line of the voltage Vw are provided on the common electrode X side and the scanning electrode Y side, respectively. On the scanning electrode Y side, the transistors Tr22 and Tr23 are omitted.

Figure 69:
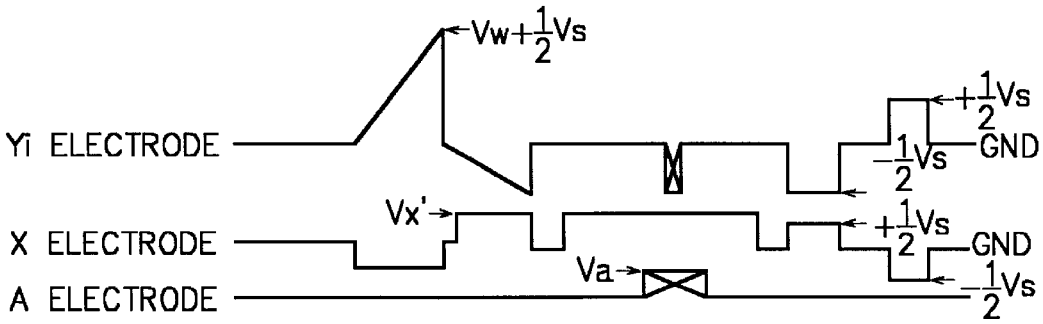
FIG. 69 is a timing chart showing an example of driving waveforms by the driving apparatus constructed as in FIG. 68.

FIG. 69 is a timing chart showing driving waveforms of the PDP by the driving apparatus constructed as shown in FIG. 68. FIG. 69 shows one of the subfields making up one frame. The waveforms shown in FIG. 69 is almost the same as the waveforms shown in FIG. 64. These waveforms are generated by controlling ON/OFF of the switches SW1 to SW5, SW8, SW1' to SW3', and SW9', which are provided in common for all display lines, and the switches SW4' and SW5' in the scan driver 51' for a display line i, at proper timings.

In either of the constructions shown in FIGS. 67 and 68, the area for mounting circuit parts can be considerably reduced. This makes it possible to realize a small device and a reduced cost in manufacturing.

In the examples of FIGS. 67 and 68, both the switches SW4' and SW5' are disposed at such positions as shown in the first embodiment, i.e., within the driver circuit. Alternatively, the switch SW4' can be disposed at such a position as shown in the second embodiment, i.e., within the power supply circuit. Or, the switch SW5' can be disposed at such a position as shown in the third embodiment, i.e., within the power supply circuit. The switch SW5' in the second embodiment or the switch SW4' in the third embodiment can be constructed by an LSI such as a scan driver circuit.

In this case, even in the driver circuit with an LSI structure by a scan driver, the switch necessary for each display line may be either the switch SW4' or SW5'. Thus the total number of switches can be considerably decreased, thereby reducing the circuit scale and cost.

Ninth Embodiment

Next, the ninth embodiment of the present invention will be described. In this ninth embodiment, the driver circuit on either side for applying voltages to a load 20, i.e., either of the driver circuits on the common electrode X side and the scanning electrode Y side is made as part of an LSI such as a scan driver circuit.

Figure 70:
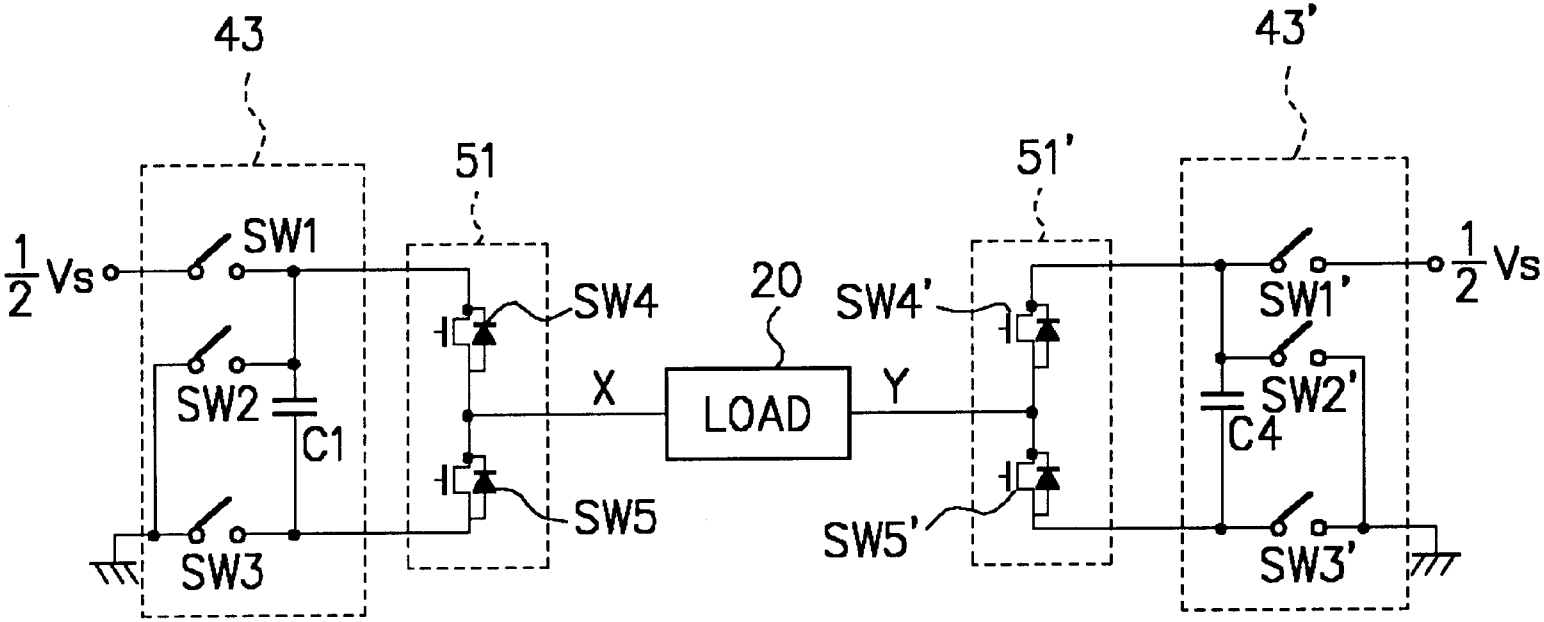
FIG. 70 is a circuit diagram showing an example of construction of a driving apparatus according to the ninth embodiment of the present invention.

FIG. 70 is a circuit diagram showing a specific example of construction of a driving apparatus according to this ninth embodiment. In FIG. 70, the components having the same functions as those in FIG. 9 or 67, are denoted by the same references as those in FIG. 9 or 67, respectively. Thus the repetitive descriptions thereof will be omitted.

Referring to FIG. 70, the driver circuit 51 on the common electrode X side is made as part of an LSI such as a scan driver circuit. That is, unlike the power supply circuit 43, which is a common circuit for all display lines provided in the PDP, such a driver circuit 51 is provided for every display line. Namely, there are provided the same numbers of switches SW4 and SW5 as the number of display lines.

Also the driver circuit 51' on the scanning electrode Y side is made as part of an LSI such as a scan driver circuit. That is, unlike the power supply circuit 43', which is a common circuit for all display lines provided in the PDP, such a driver circuit 51' is provided for every display line. Namely, there are provided the same numbers of switches SW4' and SW5' as the number of display lines.

In this construction, in both of the common electrode X side and the scanning electrode Y side, by switching control of the switches SW4, SW5, SW4', and SW5' provided for each display line, in the sustain discharge period, the voltage to be applied to the display line can be controlled individually. Besides, on the scanning electrode Y side, the transistors Tr22 and Tr23 in the above-described embodiments, which are the switching elements for applying the voltage (−Vs/2) in the address period, can be omitted.

Figure 71:
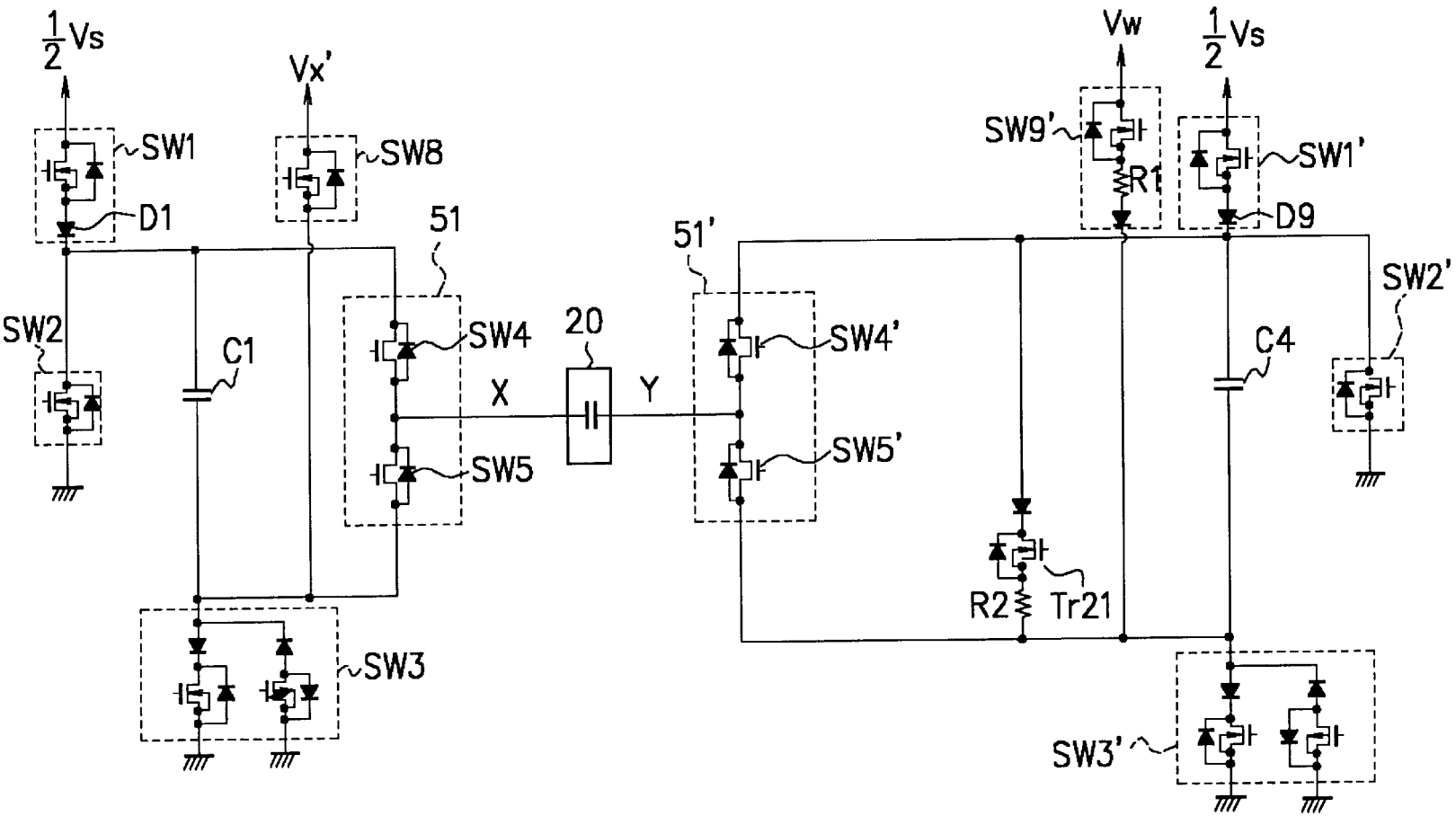
FIG. 71 is a circuit diagram showing another example of construction of a driving apparatus according to the ninth embodiment.

FIG. 71 is a circuit diagram showing another example of construction of a driving apparatus according to this ninth embodiment. In FIG. 71, the components having the same functions as those in FIG. 70 or 63, are denoted by the same references as those in FIG. 70 or 63, respectively. Thus the repetitive descriptions thereof will be omitted.

In the construction shown in FIG. 71, the driver circuits 51 and 51' on the common electrode X side and the scanning electrode Y side are respectively made as parts of LSIs such as scan driver circuits. Besides, the switch SW8 connected to the power supply line of the voltage Vx' and the switch SW9' connected to the power supply line of the voltage Vw are provided on the common electrode X side and the scanning electrode Y side, respectively. On the scanning electrode Y side, the transistors Tr22 and Tr23 are omitted.

Figure 72:
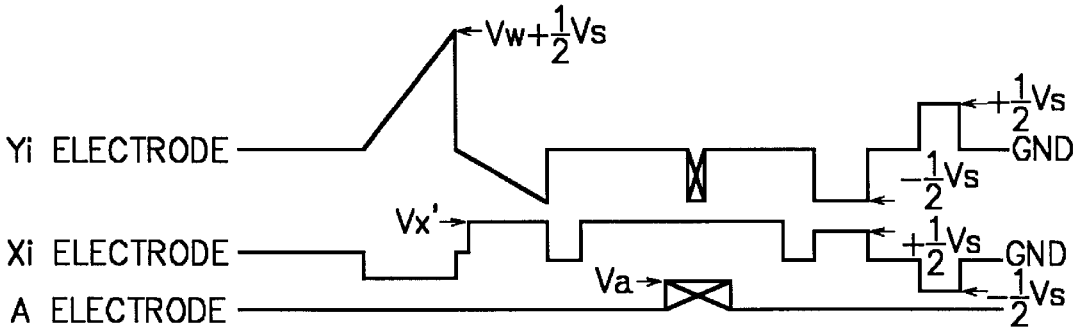
FIG. 72 is a timing chart showing an example of driving waveforms by the driving apparatus constructed as in FIG. 71.

FIG. 72 is a timing chart showing driving waveforms of the PDP by the driving apparatus constructed as shown in FIG. 71. FIG. 72 shows one of the subfields making up one frame. The waveforms shown in FIG. 72 is almost the same as the waveforms shown in FIG. 69. These waveforms are generated by controlling ON/OFF of the switches SW1 to SW3, SW8, SW1' to SW3', and SW9', which are provided in common for all display lines, and the switches SW4, SW5, SW4', and SW5' in the scan drivers 51 and 51' for a display line i, at proper timings.

In either of the constructions shown in FIGS. 70 and 71, the heat which is otherwise generated in a concentrative manner due to the power consumption in the common circuit part, can be dispersed, thereby realizing a stable circuit operation. Besides, the degree of freedom of control in relation to each display line can be improved.

In either of FIGS. 70 and 71, all the switches SW4, SW5, SW4', and SW5' are disposed at such positions as shown in the first embodiment, i.e., within the driver circuits. Alternatively, the switches SW4 and SW4' can be disposed at such positions as shown in the second embodiment, i.e., within the power supply circuits. Or, the switches SW5 and SW5' can be disposed at such positions as shown in the third embodiment, i.e., within the power supply circuits.

In this case, even in the driver circuits with LSI structures by scan drivers, on either the common electrode X side or the scanning electrode Y side, the switch necessary for each display line may be any one of the switches SW4 or SW4' and SW5 or SW5'. Thus the total number of switches can be considerably decreased, thereby reducing the circuit scale and cost.

Tenth Embodiment

Next, the tenth embodiment of the present invention will be described.

In the above-described embodiments, either of the power supply voltages on the common electrode X side and the scanning electrode Y side is (+Vs/2), and the voltages in opposite phases are applied to the electrodes X and Y to apply the difference voltage Vs between both terminals of the load 20. That is, when the power supply voltages on the common electrode X side and the scanning electrode Y side are respectively represented by V1 and V2, V1=V2. Contrastingly in this tenth embodiment, voltages of V1<V2 or V1>V2 are used as the power supply voltages on the common electrode X side and the scanning electrode Y side.

Figure 73:
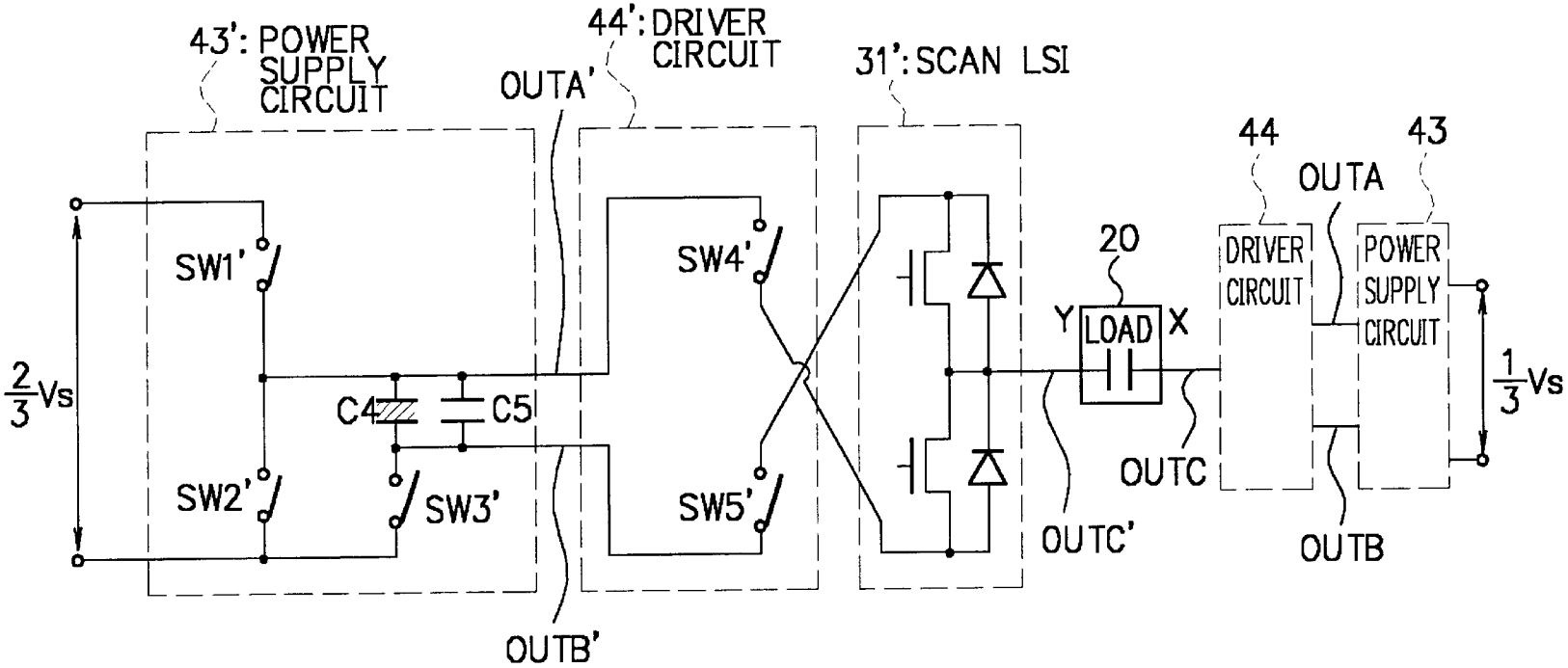
FIG. 73 is a circuit diagram showing an example of construction of a driving apparatus according to the tenth embodiment of the present invention.

FIG. 73 is a circuit diagram showing a specific example of construction of a driving apparatus according to this tenth embodiment. In FIG. 73, the components having the same functions as those in FIG. 30, are denoted by the same references as those in FIG. 30, respectively. Thus the repetitive descriptions thereof will be omitted.

The example of FIG. 73 differs from the example of FIG. 30 on the following point. In the first embodiment, the voltage (Vs/2) is applied to either of the power supply circuits 43 and 43' on the common electrode X side and the scanning electrode Y side (V1=V2=Vs/2). Contrastingly in this tenth embodiment, voltages (Vs/3) and (2Vs/3) are respectively applied to the power supply circuits 43 and 43' on the common electrode X side and the scanning electrode Y side (V1=Vs/3 and V2=2Vs/3). The other features are the same as those of the first embodiment.

According to this tenth embodiment with such a construction, the absolute value of the voltage being applied to the power supply circuit 43 and the driver circuit 44 on the common electrode X side is Vs/3 at most. Thus the breakdown voltage of each element provided in those circuits can be set at Vs/3, so the breakdown voltage can be held down to ⅓ the conventional value.

Besides, the absolute value of the voltage being applied to the power supply circuit 43' and the driver circuit 44' on the scanning electrode Y side is 2Vs/3 at most. Thus the breakdown voltage of each element provided in those circuits can be set at 2Vs/3, so the breakdown voltage can be held down to ⅔ the conventional value. This makes it possible to use inexpensive small elements and so realize simplification in circuit construction and reduction of manufacturing cost.

For example, in case that the driver circuit on the common electrode X side is provided in common for all display lines of the PDP, and driver circuits on the scanning electrode Y side are provided as an LSI for the respective display lines of the PDP, the heat attendant upon power consumption on the scanning electrode Y side is dispersed to each display line, but the heat on the common electrode X side concentrates in one place, where a great deal of heat is generated. Thus, By applying the voltages to the common and scanning electrodes X and Y in relation of V1<V2, the problem that the heat on the common electrode X side concentrates can be relieved.

Besides, as described before, the power loss when charging or discharging the load 20 is expressed by $2Cp \cdot V^2 \cdot f$, i.e., proportional to the square of the magnitude of the applied voltage. Thus, in one of the common electrode X side and the scanning electrode Y side to which the lower voltage V is applied, the power loss can be fully held down, so no power recovery circuit may be provided. For this reason, it is also possible to provide a power recovery circuit on only one of the common electrode X side and the scanning electrode Y side.

Besides, by making the voltages on the common electrode X side and the scanning electrode Y side differ, either of the voltages on the common electrode X side and the scanning electrode Y side in reset period can be controlled properly.

Figure 74:
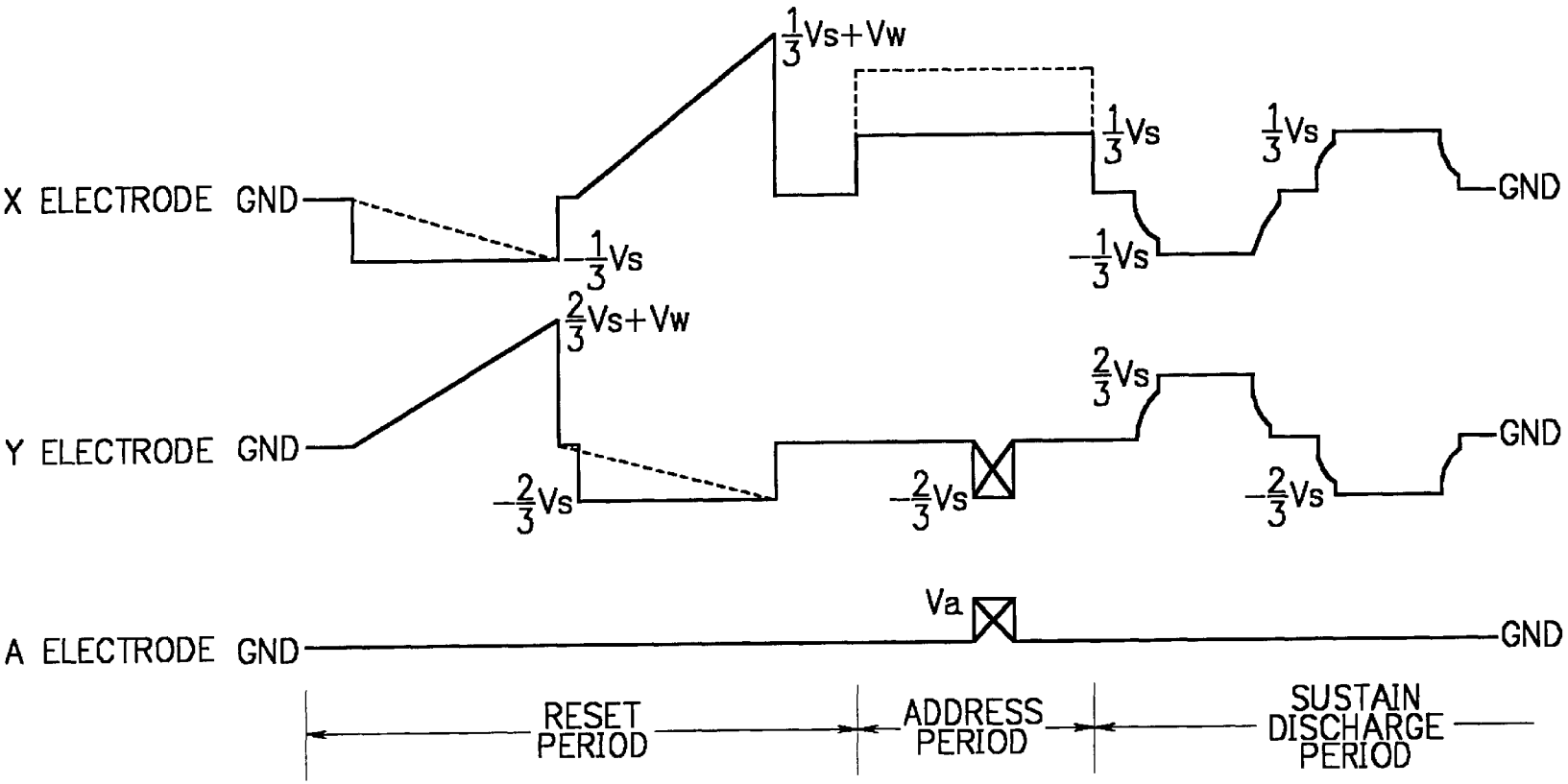
FIG. 74 is a timing chart showing an example of driving waveforms by the driving apparatus constructed as in FIG. 73.

FIG. 74 is a timing chart showing driving waveforms of the PDP by the driving apparatus constructed as shown in FIG. 73. FIG. 74 shows one of the subfields making up one frame. FIG. 74 also shows a state that the voltage Vw is applied by making control of a switch (not shown in FIG. 73), which is exclusively used for the voltage. The basic forms of the driving waveforms shown in FIG. 74 are the same as those in FIG. 49, which were already described, but the amplitudes are different.

According to the timing chart of FIG. 74, the breakdown voltages of the elements provided in the power supply circuit 43 and the driver circuit 44 on the common electrode X side can respectively be Vs/3+Vw and Vs/3, so the breakdown voltage can be held down in comparison with the conventional value. Besides, the breakdown voltages of the elements provided in the power supply circuit 43' and the driver circuit 44' on the scanning electrode Y side can respectively be 2Vs/3+Vw and 2Vs/3, so the breakdown voltage can be held down in comparison with the conventional value also on this side.

Figure 75:
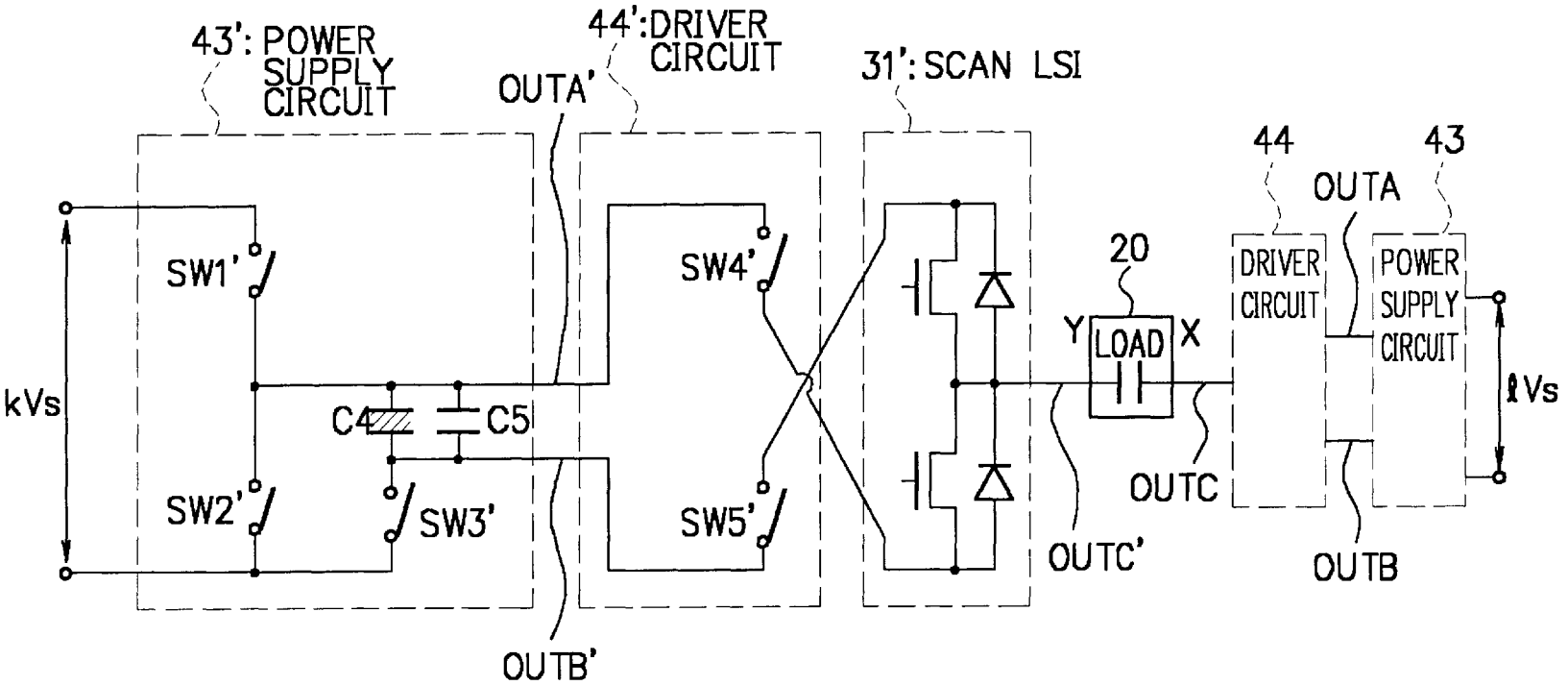
FIG. 75 is a circuit diagram showing another example of construction of a driving apparatus according to the tenth embodiment.

FIG. 75 is a circuit diagram showing another example of construction of a driving apparatus according to this tenth embodiment. In FIG. 75, the components having the same functions as those in FIG. 73, are denoted by the same references as those in FIG. 73, respectively. Thus the repetitive descriptions thereof will be omitted.

In this example of FIG. 75, the voltages V2 and V1 to be applied to the power supply circuits 43' and 43 on the scanning electrode Y side and the common electrode X side are kVs and lVs, respectively (V1+V2=nVs). The other features are quite the same as those in FIG. 73. For example, when it is wanted to apply a high voltage between the common and scanning electrodes X and Y in order to improve the luminescence efficiency of a gas discharge, it is also possible that V1=V2=Vs (V1+V2=2Vs). In this case, with each element in the driving apparatus having the same breakdown voltage as the conventional one, a higher difference voltage can be applied between the common and scanning electrodes X and Y.

In PDP, the voltage Vs to be applied between the common and scanning electrodes X and Y in sustain discharge period, is 150 to 190 V in general. This voltage is determined by the kind of gas charged within the PDP, the material of electrodes, the gap between the common and scanning electrodes X and Y, etc. The display luminance of PDP is determined by how many times the voltage Vs is applied between the common and scanning electrodes X and Y in sustain discharge period to make a gas discharge occur. The power required for a gas discharge in applying the voltage Vs each time is determined by the kind of gas, the material of electrodes, the gap between the electrodes, etc., as described above. The ratio of the luminance to a unit of power is called luminescence efficiency.

In PDP, there is a request to obtain a high luminance with a little power. If the kind of gas, the material of electrodes, the gap between the electrodes, etc., are selected in order to meet the request, i.e., for increasing the luminescence efficiency, the voltage Vs becomes high. As a result, the breakdown voltage of the circuit becomes high, resulting in a high cost. Contrastingly, according to this embodiment, without raising the breakdown voltage, the high voltage can be applied with the same breakdown voltage as the conventional one, and the luminescence efficiency can be increased.

Eleventh Embodiment

Next, the eleventh embodiment of the present invention will be described. This eleventh embodiment is to give specific examples of the above tenth embodiment, in which V1=0 and V2=Vs, or V1=Vs and V2=0, and the driving waveforms in the sustain discharge period are applied through one of the common and scanning electrodes X and Y.

Figure 76:
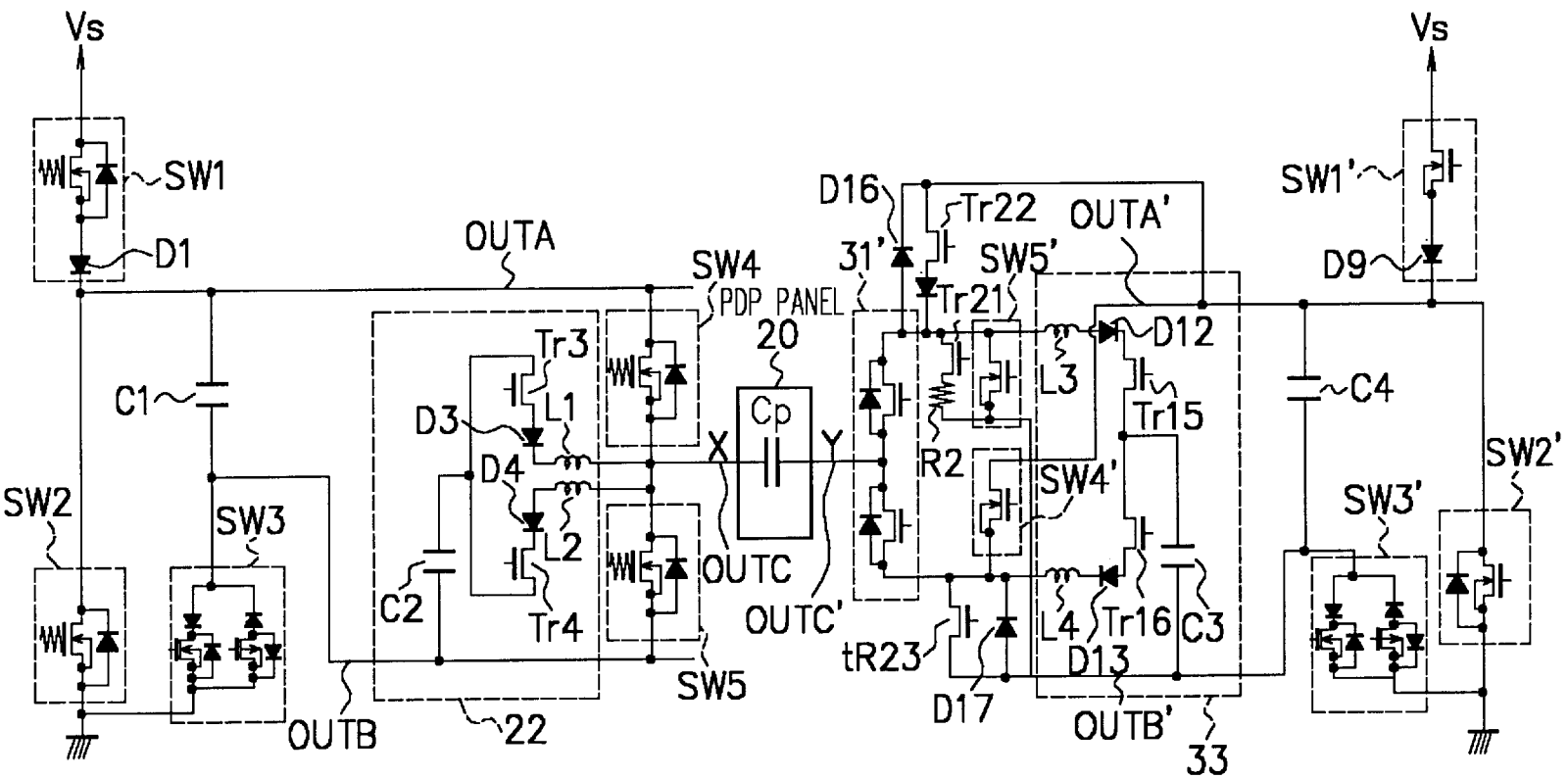
FIG. 76 is a circuit diagram showing an example of construction of a driving apparatus according to the eleventh embodiment of the present invention.

FIG. 76 is a circuit diagram showing a specific example of construction of a driving apparatus according to this eleventh embodiment. In FIG. 76, the components having the same functions as those in FIG. 48, are denoted by the same references as those in FIG. 48, respectively. Thus the repetitive descriptions thereof will be omitted. The example of FIG. 76 differs from the example of FIG. 48 only in the feature that the power supply voltage to which the switches SW1 and SW1' are connected, is Vs in FIG. 76 though it is Vs/2 in FIG. 48.

Figure 77:
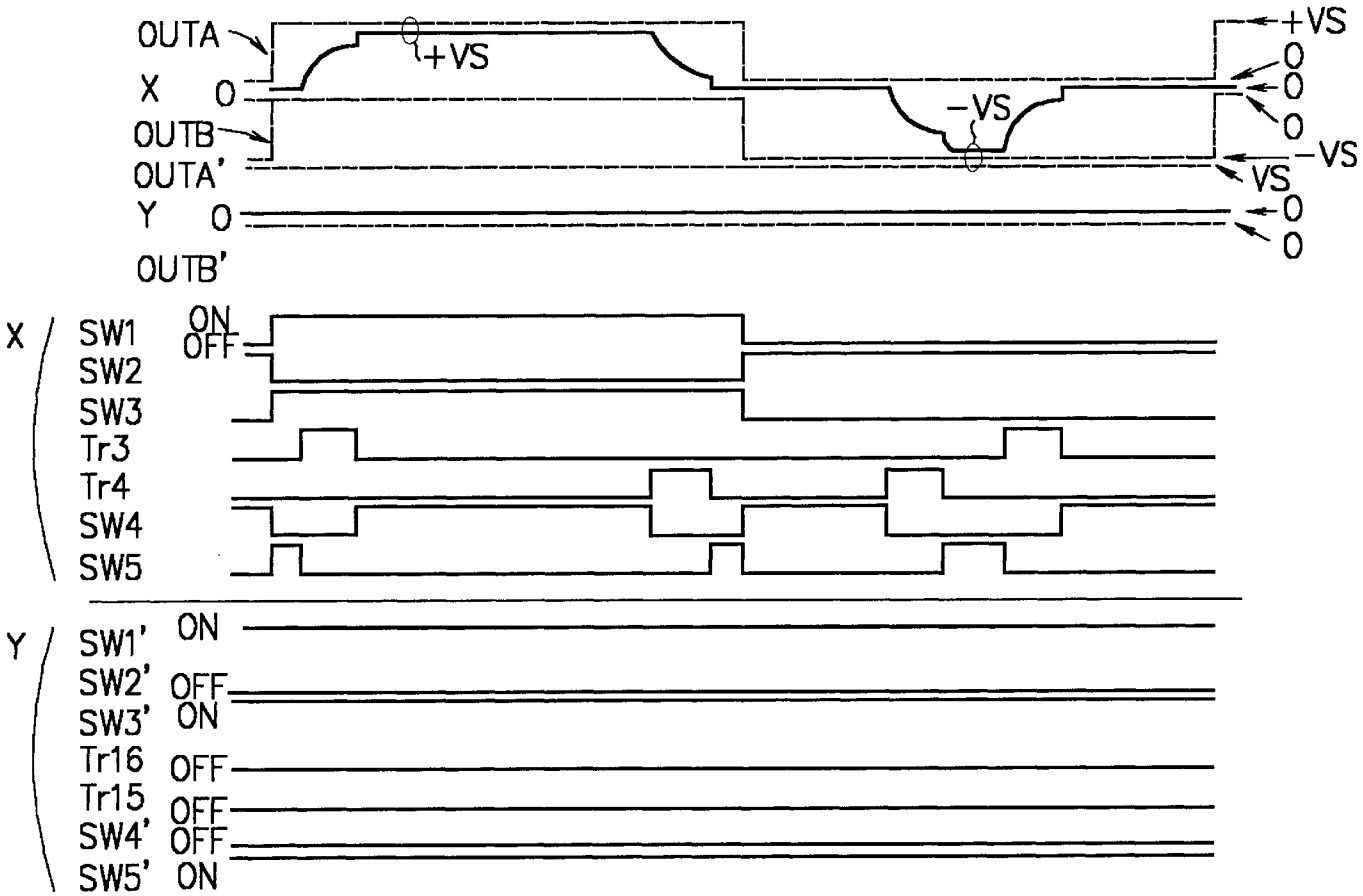
FIG. 77 is a timing chart showing an example of driving waveforms in a sustain discharge period by the driving apparatus constructed as in FIG. 76.

FIG. 77 is a timing chart showing an example of driving waveforms in a sustain discharge period by the driving apparatus shown in FIG. 76. In this example of FIG. 77, the driving waveforms on the common electrode X side is the same as those shown in FIG. 50 except the feature that the level of the voltage to be swung is Vs. Thus the repetitive description will be omitted.

On the scanning electrode Y side, the switches SW1', SW3', and SW5' are kept ON, and the switches SW2' and SW4' and the transistors Tr15 and Tr16 in the power recovery circuit 33 are kept OFF all during the execution of the series of switching operations on the common electrode X side. The voltage being applied to the scanning electrode Y is thereby always kept at zero (the ground level) through the switch SW3'. Alternatively, the reverse manner can also be employed in which the switches SW2' and SW4' are kept ON and the switches SW1', SW3', and SW5' are kept OFF to keep the voltage being applied to the scanning electrode Y at zero.

In this manner, when the voltage on the scanning electrode Y side is fixed to the ground level, and Vs is used as a power supply voltage for the common electrode X side, the power loss on the common electrode X side becomes great in comparison with the above-described embodiments in which (Vs/2) is used as the power supply voltage. Thus, at least on the common electrode X side, such a power recovery circuit 22 is preferably provided.

As described above, by fixing the voltage of one electrode (scanning electrode Y) when the voltage of the other electrode (common electrode X-) is changed, a more stable circuit operation and more stable sustain discharges can be realized. Besides, the positive and negative voltages (±Vs) can be applied from the scanning electrode Y side in the periods other than sustain discharge period.

Figure 78:
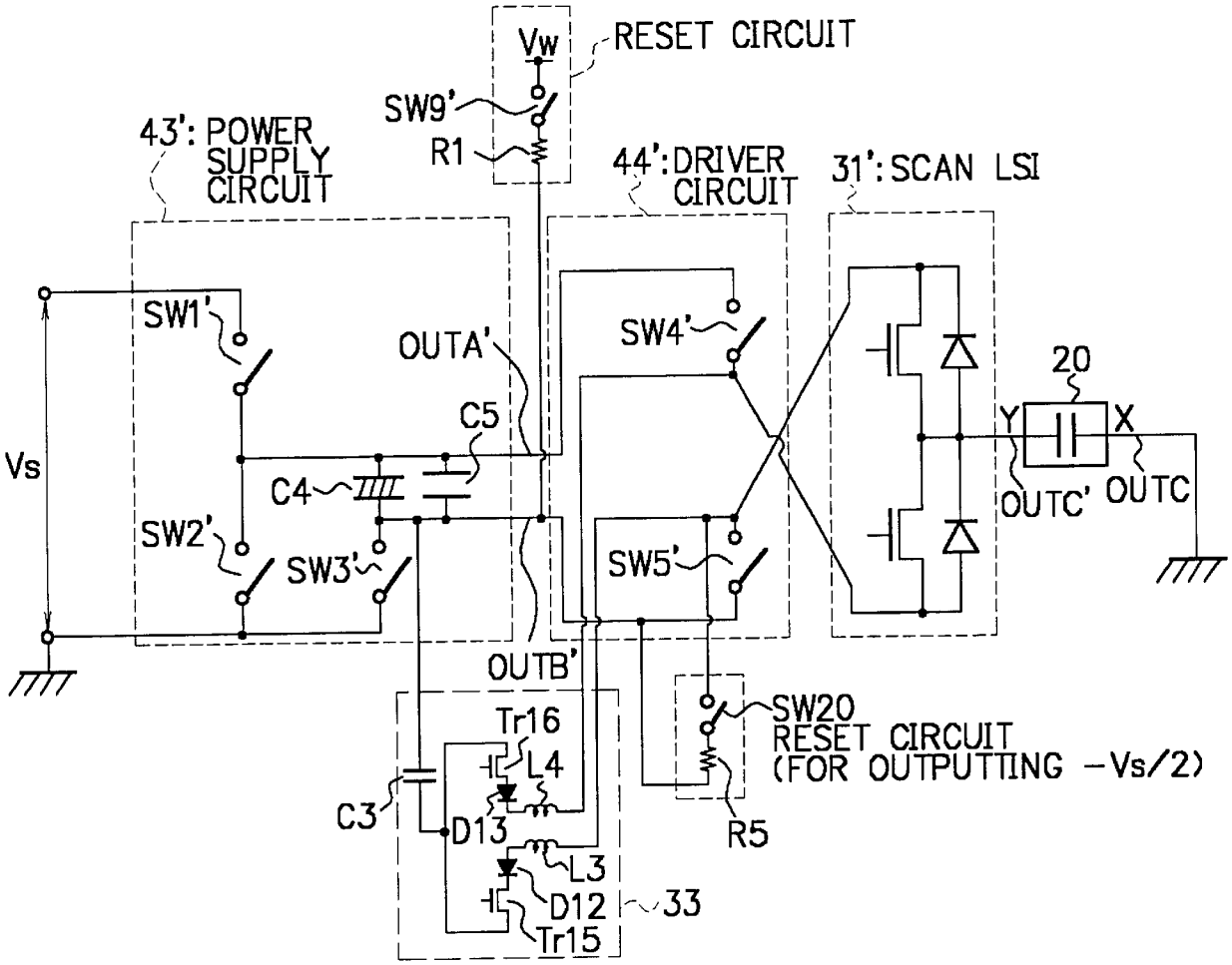
FIG. 78 is a circuit diagram showing another example of construction of a driving apparatus according to the eleventh embodiment.

FIG. 78 is a circuit diagram showing another example of construction of a driving apparatus according to this eleventh embodiment. In FIG. 78, the components having the same functions as those in FIG. 73, are denoted by the same references as those in FIG. 73, respectively. Thus the repetitive descriptions thereof will be omitted. In the example of FIG. 76, since the voltage on the scanning electrode Y side is fixed to the ground level, there is a redundancy in the construction on the scanning electrode Y side. Thus, in this example of FIG. 78, the construction on one electrode side is omitted so as simply to connect to the ground.

In this example of FIG. 78, a switch SW9' connected to the power supply line for the voltage Vw is provided on the scanning electrode Y side. Besides, a reset circuit made up from a switch SW20 and a resistor R5 is provided between both terminals of the switch SW5' on the scanning electrode Y side. Further in this example of FIG. 78, the common electrode X side of the load 20 is grounded. In this manner, when the voltage on the common electrode X side is fixed to the ground level, and Vs is used as a power supply voltage for the scanning electrode Y side, the power loss on the scanning electrode Y side becomes great in comparison with the above-described embodiments in which (Vs/2) is used as the power supply voltage. Thus, on the scanning electrode Y side, a power recovery circuit 33 is preferably provided. The construction of such a power recovery circuit 33 is the same as that shown in FIG. 48.

Figure 79:
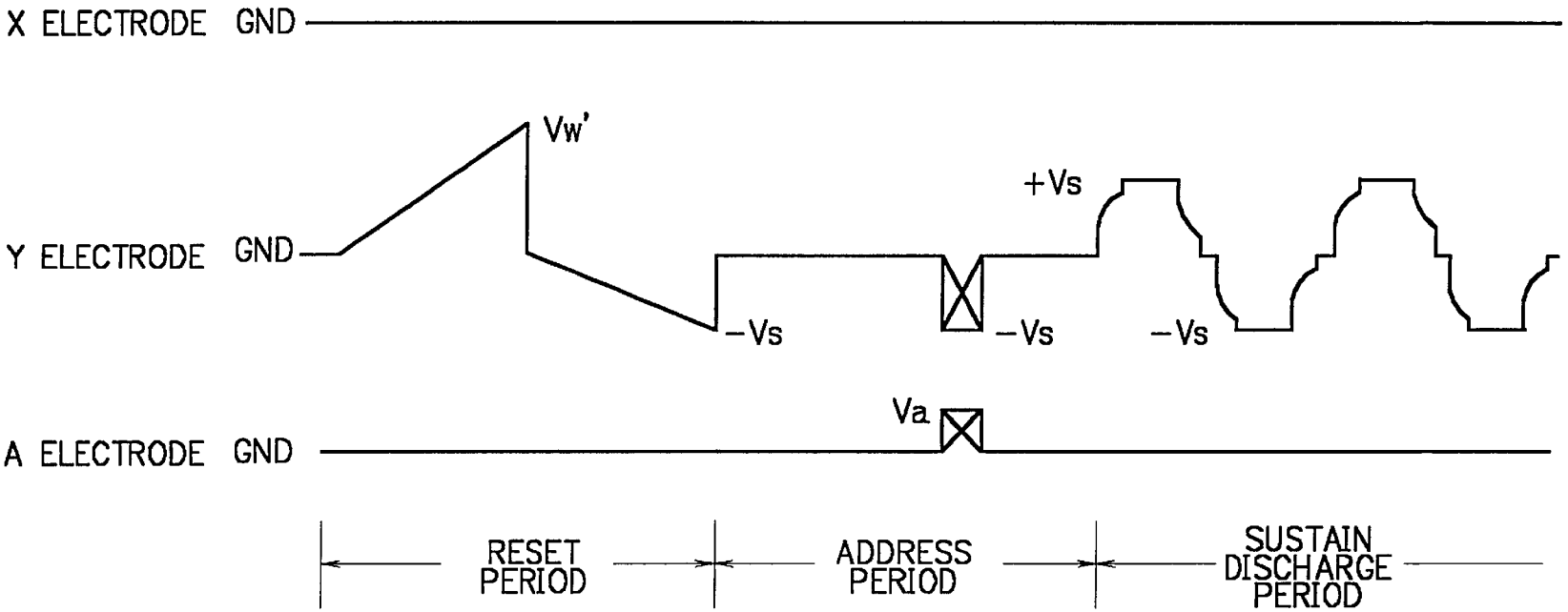
FIG. 79 is a timing chart showing an example of driving waveforms by the driving apparatus constructed as in FIG. 78.

FIG. 79 is a timing chart showing driving waveforms of the PDP by the driving apparatus constructed as shown in FIG. 78. FIG. 79 shows one of the subfields making up one frame. In this example of FIG. 79, the driving waveforms on the scanning electrode Y side is the same as those in the already described embodiments (but the absolute value of the voltage to be applied is Vs or Vw'). The voltage of the common electrode X is fixed to the ground level.

The address electrode A is fixed to the ground level but a voltage Va is applied to it in address period. The address electrode A may be kept in a high impedance state in sustain discharge period.

Figure 80:
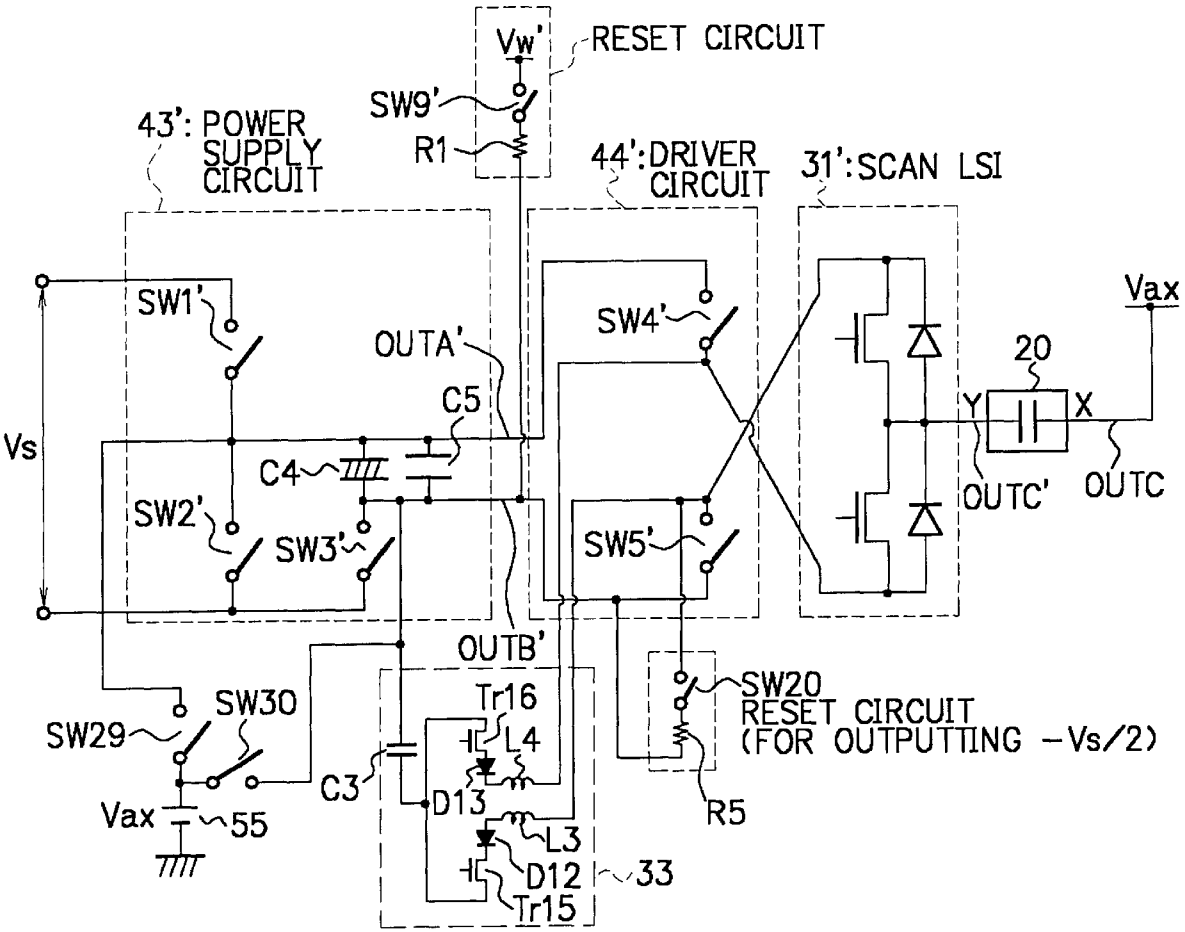
FIG. 80 is a circuit diagram showing another example of construction of a driving apparatus according to the eleventh embodiment.

FIG. 80 is a circuit diagram showing still another example of construction of a driving apparatus according to this eleventh embodiment. In FIG. 80, the components having the same functions as those in FIG. 78, are denoted by the same references as those in FIG. 78, respectively. Thus the repetitive descriptions thereof will be omitted.

The common electrode X side of the load 20 is grounded in the above example of FIG. 78, but it is connected to the power supply line for a voltage Vax in this example of FIG. 80. In case of fixing the voltage on the common electrode X side to Vax, there is required a construction for selectively applying the offset voltage Vax to the scanning electrode Y so that the potential difference between the common and scanning electrodes X and Y in sustain discharge period becomes Vs.

The construction for this purpose comprises a power supply 55 of the voltage Vax connected to the ground, a switch SW29 connected between the power supply 55 and the third signal line OUTA', and a switch SW30 connected between the power supply 55 and the fourth signal line OUTB'. With this construction, when the switch SW29 is ON, the positive voltage (+Vax) is output on the third signal line OUTA'. When the switch SW30 is ON, the positive voltage (+Vax) is output on the fourth signal line OUTB'. Thus the voltage using this offset voltage (+Vax) can be applied from the third or fourth signal line OUTA' or OUTB' through the output line OUTC' to the load 20.

Figure 81:
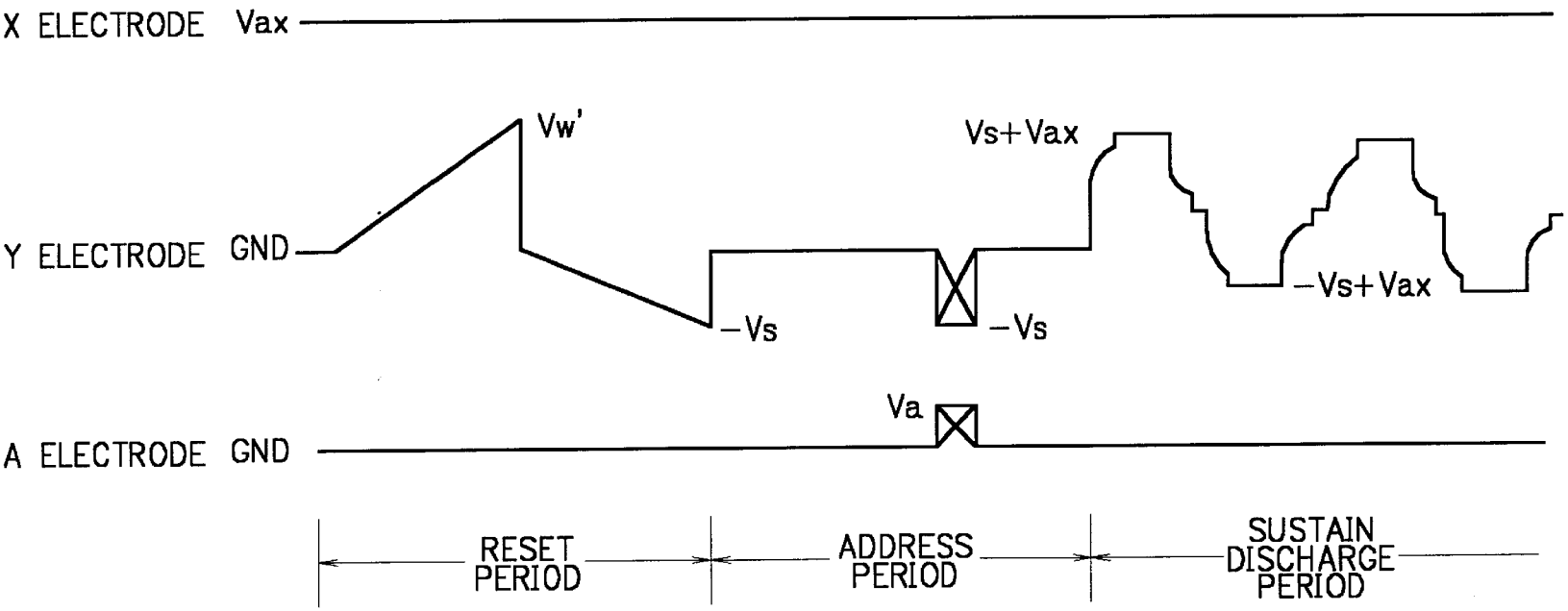
FIG. 81 is a timing chart showing an example of driving waveforms by the driving apparatus constructed as in FIG. 80.

FIG. 81 is a timing chart showing driving waveforms of the PDP by the driving apparatus constructed as shown in FIG. 80. FIG. 81 shows one of the subfields making up one frame. In this example of FIG. 81, the waveforms on the scanning electrode Y side in reset and address periods are the same as those in the already described embodiments (but the absolute value of the voltage applied is Vs or Vw').

In sustain discharge period, by alternately turning the switches SW29 and SW30 ON, the voltage Vax is added as an offset voltage to the respective positive and negative voltages (+Vs) and (−Vs) applied to the scanning electrode Y. Contrastingly, the voltage of the common electrode X is fixed to Vax. Thus the potential difference between the common and scanning electrodes X and Y in the sustain discharge period always becomes Vs.

The address electrode A is fixed at the ground level during any period but address period in which the voltage Va is applied. During sustain discharge period, the address electrode A may be kept in a high impedance state.

According to the driving apparatus constructed as shown in FIG. 78 or 80, the common electrode X side requires no power supply circuit and no driver circuit. This affords a considerably simple construction on the common electrode X side.

Figure 82:
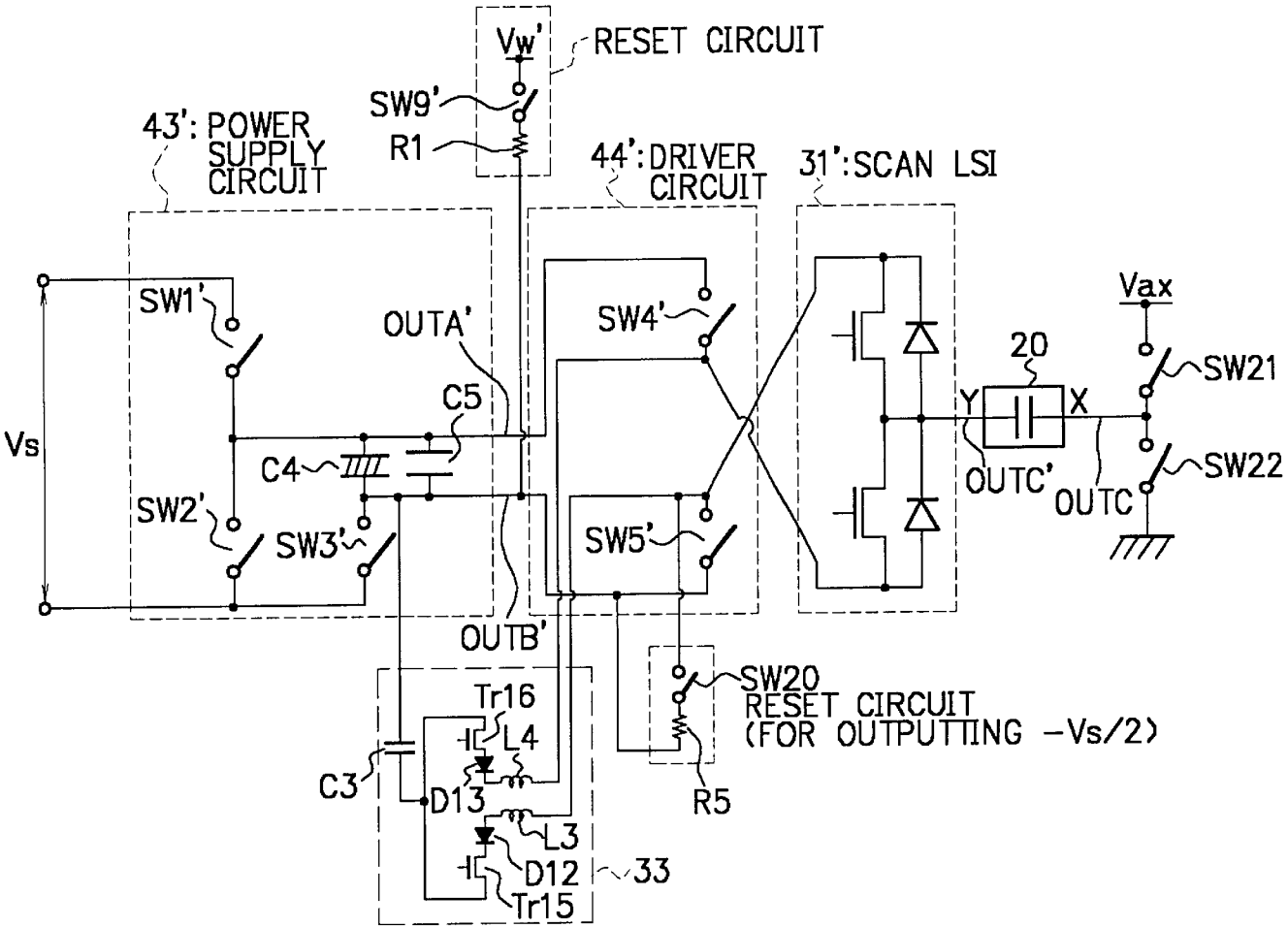
FIG. 82 is a circuit diagram showing another example of construction of a driving apparatus according to the eleventh embodiment.

FIG. 82 is a circuit diagram showing still another example of construction of a driving apparatus according to this eleventh embodiment. In FIG. 82, the components having the same functions as those in FIGS. 78 and 80, are denoted by the same references as those in FIGS. 78 and 80, respectively. Thus the repetitive descriptions thereof will be omitted.

In this driving apparatus shown in FIG. 82, the common electrode X side of the load 20 is connected to the power supply line for a voltage Vax through a switch 21, and grounded through a switch SW22. By turning one of the switches SW21 and SW22, the voltage to be applied to the common electrode X can be changed over between the ground level and Vax to use.

Figure 83:
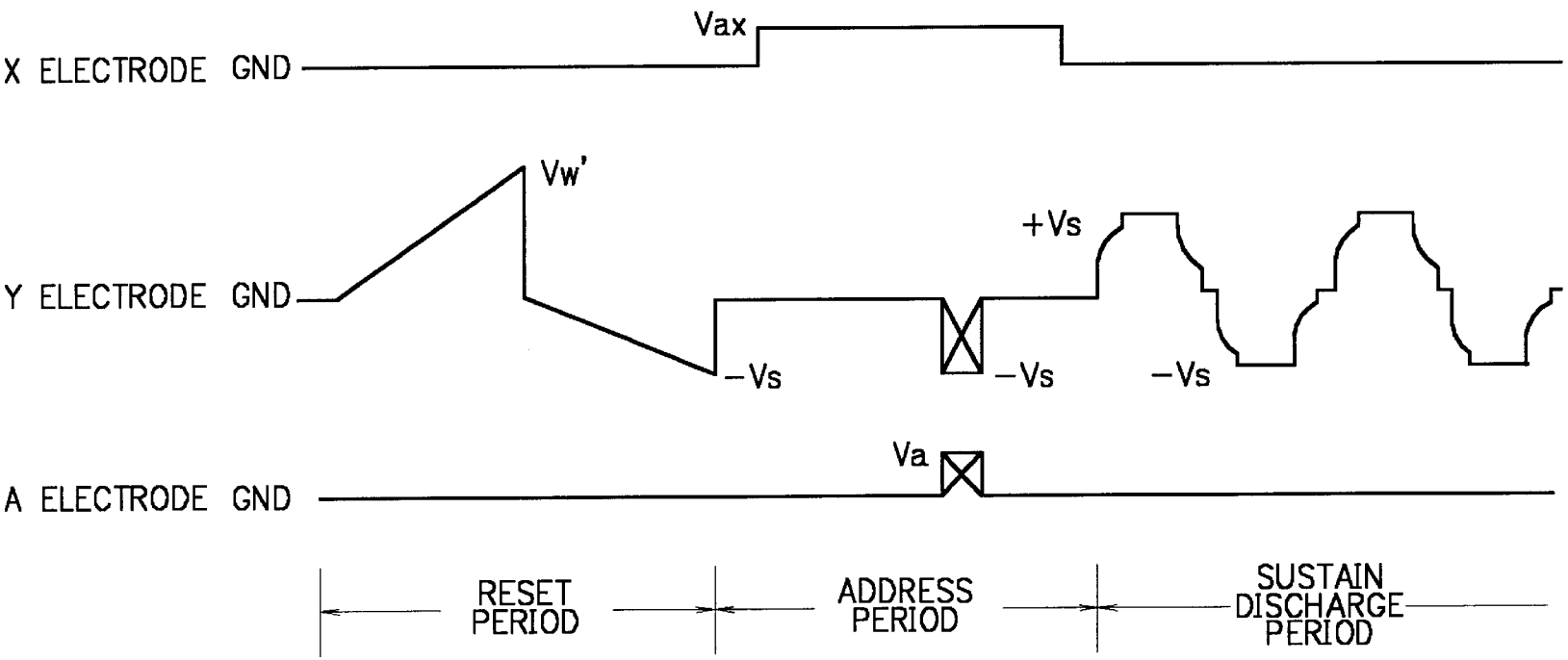
FIG. 83 is a timing chart showing an example of driving waveforms by the driving apparatus constructed as in FIG. 82.

FIG. 83 is a timing chart showing driving waveforms of the PDP by the driving apparatus constructed as shown in FIG. 82. In this example of FIG. 83, the waveforms of the scanning and address electrodes Y and A are quite the same as those in FIGS. 79 and 81. One of the ground level and Vax is applied to the common electrode X by being switched. More specifically, the voltage being applied to the common electrode X is fixed at the ground level during reset and sustain discharge periods, and at Vax during address period.

Figure 84:
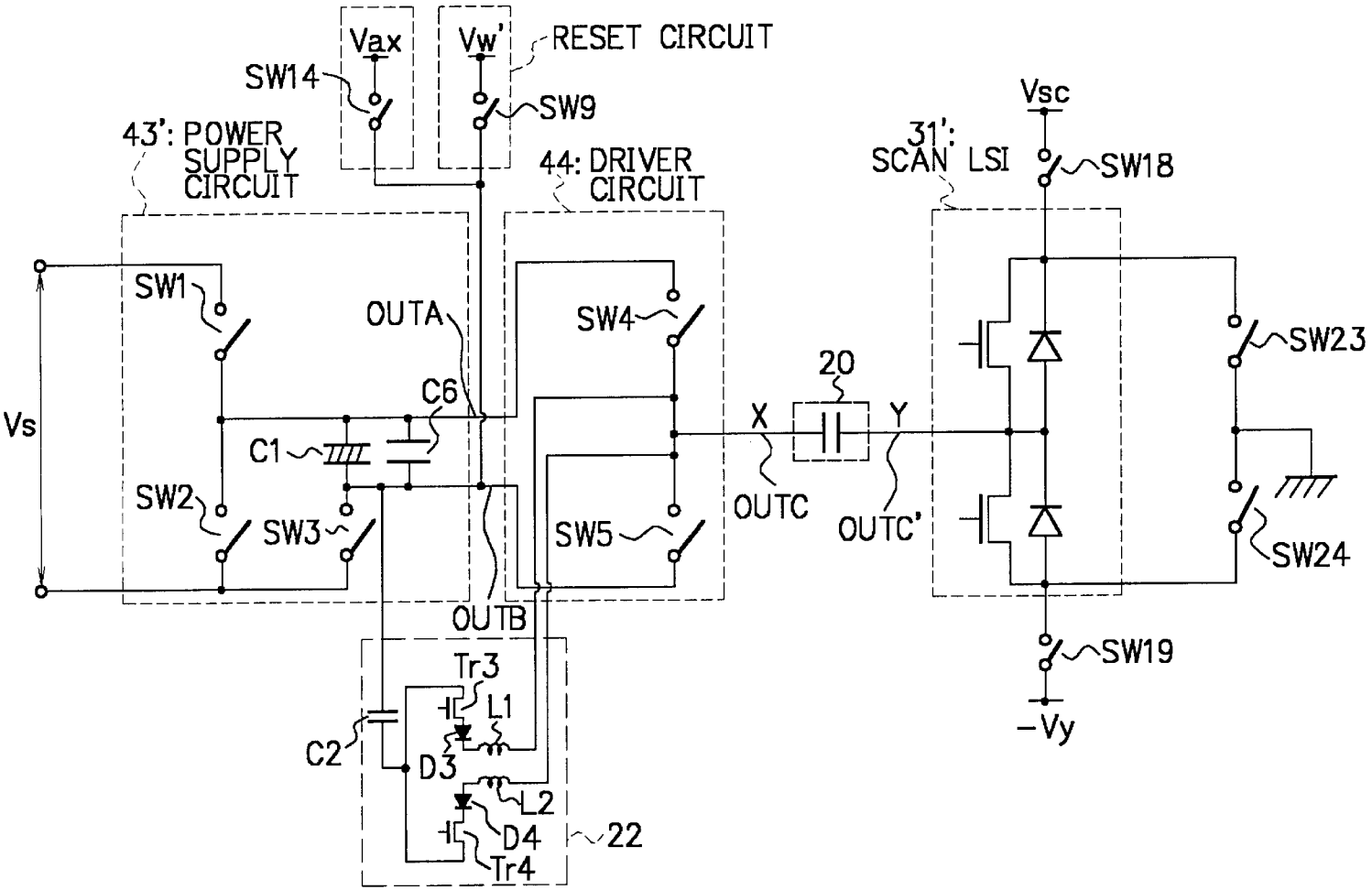
FIG. 84 is a circuit diagram showing another example of construction of a driving apparatus according to the eleventh embodiment.

FIG. 84 is a circuit diagram showing still another example of construction of a driving apparatus according to this eleventh embodiment. In the above examples of FIGS. 78, 80, and 82, the voltage being applied to the common electrode X is fixed at the ground level or Vax. But in the driving apparatus shown in FIG. 84, the voltage on the common electrode X side is not fixed, and various voltages may be applied at need. For this purpose, on the common electrode X side, a switch SW9 for switching operation in relation to the power supply line for a voltage Vw', and a switch SW14 for switching operation in relation to the power supply line for a voltage Vax, are connected in parallel to the second signal line OUTB.

On the scanning line Y side, a switch SW18 is connected between the scan driver 31' and the power supply line for a voltage Vsc, and a switch SW19 is connected between the scan driver 31' and the power supply line for a voltage (−Vy). Both terminals of the scan driver 31' are respectively connected to switches SW23 and SW 24. The node between those switches SW23 and SW 24 is grounded.

Figure 85:
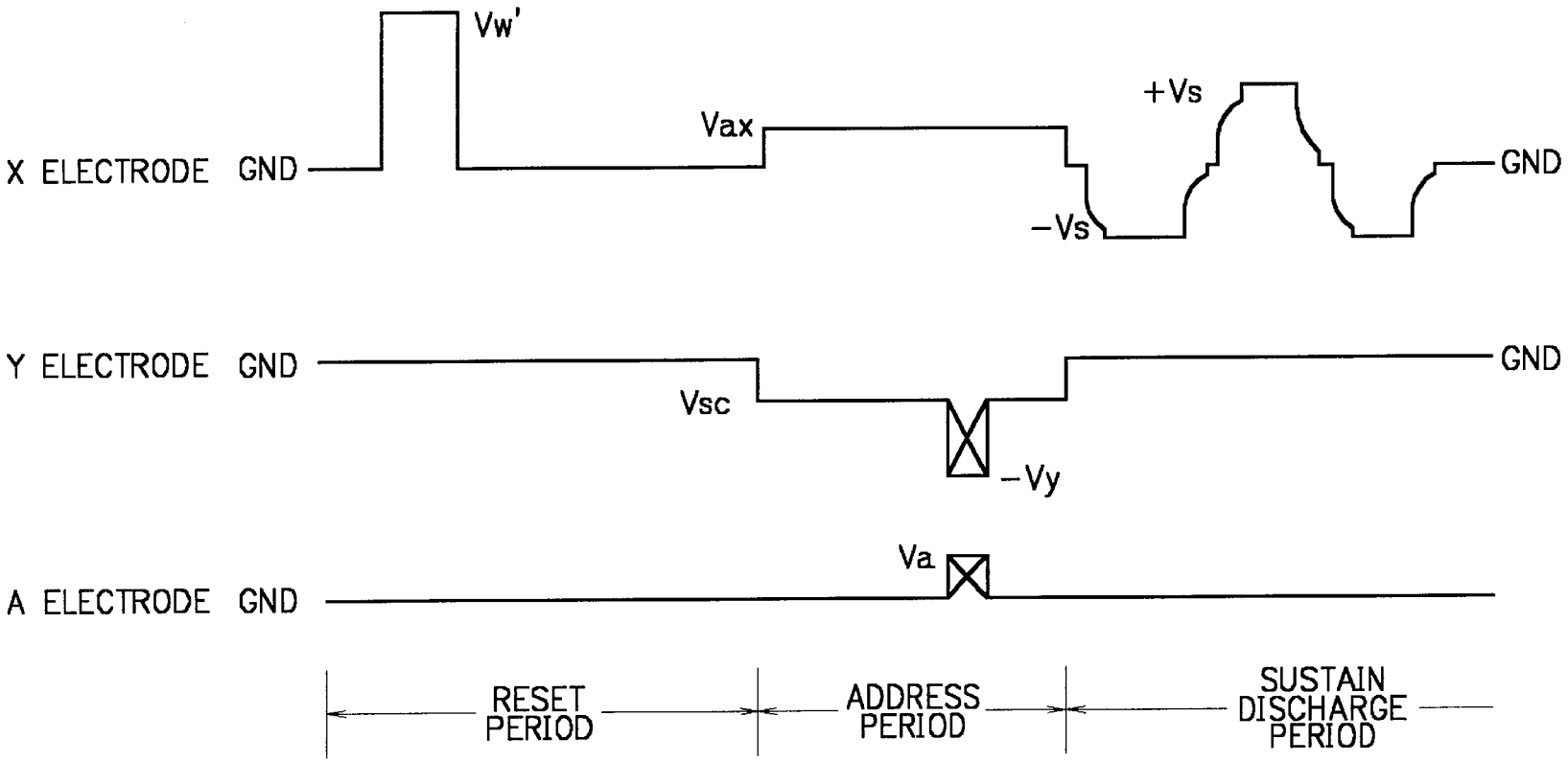
FIG. 85 is a timing chart showing an example of driving waveforms by the driving apparatus constructed as in FIG. 84.

FIG. 85 is a timing chart showing driving waveforms of the PDP by the driving apparatus constructed as shown in FIG. 84. FIG. 85 shows one of the subfields making up one frame. Referring to FIG. 85, on the common electrode X side, by ON/OFF control of the switches SW1 to SW5, SW9, and SW14 at proper timings, pulses of various voltages, e.g., Vw' and Vax necessary in reset and address periods, other than the voltages (±Vs) in sustain discharge period, are applied to the load 20.

On the scanning electrode Y side, during reset and sustain discharge periods, by setting either of the switches SW18 and SW19 OFF, and either of the switches SW23 and SW24 ON, the voltage being applied is fixed at the ground level. In address period, by keeping the switches SW23 and SW24 OFF. By turning the switches SW18 and SW19 ON, the voltage Vsc−(−Vy) is applied between both power supply terminals of the scan driver 31'. By controlling ON/OFF of the scan driver 31' at proper timings, a pulse voltage necessary for scanning is applied to the scanning electrode Y. With this construction, the circuit on the scanning electrode Y side can be further simplified, so it can be realized to reduce the manufacturing cost in comparison with the prior art.

The address electrode A is fixed at the ground level during any period but address period in which the voltage Va is applied. During sustain discharge period, the address electrode A may be kept in a high impedance state.

Figure 86:
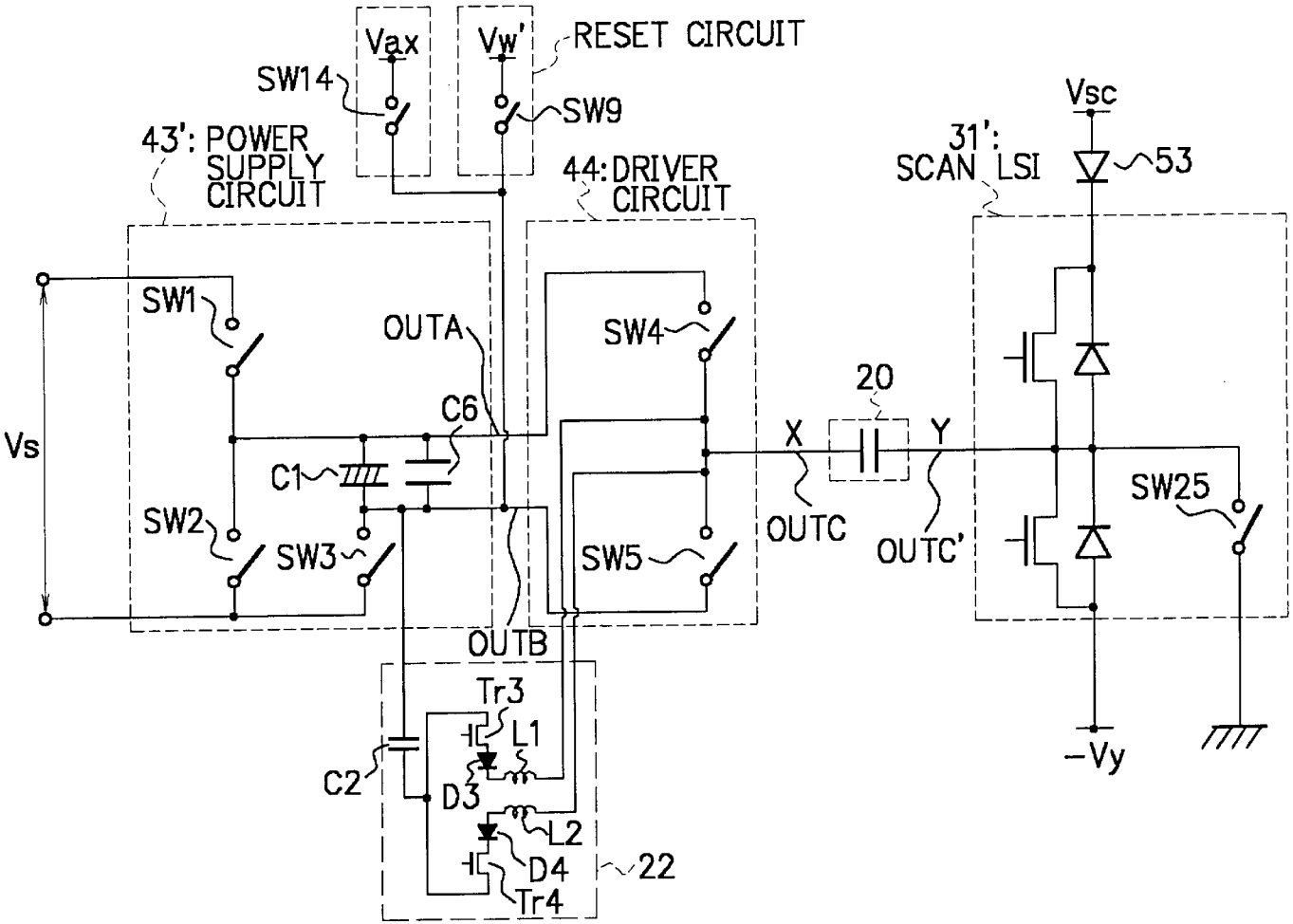
FIG. 86 is a circuit diagram showing another example of construction of a driving apparatus according to the eleventh embodiment.

FIG. 86 is a circuit diagram showing still another example of construction of a driving apparatus according to this eleventh embodiment. In FIG. 86, the components having the same functions as those in FIG. 84, are denoted by the same references as those in FIG. 84, respectively. Thus the repetitive descriptions thereof will be omitted. In the above example of FIG. 84, the switches SW23 and SW24 for setting the voltage being applied to the scanning electrode Y, at the ground level, are constructed as a common circuit for all display lines of the PDP.

Contrastingly in the construction shown in FIG. 86, a switch 25 for setting the voltage being applied to the scanning electrode Y, at the ground level, is incorporated in the scan driver 31' as part of the scan driver 31'. Such a switch 25 is provided for every display line. By this construction, switching control can be individually made for each display line. Besides, the circuit on the scanning electrode Y side can be further simplified, so it can be realized to reduce the manufacturing cost in comparison with the prior art. The waveforms in this construction of FIG. 86 is the same as those of FIG. 85.

Twelfth Embodiment

Next, the twelfth embodiment of the present invention will be described.

In the above-described first to eleventh embodiment, a positive voltage is applied to the power supply circuit, and positive and negative voltages are generated on the first and second signal lines OUTA and OUTB from the positive voltage. Contrastingly in this twelfth embodiment, a negative voltage is applied to the power supply circuit, and positive and negative voltages are generated on the output line OUTC through the first and second signal lines OUTA and OUTB from the negative voltage.

Figure 87:
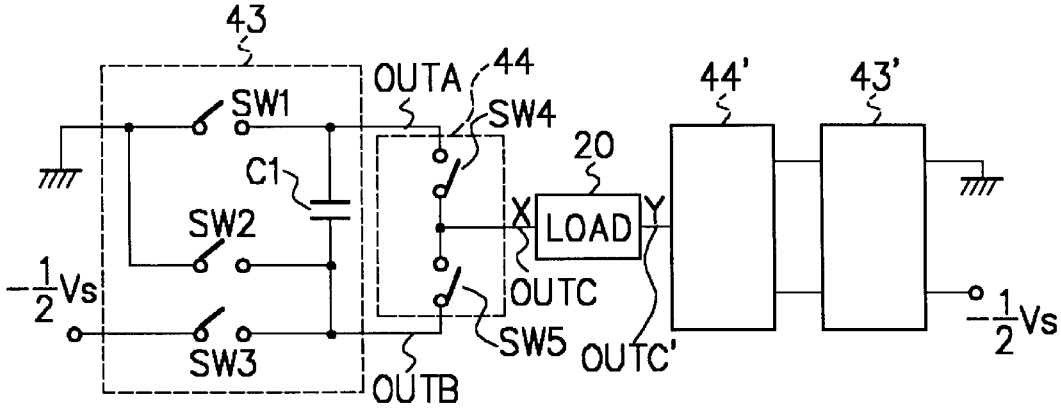
FIG. 87 is a circuit diagram showing an example of construction of a driving apparatus according to the twelfth embodiment of the present invention.

FIG. 87 is a circuit diagram showing a specific example of construction of a driving apparatus according to this twelfth embodiment. In FIG. 87, the components having the same functions as those in FIG. 9, are denoted by the same references as those in FIG. 9, respectively. Thus the repetitive descriptions thereof will be omitted. The example of FIG. 87 differs from the example of FIG. 9 on the point that the voltage to be applied to the power supply circuits 43 and 43' in FIG. 87 is a negative voltage (−Vs/2) though it is a positive voltage (+Vs/2) in the example of FIG. 9.

So as to apply the voltage with the thus reversed polarity to the power supply circuits 43 and 43', the location of the capacitor C1 in FIG. 87 differs from that in FIG. 9. That is, the capacitor C1 is connected between the switches SW2 and SW3 in FIG. 9, but it is connected between the switches SW1 and SW2 in FIG. 87.

Figure 88:
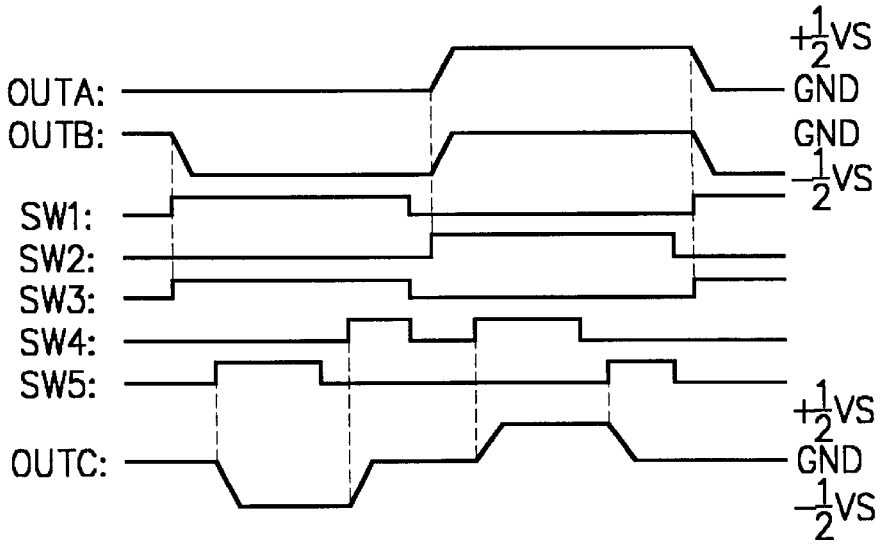
FIG. 88 is a timing chart showing an example of driving waveforms in a sustain discharge period by the driving apparatus constructed as in FIG. 87.

FIG. 88 is a timing chart showing driving waveforms of the PDP by the driving apparatus constructed as shown in FIG. 87. In the above-described first to eleventh embodiment in which a positive voltage is applied to the power supply circuits 43 and 43', in the period till the capacitor C1 has stored charges, switching control of the switches SW1, SW3, and SW4 is mainly performed to apply a positive voltage to the load 20, and then switching control of the switches SW2 and SW5 is performed to apply a negative voltage to the load 20.

Contrastingly in this twelfth embodiment in which a negative voltage is applied to the power supply circuits 43 and 43', in the period till the capacitor C1 has stored charges, switching control of the switches SW1, SW3, and SW5 is mainly performed to apply a negative voltage to the load 20, and then switching control of the switches SW2 and SW4 is performed to apply a positive voltage to the load 20. The other basic parts of the waveforms are the same as those already described, so the detailed description thereof will be omitted.

Also according to this twelfth embodiment in which a negative voltage is applied to the power supply circuits 43 and 43', the breakdown voltage of each element provided in the power supply circuits 43 and 43' and the driver circuits 44 and 44' can be held down in comparison with its conventional value. This makes it possible to use inexpensive small elements and so realize simplification in circuit construction and reduction of manufacturing cost. Alternatively, possible is the operation that the positive voltage-is applied to the power supply circuits 43 and 43' of the twelfth embodiment shown in FIG. 87 to swing the voltage of the output line OUTC shown in FIG. 88 between GND and Vs.

Figure 89:
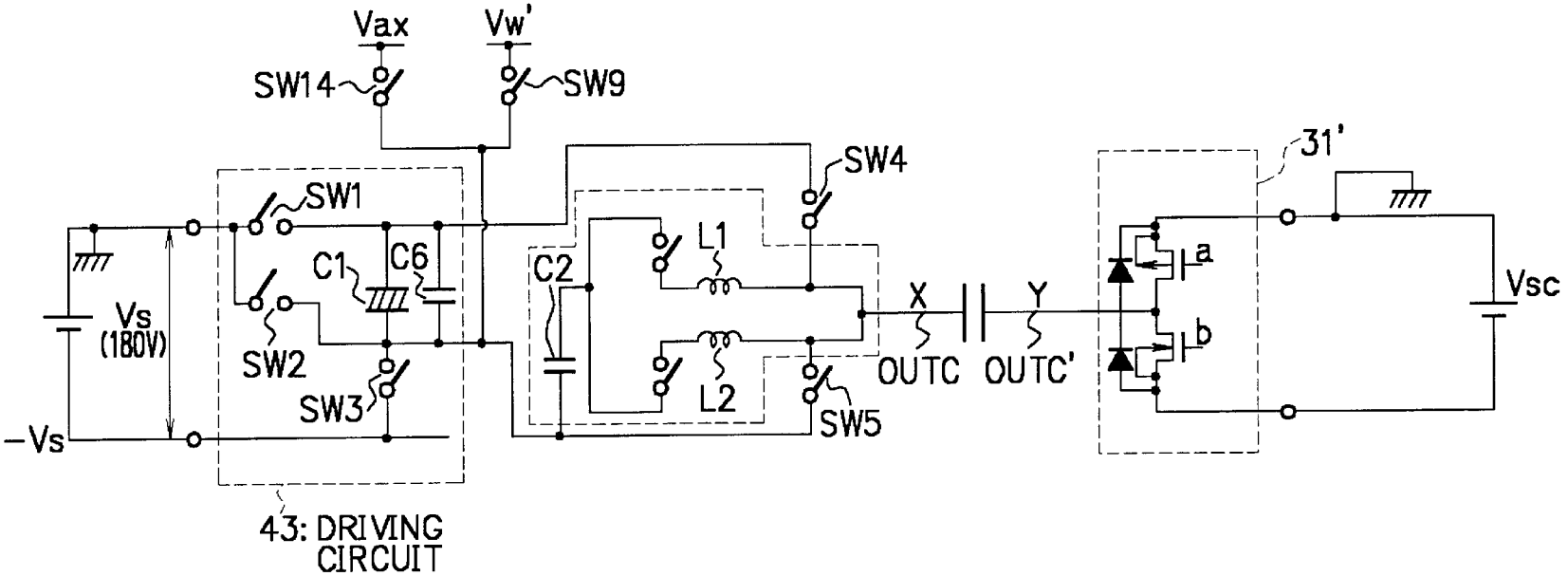
FIG. 89 is a circuit diagram showing another example of construction of a driving apparatus according to the twelfth embodiment.

FIG. 89 a circuit diagram showing another example of construction of a driving apparatus according to this twelfth embodiment. In FIG. 89, the same components as those in FIGS. 87, 84, and 86 are denoted by the same reference as those in FIGS. 87, 84, and 86, respectively. In this driving apparatus shown in FIG. 89, the idea of FIG. 87 is combined with the circuit shown in FIG. 84 or 86. With this construction, the circuits on the scanning electrode Y side shown in FIG. 84 or 86 can be reduced. Further, as occasion demands, it is also possible to set Vsc=Vs to eliminate the Vsc power supply.

Thirteenth Embodiment

Next, the thirteenth embodiment of the present invention will be described.

Figure 90:
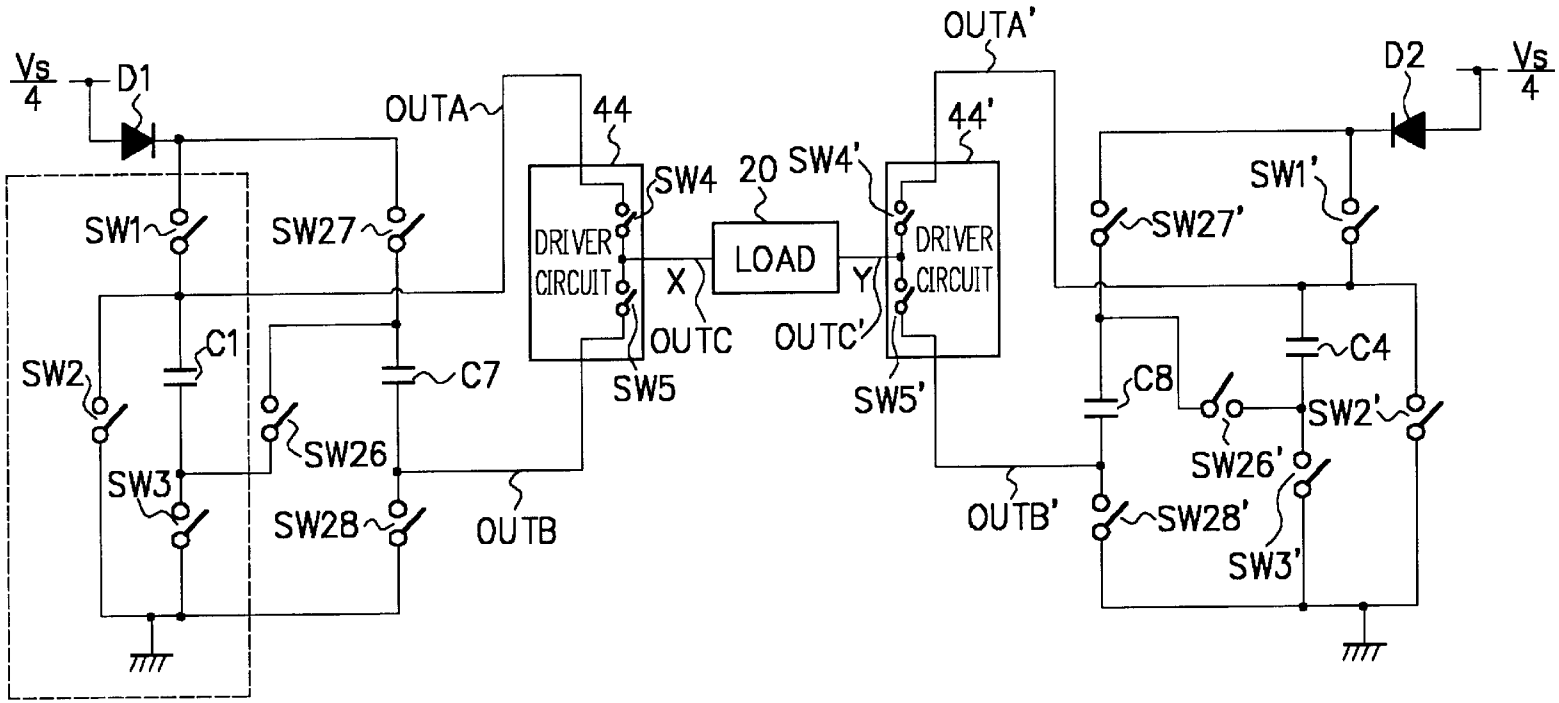
FIG. 90 is a circuit diagram showing an example of construction of a driving apparatus according to the thirteenth embodiment of the present invention.

FIG. 90 is a circuit diagram showing a specific example of construction of a driving apparatus according to this thirteenth embodiment. The construction shown in FIG. 90 is an application of the construction shown in FIG. 9. In FIG. 90, the same references as in FIG. 9 denote the same parts as in FIG. 9. Thus the repetitive descriptions thereof will be omitted.

Referring to FIG. 90, switches SW1 and SW2 on the common electrode X side are connected in series between the ground and the power supply line of a voltage (¼Vs) generated from an A/D power supply (not shown). The node between the switches SW1 and SW2 is connected to one terminal of a capacitor C1. A switch SW3 is connected between the ground and the other terminal of the capacitor C1.

A switch SW27, a capacitor C7, and a switch SW28 are connected in series in parallel with the switches SW1 and SW2 connected between the ground and the power supply line of the voltage (¼Vs). A switch SW26 is connected between the other terminal of the capacitor C1 and one terminal of the capacitor C7 connected to the switch SW27. A driver circuit 44 is connected between the one terminal of the capacitor C1 and the other terminal of the capacitor C7. This driver circuit 44 comprises two switches SW4 and SW5.

On the scanning electrode Y side, switches SW1' and SW2' are connected in series between the ground and the power supply line of a voltage (¼Vs) generated from an A/D power supply (not shown). The node between the switches SW1' and SW2' is connected to one terminal of a capacitor C4. A switch SW3' is connected between the ground and the other terminal of the capacitor C4.

A switch SW27', a capacitor C8, and a switch SW28' are connected in series in parallel with the switches SW1' and SW2' connected between the ground and the power supply line of the voltage (¼Vs). A switch SW26' is connected between the other terminal of the capacitor C4 and one terminal of the capacitor C8 connected to the switch SW27'. A driver circuit 44' is connected between the one terminal of the capacitor C4 and the other terminal of the capacitor C8. This driver circuit 44' comprises two switches SW4' and SW5'.

Figure 91:
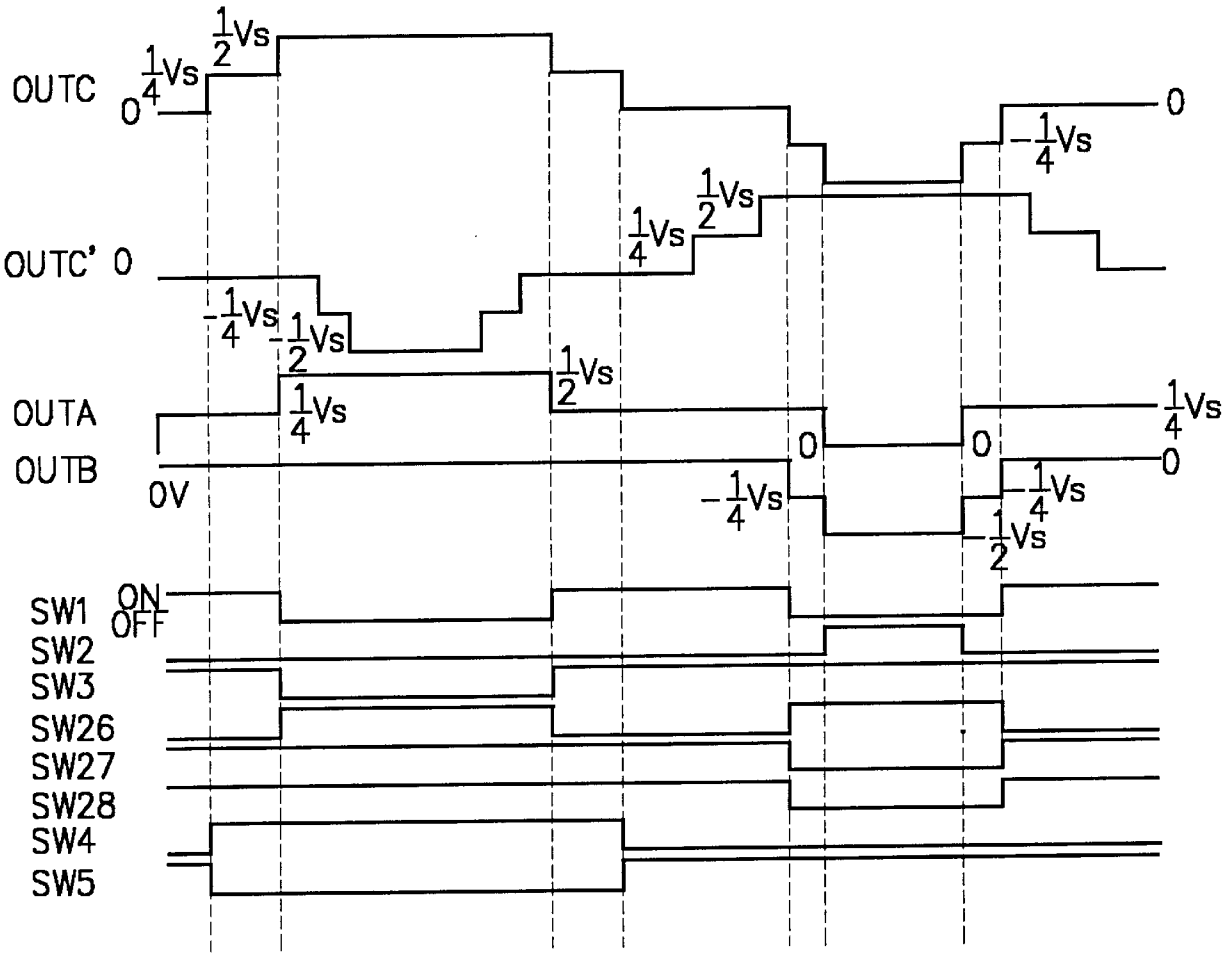
FIG. 91 is a timing chart showing an example of driving waveforms in a sustain discharge period by the driving apparatus constructed as in FIG. 90.

FIG. 91 is a timing chart showing a specific example of driving waveforms in a sustain discharge period by the driving apparatus of this embodiment.

Referring to FIG. 91, firstly, five switches SW1, SW3, SW27, SW28, and SW5 are turned ON, and the remaining switches SW2, SW26, and SW4 are kept OFF. The voltage of the first signal line OUTA thereby rises to the voltage level (¼Vs) applied through the switch SW1, and the voltage of the second signal line OUTB remains at the ground level. At this time, the charges corresponding to the voltage (¼Vs) are stored in the capacitors C1 and C7. Further, by turning the respective switches SW5 and SW4 OFF and ON, the voltage (Vs/4) of the first signal line OUTA is output on the output line OUTC to be applied to the common electrode X of the load 20.

Next, the switches SW26, SW27, SW28, and SW4 are set ON, and the remaining switches SW1, SW2, SW3, and SW5 are set OFF. With this operation, the capacitors C1 and C7 are connected in series between the ground and the power supply line of the voltage (¼Vs). Since the charges corresponding to the voltage (¼Vs) are stored in the capacitors C1 and C7, the charges in the capacitors C1 and C7 are summed to generate the voltage of (Vs/2) of the first signal line OUTA. Even in this state, the voltage of the second signal line OUTB still remains at the ground level. At this time, since the respective switches SW5 and SW4 are OFF and ON, the voltage (Vs/2) of the first signal line OUTA is output on the output line OUTC to be applied to the common electrode X of the load 20.

At the next timing, the switches SW1, SW3, SW27, SW28, and SW4 are set ON, and the remaining switches SW2, SW26, and SW5 are set OFF. The voltage (Vs/4) is thereby applied to the first signal line OUTA through the switch SW1. In this state, the voltage of the second signal line OUTB remains at the ground level. At this time, since the respective switches SW5 and SW4 are OFF and ON, the voltage (Vs/4) of the first signal line OUTA is output on the output line OUTC to be applied to the common electrode X of the load 20.

Next, the switches SW4 and SW5 are turned OFF and ON, respectively. The voltage of the second signal line OUTB is thereby output on the output line OUTC to set the voltage being applied to the common electrode X of the load 20 at the ground level.

After this, the switches SW3, SW26, and SW5 are turned ON, the remaining switches SW1, SW2, SW27, SW28, and SW4 are turned OFF. The voltage of the second signal line OUTB is thereby lowered to (−Vs/4) in accordance with the charges accumulated in the capacitor C7. At this time, since the switch SW5 is ON, the voltage (−Vs/4) of the second signal line OUTB is output on the output line OUTC to be applied to the common electrode X of the load 20.

Next, the switches SW3 and SW2 are turned OFF and ON, respectively. This makes the state that the capacitors C1 and C7 are connected in series between the common electrode X and the ground. At this time, since the charges corresponding to (Vs/4) are accumulated in either of the capacitors C1 and C7, the voltage of the second signal line OUTB is lowered to (Vs/2) as a result of addition of the charges in those two capacitors C1 and C7. The voltage of the first signal line OUTA remains at the ground level. At this time, since the switch SW5 is ON, the voltage (−Vs/2) of the second signal line OUTB is output on the output line OUTC to be applied to the common electrode X of the load 20.

After this, the switches SW2 and SW3 are again turned OFF and ON, respectively. By this operation, the voltage of the first signal line OUTA is raised to (+Vs/4), and the voltage of the second signal line OUTB is lowered to (−Vs/4). At this time, since the switch SW5 is ON, the voltage (−Vs/4) of the second signal line OUTB is output on the output line OUTC to be applied to the common electrode X of the load 20.

Next, similarly to the first state, five switches SW1, SW3, SW27, SW28, and SW5 are turned ON, and the remaining switches SW2, SW26, and SW4 are turned OFF. The voltage of the first signal line OUTA is set at (Vs/4), and the voltage of the second signal line OUTB is set at the ground level. At this time, the voltage of the second signal line OUTB is output on the output line OUTC to be applied to the common electrode X of the load 20. After this, the same operation is repeated.

Although not shown in FIG. 91, a similar switching control to that on the common electrode X side is performed in relation to the switches SW1', SW2', SW3', SW26', SW27', SW28', SW4', and SW5' on the scanning electrode Y side. But, as shown in FIG. 91, the switching control is performed such that the output voltages of the output lines OUTC and OUTC' on the common electrode X side and the scanning electrode Y side are reverse in polarity to each other.

As described above, according to this embodiment, the waveforms in which the positive and negative voltages (±Vs/2) are alternately repeated, can be generated on the output lines OUTC and OUTC' with a single power supply for generating the voltage (Vs/4). By applying the positive and negative voltages (±Vs/2) thus generated are applied in opposite phases to the output lines OUTC and OUTC' on the common electrode X side and the scanning electrode Y side, the difference voltage (Vs) can be applied between the common and scanning electrodes X and Y of the load 20.

As described above, when driving the capacitive load 20, the power is expressed by $2Cp \cdot V^2 \cdot f$ using the capacitance Cp of the load 20, the driving voltage V of the load 20, and the frequency when the voltage is applied to the load 20. According to this embodiment, the absolute value of the voltage to be applied to the load 20 suffices to be ¼ the conventional one. Instead of this, however, the frequency when the voltage is applied to the load 20 becomes four times. Consequently, the power loss when driving the load 20 is expressed by $2Cp \cdot (V/4)^2 \cdot (4f)$. This shows that the power loss can be held down to ¼ the conventional one. Thus, even in case of providing no power supply circuit, the power use efficiency can be improved in comparison with the prior art.

Figure 92:
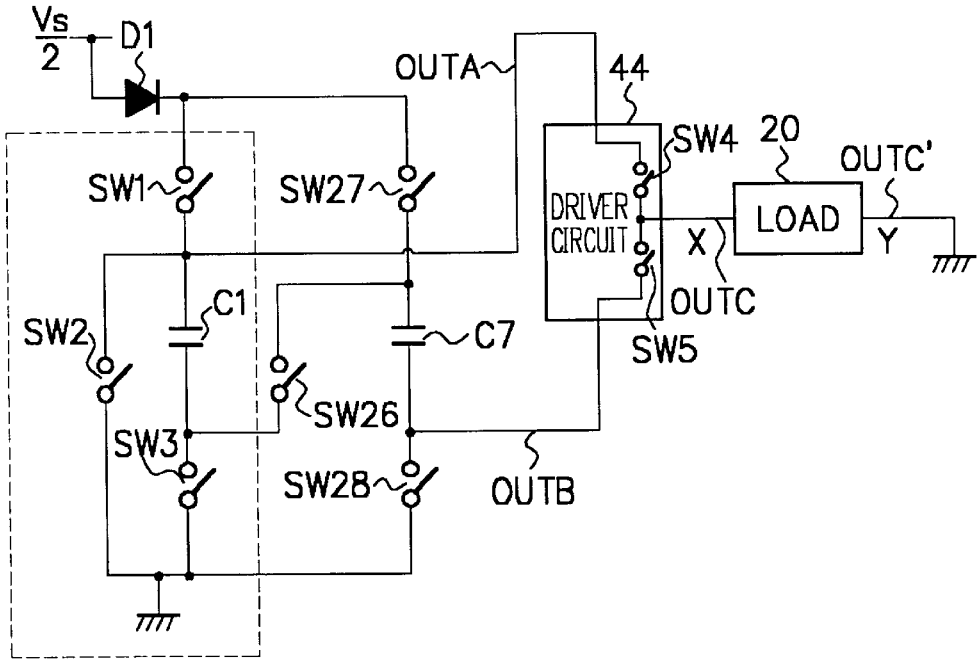
FIG. 92 is a circuit diagram showing another example of construction of a driving apparatus according to the thirteenth embodiment.
Figure 93:
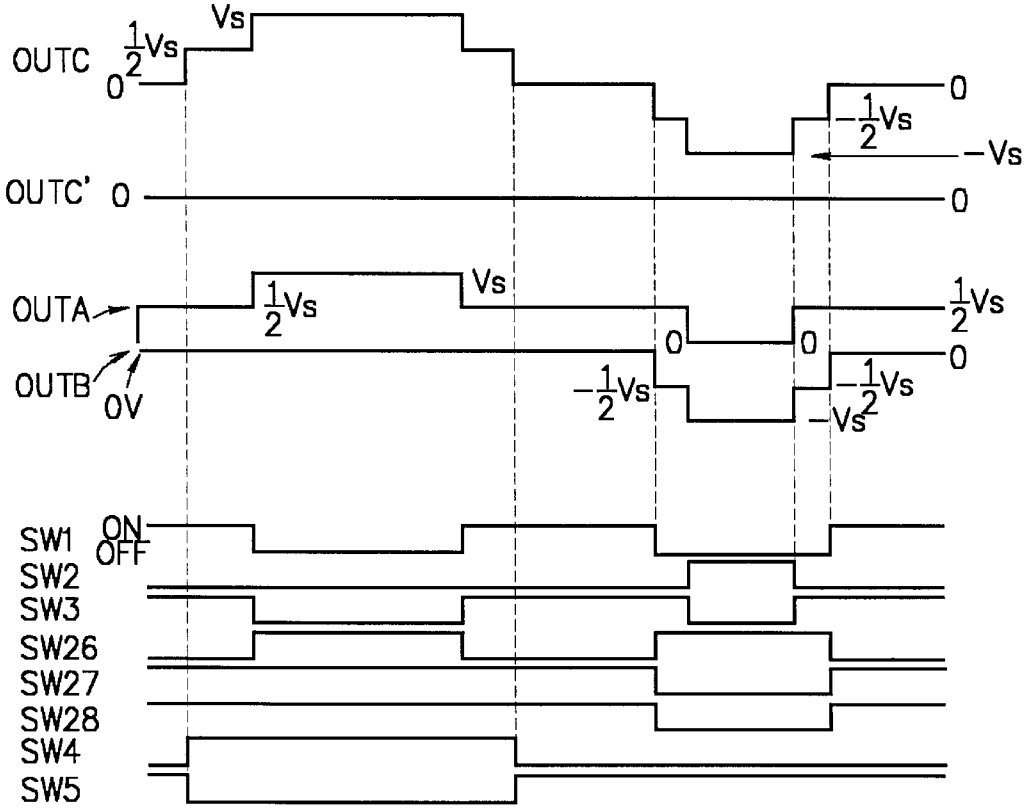
FIG. 93 is a timing chart showing an example of driving waveforms in a sustain discharge period by the driving apparatus constructed as in FIG. 92.

In this example, the positive and negative voltages (±Vs/2) are applied in opposite phases between the common and scanning electrodes X and Y. But, for example, the positive and negative voltages (±Vs) may be applied to the common electrode X while the scanning electrode Y side is connected to the ground, like the eleventh embodiment. In this case, the construction shown in FIG. 92 can be used. In the construction shown in FIG. 92, the construction on the common electrode X side is almost the same as that shown in FIG. 90 except the feature that the power supply line is not of (Vs/4) but of (Vs/2). In the construction shown in FIG. 92, the scanning electrode Y side is connected to the ground. The driving waveforms in this case are as shown in FIG. 93.

As described above, according to the example of FIG. 93, the waveforms in which the positive and negative voltages (±Vs) are alternately repeated, can be generated on the output lines OUTC with a single power supply for generating the voltage (Vs/2).

In the example of FIG. 90, the driving waveforms are generated with an A/D power supply of the voltage (Vs/4). But, by further adding, in series, low-voltage and low-power power supply circuit sections each having the same construction as the switches SW26 to SW28 and the capacitor C7 as shown in FIG. 90, the same driving waveforms can be generated with an A/D power supply of a smaller voltage (e.g., Vs/8, Vs/16, . . . ). Thus the power loss when driving the load 20 can be reduced more. For example, when n stages of such low-voltage and low-power power supply circuit sections are provided in series, the power loss when driving the load 20 is expressed by $2Cp \cdot (V/n)^2 \cdot (nf)$. This shows that the power loss can be held down to 1/n the conventional one.

Figure 94:
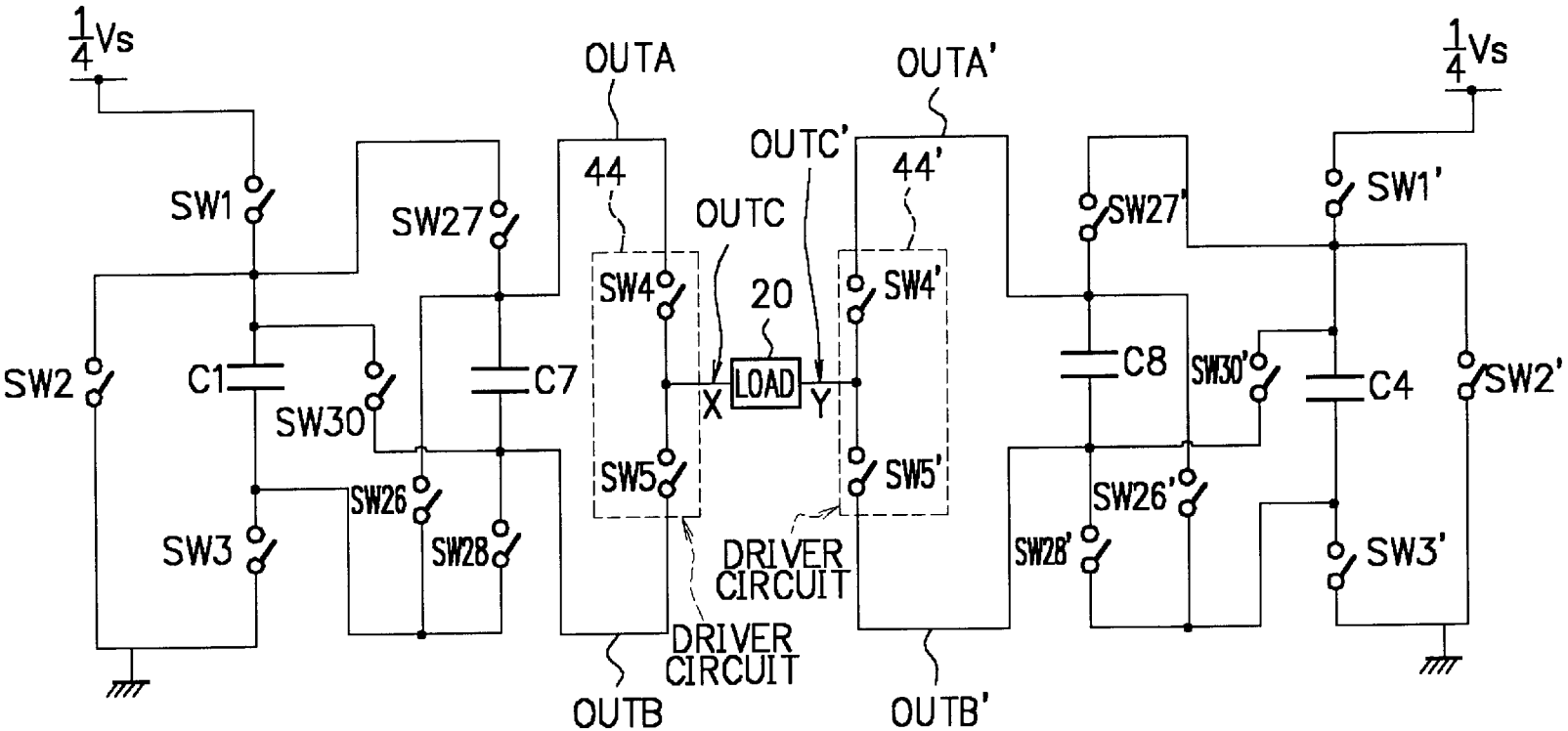
FIG. 94 is a circuit diagram showing another example of construction of a driving apparatus according to the thirteenth embodiment.

FIG. 94 is a circuit diagram showing another example of construction of a driving apparatus according to this thirteenth embodiment. In FIG. 94, the components having the same functions as those in FIG. 90, are denoted by the same references as those in FIG. 90, respectively. Thus the repetitive descriptions thereof will be omitted.

In the driving apparatus shown in FIG. 94, in addition to the construction shown in FIG. 90, switches SW30 and SW30' are provided on the common electrode X side and the scanning electrode Y side, respectively. The switch SW30 is connected between one terminal of the capacitor C1 and the other side terminal of the capacitor C7. The switch SW30' is connected between one terminal of the capacitor C4 and the other side terminal of the capacitor C8. As shown in FIG. 94, the connecting manners of the switches SW28 and SW28' differ from those in FIG. 90. The switch SW1 is connected between the Vs/4 power supply line and one terminal of the capacitor C1. The switch SW1' is connected between the Vs/4 power supply line and one terminal of the capacitor C4. One terminal of the capacitor C7 is connected to the first signal line OUTA. One terminal of the capacitor C8 is connected to the third signal line OUTA'.

Figure 95:
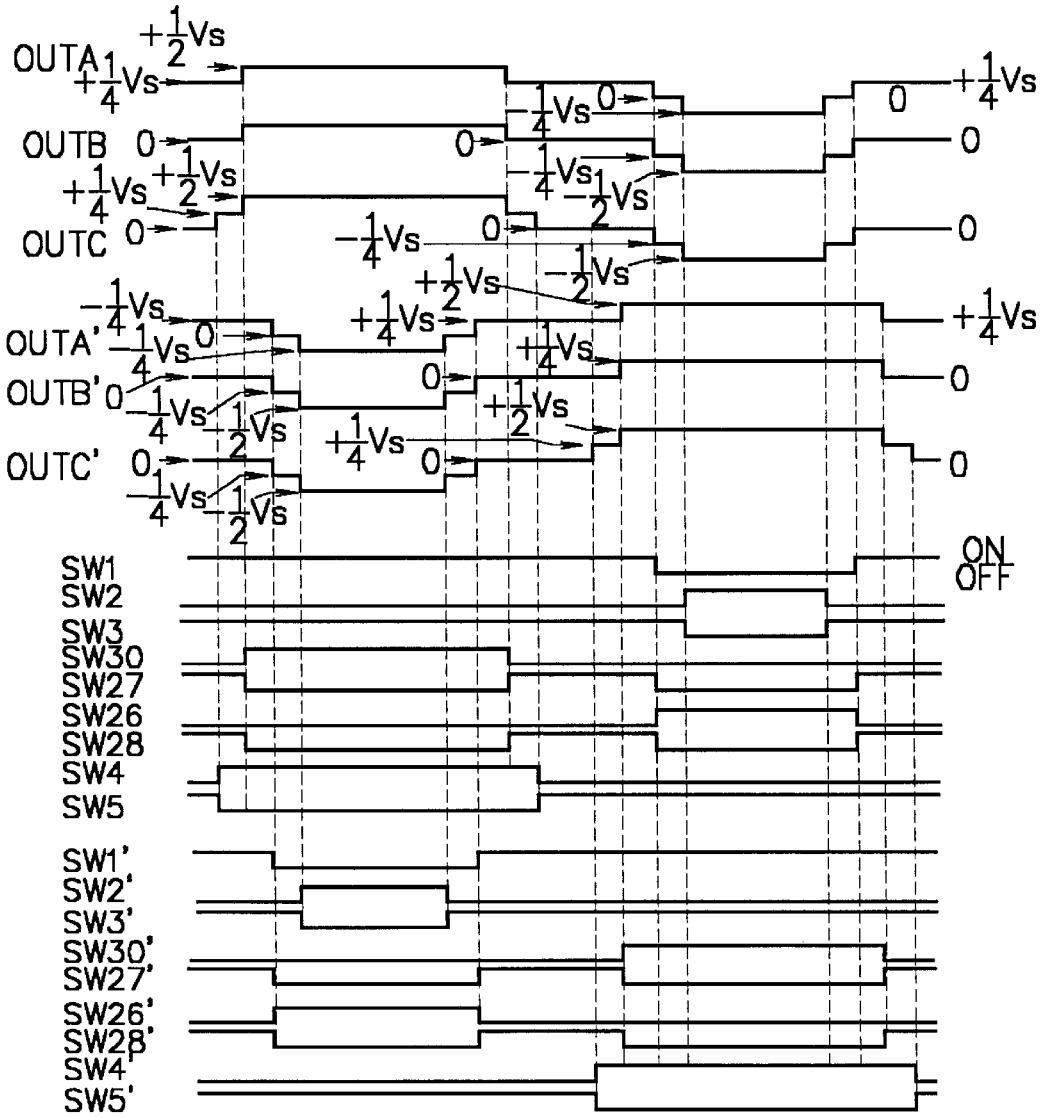
FIG. 95 is a timing chart showing an example of driving waveforms in a sustain discharge period by the driving apparatus constructed as in FIG. 94.

FIG. 95 is a timing chart showing an specific example of driving waveforms in sustain discharge period by the driving apparatus shown in FIG. 94.

Referring to FIG. 95, the waveform of the first signal line OUTA on the common electrode X side is the same as that shown in FIG. 91 except two differences described below. On the first difference, in the example of FIG. 91, the voltage of the second signal line OUTB is fixed to the ground level when the positive voltage is applied to the first signal line OUTA. Contrastingly in the example of FIG. 95, the voltage of the second signal line OUTB is raised to (+Vs/4) while the voltage of the first signal line OUTA is (+Vs/2).

On the second difference, in the example of FIG. 91, the voltage of the first signal line OUTA is at the ground level while the voltage of the second signal line OUTB is (−Vs/2). Contrastingly in the example of FIG. 95, the first signal line OUTA is lowered to the (−Vs/4) level. This second difference will be described below in detail.

The switches SW1, SW2, SW4, SW27, and SW28 are set OFF, and the switches SW3, SW5, and SW26 are set ON to lower the voltage of the second signal line OUTB .from the ground level to (−Vs/4). At this time, by keeping the switch SW30 OFF, the voltage of the first signal line OUTA is lowered from (Vs/4) to the ground level. Although the switches SW3 and SW26 are turned ON in this example, the switches SW2 and SW27 may be turned ON while the switches SW3 and SW26 are kept OFF. Further, when the switch SW28 is also turned ON, the charges accumulated in the capacitor C1 can be more efficiently used because the capacitors C7 and C1 can be connected in parallel.

Next, in the state that the voltages of the first and second signal lines OUTA and OUTB are thus respectively set at the ground level and (−Vs/4), the switches SW2 and SW3 are turned ON and OFF, respectively. The voltages of the first and second signal lines OUTA and OUTB are thereby lowered from the ground level to (−Vs/4) and from (−Vs/4) to (−Vs/2), respectively.

After this, the switches SW2 and SW3 are again turned OFF and ON, respectively. The voltages of the first and second signal lines OUTA and OUTB are thereby raised to the ground level and (−Vs/4), respectively. Next, like the first state, the switches SW1, SW3, SW27, SW28, and SW5 are turned ON, and the remaining switches SW2, SW26, SW4, and SW30 are turned OFF. The voltages of the first and second signal lines OUTA and OUTB are thereby set at (Vs/4) and the ground level, respectively.

A similar switching control to that on the common electrode X side is performed in relation to the switches SW1', SW2', SW3', SW26', SW27', SW28', SW4', SW5', and SW30' on the scanning electrode Y side. But, as shown in FIG. 94, the switching control is performed such that the output voltages of the output lines OUTC and OUTC' on the common electrode X side and the scanning electrode Y side are reverse in polarity to each other.

As described above, also in the example of construction of FIG. 94, the waveforms in which the positive and negative voltages (±Vs/2) are alternately repeated, can be generated on the output lines OUTC and OUTC' with a single power supply for generating the voltage (Vs/4). By applying the positive and negative voltages (±Vs/2) thus generated are applied in opposite phases to the output lines OUTC and OUTC' on the common electrode X side and the scanning electrode Y side, the difference voltage (Vs) can be applied between the common and scanning electrodes X and Y of the load 20. In this manner, since the absolute value of the voltage to be applied to the load 20 suffices to be ¼ the conventional one, the power loss can be held down to ¼ the conventional one. Thus, even in case of providing no power recovery circuit, the power use efficiency can be improved in comparison with the prior art.

For setting the voltage of the output line OUTC (OUTC') at the ground level, a method is thinkable in which the voltages of the first and second signal lines OUTA (OUTA') and OUTB (OUTB') are respectively set at the ground level and (−Vs/4), and then the switch SW4 (SW4') is turned ON. However, in order to obtain longer periods for charging the capacitors C1, C7, C4, and CB, the example shown in FIG. 94 is preferable.

Figure 96:
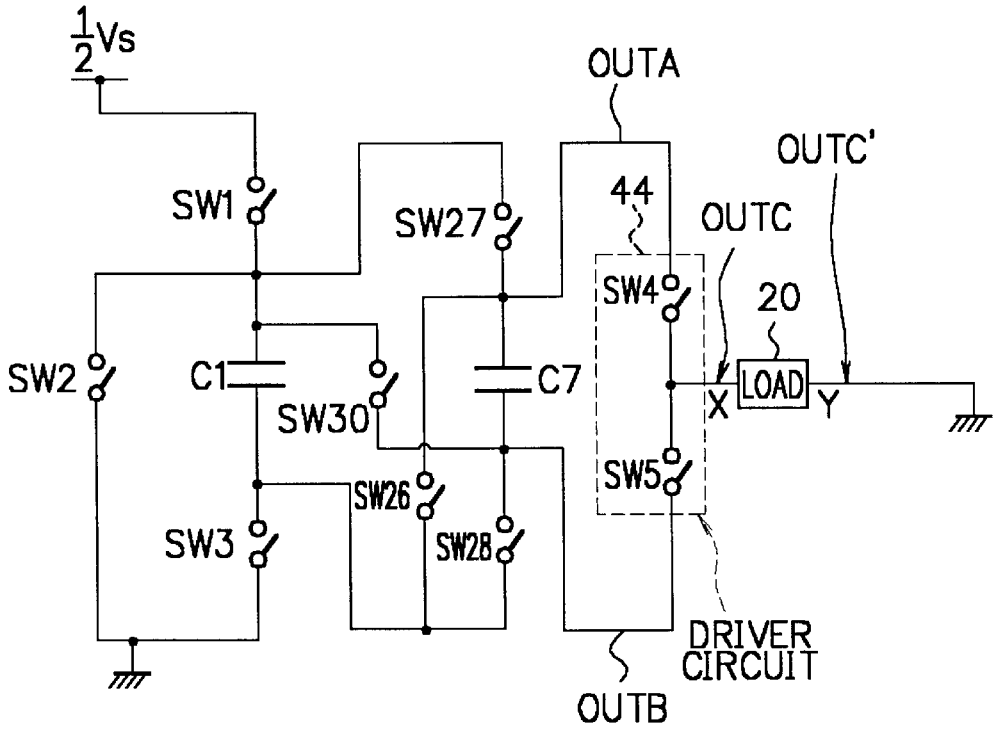
FIG. 96 is a circuit diagram showing another example of construction of a driving apparatus according to the thirteenth embodiment.
Figure 97:
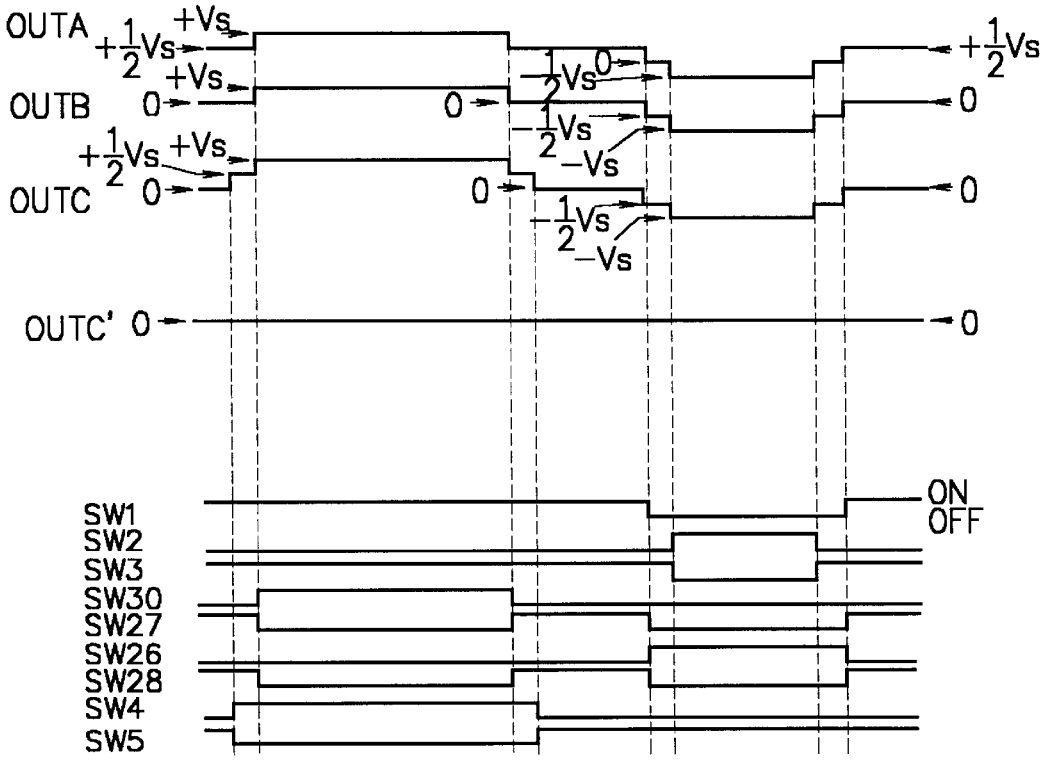
FIG. 97 is a timing chart showing an example of driving waveforms in a sustain discharge period by the driving apparatus constructed as in FIG. 96.

In this example, the positive and negative voltages (±Vs/2) are applied in opposite phases between the common and scanning electrodes X and Y. But, for example, the positive and negative voltages (±Vs) may be applied to the common electrode X while the scanning electrode Y side is connected to the ground, like the eleventh embodiment. In this case, the construction shown in FIG. 96 can be used. In the construction shown in FIG. 96, the construction on the common electrode X side is almost the same as that shown in FIG. 94 except the feature that the power supply line is not of (Vs/4) but of (Vs/2). In the construction shown in FIG. 96, the scanning electrode Y side is connected to the ground. The driving waveforms in this case are as shown in FIG. 97.

As described above, according to the example of FIG. 96, the waveforms in which the positive and negative voltages (±Vs) are alternately repeated, can be generated on the output lines OUTC and OUTC' with a single power supply for generating the voltage (Vs/2).

In the example of FIG. 94, the driving waveforms are generated with an A/D power supply of the voltage (Vs/4). But, by further adding, in series, low-voltage and low-power power supply circuit sections each having the same construction as the switches SW26 to SW28 and the capacitor C7 as shown in FIG. 94, the same driving waveforms can be generated with an A/D power supply of a smaller voltage (e.g., Vs/8, Vs/16, . . . ). Thus the power loss when driving the load 20 can be reduced more. For example, when a stages of such low-voltage and low-power power supply circuit sections are provided in series, the power loss when driving the load 20 is expressed by $2Cp\cdot(V/n)^2\cdot(nf)$. This shows that the power loss can be held down to 1/n the conventional one.

Figure 98:
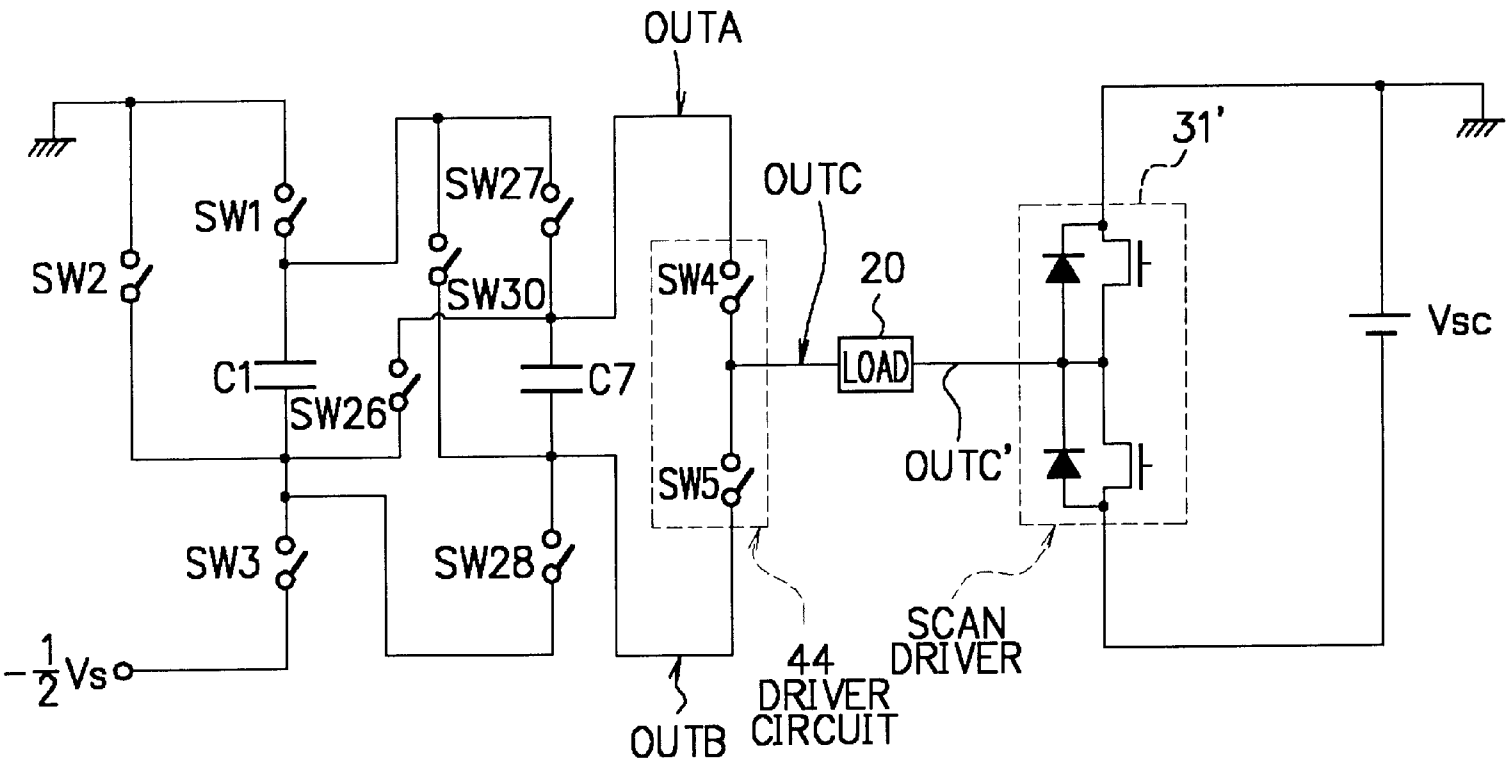
FIG. 98 is a circuit diagram showing another example of construction of a driving apparatus according to the thirteenth embodiment.

FIG. 98 is a circuit diagram showing another example of construction of a driving apparatus according to this thirteenth embodiment. In FIG. 98, the components having the same functions as those in FIGS. 96 and 84, are denoted by the same references as those in FIGS. 96 and 84, respectively. Thus the repetitive descriptions thereof will be omitted.

In the driving apparatus shown in FIG. 98, combined are the feature that two stages of low-voltage and low-power circuit sections are provided in series on the common electrode X side as shown in the example of FIG. 96, the feature that the negative voltage (Vs/2) is used as a power supply as shown in FIG. 87, and the feature that the scanning electrode Y side is made up from the scan driver 31' and the power supply line of the voltage Vsc, and the voltages (±Vs) are applied to one side of the load 20, as shown in FIG. 84.

This construction makes it possible to apply the voltages (±Vs) to the load 20 from the common electrode X side, thereby simplifying the circuit construction on the scanning electrode Y side. Besides, the external power supply voltage is (−Vs/2), and the power loss in relation to the load 20 becomes half the conventional one. Further, the breakdown voltage of either of the driver circuit 44 and the scan driver 31' is sufficed by Vs/2 or more (in case of Vsc=Vs/2). This shows that the breakdown voltage can be held down to half the conventional value.

Figure 99:
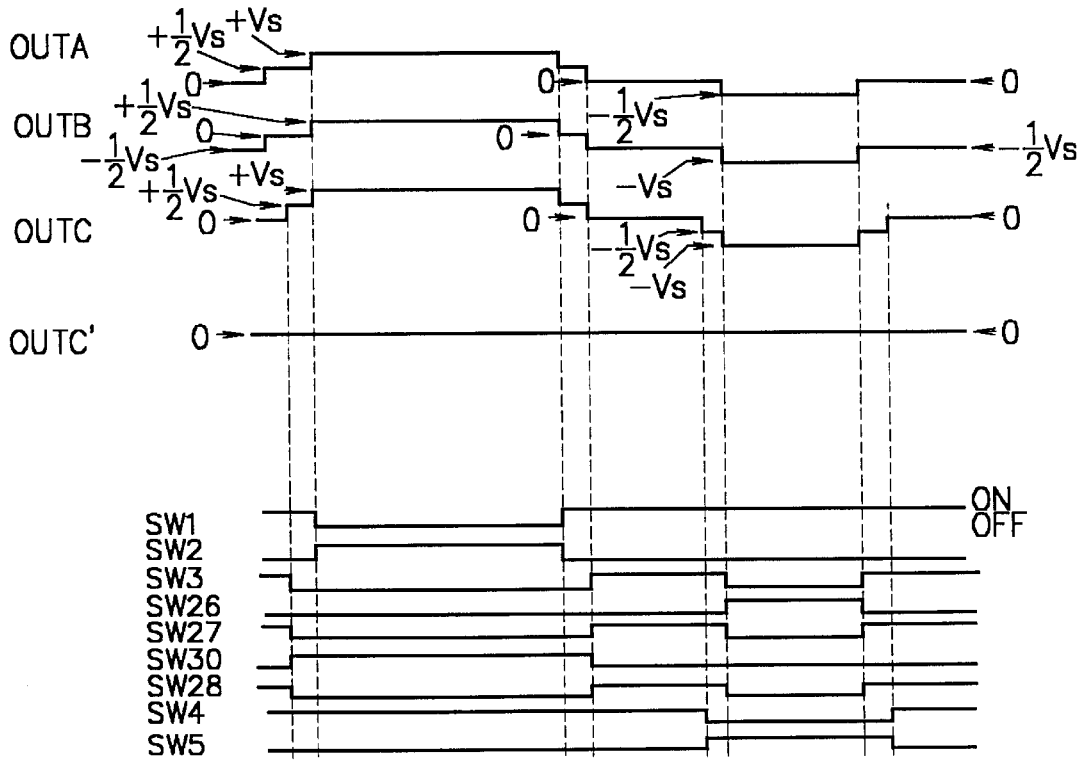
FIG. 99 is a timing chart showing an example of driving waveforms in a sustain discharge period by the driving apparatus constructed as in FIG. 98.

FIG. 99 is a timing chart showing a specific example of driving waveforms in sustain discharge period by the driving apparatus shown in FIG. 98.

Referring to FIG. 99, the driving waveforms of the output lines OUTC and OUTC' on the common electrode X side and the scanning electrode Y side are quite the same as those shown in FIG. 97. In the example of FIG. 97, the duration of either of the driving waveforms of the first and second signal lines OUTA and OUTB on the common electrode X side in the period of the (Vs/2) level is longer than that in the period of the ground level. This relation is reverse in the example of FIG. 99, i.e. the duration thereof in the period of the ground level is longer than that in the period of the (Vs/2) level. The other features of the waveforms in both drawings are almost the same.

For setting the voltage of the output line OUTC at the ground level, a method is thinkable in which the voltages of the first and second signal lines OUTA and OUTB are respectively set at (Vs/2) and the ground level, and then the switch SW5 is turned ON. However, in order to obtain longer periods. for charging the capacitors C1 and C7, the example shown in FIG. 99 is preferable, in which the voltages of the first and second signal lines OUTA and OUTB are respectively set at the ground level and (−Vs/2), and then the switch SW4 is turned ON.

Besides, for setting the voltages of the first and second signal lines OUTA and OUTB respectively at (Vs/2) and the-ground level, the switches SW1 and SW30 are turned ON in the example of FIG. 99. Alternatively, the switches SW2 and SW28 may be turned ON. Further, when the switch SW27 is also turned ON, the charges accumulated in the capacitor C1 can be more efficiently used.

Figure 1:
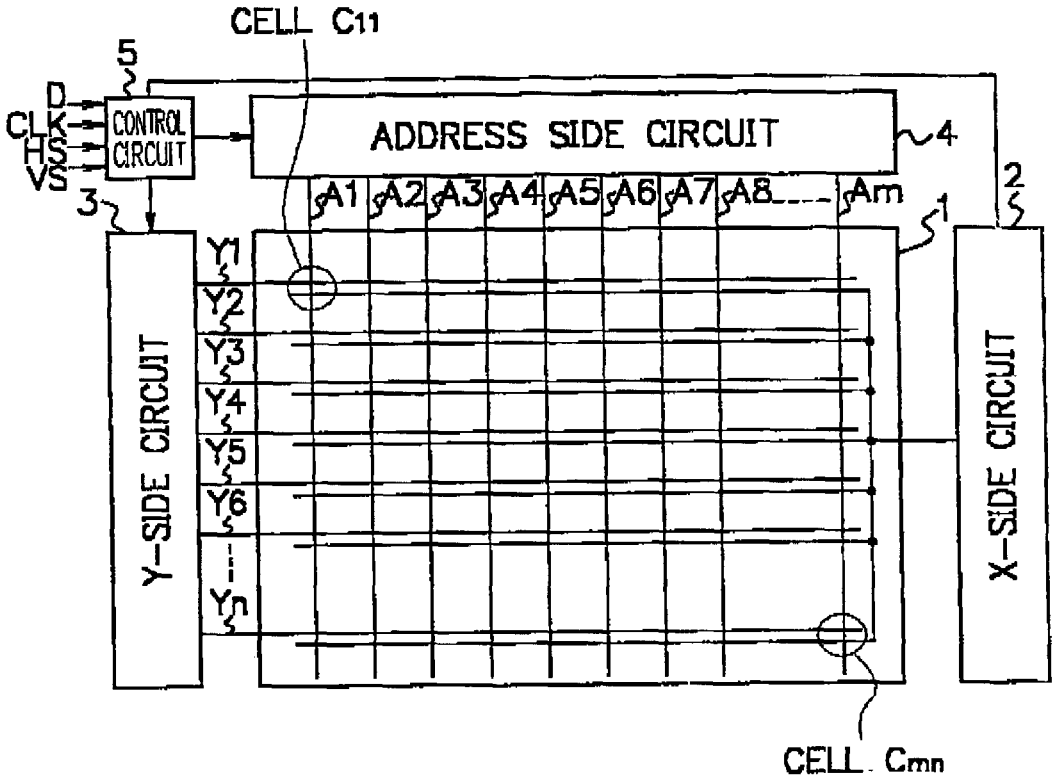
F I G. 1 PRIOR ART
FIG. 1 is a diagrammatic view showing the whole construction of an AC-driven plasma display panel (PDP) apparatus.
Figure 2A:
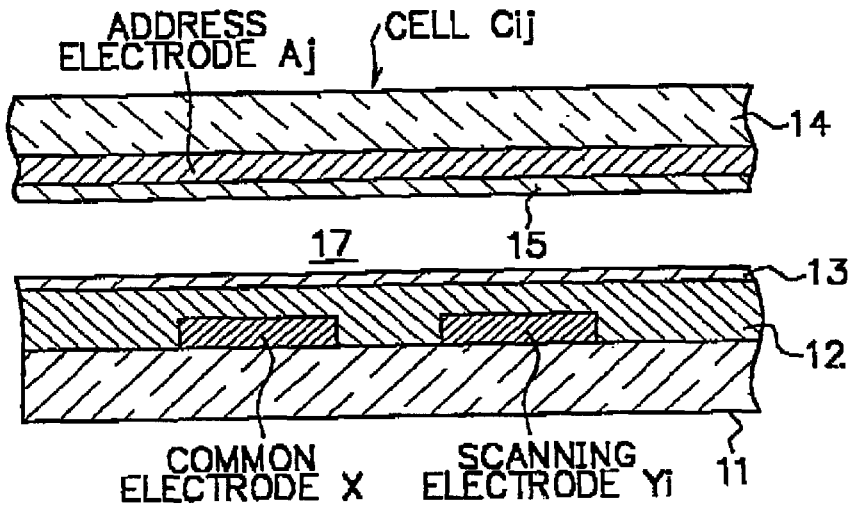
FIG. 2A PRIOR ART
FIGS. 2A to 2C are sectional views of a cell Cij as one pixel of the PDP, which is in the i-th row and the j-th column.
Figure 2B:
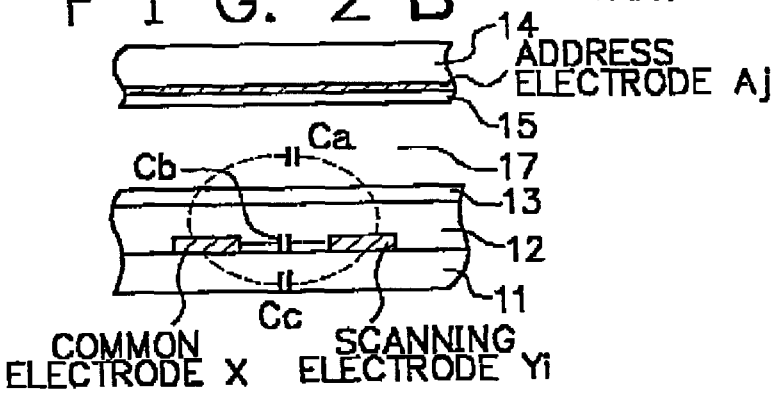
FIG. 2B PRIOR ART
Figure 2C:
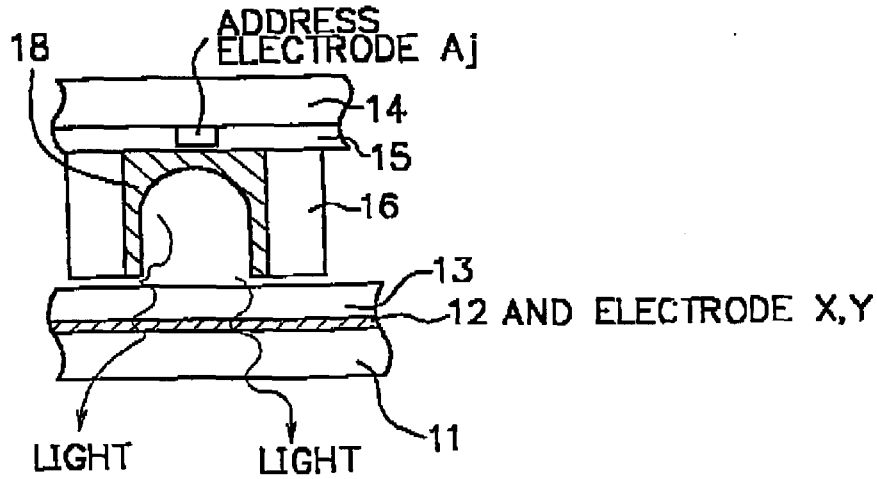
FIG. 2C PRIOR ART

The first to thirteenth embodiments of the present invention have been described above. Any of those driving apparatus is applicable to a plasma display apparatus. The construction of such a plasma display apparatus is as shown in FIGS. 1 to 3.

Fourteenth Embodiment

Next, the fourteenth embodiment of the present invention will be described.

In this fourteenth embodiment, the driving method shown in any of the above-described embodiments is applied to the driving method described in Japanese Patent No. 2801893, which has been acquired by the present applicant.

Figure 100:
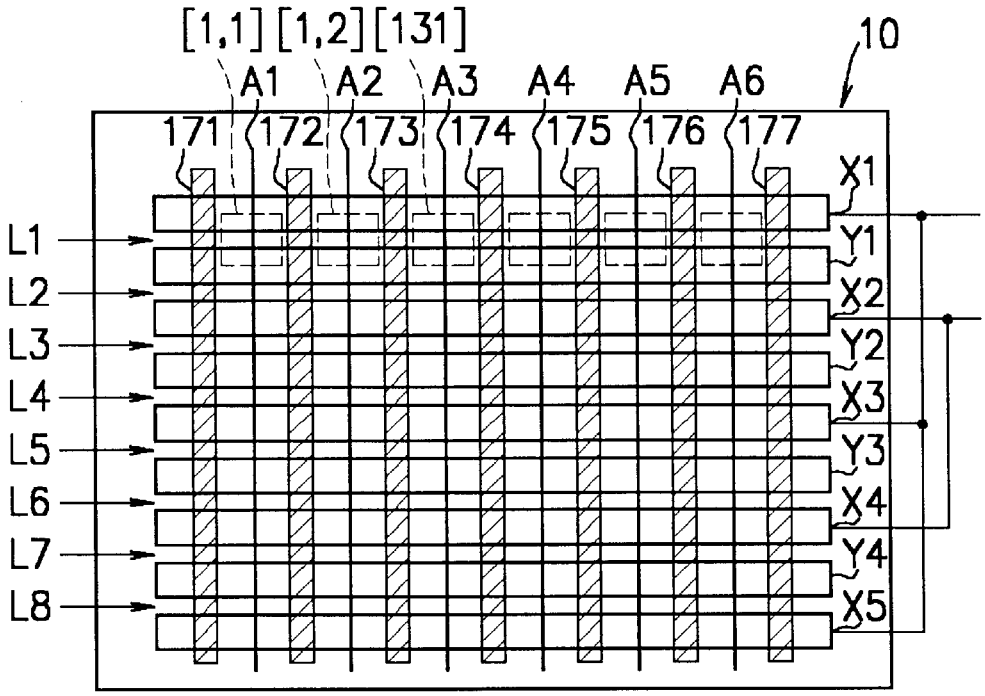
FIG. 100 is a diagrammatic view showing a schematic construction of a PDP according to the fourteenth embodiment of the present invention.
Figure 101:
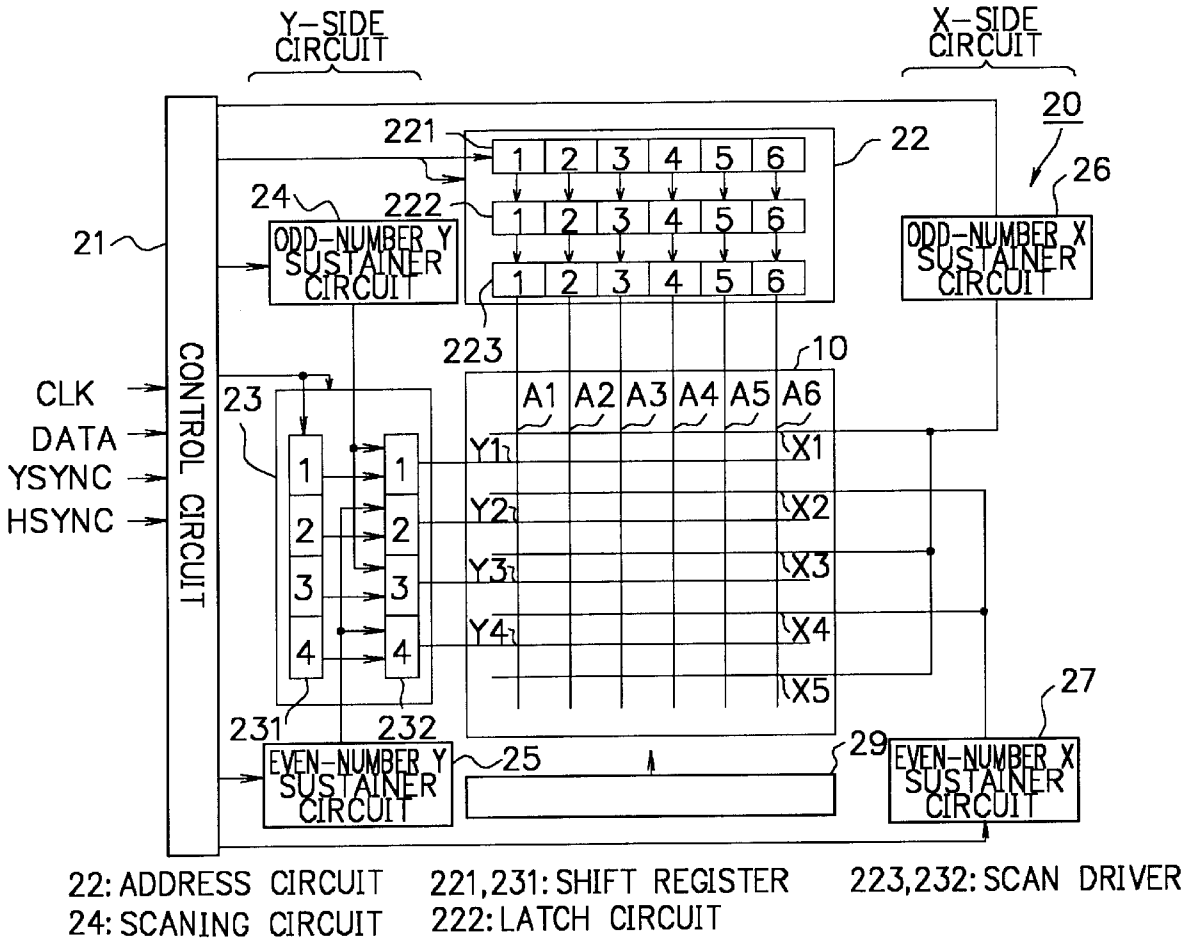
FIG. 101 is a block diagram showing an example of a schematic construction of a plasma display apparatus according to the fourteenth embodiment.
Figure 102:
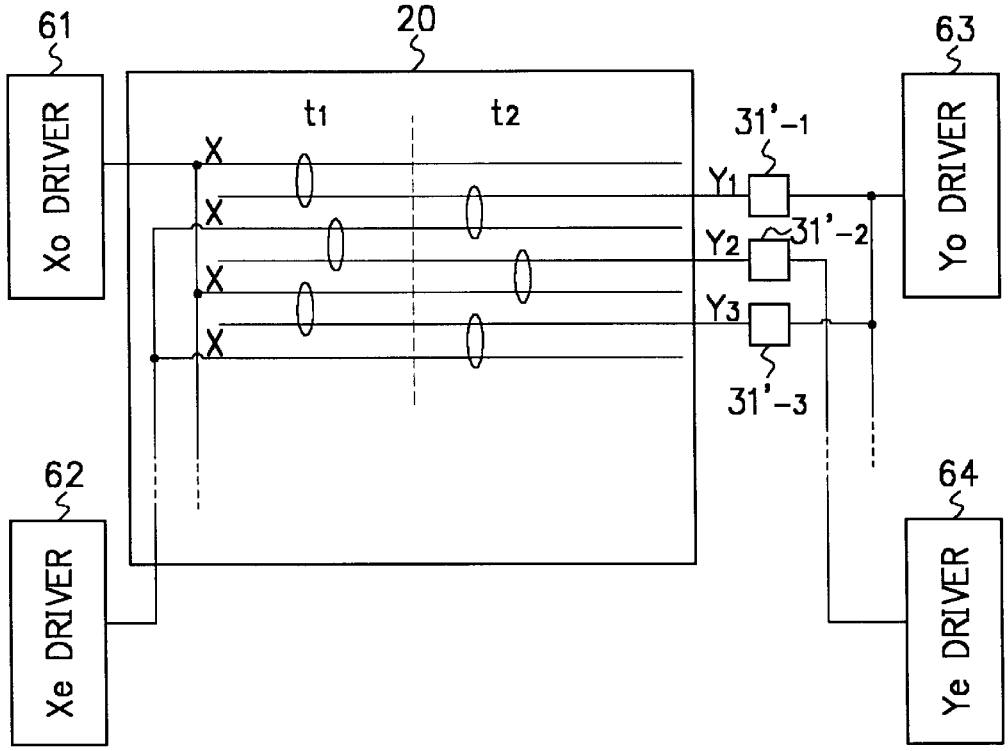
FIG. 102 is a block diagram showing an example of construction of a driving apparatus according to the fourteenth embodiment.

FIGS. 100 and 101 respectively show schematic constructions of the PDP and the plasma display apparatus described in the Japanese Patent No. 2801893. FIG. 102 shows a schematic construction of a driving apparatus for realizing the driving method described in the Japanese Patent No. 2801893.

The driving method described in the Japanese Patent No. 2801893 will be briefly described below with reference to FIG. 102. Referring to FIG. 102, of common electrodes X formed on one surface of a load 20 (PDP) to run parallel with one another, the common electrodes Xo in odd numbers are connected to an Xo driver 61 for odd number, and the common electrodes Xe in even numbers are connected to an Xe driver 62 for even number.

Scanning electrodes Y1 to Yn formed on the one surface of the load 20 (PDP) to run parallel with one another, are respectively connected to scan drivers $\mathbf{31'}_{-1}$ to $\mathbf{31'}_{-n}$ provided for the respective display lines. Of these scan drivers $\mathbf{31'}_{-1}$, to $\mathbf{31'}_{-n}$, the scan drivers $\mathbf{31'}_{-1}$, $\mathbf{31'}_{-3}$, . . . , in odd numbers are connected to a Yo common circuit 63 for odd number, and the scan drivers $\mathbf{31'}_{-2}$, $\mathbf{31'}_{-4}$, . . . , are connected to a Ye common circuit 64 for even number.

At a timing t1, the common and scanning electrodes X and Y are driven by the combination of the Xo driver 61 and the Yo common circuit 63, and the combination of the Xe driver 62 and the Ye common circuit 64. At the next timing t2, the common and scanning electrodes X and Y are driven by the combination of the Xo driver 61 and the Ye common circuit 64, and the combination of the Xe driver 62 and the Yo common circuit 63.

The above operations are repeated alternately with displaying the odd and even display lines in separate fields, thereby displaying the whole picture. While the drives corresponding to the drives at the above timings t1 are only performed in the conventional plasma display apparatus shown in FIG. 1, drives for interpolation of the drives of the display lines at the timings t1 are performed at timings t2 in the example of FIG. 102. This makes it possible to double apparently the number of display lines of the PDP, and improve the resolution and luminance of display.

In this fourteenth embodiment, the construction described in any of the above-described first to thirteenth embodiments is applied to each of the Xo driver 61, the Xe driver 62, the Yo common circuit 63, and the Ye common circuit 64 shown in FIG. 102.

More specifically, the load 20 shown in FIG. 102 is a plasma display panel, and the operations, e.g., described with reference to FIGS. 63 to 67 can apply to the Xo and Xe drivers 61 and 62 and the Yo and Ye common circuits 63 and 64. The scan driver 31' shown in FIG. 63 can apply to each of the scan drivers $\mathbf{31'}_{-1}$, $\mathbf{31'}_{-3}$, . . . shown in FIG. 102.

With this construction, the breakdown voltage of each element can be held down. Besides, with realizing a power saving by lowering used voltages, and a reduced cost by lowering used voltages and breakdown voltages, the display resolution and the luminance of PDP can be improved.

Fifteenth Embodiment

Next, the fifteenth embodiment of the present invention will be described.

Figure 103:
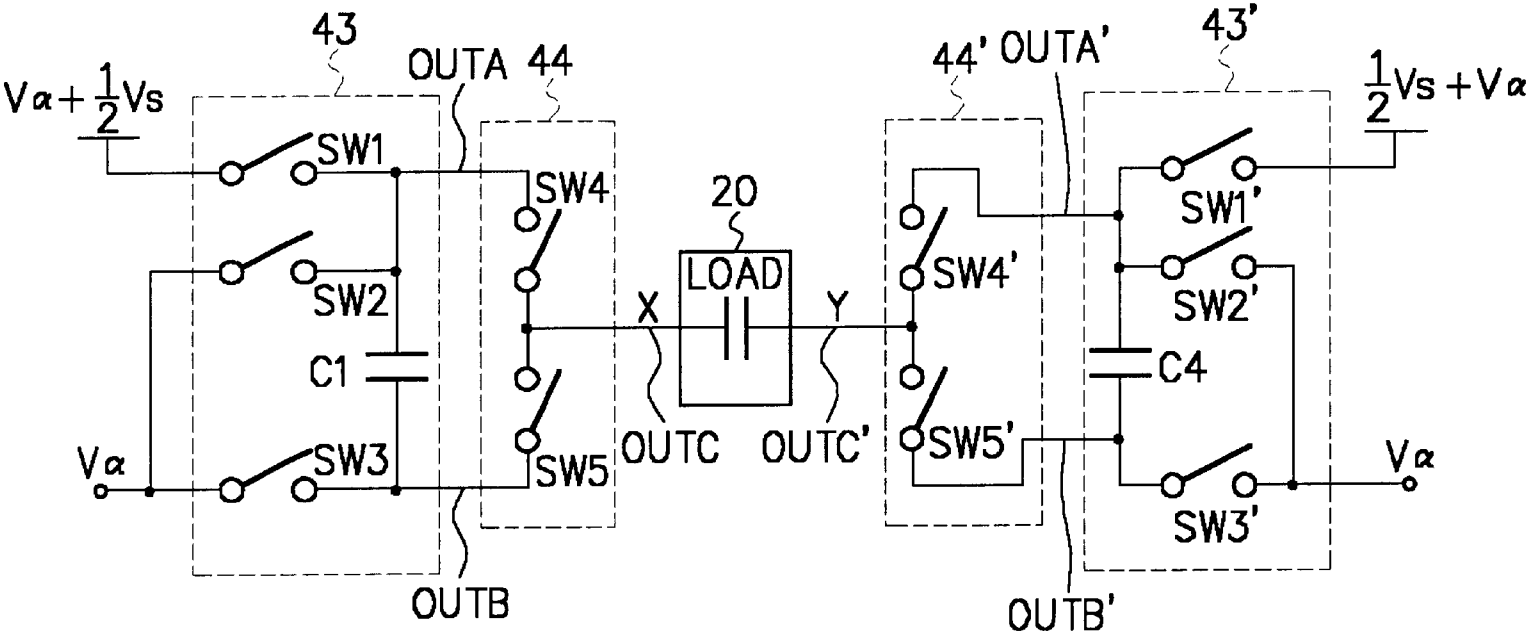
FIG. 103 is a block diagram showing an example of construction of a driving apparatus according to the fifteenth embodiment.
Figure 104:
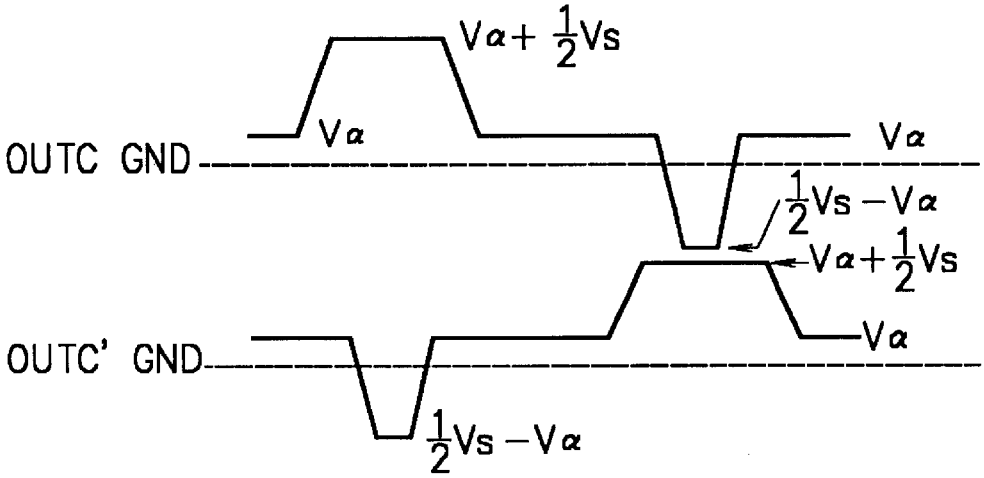
FIG. 104 is a timing chart showing an example of driving waveforms in a sustain discharge period by the driving apparatus constructed as in FIG. 103.

FIG. 103 shows an example in which the construction shown in FIG. 9 is modified. In FIG. 103, the corresponding parts to those in FIG. 9 are denoted by the same references as those in FIG. 9, respectively. This example of FIG. 103 differs from the example of FIG. 9 only on the feature of the input voltage of the power supply circuit. Consequently, the output waveforms of the output lines OUTC and OUTC' are as shown in FIG. 104. The specific operation is the same as that in case of the example of FIG. 2, so the description thereof is omitted.

Another Embodiment

Figure 105:
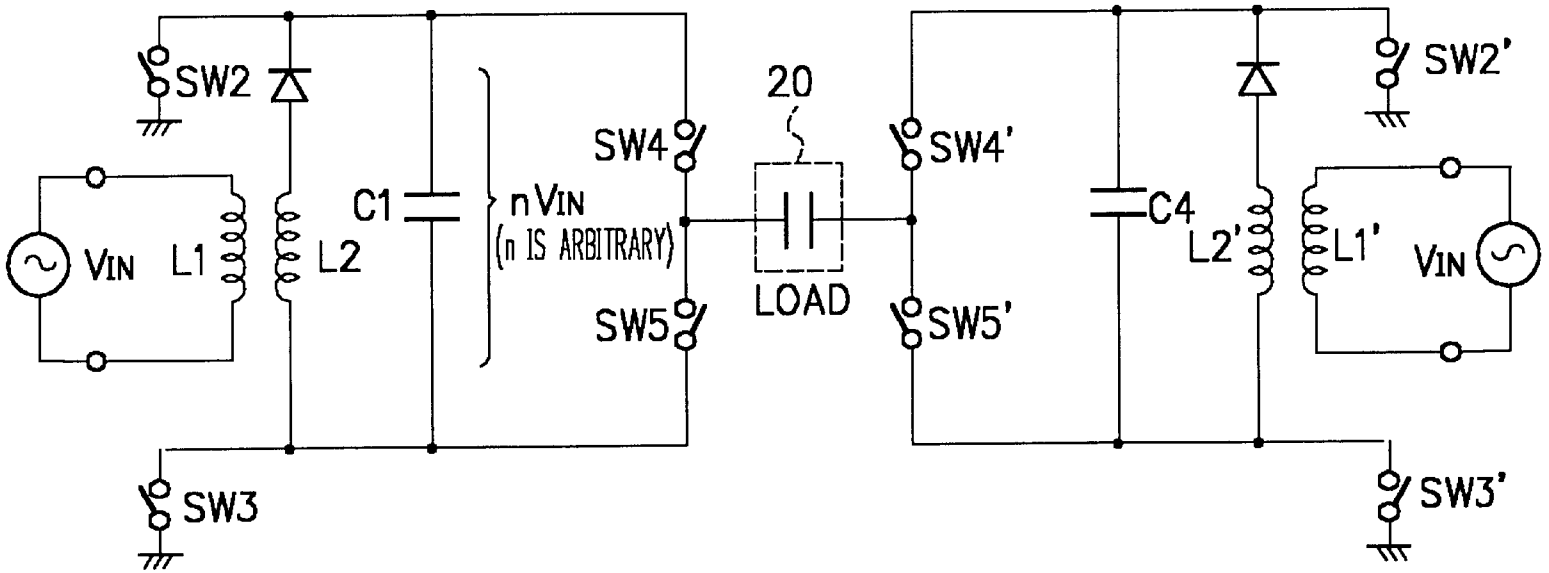
FIG. 105 is a circuit diagram showing an example of construction according to still another embodiment.

FIG. 105 is a circuit diagram showing another embodiment of the present invention. FIG. 105 shows another method for applying a voltage to the capacitor C1. More specifically, a power supply of VIN is provided on the primary side. On the secondary side, the voltage nVIN that is a times the input voltage VIN (n is an arbitrary number) is generated using the coils L1 and L2 to be applied to the capacitor C1. Using the switches SW2 and SW3, the operation of each of the above-described embodiments is realized. With this construction, the switch SW1 can be omitted, and the power supply can be simplified.

In the above embodiments, the driving voltage is applied to loads of flat display apparatus, in particular, of AC-driven PDP apparatus. However, the present invention is not limited to those examples and can also apply to apparatus other than such flat display apparatus.

What is claimed is:

1. A driving apparatus for applying predetermined voltages to a load, said apparatus comprising:

a first signal line supplying a voltage at a first level to one terminal of said load, a second signal line supplying a voltage at a second level to said one terminal of said load, a third signal line supplying a voltage at a third level to another terminal of said load, and a fourth signal line supplying a voltage at a fourth level to said another terminal of said load, wherein the voltage of said second signal line is set at a fifth level and the voltage of said first signal line is set at said first level so that the voltage at said first level is supplied to said one terminal of said load through said first signal line, while the voltage of said third signal line is set at a sixth level and the voltage of said fourth signal line is set at said fourth level so that the voltage at said fourth level is supplied to said another terminal of said load through said fourth signal line, the voltage of said first signal line is set at said fifth level and the voltage of said second signal line is set at said second level so that the voltage at said second level is supplied to said one terminal of said load through said second signal line, while the voltage of said fourth signal line is set at said sixth level and the voltage of said third signal line is set at said third level so that the voltage at said third level is supplied to said another terminal of said load through said third signal line; and the fifth level is intermediate the first and second levels and the sixth level is intermediate the third and fourth levels.

2. An apparatus according to claim 1, further comprising:

at least one of a first driving circuit for driving said load and a second driving circuit for driving said load, wherein:

said first driving circuit is provided between said first and second signal lines and selectively applies the voltage at said first level supplied through said first signal line and the voltage at said second level supplied through said second signal line to said one terminal of said load, and said second driving circuit is provided-between said third and fourth signal lines and selectively applies the voltage at said third level, supplied through said third signal line, and the voltage at said fourth level, supplied through said fourth signal line, to said other terminal of said load.

3. An apparatus according to claim 1, wherein at least one of said fifth level and said sixth level is the ground level.

4. An apparatus according to claim 1, further comprising at least one of first and second power supplies, wherein:

the first power supply generates a positive voltage in relation to said fifth level to supply the voltages at said first, second, and fifth levels to said first and second signal lines; and the second power supply generates a positive voltage in relation to said sixth level to supply the voltages at said third, fourth, and sixth levels to said third and fourth signal lines.

5. An apparatus according to claim 1, Further comprising at least one of first and second power supplies, wherein:

the first power supply generates a negative voltage in relation to said fifth level to supply the voltages at said first, second, and fifth levels to said first and second signal lines; and the second power supply generates a negative voltage in relation to said sixth level to supply the voltages at said third, fourth, and sixth levels to said third and fourth signal lines.

6. An apparatus according to claim 1, wherein said first and second levels are equal to said third and fourth levels, respectively, said fifth and sixth levels are both the ground level, and a common power supply is provided for generating the voltage at said first and third or said second and fourth level on both sides of said load.

7. An apparatus according to claim 1, wherein said first and second levels are different from said third and fourth levels, respectively.

8. An apparatus according to claim 7, wherein either said first or second level, and either said third or fourth level are the ground level.

9. An apparatus according to claim 1, further comprising a power supply, generating a positive voltage in relation to said sixth level, and supplying the voltages at said third, fourth, and sixth levels to said third and fourth signal lines.

10. An apparatus according to claim 1, further comprising a power supply, generating a negative voltage in relation to said sixth level, and supplying the voltages at said third, fourth, and sixth levels to said third and fourth signal lines.

11. An apparatus according to claim 1, wherein a timing for supplying the voltage at said first level to said one terminal of said load is earlier than a timing for supplying the voltage at said fourth level to said other terminal of said load, and a timing for supplying the voltage at said third level to said other terminal of said load is earlier than the timing for supplying the voltage at said second level to said one terminal of said load.

12. An apparatus according to claim 11, wherein a pulse width of the voltage at said first level is greater than a pulse width of the voltage at said fourth level, and a pulse width of the voltage at said third level is greater than a pulse width of the voltage at said second level.

13. An apparatus according to claim 1, wherein a timing for supplying the voltage at said fourth level to said other terminal of said load is earlier than a timing for supplying the voltage at said first level to said one terminal of said load, and a timing for supplying the voltage at said second level to said one terminal of said load is earlier than a timing for supplying the voltage at said third level to said other terminal of said load.

14. An apparatus according to claim 13, wherein a pulse width of the voltage at said fourth level is greater than a pulse width of the voltage at said first level, and a pulse width of the voltage at said second level is greater than a pulse width of the voltage at said third level.

15. An apparatus according to claim 1, wherein the voltage at said first level is supplied to said one terminal of said load in a state that the voltage at said fourth level is supplied to said other terminal of said load, and the voltage at said third level is supplied to said other terminal of said load in a state that the voltage at said second level is supplied to said one terminal of said load.

16. An apparatus according to claim 15, wherein the voltage at said third level is supplied to said other terminal of said load before the voltage being applied to said one terminal of said load is changed from the voltage at said first level to the voltage at said second level, said one terminal of said load is made in a high impedance state, and the voltage at said third level supplied to said other terminal of said load is changed to the voltage at said fourth level.

17. An apparatus according to claim 1, wherein the voltage at said fourth level is supplied to said other terminal of said load in a state that the voltage at said first level is supplied to said one terminal of said load, and the voltage at said second level is supplied to said one terminal of said load in a state that the voltage at said third level is supplied to said other terminal of said load.

18. An apparatus according to claim 1, wherein the voltage, at said third level is supplied to said other terminal of said load before the voltage being applied to said one terminal of said load is changed from the voltage at said first level to the voltage at said fifth level, said one terminal of said load is made in a high impedance state, and the voltage at said third level supplied to said another terminal of said load is changed to the voltage at said sixth level.

19. An apparatus according to claim 1, wherein the timing for supplying the voltage at said first level to said one terminal of said load is earlier than the timing for, supplying the voltage at said fourth level to said other terminal of said load, and the timing for supplying the voltage at said second level to said one terminal of said load is earlier than the timing for supplying the voltage at said third level to said another terminal of said load.

20. An apparatus according to claim 1, further comprising:

first and second switches connected in series between a first power supply, supplying the voltage at said first or second level, and a second power supply, supplying the voltage at said fifth level;

a capacitor having one terminal connected to a node between said first and second switches;

a third switch connected between another terminal of said capacitor and said second power supply;

said first and second signal lines are connected to opposite terminals of said capacitor; and said first and second signal lines are connected to said one terminal of said load.

21. An apparatus according to claim 20, further comprising:

fourth and fifth switches connected in series between said first and second signal lines.

22. An apparatus according to claim 21, wherein said fourth switch is turned ON after said first switch is turned ON.

23. An apparatus according to claim 21, wherein said first switch is turned ON after said fourth switch is turned ON.

24. An apparatus according to claim 21, wherein control of said first to fifth switches is performed in accordance with a program recorded in a recording medium.

25. An apparatus according to claim 20, further comprising:

sixth and seventh switches connected in series between a third power supply, supplying the voltage at said third or fourth level, and a fourth power supply, supplying the voltage at said sixth level;

a capacitor having one terminal thereof connected to a node between said sixth and seventh switches; and an eighth switch connected between the another terminal of said capacitor and said fourth power supply;

said third and fourth signal lines are connected to opposite terminals of said capacitor, and said third and fourth signal lines are connected to said another terminal of said load.

26. An apparatus according to claim 25, further comprising:

ninth and tenth switches connected in series between said third and fourth signal lines connected to opposite terminals of said capacitor; and a node between said ninth and tenth switches connected to another terminal of said load.

27. An apparatus according to claim 26, wherein said load is a plasma display panel, and said ninth switch serves as either of a switching element, generating a pulse to be applied to said load in an address period, and a switching element, generating a pulse to be applied to said load in a sustain discharge period.

28. An apparatus according to claim 26, wherein said load is a plasma display panel, and said tenth switch serves as either a switching element, generating a pulse to be applied to said load in an address period, and a switching element, generating a pulse to be applied to said load in a sustain discharge period.

29. An apparatus according to claim 25, further comprising a circuit supplying a voltage other than said predetermined voltage, to said load.

30. An apparatus according to claim 20, wherein said load is a plasma display panel, and said apparatus further comprises an eleventh switch connected between a power supply, generating a write voltage in a reset period, and said fourth signal line.

31. An apparatus according to claim 30, wherein a sum of the voltage, supplied from said first power supply, and the voltage, supplied from said power supply for generating a write voltage, is applied to said load.

32. An apparatus according to claim 30, wherein only the voltage supplied from said power supply generating a write voltage is applied to said load.

33. An apparatus according to claim 30, wherein a pulse, in which the voltage being applied changes gradually with elapsing time, is applied to said load in reset period.

34. An apparatus according to claim 25, further comprising plurality of circuits applying voltages other than said predetermined voltages to said load from the respective power supplies.

35. An apparatus according to claim 25, wherein said load is a line-sequential scan type plasma display panel, and said apparatus further comprises a scan driver circuit connected between said third and fourth signal lines and generating a pulse to be applied to said load in an address period.

36. An apparatus according to claim 35, wherein said load is a line-sequential scan type plasma display panel, and said apparatus further comprises:

an integrated circuit comprising scan driver circuits provided for the respective display lines of said line-sequential scan type plasma display panel.

37. An apparatus according to claim 36, wherein said scan driver circuits are provided on both sides of said load, and said scan driver circuits and the driving circuits on both sides of said load are made up into said integrated circuit.

38. An apparatus according to claim 35, further comprising:

ninth and tenth switches connected in series between said third and fourth signal lines connected to the terminals of said capacitor, wherein said scan driver circuit is connected between said third and fourth signal lines through said ninth and tenth switches.

39. An apparatus according to claim 25, further comprising a power recovery circuit connected between said third and fourth signal lines.

40. An apparatus according to claim 39, wherein said load is a plasma display panel, and said apparatus further comprises:

a scan driver circuit connected between said third and fourth signal lines and generating a pulse to be applied to said load in an address period; and a switching operation in said power recovery circuit is performed by a switching element in said scan driver circuit.

41. An apparatus according to claim 20, wherein each of said first to third switches is made up of a MOSFET and a diode connected to said MOSFET.

42. An apparatus according to claim 20, wherein said first switch is made up of a p- or n-channel MOSFET, connected to said first power supply, and a diode having an anode connected to the drain or the source of said p- or n-channel MOSFET.

43. An apparatus according to claim 20, wherein said second switch is made up of an n-channel MOSFET, connected to said second power supply, and a diode having a cathode connected to the drain of said n-channel MOSFET.

44. An apparatus according to claim 20, wherein said third switch is made up of two sets of a MOSFET and a diode connected to said MOSFET, said two sets being connected to each other.

45. An apparatus according to claim 20, further comprising an offset circuit generating an offset voltage on said first and second signal lines.

46. An apparatus according to claim 20, further comprising a power recovery circuit connected between said first and second signal lines.

47. An apparatus according to claim 46, wherein said power recovery circuit comprises two systems of resonance circuits.

48. An apparatus according to claim 46, wherein said power recovery circuit comprises one system of a resonance circuit.

49. An apparatus according to claim 46, further comprising a diode connected between a coil in said power recovery circuit and said load.

50. An apparatus according to claim 46, wherein said power recovery circuit comprises:

two capacitors for providing power recovery and connected in series between said first and second signal lines; and a coil connected through a switching element to a node between said two capacitors for power recovery.

51. An apparatus according to claim 1, further comprising:

first, fourth, and second switches connected in series between a first power supply, supplying the voltage at said first or second level, and a second power supply, supplying the voltage at said fifth level;

a capacitor having one terminal connected to a node between said fourth and second switches;

a third switch connected between another terminal of said capacitor and said second power supply; and a fifth switch connected between said first signal line, connected to the node between said first and fourth switches, and said second signal line, connected to said other terminal of said capacitor; and said one terminal of said load is connected to the node between said first signal line and said fifth switch.

52. An apparatus according to claim 1, further comprising:

first and second switches connected in series between a first power supply, supplying the voltage at said first or second level, and a second power supply, supplying the voltage at said fifth level;

a capacitor having one terminal connected to a node between said first and second switches;

fifth and third switches connected in series between another terminal of said capacitor and said second power supply;

a fourth switch connected between said first signal line, connected to said one terminal of said capacitor, and said second signal line, connected to a node between said fifth and third switches; and said one terminal of said load is connected to a node between said fourth switch and said second signal line.

53. An apparatus according to claim 1, wherein said load is a plasma display panel in which scanning electrodes and common electrodes are alternately disposed and address electrodes are disposed so as to cross the scanning electrodes and common electrodes, the voltages at said first and second levels, respectively supplied through said first and second signal lines, are selectively applied to said common electrodes and the voltages at said third and fourth levels, respectively supplied through said third and fourth signal lines, are selectively applied to said scanning electrodes.

54. An apparatus according to claim 53, wherein voltages in opposite phases are respectively applied to said common and scanning electrodes.

55. An apparatus according to claim 54, wherein the potentials of said address electrodes are set at the ground level in a sustain period.

56. An apparatus according to claim 1, wherein said load is a line-sequential scan type, and memory type, plasma display panel in which scanning electrodes and common electrodes are alternately disposed, said apparatus further comprising:

an odd number common electrode driver driving the common electrodes in odd numbers, and an even number common electrode driver driving the common electrodes in even numbers; and an odd number scanning electrode driver driving the scanning electrodes in odd numbers, and an even number scanning electrode driver driving the scanning electrodes in even numbers, either of said odd number and even number common electrode drivers comprises said first and second signal lines, and either of said odd number and even number scanning electrode drivers comprises said third and fourth signal lines, said scanning and common electrodes are driven at one timing determined by a combination of said odd number common electrode driver and said odd number scanning electrode driver, and the combination of said even number common electrode driver and said even number scanning electrode driver, and at another timing by a combination of said odd number common electrode driver and said even number scanning electrode driver, and a combination of said even number common electrode driver and said odd number scanning electrode driver, and voltages are thereby applied to said load by alternately switching the combinations of said drivers on the common electrode side and said drivers on the scanning electrode side.

57. An apparatus according to claim 1, further comprising:

first and second switches connected in series between a first power supply, supplying the voltage at said first or second level, and a second power supply, supplying the voltage at said fifth level;

a first capacitor having one terminal connected to a node between said first and second switches;

a third switch connected between another terminal of said first capacitor and said second power supply;

a sixth switch, a second capacitor, and a seventh switch connected in series between said first and second power supplies;

an eighth switch connected between said another terminal of said first capacitor and one terminal of said second capacitor;

fourth and fifth switches connected between said first signal line connected to said one terminal of said first capacitor and said second signal line connected to another terminal of said second capacitor; and a node between said fourth and fifth switches is connected to said one terminal of said load.

58. An apparatus according to claim 1, further comprising:

a transformer comprising a primary coil connected to a power supply and supplying the voltage at said first level, and a secondary coil;

a capacitor connected to opposite terminals of the secondary coil;

a first switch connected between a power supply, supplying the voltage at said fifth level, and one terminal of said secondary coil;

a second switch connected between said power supply, supplying the voltage at said fifth level, and another terminal of said secondary coil; and third and fourth switches, connected in series between said first and second signal lines, and connected to the terminals of said capacitor, wherein the node between said third and fourth switches is connected to said one terminal of said load.

59. A driving apparatus according to claim 1, wherein the fifth and sixth levels are at substantially a middle level between the first and second, and the third and fourth levels, respectively.

60. A driving method for applying predetermined voltages to a load, wherein:

the voltage of a first signal line is changed between first and fifth levels, and the voltage of a second signal line is changed between said fifth level and a second level, while the voltage of a third signal line is changed between third and sixth levels, and the voltage of a fourth signal line is changed between said sixth level and a fourth level;

the voltage at said first level, supplied by said first signal line in a state that the voltage of said second signal line is set at said fifth level, is supplied to one terminal of said load, while the voltage at said fourth level, supplied by said fourth signal line in a state that the voltage of said third signal line is set at said sixth level, is supplied to other terminal of said load;

the voltage at said second level, supplied by said second signal line in the state that the voltage of said first signal line is set at said fifth level, is supplied to said one terminal of said load, while the voltage at said third level, supplied by said third signal line in the state that the voltage of said fourth signal line is set at said sixth level, is supplied to said other terminal of said load; and the fifth level is intermediate the first and second levels and the sixth level is intermediate the third and fourth levels.

61. A driving apparatus for applying predetermined voltages to a load, said apparatus comprising:

a first signal line for supplying a voltage at a first level or a fifth level to one terminal of said load, a second signal line for supplying a voltage at a second level or said fifth level to said one terminal of said load, a third signal line for supplying a voltage at a third level or a sixth level to other terminal of said load, and a fourth signal line for supplying a voltage at a fourth level or said sixth level to another terminal of said load, wherein:

the voltage of said second signal line is set at said fifth level and the voltage of said first signal line is set at said first level so that the voltage at said first level is supplied to said one terminal of said load through said first signal line, or the voltage at said fifth level is supplied to said one terminal of said load through said second signal line, while the voltage of said third signal line is set at said sixth level and the voltage of said fourth signal line is set at said fourth level so that the voltage at said fourth level is supplied to said other terminal of said load through said fourth signal line, or the voltage at said sixth level is supplied to said other terminal of said load through said third signal line, the voltage of said first signal line is set at said fifth level and the voltage of said second signal line is set at said second level so that the voltage at said second level is supplied to said one terminal of said load through said second signal line, or the voltage at said fifth level is supplied to said one terminal of said load through said first signal line, while the voltage of said fourth signal line is set at said sixth level and the voltage of said third signal line is set at said third level so that the voltage at said third level is supplied to said other terminal of said load through said third signal line, or the voltage at said sixth level is supplied to said other terminal of said load through said fourth signal line, and the fifth level is Intermediate the first and second levels and the sixth level is Intermediate the third and fourth levels.

62. A driving apparatus according to claim 61, wherein the fifth and sixth levels are at substantially a middle level between the first and second, and the third and fourth levels, respectively.

63. A driving method of a plasma display apparatus including a plasma display panel having a pair of electrodes between which a discharge occurs, said method comprising:

a first step of supplying a voltage at a first level to one of said electrodes, and supplying the voltage at said first level to one terminal of a first capacitor to charge said first capacitor with the voltage at said first level;

a second step of outputting a voltage at a second level reversed in polarity to the voltage at said first level, from the other terminal of said first capacitor, and supplying the voltage at said second level to said one of said electrodes;

a third step of supplying a voltage at a third level to the other of said electrodes, and supplying the voltage at said third level to one terminal of a second capacitor to charge said second capacitor with the voltage at said third level; and a fourth step of outputting a voltage at a fourth level, reversed in polarity to the voltage at said third level, from the other terminal of said second capacitor, and supplying the voltage at said fourth level to said other of said electrodes, and said first and fourth steps are performed at substantially the same time so that a voltage required for a discharge and obtained due to the potential difference between the voltages at said first and fourth levels is applied between said electrodes, and then said second and third steps are performed at substantially the same time so that a voltage required for a discharge, and obtained due to the potential difference between the voltages at said second and third levels, is applied between said electrodes.

64. A method according to claim 63, wherein, in either of said first and second steps, a voltage at a fifth level is applied as a reference potential to one of said electrodes after the voltage at said first level or said second level is applied to said one of said electrodes, and in either of said third and fourth steps, a voltage at a sixth level is applied as a reference potential to the other of said electrodes after the voltage at said third or fourth level is applied to said other of said electrodes.

65. A driving method for applying predetermined voltages to a load, wherein:

a voltage of a first signal line is changed between first and fifth levels, and a voltage of a second signal line is changed between said fifth level and a second level, while a voltage of a third signal line is changed between third and sixth levels, and a voltage of a fourth signal line is changed between said sixth level and a fourth level;

the voltage at said first level on said first signal line, or the voltage at said fifth level on said second signal line, is supplied to one terminal of said load, in the state that the voltage of said first signal line is set at said first level and the voltage of said second signal line is set at said fifth level, while the voltage at said fourth level on said fourth signal line, or the voltage at said sixth level on said third signal line is supplied to other terminal of said load, in the state that the voltage of said fourth signal line is set at said fourth level and the voltage of said third signal line is set at said sixth level;

the voltage at said second level on said second signal line, or the voltage at said fifth level on said first signal line, is supplied to said one terminal of said load, in the state that the voltage of said second signal line is set at said second level and the voltage of said first signal line is set at said fifth level, while the voltage at said third level supplied by said third signal line, or the voltage at said sixth level supplied by said fourth signal line, is supplied to said other terminal of said load, in the state that the voltage of said third signal line is set at said third level and the voltage of said fourth signal line is set at said sixth level; and the fifth level is intermediate the first and second levels and the sixth level is intermediate the third and fourth levels.

66. A driving apparatus according to claim 65, wherein the fifth and sixth levels are at substantially a middle level between the first and second, and the third and fourth levels, respectively.

67. A driving circuit of a plasma display panel, comprising:

a pair of driving apparatuses, respectively connected to a pair of electrodes forming a discharge cell of an AC-driven plasma display panel, generating first and second pulse voltage waves which reverse their respective polarities in a positive or a negative direction from a voltage at a reference level, in mutually opposite phases, and supplying a predetermined sustain pulse voltage, as a difference voltage between the first and second pulse voltage waves, to said discharge cell; and each of said respective driving apparatuses further comprises a power supply for outputting almost one half a voltage of said predetermined sustain pulse voltage with reference to ground potential, a capacitor charged at a first terminal thereof by a voltage which is supplied from the power supply, and a switching circuit connecting a second terminal and the first terminal of the capacitor alternately to the ground potential while connecting the first terminal and the second terminal alternately to said respective electrodes.

68. A driving method of a plasma display apparatus including a plasma display panel, said method comprising:

supplying a voltage at a first level to said plasma display panel to drive said plasma display panel, and supplying the voltage at said first level to a first terminal of a capacitor to charge said capacitor with the voltage at said first level; and interrupting the supply of the voltage at said first level to said plasma display panel and the first terminal of said capacitor, outputting a voltage at a second level, opposite in polarity to the voltage at said first level, from a second terminal of said capacitor, and supplying the voltage at said second level to said plasma display panel.

69. A driving method of a plasma display apparatus according to claim 68, the plasma display panel comprising a pair of electrodes, wherein:

the voltage at said first level or the voltage at said second level is supplied to one of said pair of electrodes; and a fixed voltage is supplied to the other of said pair of electrodes by connecting the other of said pair of electrodes to a fixed power supply or the ground.

70. A driving method of a plasma display apparatus according to claim 68, the plasma display panel comprising a pair of electrodes, wherein:

the voltage of said first level or the voltage at said second level is supplied to one of said pair of electrodes, and a fixed voltage is supplied to the other of said pair of electrodes through a switching element by connecting the other of said pair of electrodes to a fixed power supply or the ground.

71. A driving method of a plasma display apparatus according to claim 68, the plasma display panel comprising a pair of electrodes, wherein:

the voltage at said first level or the voltage at said second level is supplied to one of said pair of electrodes, and a fixed voltage is supplied to the other of said pair of electrodes through a scan driver circuit for generating a pulse to be applied in address period and a switching element by connecting the other of said pair of electrodes to a fixed power supply or the ground.

72. A driving method of a plasma display apparatus according to claim 71, wherein said scan driver circuit is connected also to the ground through a switching element.

73. A driving method of a plasma display apparatus according to claim 72, wherein said switching element connected to said ground is provided within said scan driver circuit.

74. A driving apparatus for applying a predetermined voltage to a load, said apparatus comprising:

first and second switches connected in series at a node and between a power supply, supplying a voltage at a first level, and a reference level;

a capacitor having one terminal connected to the node between said first and second switches;

a third switch connected between a second terminal of said capacitor and said reference level;

a first signal line connected to said one terminal of said capacitor for outputting the voltage at said first level; and a second signal line connected to said second terminal of said capacitor for outputting a voltage at a second level, reversed in polarity relatively to the voltage at said first level, wherein the voltage at said first level supplied by said first signal line, and the voltage at said second level supplied by said second signal line are selectively applied to said one terminal of said load.

75. A power supply circuit of a plasma display panel having a pair of electrodes between which a discharge occurs, the power supply circuit applying a predetermined voltage to one of said pair of electrodes and comprising:

a first signal line outputting a voltage at a first level and a second signal line outputting a voltage at a second level, the voltage at said first level being output through said first signal line and supplied to one terminal of a capacitor to charge said capacitor with the voltage at said first level, and the voltage at said second level being reversed in polarity relatively to the voltage at said first level and being output from a second terminal of said capacitor, after interrupting the output of the voltage at said first level and the supply of the voltage at said first level to said one terminal of said capacitor, so that the voltage at said second level is output through said second signal line.

76. A power supply circuit of a plasma display panel having a pair of electrodes between which a discharge occurs, the power supply circuit applying a predetermined voltage to one of said pair of electrodes and comprising:

first and second switches connected in series at a node and between a power supply terminal and a reference terminal of a power supply and selectively supplying a voltage at a first level and a reference level;

a capacitor having one terminal connected to the node between said first and second switches;

a third switch connected between a second terminal of said capacitor and said reference level;

a first signal line connected to said one terminal of said capacitor for outputting the voltage at said first level; and a second signal line connected to said second terminal of said capacitor for outputting a voltage at a second level, reversed in polarity to the voltage at said first level.

77. A pulse voltage generating circuit generating pulse voltage waves used by a driving circuit, of an AC-driven plasma display panel, to apply said pulse voltage waves, which reverse their polarity in a positive or a negative direction from a voltage at a reference level, to opposite terminals of a discharge cell of the AC-driven plasma display panel, in mutually opposite phases, thereby to drive said discharge cell with a difference voltage of both the pulse voltage waves, comprising:

first and second switches connected in series at a node and between a power supply terminal and a reference terminal of a power supply terminal and selectively supplying a voltage at a first level and a reference level;

a capacitor having one terminal connected to the node between said first and second switches;

a third switch connected between a second terminal of said capacitor and said reference level;

a first signal line connected to said one terminal of said capacitor for outputting the voltage at said first level; and a second signal line connected to said second terminal of said capacitor for outputting a voltage at a second level, reversed in polarity to the voltage at said first level.

* * * * *